US007764261B2

(12) United States Patent
Yoshida et al.

(10) Patent No.: US 7,764,261 B2
(45) Date of Patent: Jul. 27, 2010

(54) APPARATUS AND METHOD TO IMPROVE QUALITY OF MOVING IMAGE DISPLAYED ON LIQUID CRYSTAL DISPLAY DEVICE

(75) Inventors: Hidefumi Yoshida, Kawasaki (JP); Seiji Tanuma, Kawasaki (JP); Takatoshi Mayama, Kawasaki (JP); Yuichi Inoue, Kawasaki (JP); Toshiaki Suzuki, Kawasaki (JP); Kazutaka Hanaoka, Kawasaki (JP); Takeshi Gotoh, Kawasaki (JP); Tetsuya Kobayashi, Kawasaki (JP); Makoto Ohashi, Kawasaki (JP); Hisashi Yamaguchi, Kawasaki (JP); Katsunori Tanaka, Kawasaki (JP); Koichi Katagawa, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 970 days.

(21) Appl. No.: 11/357,541

(22) Filed: Feb. 17, 2006

(65) Prior Publication Data

US 2006/0139289 A1 Jun. 29, 2006

Related U.S. Application Data

(62) Division of application No. 09/651,288, filed on Aug. 30, 2000, now Pat. No. 7,133,015.

(30) Foreign Application Priority Data

Oct. 13, 1999 (JP) ..... 11-291156
Mar. 24, 2000 (JP) ..... 2000-84770

(51) Int. Cl.
*G09G 3/36* (2006.01)

(52) U.S. Cl. ..... 345/99; 345/103

(58) Field of Classification Search ..... 345/87–104
See application file for complete search history.

(56) References Cited

U.S. PATENT DOCUMENTS 5,103,328 A 4/1992 Numao ..... 349/74
5,644,332 A 7/1997 Matsuzaki et al. ..... 345/100

(Continued)

FOREIGN PATENT DOCUMENTS

EP 0361471 4/1990
JP 64-82019 3/1989

(Continued)

OTHER PUBLICATIONS

Nakamura, et al.; "A Novel Wide-Viewing-Angle Motion-Picture LCD"; *Digest of Technical Papers*; SID International Symposium; pp. 143-146; 1998.

*Primary Examiner*—Srilakshmi K Kumar
(74) *Attorney, Agent, or Firm*—Greer, Burns & Crain, Ltd.

(57) ABSTRACT

A liquid crystal display device includes a panel having pixel electrodes arranged at intersections of a plurality of signal lines via switching elements for transmitting display data and a plurality of scanning lines for transmitting control signals, and a control circuit for controlling the panel. The liquid crystal panel is divided into first pixel regions and second pixel regions adjacent to the first pixel regions. The control circuit carries out impulse driving in which the control signals transmitted to each of the scanning lines are activated two times in one frame period for displaying an image. The control circuit writes the display data in either one of the pixel regions and writes reset data in the other pixel regions when the control signals are activated once of the two times. By writing the reset data in the pixel regions, the display data written in an immediately preceding frame are reset. In consecutive frames, the display data written in the pixel regions are always reset in one frame period. Therefore, blurring in a moving image can be alleviated. Since writing the display data and the reset data is carried out separately in the first pixel regions and in the second pixel regions, flicker is prevented from occurring in a display screen.

44 Claims, 82 Drawing Sheets

U.S. PATENT DOCUMENTS

| | | | | |
|---|---|---|---|---|
| 5,731,794 | A | 3/1998 | Miyazawa | |
| 5,760,759 | A * | 6/1998 | Tanaka et al. | 345/95 |
| 5,844,540 | A | 12/1998 | Terasaki | 345/102 |
| 5,949,391 | A | 9/1999 | Saishu et al. | |
| 6,211,854 | B1 | 4/2001 | Fujiyoshi | 345/10 |
| 6,266,370 | B1 | 7/2001 | Kamikura et al. | 375/240.15 |
| 6,329,973 | B1 | 12/2001 | Akimoto et al. | 345/98 |
| 6,396,469 | B1 | 5/2002 | Miwa et al. | |
| 2002/0000960 | A1 | 1/2002 | Yoshihara et al. | |

FOREIGN PATENT DOCUMENTS

| | | |
|---|---|---|
| JP | 5-265042 | 10/1993 |
| JP | 7-72453 | 3/1995 |
| JP | 7-281647 | 10/1995 |
| JP | 09-127917 | 5/1997 |
| JP | 10-10997 | 1/1998 |
| JP | 10-254390 | 9/1998 |
| JP | 11-101967 | 4/1999 |
| JP | 11-109921 | 4/1999 |
| JP | 11-119189 | 4/1999 |
| JP | 11-142813 | 5/1999 |
| JP | 11-202285 | 7/1999 |
| JP | 11-202286 | 7/1999 |
| JP | 2001-042282 | 2/2001 |

* cited by examiner

Prior Art

Prior Art

Prior Art

Prior Art

Prior Art (a)

APPARATUS AND METHOD TO IMPROVE QUALITY OF MOVING IMAGE DISPLAYED ON LIQUID CRYSTAL DISPLAY DEVICE

This is divisional of application Ser. No. 09/651,288, filed Aug. 30, 2000.

BACKGROUND OF THE INVENTION

1. Field of the Invention

The present invention relates to a liquid crystal display device of active matrix type and a method of controlling the liquid crystal display device. Especially, the present invention relates to a technique for preferable image display.

2. Description of the Related Art

Liquid crystal display devices of active matrix type using TFTs (Thin Film Transistors) as driving elements have been in wide use as display devices for personal computers or the like. Generally, liquid crystal devices of this kind often adopt a display method called a TN (Twisted Nematic) type. A liquid crystal display device of TN type are formed with twisted nematic cells in which arrangement of liquid crystal molecules are consecutively twisted by 90 degrees, with the liquid crystal cells sandwiched between two transparent electrode-plated substrates. The liquid crystal display device lets light penetrate through when a voltage is not supplied between the electrode-plated substrates.

FIG. 1 shows an outline of a TFT (Thin Film Transistor) driving liquid crystal display device described above.

This device comprises TFTs and pixel electrodes 1 laid out in the form of a matrix. Gate electrodes of the TFTs which are switching elements are connected to scanning lines G1, G2, . . . , Gn each transmitting a gate signal output from a Y driver 2. Drain electrodes of the TFTs are connected to signal lines D1, D2, . . . , Dm each transmitting a data signal output from an X driver 3. Source electrodes of the TFTs are connected the pixel electrodes 1. Counter electrodes facing the pixel electrodes 1 are also laid out (not shown). Liquid crystals (not shown) are sandwiched by the pixel electrodes 1 and the counter electrodes, forming liquid crystal cells C.

Data are written in the liquid crystal cells C by sequentially causing TFTs to be on by pulse-like gate signals sequentially supplied to the scanning lines and by transmitting the data signals simultaneously supplied to the signal lines to the pixel electrodes 1 (line-sequential driving). Information of the data signals written in the liquid crystal cells C is retained until the pixel electrodes 1 are driven in a subsequent frame. This control of retaining the information in the liquid crystal cells C until next data signal writing is generally called hold driving.

FIG. 2 shows a waveform of a driving voltage and a response waveform of the liquid crystal cells C when the TFT driving liquid crystal display device described above is driven in the hold driving method. The waveform of the pixel response corresponds to the amount of light penetrated through the liquid crystal cells C. A state of writing data in one of the liquid crystal cells C is shown here.

The Y driver shown in FIG. 1 drives each of the scanning lines in every 16 ms, and generates an high level pulse of the gate signal. The X driver 3 generates the data signal in synchronization with the gate signal. Polarity of the data signal is inverted at every frame scan and so-called frame inversion driving is carried out. Within the 16 ms period shown in FIG. 2, all the scanning lines are scanned although the waveforms thereof are not shown.

For example, in a period of first three frames, an absolute value of a voltage supplied between the pixel electrode 1 and the counter electrode (not shown) is 5 V in all the frames.

Therefore, the liquid crystal cell C in FIG. 2 lets the light penetrate through the cell C and white is displayed on a screen. For the remaining three-frame period, the voltage between the pixel electrode 1 and the counter electrode (not shown) is 0 V. Therefore, the liquid crystal cell C shuts the light and black is displayed on the screen.

Generally, a response time of the liquid crystal cells C in the TN type liquid crystal display device is longer than the scanning period of one frame. Especially, the response time of the liquid crystal cells C in a half tone continues for several frames, as shown by a dashed line in FIG. 2. Recently, a liquid crystal cell called a π cell having a short response time has been developed.

As has been described above, the TN type liquid crystal display device displays an image by being driven in the hold driving method. In hold driving, information in the liquid crystal cells C is retained until a subsequent data signal is written. As a result, blurring (image tailing) occurs in a moving image due to partial overlap of display data in a previous frame. Such blurring does not occur on a CRT (Cathode Ray Tube) display.

FIG. 3 shows waveforms of a voltage driving a CRT according to a so-called impulse driving method. Light is emitted from a pixel only in the case where the voltage is supplied to the driving signal and an electron beam is emitted on the pixel. Data scanned in an immediately preceding frame disappears with a shift of the driving signal to low level so that no blurring occurs.

In order to alleviate the blurring on the liquid crystal display device, impulse driving has been tried on the liquid crystal display device. Details of this trial have been described in Digest of SID98 pp. 143-146. Liquid crystal display devices of this type uses the π cells or the like having a short response time.

FIG. 4 shows waveforms of a driving voltage and a response waveform of a liquid crystal cell observed in the case of impulse driving of a liquid crystal display device. As in the case shown in FIG. 2, white is displayed for first three frames and black is displayed in the remaining three frames.

The liquid crystal display device scans each of the scanning lines twice in every 16 ms (one frame). A first scan is used for receiving a data signal and a second scan is used for resetting the liquid crystal cells. In other words, impulse driving is realized by writing black data after a predetermined time has elapsed since the data signal were written in the liquid crystal cells C. "W" shown with arrows in FIG. 4 refers to an operation of writing white, while "B" means an operation of writing black. "R" refers to a resetting operation. In this manner, display data in the liquid crystal cells C are retained only for a predetermined period T1 in one frame and blurring in a moving image is alleviated.

FIG. 5 shows an example of a display screen in the case where the impulse driving described above is carried out. In FIG. 5, liquid crystal cells in white display white and hatched cells display black.

As waveforms in FIG. 5 shows, display data (white) are written at the first scan in a display period (16 ms) of one frame. At the second scan in one frame period, reset data (black) are written in the liquid crystal cells. In other words, as shown in top of FIG. 5, the display data and the reset data having band-like shapes move from the top to the bottom in the scanning in one frame.

However, line-sequential writing of the display data (white) and the reset data (black) in alternation causes flicker.

Especially, when a display speed of the liquid crystal cells C is low, or when a scanning period (refresh rate) is long, flicker becomes large.

Japanese Patent Application Laid-open Publication No. HEI 10-62811 describes a liquid crystal display device comprising a plurality of X drivers and Y drivers and individually driving neighboring liquid crystal cells. This liquid crystal display device secures time to write and reset for each of the liquid crystal cells by carrying out partially overlapping write and reset operations on the cells. In this manner, contrast of display data is improved. However, liquid crystal display devices of this kind have the plurality of X drivers and Y drivers, which leads an increase in circuit size. Furthermore, since the number of signal lines becomes double, a problem of aperture ratio reduction also occurs.

In order to improve brightness of a display image, a backlight is generally arranged, facing a liquid crystal panel comprising pixel electrodes, TFTs, and a control circuit thereof. However, when the impulse driving described above is carried out, pixel electrodes having reset data written therein and thus displaying black absorb light from the backlight. As a result, a problem of wasteful power consumption occurs. Moreover, since an image displayed by impulse driving has lower brightness than an image displayed by hold driving, it is necessary to increase the brightness of the backlight. As a result, power consumption increases.

In the case where a plurality of fluorescent tubes laid out in parallel are used as the backlight, a problem of uneven image display caused by a difference in a degradation speed of each fluorescent tube also occurs.

SUMMARY OF THE INVENTION

An object of the present invention is to provide a liquid crystal display device and its controlling method to improve quality of moving images. Especially, the present invention is aimed at alleviation of blurring in image and prevention of flicker and ghosts.

Another object of the present invention is to efficiently turn backlights on and off to reduce power consumption.

Still another object of the present invention is to provide a backlight which does not cause uneven image display.

According to one of the aspects of a liquid crystal display device in the present invention, the liquid crystal display device comprises a liquid crystal panel in which a plurality of signal lines for transmitting display data and a plurality of scanning lines for transmitting control signals are laid out vertically and horizontally, and pixel electrodes are arranged at intersections of the signal lines and the scanning lines via switching elements, and a control circuit for controlling the liquid crystal panel via the signal lines and the scanning lines. The liquid crystal panel is divided into first pixel regions and second pixel regions adjacent to the first pixel regions.

The control circuit carries out impulse driving in which the control signals supplied to the respective scanning lines are each activated two times per one frame period for displaying one image. The control circuit writes the display data in the first pixel regions and writes reset data in the second pixel regions when the control signals are activated once of the two times. The control circuit writes the reset data in the first pixel regions and writes the display data in the second pixel regions when the control signals are activated the other time of the two times. By writing the reset data in the pixel regions, the display data written therein immediately before are reset. In a plurality of consecutive frames, the display data written in the pixel regions are always reset within one frame period. Therefore, blurring in display image can be alleviated. Since writing and resetting of the display data are carried out separately in the first pixel regions and in the second pixel regions, flicker can be prevented from occurring on a display screen.

According to another aspect of the liquid crystal display device of the present invention, the display data and the reset data are sequentially written in the first pixel regions and the second pixel regions divided in the form of stripes along the scanning lines. The regions in which the reset data are written exist separately in a plurality of the pixel regions. Therefore, blurring in display image can be alleviated and occurrence of flicker in the display screen can be prevented.

According to another aspect of the liquid crystal display device in the present invention, the first pixel regions and the second pixel regions are divided in lattice-like form. The display data and the reset data are sequentially written in the first pixel regions and the second pixel regions divided into lattice-like form. The regions in which the reset data are written are separated into a plurality of the pixel regions. Therefore, blurring in display image can be alleviated and flicker can be prevented from occurring on the display screen.

According to another aspect of the liquid crystal display device in the present invention, the liquid crystal display device comprises backlights facing the first pixel regions and the second pixel regions, on the backside of the liquid crystal panel. Each of the backlights is turned on in synchronization with writing display data in the first pixel regions and in the second pixel regions, respectively. Each of the backlights is turned off in synchronization with writing reset data in the first pixel regions and in the second pixel regions. Therefore, a contrast ratio between when the display data is written and when the reset data is written can be increased and an easy-to-see screen can be configured. Furthermore, since the backlights corresponding to pixel regions in which the display data are not written are turned off, there is less power consumption.

According to another aspect of the liquid crystal display device in the present invention, the backlights comprise light-emitting diodes, or fluorescent tubes, or a PDP. Therefore, the backlights can be configured in accordance with the size of the first pixel regions and the second pixel regions.

According to another aspect of the liquid crystal display device in the present invention, the backlights comprise fluorescent tubes. The cycle of one frame is adjusted in accordance with a cycle of an alternating current signal supplied to the fluorescent tubes. By writing the display data in accordance with a peak of brightness of the fluorescent tube, the contrast ratio between when the display data is written and when the reset data is written can be increased without on-off controlling the fluorescent tubes.

According to another aspect of the liquid crystal display device in the present invention, light guide plates are arranged on the backside of the liquid crystal panel, facing the first pixel regions and the second pixel regions. Furthermore, the liquid crystal display device comprises a fluorescent tube each arranged at one end of each of the light guide plates. Light emitted from the fluorescent tubes is guided to the first and second pixel regions by the light guide plates. Therefore, the number of the fluorescent tubes can be minimized.

According to another aspect of the liquid crystal display device of the present invention, the control circuit receives the display data for two images per frame. The control circuit displays the data by discarding data of pixels corresponding to the first pixel regions and the second pixel regions for writing the reset data, of the display data. Therefore, complex data processing on display data unnecessary. It is also unnecessary for the display data to be stored in a buffer memory or the like. Consequently, flicker can be prevented without complicating the control circuit.

According another aspect of the liquid crystal display device of the present invention, the control circuit receives the display data for one image per frame. The control circuit writes a portion of the display data in the first pixel regions when the control signals are activated once of the two times, while it writes the remaining display data in the second pixel regions when the control signals are activated the other time of the two times. Therefore, the received data are all used as the display data without being deleted.

According to another aspect of the liquid crystal display device in the present invention, the liquid crystal display device has a hold driving function for activating each of the control signals once in one frame period, and writing the display data in all the pixel electrodes. The control circuit controls switching from the hold driving to the impulse driving and vice versa, depending on an image to be displayed. For example, a moving image is displayed by the impulse driving while a still image is displayed by the hold driving. In this manner, optimal screen display for any image can be realized.

According to another aspect of the liquid crystal display device in the present invention, the backlights in which brightness can be adjusted are arranged on the backside of the liquid crystal panel. A variance in brightness between the cases of hold driving and impulse driving can be reduced by increasing the brightness of the backlights compared to when hold driving, when impulse driving.

According to another aspect of the liquid crystal display device in the present invention, gamma correction is carried out during the impulse driving and the hold driving. During the impulse driving, the control signals are activated more times than in the hold driving. Therefore, a change in the amount of light penetrating through the liquid crystal cells is accelerated by gamma correcting more rapidly in the impulse driving than in the hold driving. Brightness can be increased in this manner.

According to another aspect of the liquid crystal display device in the present invention, the control circuit selects the scanning lines according to an order the scanning lines are arranged in. Therefore, the control circuit can be configured without substantially changing a conventional circuit.

According to another aspect of the liquid crystal display device in the present invention, the control circuit selects the scanning lines according to a predetermined order which is not related to the order the scanning lines are arranged in. Therefore, flicker can be prevented from occurring with certainty.

According to another aspect of the liquid crystal display device in the present invention, the first pixel regions and the second pixel regions are divided, each including a plurality of the scanning lines. The control circuit selects the scanning lines according to the order they are arranged in, in the first pixel regions and the second pixel regions. Therefore, without complicating the control circuit, flicker can be prevented from occurring with certainty.

According to another aspect of the liquid crystal display device in the present invention, the liquid crystal display device comprises a liquid crystal panel in which a plurality of signal lines for transmitting display data and a plurality of control lines for transmitting control signals are laid out vertically and horizontally, and pixel electrodes are arranged at intersections of the signal lines and the control lines via switching elements, and a control circuit for carrying out gamma correction in response to a temperature change of the liquid crystal panel. Therefore, regardless of the temperature change in the liquid crystal panel, brightness and contrast of a display screen is constant.

According to another aspect of the liquid crystal display device in the present invention, the liquid crystal display device comprises a liquid crystal panel in which a plurality of signal lines for transmitting display data and a plurality of control lines for transmitting control signals are laid out vertically and horizontally, and pixel electrodes are arranged at intersections of the signal lines and the control lines via switching elements, a plurality of first backlights arranged on the backside of the liquid crystal panel and separated from each other, and a plurality of second backlights each adjacent to the first backlights but separated from each other. Pseudo-impulse driving can be realized by alternately turning on and off the first backlights and the second backlights. In this manner, blurring in image can be alleviated and flicker can be prevented from occurring.

According to another aspect of the liquid crystal display device in the present invention, the liquid crystal display device comprises a liquid crystal panel in which a plurality of signal lines for transmitting display data and a plurality of control lines for transmitting control signals are laid out vertically and horizontally, and pixel electrodes are arranged at intersections of the signal lines and the control lines via switching elements, a plurality of backlights on the backside of the liquid crystal panel adjacent along the scanning lines, and a control circuit for controlling the liquid crystal panel via the signal lines and the control lines. The control circuit normally drives the liquid crystal panel without inputting a reset signal, and displays data. Furthermore, the control circuit carries out on-off control of the backlights. In response to the backlights turned on and off, the scanning lines facing the backlights are controlled by the control circuit. A period of scanning the lines agrees with the scanning period of the liquid crystal panel.

The control of the scanning lines by the control circuit is carried out as in a conventional liquid crystal display device. Therefore, a cost-increasing factor does not exist. Consequently, preferable moving image display can be realized by exchanging only the backlights.

According to another aspect of the liquid crystal display device in the present invention, light corresponding to the scanning lines is turned off immediately before the scanning lines are scanned. In this manner, maximum brightness of the liquid crystal panel can contribute to the display.

According to another aspect of the liquid crystal display device in the present invention, backlights larger than a pixel, such as fluorescent tubes, can be used.

According to another aspect of the liquid crystal display device in the present invention, quality of displaying moving images can be improved by extending the time no data is displayed.

According to another aspect of the liquid crystal display device in the present invention, quality of displaying moving images can be improved for all gradations.

According to another aspect of the liquid crystal display device in the present invention, the liquid crystal display device comprises a liquid crystal panel in which a plurality of signal lines for transmitting display data and a plurality of control lines for transmitting control signals laid out vertically and horizontally, and pixel electrodes are arranged at intersections of the signal lines and the control lines via switching elements, a light guide plate facing the panel, and a backlight arranged at one end of the light guide plate and supplying light to the light guide plate along the scanning lines. The light guide plate comprises a plurality of luminescent parts along the scanning lines. A portion of the luminescent parts emits light to the liquid crystal panel by collecting light guided to the light guide plate. The remaining luminescent parts do not collect light at this time. For example, when display data are displayed on the liquid crystal panel, the luminescent parts in which light is collected are sequentially switched in accordance with control of the liquid crystal panel, which enables impulse driving to be easily realized. Therefore, blurring in moving image can be reduced and flicker can be prevented from occurring. Furthermore, since the light guided to the light guide plate can be used efficiently, power consumption can be reduced. Moreover, since no fluorescent tubes are used, uneven display caused by degradation of the fluorescent tubes does not occur.

According to another aspect of the liquid crystal display device in the present invention, along the scanning lines in the light guide plate, a plurality of film-like scattering parts exist for totally or irregularly reflecting light passing through the light guide plate in response to control from the exterior. The luminescent parts of the light guide plate are formed by irregular reflection of the light by the scattering parts. By controlling the scattering parts from the exterior, the luminescent parts can be formed easily at a desired position in the light guide plate.

According to another aspect of the liquid crystal display device in the present invention, the scattering parts are arranged in parallel on a surface of the light guide plate. For this reason, the scattering parts can be formed easily.

According to another aspect of the liquid crystal display device in the present invention, each of the scattering parts is arranged on a surface of the light guide plate, on the side of the liquid crystal panel. Light scattered by the scattering parts is emitted toward exterior of the light guide plate. The light is emitted on a portion of the liquid crystal panel facing the luminescent parts (or the scattering parts). Since the boundary between the luminescent parts adjacent to each other becomes clear, impulse driving can be carried out with better visibility and flicker can be prevented.

According to another aspect of the liquid crystal display device in the present invention, the scattering parts are arranged on a surface of the light guide plate, on the opposite side of the liquid crystal panel. The light irregularly reflected by the scattering parts is emitted on the liquid crystal panel, passing through the light guide plate. Since no light-shutting material on the side of the liquid crystal panel, such as the scattering parts, is arranged on the light guide plate, emission efficiency can be improved. Furthermore, the boundary between the scattering parts adjacent to each other becomes inconspicuous.

According to another aspect of the liquid crystal display device in the present invention, the liquid crystal display device comprises a plurality of light guide plates facing each other. Each of the scattering parts is arranged between the light guide plates. By sandwiching the scattering parts between the light guide plates, the scattering parts can be protected. Furthermore, a light emission system comprising the scattering parts and the light guide plates can be formed easily and precisely.

According to another aspect of the liquid crystal display device in the present invention, the scattering parts are arranged between the light guide plates and on outer surfaces of the light guide plates. By forming the scattering parts with a plurality of layers, light passing through the light guide plates can be scattered with certainty.

In this liquid crystal display device, the scattering parts are arranged within the light guide plates, so as to cut across a direction light is guided. Light passing through the light guide plates always passes through the scattering parts. Therefore, the light can be scattered with certainty.

According to another aspect of the liquid crystal display device in the present invention, the scattering parts are orthogonal to the direction light is guided. Therefore, when the scattering parts are arranged so as to cut across the direction light is guided, the scattering parts and the light guide plates can be joined with high accuracy.

According to another aspect of the liquid crystal display device in the present invention, the scattering parts are diagonal to the direction light is guided. Therefore, the light scattered by the scattering parts is emitted in a large dose in a direction orthogonal to the direction light is guided, that is, toward the liquid crystal panel.

According to another aspect of the liquid crystal display device in the present invention, the scattering parts are formed with a liquid crystal film of high-molecular type. Therefore, the scattering parts can be formed easily. Furthermore, by controlling an electric field supplied to the scattering parts, light scattering can be controlled easily.

According to another aspect of the liquid crystal display device in the present invention, a resin layer covering low molecular liquid crystals in the liquid crystal film is formed with high-molecular liquid crystals. Therefore, in a state where the scattering parts penetrate the light, scattering can be prevented from occurring at an interface between the low molecular liquid crystal and the resin layer.

According to another aspect of the liquid crystal display device in the present invention, the low molecular liquid crystals and the high-molecular liquid crystals are aligned orthogonal to a liquid crystal film surface in a state where voltage is not supplied thereto. This liquid crystal film scatters light when an electric field is supplied thereto.

According to another aspect of the liquid crystal display device in the present invention, the low molecular liquid crystals have negative dielectric anisotropy. In this liquid crystal film, liquid crystal molecules are directed orthogonal to the electric field when the electric field is supplied.

According to another aspect of the liquid crystal display device in the present invention, the low molecular liquid crystals and the high-molecular liquid crystals are aligned orthogonal to a direction light is guided in a state where voltage is not supplied thereto. This liquid crystal film scatters light when an electric field is supplied thereto.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and pixel electrodes are arranged at intersections of the signal lines and the scanning lines via switching elements. A luminescent period in which an image to be displayed in one frame period is output to exterior of the liquid crystal panel can be adjusted manually. Therefore, a viewer of the display image can adjust the luminescent period for the most optimal view of the display image. For example, the luminescent period is lengthened when still image is viewed, while it is shortened when moving image is viewed. Since the luminescent period is adjustable in accordance with how the viewer of the display image feels, blurring in the moving image can be alleviated and flicker can be prevented.

According to another aspect of the liquid crystal display device in the present invention, brightness of the liquid crystal panel is kept constant in cooperation with controlling the luminescent period. Regardless of whether the display image is still or moving, the brightness can always be kept constant, so the screen becomes easy to view.

According to another aspect of the liquid crystal display device in the present invention, the brightness is controlled by adjusting brightness of a backlight facing the liquid crystal panel.

According to another aspect of the liquid crystal display device in the present invention, the brightness is controlled by adjusting the amount of display data signal written in the pixel electrodes.

According to another aspect of the liquid crystal display device in the present invention, the luminescent period is adjusted by on-off controlling a backlight facing the liquid crystal panel.

According to another aspect of the liquid crystal display device in the present invention, impulse driving is carried out, in which each of the scanning lines is scanned twice in one frame period, and display data and reset data are written in the pixel electrodes. The luminescent period is adjusted in accordance with a period data is displayed.

According to another aspect of the liquid crystal display device in the present invention, the luminescent period is adjusted by opening and closing a shutter facing the liquid crystal panel.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and pixel electrodes are arranged at intersections of the signal lines and the scanning lines via switching elements. A luminescent period in which an image to be displayed in one frame period is output can be adjusted in accordance with a speed of motion of the image displayed on the panel. Therefore, blurring in moving image can be alleviated by shortening the luminescent period in the moving image display and flicker can be prevented.

According to another aspect of the liquid crystal display device in the present invention, a display image is judged to be a moving image and the luminescent period is adjusted for the moving image, when estimated motion of a DC component in DCT (Discrete Cosine Transform) exceeds a size of a block comprising a predetermined pixel matrix. By using the DCT method used widely in motion compensation for moving images, images can be judged to be still or moving with certainty.

According to another aspect of the liquid crystal display device in the present invention, impulse driving is carried out, in which the scanning lines are scanned twice in one frame period, and display data and reset data are written in the pixel electrodes. The luminescent period is adjusted in accordance with a period of displaying the display data.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and pixel electrodes are arranged at intersections of the signal lines and the scanning lines via switching elements. The liquid crystal display device has a hold control function in which an image to be displayed is output in one frame period and an impulse control function in which an image to be displayed is output in a predetermined period within one frame period. When the display image is a still image, the hold control is carried out while the impulse control is carried out when the display image is a moving image. Therefore, blurring in the moving image can be alleviated and flicker can be prevented from occurring.

According to another aspect of the liquid crystal display device in the present invention, the hold control is switched to the impulse control in the case where a ratio of the moving image to all of the display data exceeds a predetermined value.

According to another aspect of the liquid crystal display device in the present invention, the displayed data are judged to be moving image data and the hold control is switched to the impulse control, when the displayed data changes over a period of two or more frames.

According to another aspect of the liquid crystal display device in the present invention, the impulse control is carried out by opening and closing a shutter facing the liquid crystal panel.

According to another aspect of the liquid crystal display device in the present invention, the impulse control is carried out by scanning the scanning lines twice in one frame period and writing the display data and the reset data in the pixel electrodes.

According to another aspect of the liquid crystal display device in the present invention, brightness of a backlight facing the liquid crystal panel is increased in the impulse control than in the hold control. Therefore, brightness of a moving image can be equal to brightness of a still image, and a screen becomes easier to view.

According to another aspect of the liquid crystal display device in the present invention, brightness of a display image output is made to be the same between the impulse control and the hold control. Since the brightness of display can be kept constant regardless of whether a still image or a moving image is being displayed, the screen becomes easier to view.

According to another aspect of the liquid crystal display device in the present invention, the pixel electrodes are controlled by polysilicon TFTs (Thin Film Transistors) whose switching speed is faster than a switching speed of amorphous silicon TFTs. Therefore, blurring in moving image can be alleviated especially at the time of the impulse control.

According to another aspect of the liquid crystal display device in the present invention, a display image is judged to be moving when a ratio of pixels of the display image in one frame which is different from pixels of the image displayed in an immediately preceding frame to all pixels of the displayed image exceeds a predetermined value or more, and impulse control is then carried out.

According to another aspect of the liquid crystal display device in the present invention, motion compensation is carried out by using DCT. When an average of a DC component of the display image in one frame and an average of the DC component of the image displayed in an immediately preceding frame differs by a predetermined value or more, the display image is judged to be moving and impulse control is carried out.

According to another aspect of the liquid crystal display device in the present invention, motion compensation is carried out by using DCT. When compressed image information includes vector information indicating image motion, the image is judged to be moving and impulse control is carried out.

According to another aspect of the liquid crystal display device in the present invention, the liquid crystal display device comprises a liquid crystal panel and backlights. In the liquid crystal panel, a plurality of signal lines for transmitting display data and a plurality of scanning lines for transmitting control signals are laid out vertically and horizontally, and pixel electrodes exist at intersections of the signal lines and the scanning lines via switching elements. The liquid crystal panel comprises a plurality of control blocks divided into n portions along the scanning lines. The backlights are arranged facing each of the blocks. The liquid crystal panel carries out hold driving in which each of the scanning lines is scanned once in one frame period and display data are written in the pixel electrodes. The backlights corresponding to the respective blocks are turned on for a predetermined period immediately before scanning the corresponding blocks. A response time of each pixel in the liquid crystal panel is set smaller than:

$$1 \text{ frame period} \times (n-2)/n.$$

Therefore, the pixels complete responding with certainty before the backlights are turned on. As a result, blurring in moving image can be alleviated.

According to another aspect of the liquid crystal display device in the present invention, the liquid crystal display device comprises a liquid crystal panel and backlights. In the liquid crystal panel, a plurality of signal lines for transmitting display data and a plurality of scanning lines for transmitting control signals are laid out vertically and horizontally, and pixel electrodes exist at intersections of the signal lines and the scanning lines via switching elements. The liquid crystal panel comprises a plurality of control blocks divided into n portions along the scanning lines. Each of the backlights faces each of the blocks. The panel carries out hold driving in which each of the scanning lines is scanned twice in one frame period and the display data and reset data are written in the pixel electrodes. The backlights corresponding to the blocks are turned on for a predetermined period immediately before scanning the corresponding blocks. A response time of each pixel in the liquid crystal panel is set smaller than:

$$1 \text{ frame period} \times [[(n-1)/2n]-(1/n)] (n\text{: odd number}) \text{ or}$$

$$1 \text{ frame period} \times [[(n-2)/2n]-(1/n)] (n\text{: even number}).$$

Therefore, the pixels complete responding with certainty before the backlights are turned on. As a result, blurring in moving image can be alleviated.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and pixel electrodes are arranged at intersections of the signal lines and the scanning lines via switching elements, a light guide plate facing the liquid crystal panel, a first polarization splitting sheet, a liquid crystal shutter divided along the scanning lines, a second polarization splitting sheet, a scattering element, arranged in order on one surface of the light guide plate in this order, and a light source at one end of the light guide plate.

Among light passing through the light guide plate (unpolarized light), an abnormal light component is reflected by the first polarization splitting sheet and passes through the light guide plate again. A normal light component among the unpolarized light penetrates through the first polarization splitting sheet and reaches the liquid crystal shutter. In the case where the liquid crystal shutter is in a state of birefringence, a phase of the light penetrated through the first polarization splitting sheet is shifted by 90° and the light reaches the second polarization splitting sheet as an abnormal light component. The light is then reflected by the second polarization splitting sheet and the phase thereof is shifted by 90° by the liquid crystal shutter to become the original normal light component. Thereafter, the light penetrates through the first polarization splitting sheet and returned to the light guide plate. On the other hand, in the case where the liquid crystal shutter is not in the state of birefringence, the light penetrates through the liquid crystal shutter and the second polarization splitting sheet as the normal light component and scattered by the scattering element. In the case of the scattering element which reflects light, the light irregularly reflected by the scattering sheet penetrates through the second polarization splitting sheet, the liquid crystal shutter, and the first polarization splitting sheet again to return to the light guide plate. At this time, since most components of the light exceed a critical angle, they penetrate through the light guide plate to be emitted toward the liquid crystal panel. In other words, the light collected is emitted only from a predetermined region of the liquid crystal shutter controlled to be in the penetrative state.

By making the predetermined region of the liquid crystal shutter to sequentially become penetrative in accordance with the control of the liquid crystal panel, impulse driving can be carried out easily. Therefore, blurring in moving image can be alleviated and flicker can be prevented. Furthermore, by collecting the light guided to the light guide plate, the light can be used efficiently, and power consumption can be reduced. Since no fluorescent tubes are used, uneven display due to degradation of the fluorescent tubes does not occur.

According to another aspect of the liquid crystal display device in the present invention, a change in a reflection angle at an interface between neighboring materials is prevented. As a result, light transmitting through the light guide plate is prevented from exceeding a critical angle at a position other than a desired position.

According to another aspect of the liquid crystal display device in the present invention, a phase of the light passing through the light guide plate is shifted by a retardation sheet. Therefore, light not including a normal light component comes to include the normal light component by the shift of the phase of reflected light by the retardation sheet. In other words, the normal light component penetrating through the polarization splitting sheet can be increased. In this manner, efficient use of light can be improved and power consumption can be reduced.

According to another aspect of the liquid crystal display device in the present invention, the light from the light guide plate is reflected by a prism and emitted toward a predetermined direction. Therefore, luminous intensity of the light can be increased.

According to another aspect of the liquid crystal display device in the present invention, the liquid crystal display device comprises a liquid crystal panel in which a plurality of signal lines for transmitting display data and scanning lines for transmitting control signals are laid out vertically and horizontally, and capacitor parts comprising liquid crystals are arranged at intersections of the signal lines and the scanning lines via switching elements. The liquid crystal panel comprises resistor parts connected to the capacitor parts in parallel and having a resistance lower than a resistance of each of the capacitor parts. Therefore, an electric charge stored by writing display data is discharged gradually via the resistor parts. In other words, without using a special control circuit, impulse driving can be carried out with liquid crystal cells alone. As a result, blurring in moving image can be alleviated and flicker can be prevented.

According to another aspect of the liquid crystal display device in the present invention, display data are displayed at higher brightness.

According to another aspect of the liquid crystal display device in the present invention, uneven brightness due to a manufacturing error in a subsidiary capacitance is prevented.

According to another aspect of the liquid crystal display device in the present invention, the resistor parts are easily formed by using the subsidiary capacitance added to general liquid crystal cells.

According to another aspect of the liquid crystal display device in the present invention, display data are reset to black by discharging an electric charge in the capacitor parts after the data are written. Therefore, impulse driving can be realized easily without using a special control circuit.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and pixel electrodes are laid out at intersections of the signal lines and the scanning lines. The pixel electrodes are connected to a first TFT and a second TFT having different threshold voltages. The gate electrodes of the first TFT and the second TFT connected to the pixel electrodes adjacent to each other in a direction of the scanning lines are connected to the same scanning line. One of the TFTs is used for writing display data and the other is used for writing reset data. Since the threshold voltage of the first TFT is different from the threshold voltage of the second TFT, for example, the reset data are not written when the display data are written. When the reset data are written, the display data are written in the adjacent pixel electrode, but the reset data are written immediately thereafter. Therefore, wrong display data are not displayed. Impulse driving in which the display data and the reset data are written alternately is carried out in this manner. As a result, blurring in moving image can be alleviated and flicker can be prevented.

According to another aspect of the liquid crystal display device in the present invention, each of the scanning lines is selected twice at different voltages in one frame period. First, each of the scanning lines is selected at a predetermined voltage. One of the TFTs turns on and the display data are written in the corresponding pixel electrode. At this time, the other TFT is off. The scanning line is then selected at a high voltage. The other TFT becomes on and the reset data area written in the corresponding pixel electrode. At this time, one of the TFTs connected to the pixel electrode next to the corresponding pixel electrode also turns on and the display data are written. However, the other TFT connected to the neighboring pixel electrode also turns on in an immediately subsequent scan. Therefore, the display data are not displayed.

According to another aspect of the liquid crystal display device in the present invention, the display data are written in the pixel electrode via the signal line and the first TFT. The reset data are written in the pixel electrode via an electrode to which a voltage corresponding to the reset data is supplied and via the second TFT having the threshold voltage higher than that of the first TFT.

According to another aspect of the liquid crystal display device in the present invention, the display data can be displayed at high brightness and black data can be displayed darker.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and liquid crystal cells are arranged at intersections of the signal lines and the scanning lines, and a backlight system facing the liquid crystal panel and divided into a plurality of luminescent parts along the scanning lines. The liquid crystal display device carries out impulse driving. In the impulse driving, the luminescent parts are sequentially turned on, and the scanning lines corresponding to the luminescent parts are scanned to start writing display data in liquid crystal cells while the luminescent parts are turned off. The number of the luminescent parts, a ratio of an on-period of the luminescent parts to an off-period within one frame period (a duty ratio), and a response time of the liquid crystal cells are determined so that a change in brightness during a transient response of the liquid crystal cells after the luminescent parts become on is equal to or less than 5% of the brightness at the time the luminescent parts are on. Generally, when the brightness change exceeds 5%, not only blurring in an image but also ghosts in which an image is viewed as two images appear. By keeping the brightness change at 5% or less, blurring in image can be prevented and ghosts can be prevented from appearing. Improvement of moving image quality by adopting liquid crystal cells having a fast response speed has been tried. However, in order to prevent ghosts in the impulse driving, the response time of the cells, the number of the luminescent parts, and the duty ratio of the luminescent parts need to be optimal. The larger the number of the emission parts is, the more the ghosts are alleviated. The smaller the duty ratio is, the more the ghosts are prevented.

According to another aspect of the liquid crystal display device in the present invention, the number of lighting systems turned on at the same time is changed in each frame and a region of the luminescent parts changes. Therefore, a boundary between the luminescent parts which are on and off becomes different in each frame. By moving the boundary of the luminescent parts in each frame, the boundary becomes inconspicuous.

According to another aspect of the liquid crystal display device in the present invention, the amount of light emitted on a phosphor layer is adjusted in accordance with a voltage supplied to the liquid crystal cells. As a result, a viewing angle becomes large and display data can be displayed at high brightness.

According to another aspect of the liquid crystal display device in the present invention, the liquid crystal display device comprises a liquid crystal panel in which a plurality of signal lines for transmitting display data and a plurality of scanning lines for transmitting control signals are laid out vertically and horizontally, and liquid crystal cells are laid out at intersections of the signal lines and the scanning lines, and a backlight system facing the liquid crystal panel. The liquid crystal display device carries out impulse driving in which the scanning lines are sequentially scanned while causing the backlight system to blink, and the display data are written in the cells. The display data written in the liquid crystal cells in a predetermined time before and after the backlight system is turned off are estimate data in an on-state of the backlight system generated by carrying out motion compensation. Therefore, the display data corresponding to the timing of actual image display by the liquid crystal display device (at the time the backlight system is on) are generated. As a result, blurring and awkward motion in moving image can be prevented. In other words, quality of moving image improves.

According to another aspect of the liquid crystal display device in the present invention, motion compensation is carried out accurately by adopting an easy method using display data in a current frame and in another frame.

According to one of the aspects of a method of controlling a liquid crystal display device in the present invention, a liquid crystal display device comprising a liquid crystal panel is controlled. In this liquid crystal panel, a plurality of signal lines for transmitting display data and a plurality of scanning lines for transmitting control signals are laid out vertically and horizontally, and pixel electrodes are arranged at intersections of the signal lines and the scanning lines via switching elements. This panel is divided into first pixel regions and second pixel regions adjacent to the first pixel regions. The control signals transmitted to the respective scanning lines are activated two times each in one frame period in which an image is displayed, and impulse driving is carried out. The display data are written in the first pixel regions and the reset data are written in the second pixel regions when the control signals are activated once of the two times. The reset data are written in the first pixel regions and the display data are written in the second pixel regions respectively when the control signals are activated the other time. By writing the reset data in the pixel regions, the display data written in the pixel regions immediately before are reset. In a plurality of consecutive frames, the display data written in the pixel regions are necessarily reset within one frame period. Therefore, blurring in display image can be alleviated. Since writing and resetting the display data are carried out separately in the first pixel regions and the second pixel regions, flicker can be prevented from occurring in a display screen.

According to another aspect of the liquid crystal display device controlling method in the present invention, each backlight is turned on in synchronization with display data writing in the first pixel regions and in the second pixel regions. Each backlight is turned off in synchronization with writing reset data in the first pixel regions and in the second pixel regions. Therefore, a contrast ratio between the cases of writing the display data and writing the reset data can be increased and an easy-to-see screen can be configured.

According to another aspect of liquid crystal display device controlling method in the present invention, the period of one frame for one image is in accordance with a period of an alternating current signal supplied to a fluorescent tube. By writing the display data in accordance with a peak of brightness of the fluorescent tube, the contrast ratio between the cases of writing and resetting the display data can be increased without carrying out on-off control of the fluorescent tube.

According to another aspect of the liquid crystal display device controlling method in the present invention, display data for two images are received in each frame. Out of the received display data, data corresponding to the first pixel regions and the second pixel regions in which the reset data are written are deleted. Therefore, complex data processing on display data is unnecessary. It is also unnecessary for the display data to be stored in a buffer memory or the like. Consequently, flicker can be prevented without causing the control circuit to become complex.

According another aspect of the liquid crystal display device controlling method of the present invention, display data for one image are received in every frame. A portion of the display data are written in the first pixel regions when the control signals are activated once of the two times, while the remaining display data are written in the second pixel regions when the control signals are activated the other time. Therefore, the received data are all used as the display data without being deleted.

According to another aspect of the liquid crystal display device controlling method in the present invention, a function of hold driving for activating each of the control signals once in one frame and writing display data in all the pixel electrodes is used. Control of switching between hold driving and impulse driving is carried out depending on an image to be displayed. For example, a moving image is displayed by using impulse driving while a still image is displayed by using hold driving. In this manner, optimal screen display can be realized for any image.

According to another aspect of the liquid crystal display device controlling method in the present invention, a variance in brightness between the cases of the hold driving and the impulse driving is reduced by increasing the brightness of the backlight upon impulse driving than in the case of hold driving.

According to another aspect of the liquid crystal display device controlling method in the present invention, gamma correction is carried out in impulse driving and hold driving. In the impulse driving, control signals are activated more times than in the hold driving. Therefore, a change in the amount of light penetrating the liquid crystal cells is accelerated by carrying out the gamma correction more rapidly in the impulse driving than in the gamma correction in the hold driving. In this manner, brightness can be increased.

According to another aspect of the liquid crystal display device controlling method in the present invention, the scanning lines are selected according to an order the scanning lines are arranged in. Therefore, control of the scanning lines becomes easier.

According to another aspect of the liquid crystal display device controlling method in the present invention, the scanning lines are selected according to a predetermined order which is not related to an order the scanning lines are arranged. Therefore, flicker can be prevented with more certainty from occurring.

According to another aspect of the liquid crystal display device controlling method in the present invention, the scanning lines are selected according to an order the scanning lines are arranged in the first pixel regions and in the second pixel regions. Therefore, without causing the control of the scanning lines to become complex, flicker can be more certainly prevented from occurring.

According to another aspect of the liquid crystal display device controlling method in the present invention, the liquid crystal display device comprises a liquid crystal panel in which a plurality of signal lines for transmitting display data and a plurality of control lines for transmitting control signals are laid out vertically and horizontally, and pixel electrodes are arranged via switching elements at intersections of the signal lines and the control lines. The liquid crystal display device carries out gamma correction in response to a temperature change of the liquid crystal panel. Therefore, regardless of the temperature change of the liquid crystal panel, brightness and contrast of a display screen are constant.

According to another aspect of the liquid crystal display device controlling method in the present invention, the controlling method controls a liquid crystal display device comprising a liquid crystal panel in which a plurality of signal lines for transmitting display data and a plurality of control lines for transmitting control signals are laid out vertically and horizontally, and pixel electrodes are arranged via switching elements at intersections of the signal lines and the control lines, a plurality of first backlights arranged on the backside of the liquid crystal panel and separated from each other, and a plurality of second backlights each adjacent to the first backlights and separated from each other. In other words, by turning on and off the first backlights and the second backlights, pseudo-impulse driving can be realized. Image blurring can be alleviated and flicker can thus be prevented from occurring.

According to another aspect of the liquid crystal display device controlling method in the present invention, a luminescent period in which a display image in one frame period is output can be adjusted manually. Therefore, a viewer of the display image can directly adjust the display image for optimal view of the image. For example, the luminescent period is lengthened when a still image is viewed, while shortened when a moving image is viewed. Since the liquid crystal display device is adjustable in accordance with how the viewer of the display image feels, blurring in moving image can be alleviated and flicker can be prevented.

According to another aspect of the liquid crystal display device controlling method in the present invention, a luminescent period in which a display image in one frame period is output can be adjusted in accordance with a speed of motion of an image displayed on the liquid crystal panel. Therefore, blurring in moving image can be alleviated by shortening the luminescent period in the case of displaying a moving image and flicker can be prevented.

According to another aspect of the liquid crystal display device controlling method in the present invention, a data driver outputs display data to signal lines while a timing signal is active. A gate driver sequentially outputs gate pulses to scanning lines. Switching elements are controlled by the gate pulses, and the display data or reset data are written in pixel electrodes at intersections of the signal lines and the scanning lines. The data driver outputs the display data in an active period of the timing signal in one horizontal period, and outputs the reset data in an inactive period of the signal. By controlling the gate driver in accordance with the output timings of the display data and the reset data and by writing the data in one frame period, impulse driving can be carried out. As a result, blurring in a moving image can be alleviated and flicker can be prevented from occurring.

According to another aspect of the liquid crystal display device controlling method in the present invention, the reset data are written in the beginning of the one horizontal period and the display data are written consecutively thereafter. In other words, the display data are written over the reset data. As a result, the gate pulses for writing the display data can be formed easily.

According to another aspect of the liquid crystal display device controlling method in the present invention, width of the gate pulses for writing the reset data can be widened sufficiently and the reset data can be written with certainty.

According to another aspect of the liquid crystal display device controlling method in the present invention, a conventional data driver for generating display data, for example, can be used as it is for impulse driving.

According to another aspect of the liquid crystal display device controlling method in the present invention, AC driving can be carried out for also the reset data.

According to another aspect of the liquid crystal display device controlling method in the present invention, the reset data can be written with certainty.

According to another aspect of the liquid crystal display device controlling method in the present invention, reset data are also written in a blanking period. Therefore, the reset data are always written after a certain amount of time has elapsed since display data writing. As a result, in each pixel electrode, display data are displayed for the same duration and a period of displaying the reset data becomes equal. Therefore, brightness of the display data in the panel can be uniformed and brightness can be prevented from becoming uneven.

BRIEF DESCRIPTION OF THE DRAWINGS

The nature, principle, and utility of the invention will become more apparent from the following detailed description when read in conjunction with the accompanying drawings in which like parts are designated by identical reference numbers, in which.

DESCRIPTION OF THE PREFERRED EMBODIMENTS

Hereinafter, embodiments of the present invention will be explained with reference to the accompanying drawings.

Figure 1:
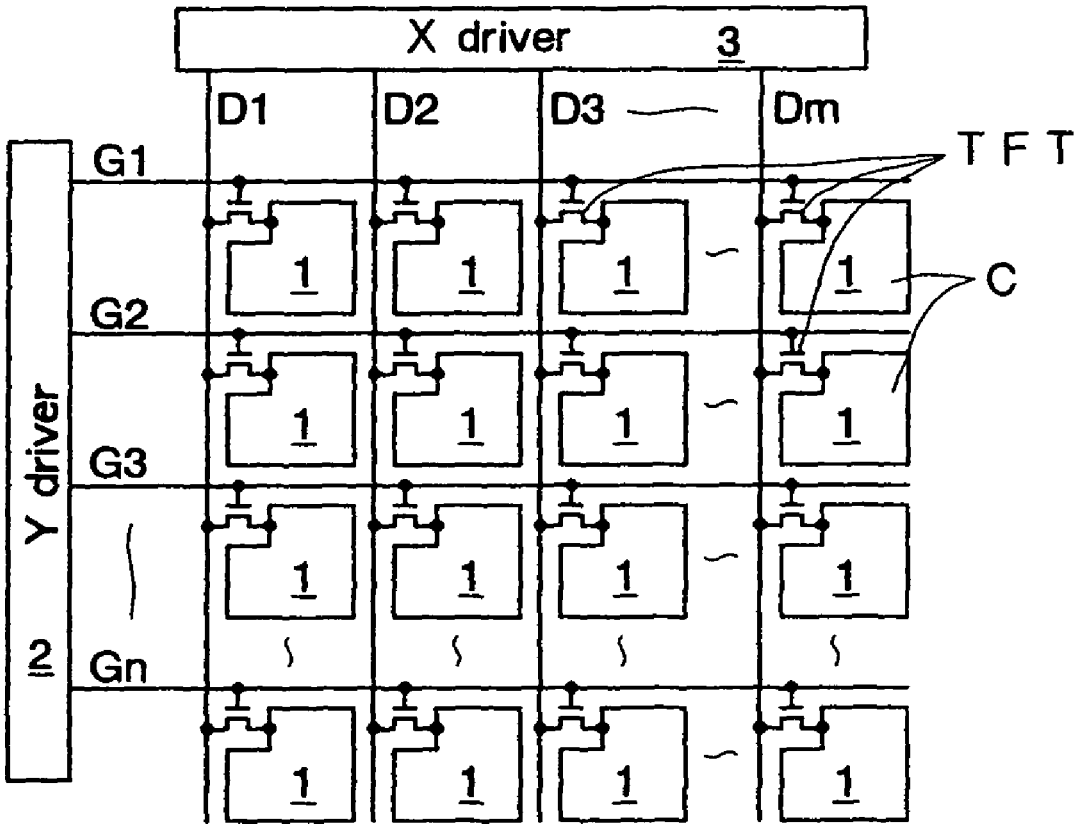
FIG. 1 is a block diagram showing an outline of a conventional liquid crystal display device.
Figure 2:
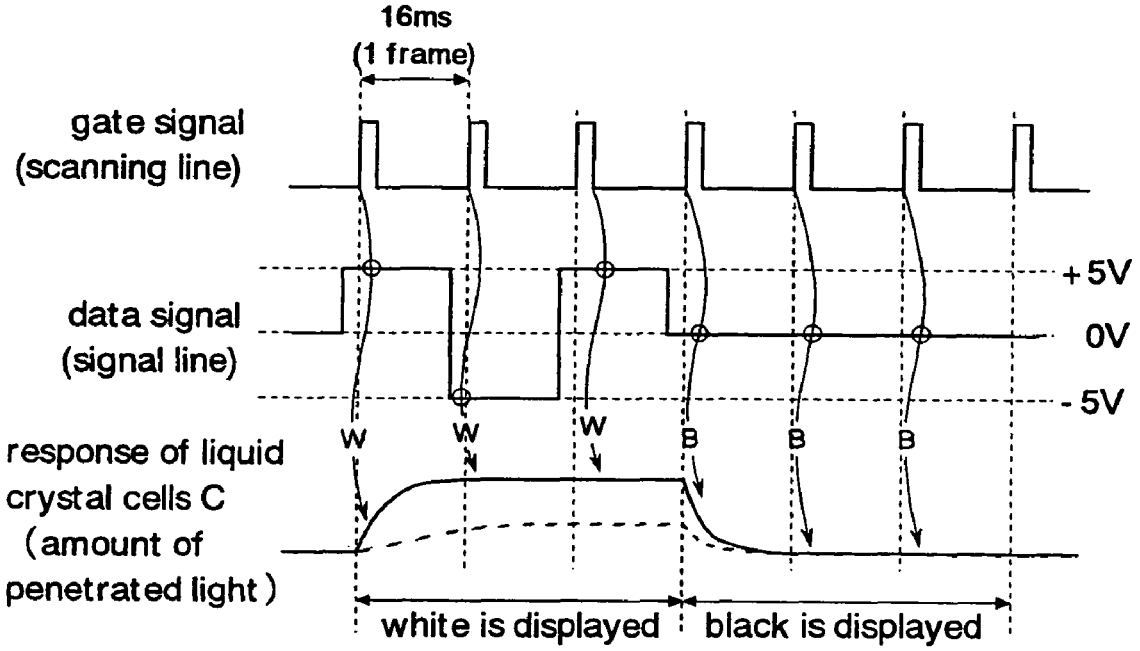
FIG. 2 is a timing chart showing a state of writing display data in the liquid crystal display device in FIG. 1.
Figure 3:
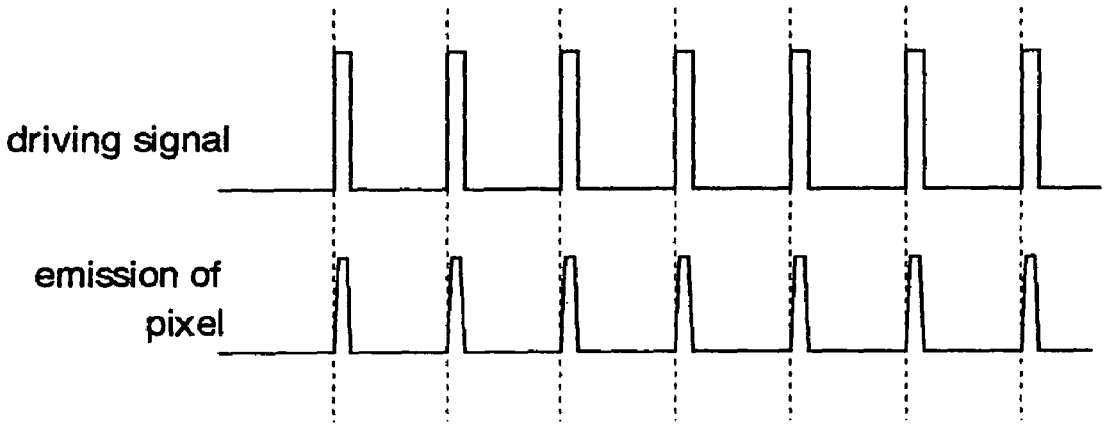
FIG. 3 is a timing chart showing a waveform of a driving voltage in a conventional CRT.
Figure 4:
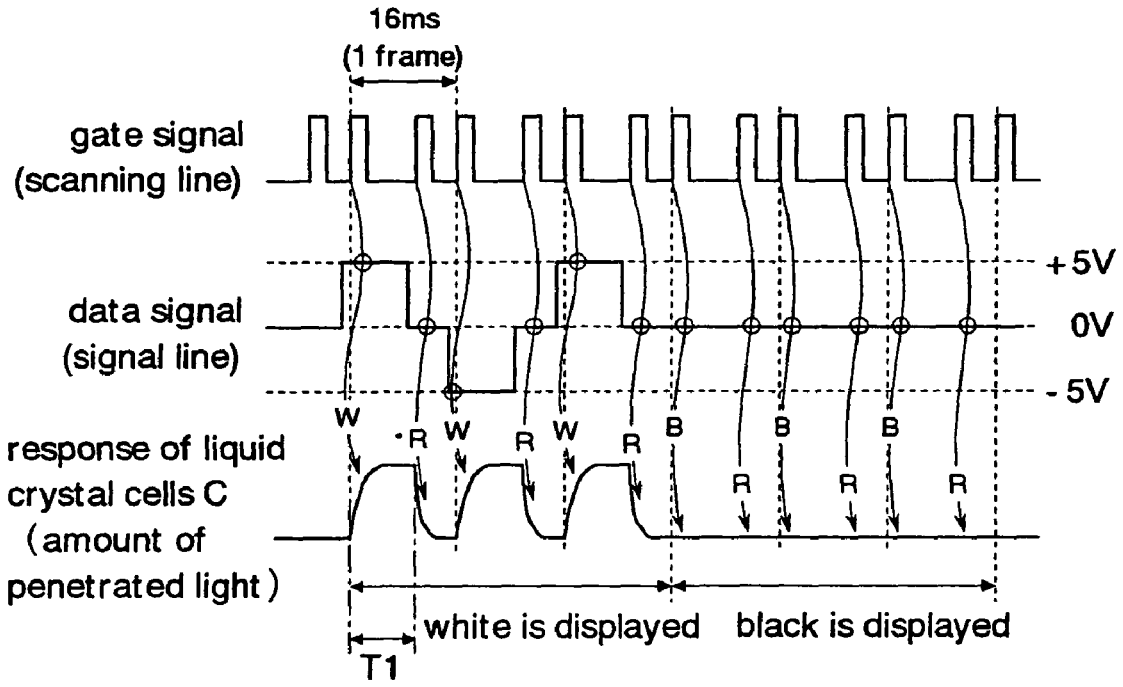
FIG. 4 is a timing chart showing a state of impulse driving carried out in a conventional liquid crystal display device.
Figure 5:
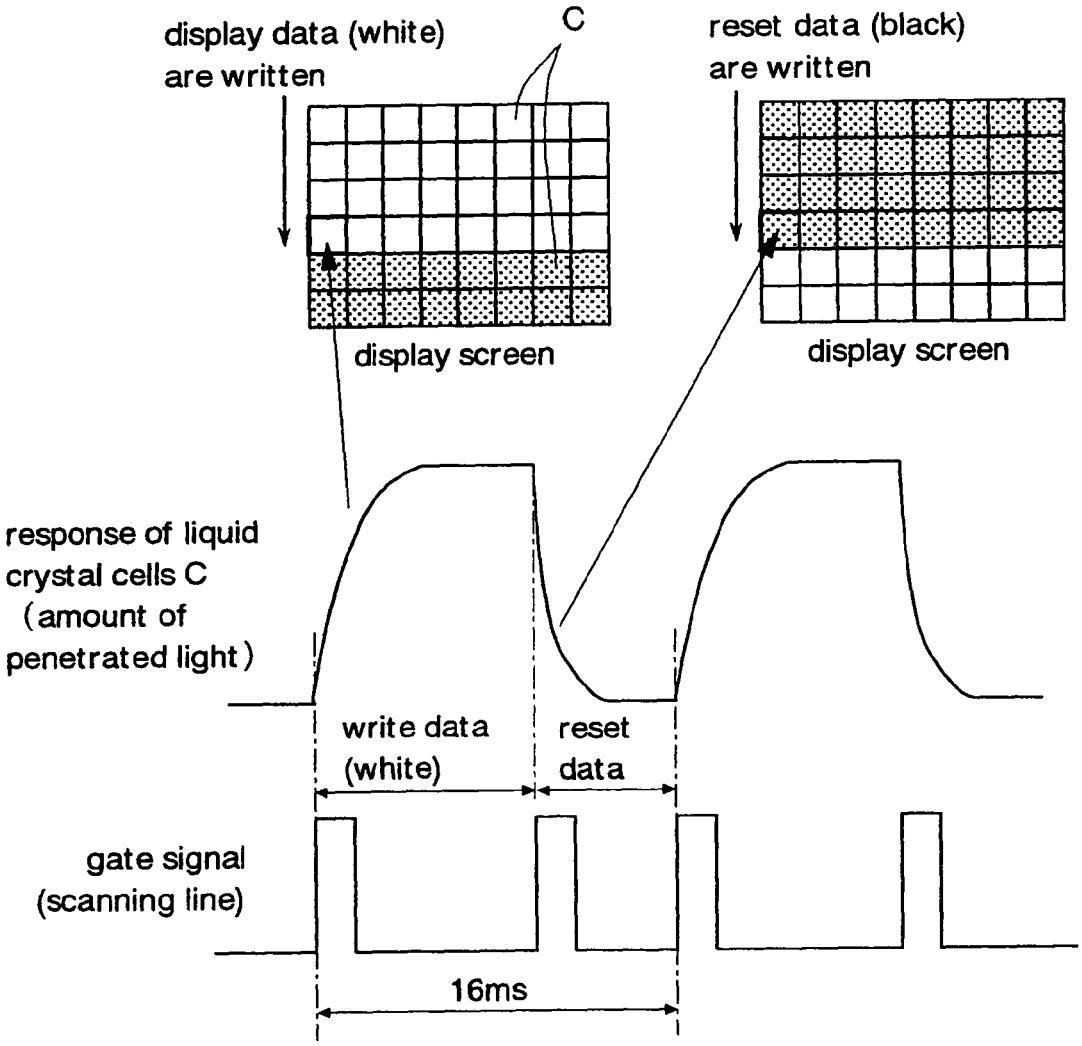
FIG. 5 shows an example of a display screen in the case of the impulse driving shown in FIG. 4.
Figure 6:
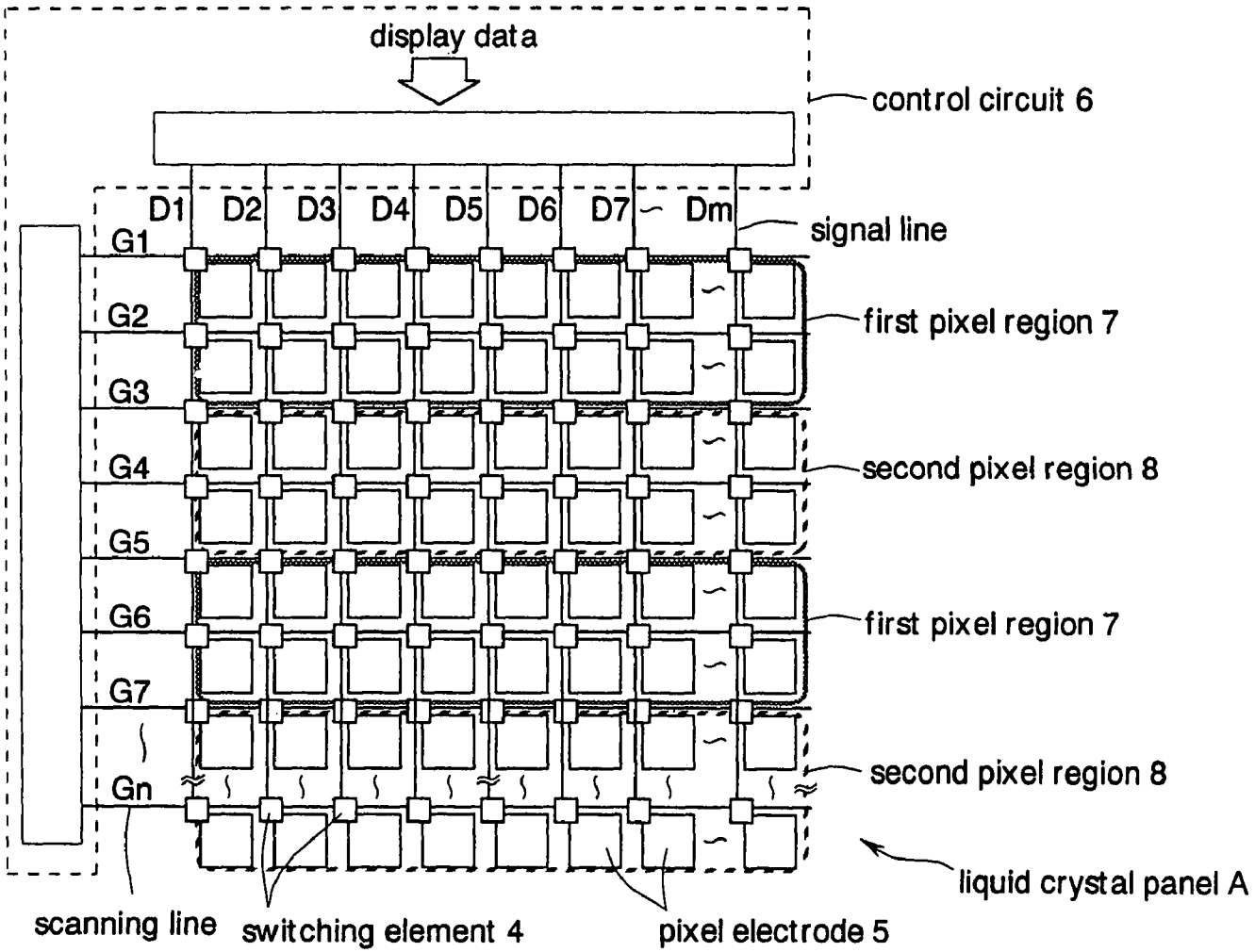
FIG. 6 is a block diagram showing a basic principle of a liquid crystal display device of the present invention and a controlling method thereof.

FIG. 6 is a block diagram showing a basic principle of a liquid crystal display device of the present invention and a method of controlling the liquid crystal display device.

The liquid crystal display device comprises a liquid crystal panel A in which a plurality of signal lines D1-Dm for transmitting display data and a plurality of scanning lines G1-Gn for transmitting control signals are laid out vertically and horizontally and pixel electrodes 5 are arranged via switching elements 4 at intersections of the signal lines and the scanning lines, and a control circuit 6 for controlling the liquid crystal panel A via the signal lines D1-Dm and the scanning lines G1-Gn. The liquid crystal panel A is divided into first pixel regions 7 and second pixel regions 8 next to the pixel regions 7.

The control circuit 6 carries out impulse driving in which the control signals transmitted to the respective scanning lines are activated two times each in one frame period in which one image is displayed. The control circuit 6 writes display data in the first pixel regions 7 and reset data in the second pixel regions 8 when the control signals are active at one of the two times. The control circuit 6 also writes the reset data in the first pixel regions 7 and the display data in the second pixel regions 8 when the control signals are active at the other time. By writing the reset data in the first pixel regions 7 and the second pixel regions 8, display data written therein immediately before are reset. In consecutive frames, the display data written in the first pixel regions 7 and the second pixel regions 8 are always reset in one frame period. Therefore, blurring in a display image is alleviated. Since writing and resetting of the display data are carried out separately in the first pixel regions 7 and the second pixel regions 8, flicker is prevented from occurring in a display screen.

Furthermore, as shown in FIG. 6, the display data and the reset data are written sequentially in the first pixel regions 7 and the second pixel regions 8 divided in stripes along the scanning lines. The regions for writing the reset data are divided into the plurality of pixel regions 7 and 8. Therefore, blurring in a display image is alleviated and flicker is prevented from occurring in the display screen.

Figure 7:
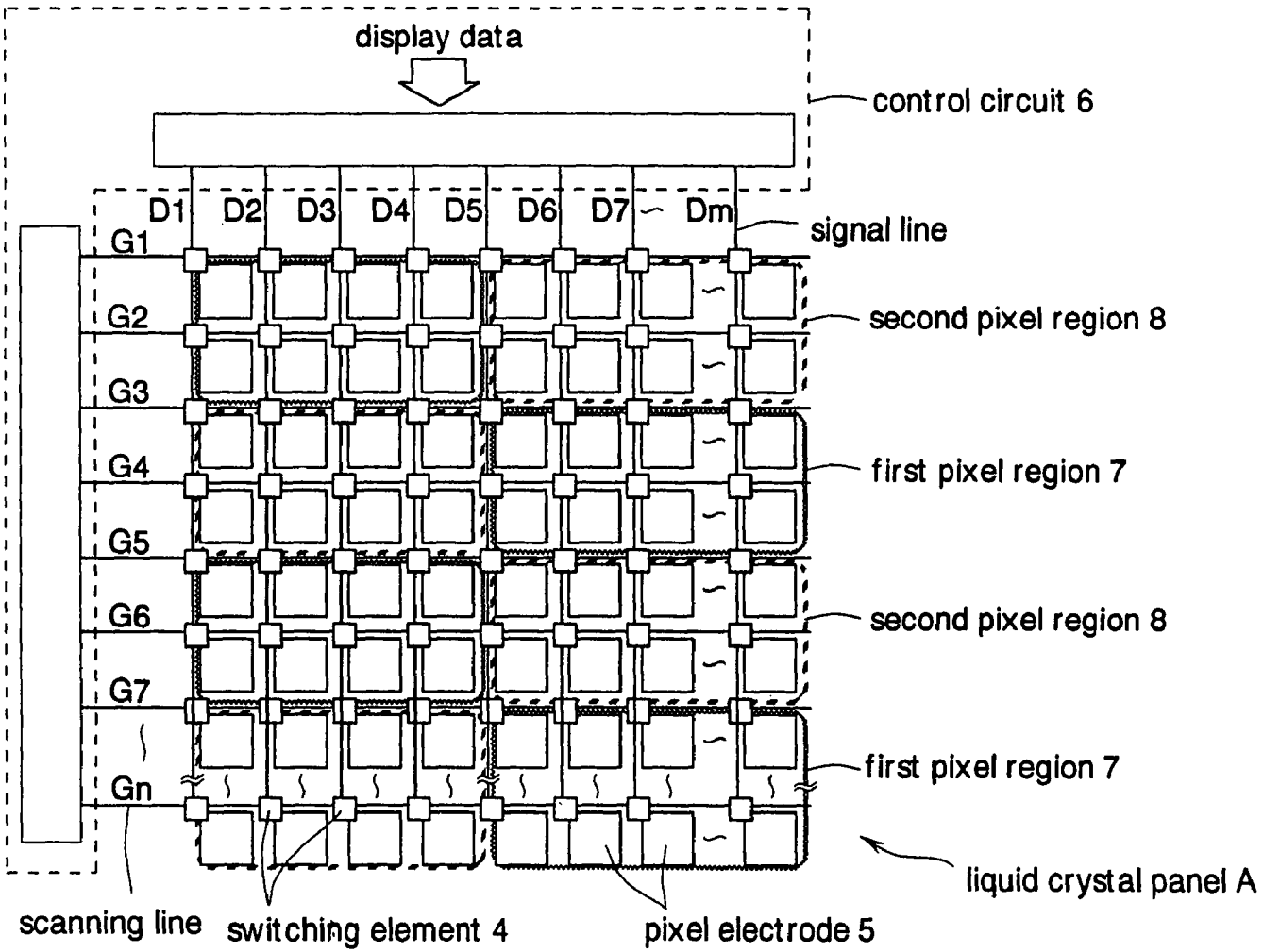
FIG. 7 is a block diagram showing a basic principle of another liquid crystal display device of the present invention and a controlling method thereof.

FIG. 7 is a block diagram showing a basic principle of another liquid crystal display device of the present invention and a controlling method of the liquid crystal display device.

In the liquid crystal display device, the first pixel regions 7 and the second pixel regions 8 are divided into a lattice-like form. The display data and the reset data are sequentially written in the first pixel regions 7 and the second pixel regions 8 divided into a lattice-like form. The regions in which the reset data are written are divided into the plurality of the first pixel regions 7 and the second pixel regions 8. Therefore, blurring in a display image is alleviated and flicker is prevented from occurring in the display screen.

Figure 8:
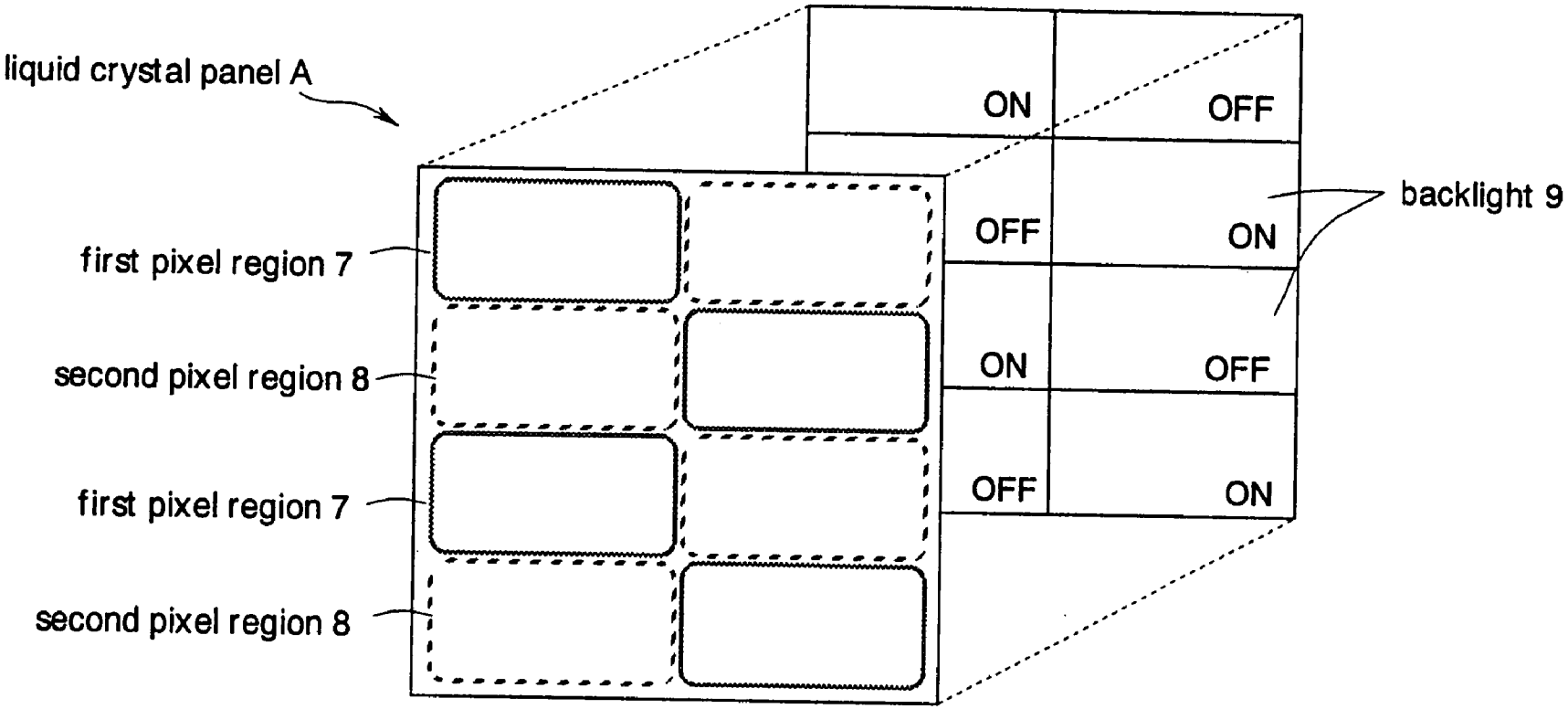
FIG. 8 is a block diagram showing a basic principle of another liquid crystal display device of the present invention and a controlling method thereof.

FIG. 8 is a block diagram showing a basic principle of another liquid crystal display device of the present invention and a method of controlling the liquid crystal display device.

The liquid crystal display device comprises backlights 9 on the backside of the liquid crystal panel A, facing the first pixel regions 7 and the second pixel regions 8. Each of the backlights 9 is turned on in synchronization with writing the display data in the first pixel regions 7 and the second pixel regions 8. Each of the backlights 9 is turned off in synchronization with writing the reset data in the first pixel regions 7 and the second pixel regions 8. Therefore, a contrast ratio between the cases of writing display data and writing reset data can be increased and an easy-to-see screen can be configured. Furthermore, since the backlights 9 corresponding to the pixel regions 7 and 8 in which the display data are not written are turned off, power consumption can be reduced.

Figure 9:
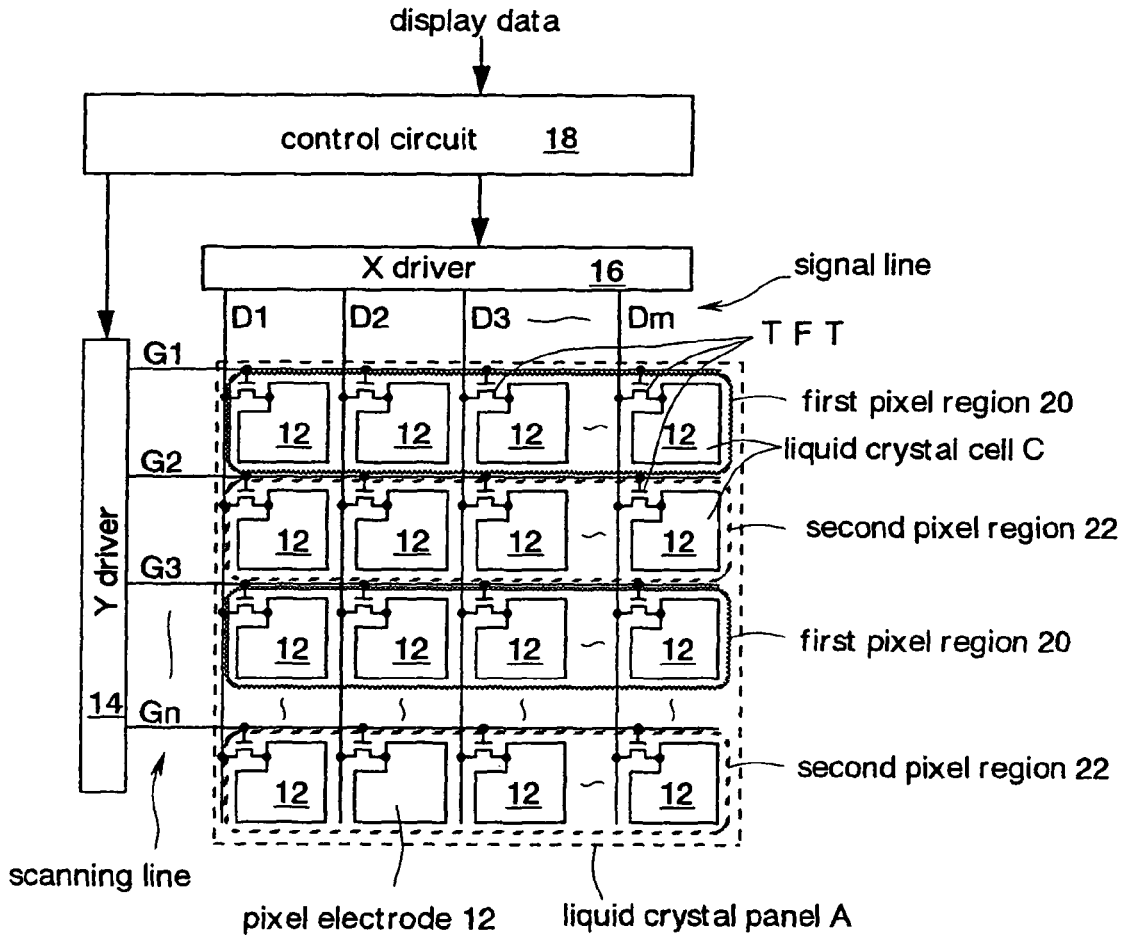
FIG. 9 is a block diagram showing a first embodiment of the liquid crystal display device of the present invention and the controlling method thereof.

The First Embodiment of the Liquid Crystal Display Device and the First Embodiment of the Liquid Crystal Display Device Controlling Method FIG. 9 shows an outline of a TFT (Thin Film Transistor) driving liquid crystal display device used in this embodiment.

This device comprises TFTs and pixel electrodes 12 laid out in the form of a matrix. Gate electrodes of the TFTs which are switching elements are connected to the scanning lines G1-Gn. The scanning lines G1-Gn are lines for transmitting gate signals output from a Y driver 14. Drain electrodes of the TFTs are connected to the signal lines D1-Dm. The signal lines D1-Dm are signal lines for transmitting data signals from an X driver 16. The source electrodes of the TFTs are connected to the pixel electrodes 12.

Counter electrodes (not shown) are arranged, facing the pixel electrodes 12. Liquid crystals (not shown) are sandwiched by the pixel electrodes 12 and the counter electrodes, forming liquid crystal cells C. The liquid crystal panel A is formed with liquid crystal cells C arranged vertically and horizontally. In this embodiment, the liquid crystal cells C are formed with $\pi$ cells having a short response time such as 2 ms, for example. For the liquid crystal liquid crystal panel A, other liquid crystal display modes, such as a TN (Twisted Nematic) type LCD or an LCD of in-plane switching mode can be used.

The Y driver 14 and the X driver 16 are controlled by a control circuit 18. The control circuit 18 receives the display data from exterior. The Y driver 14, the X driver 16, and the control circuit 18 correspond to the control circuit 6 shown in FIG. 6.

The liquid crystal panel A is divided into a plurality of first pixel regions 20 spaced out evenly and a plurality of second pixel regions 22 separated from each other and each adjacent to the first pixel regions 20. The first pixel regions 20 and the second pixel regions 22 are formed in the form of stripes along the scanning lines.

Figure 10:
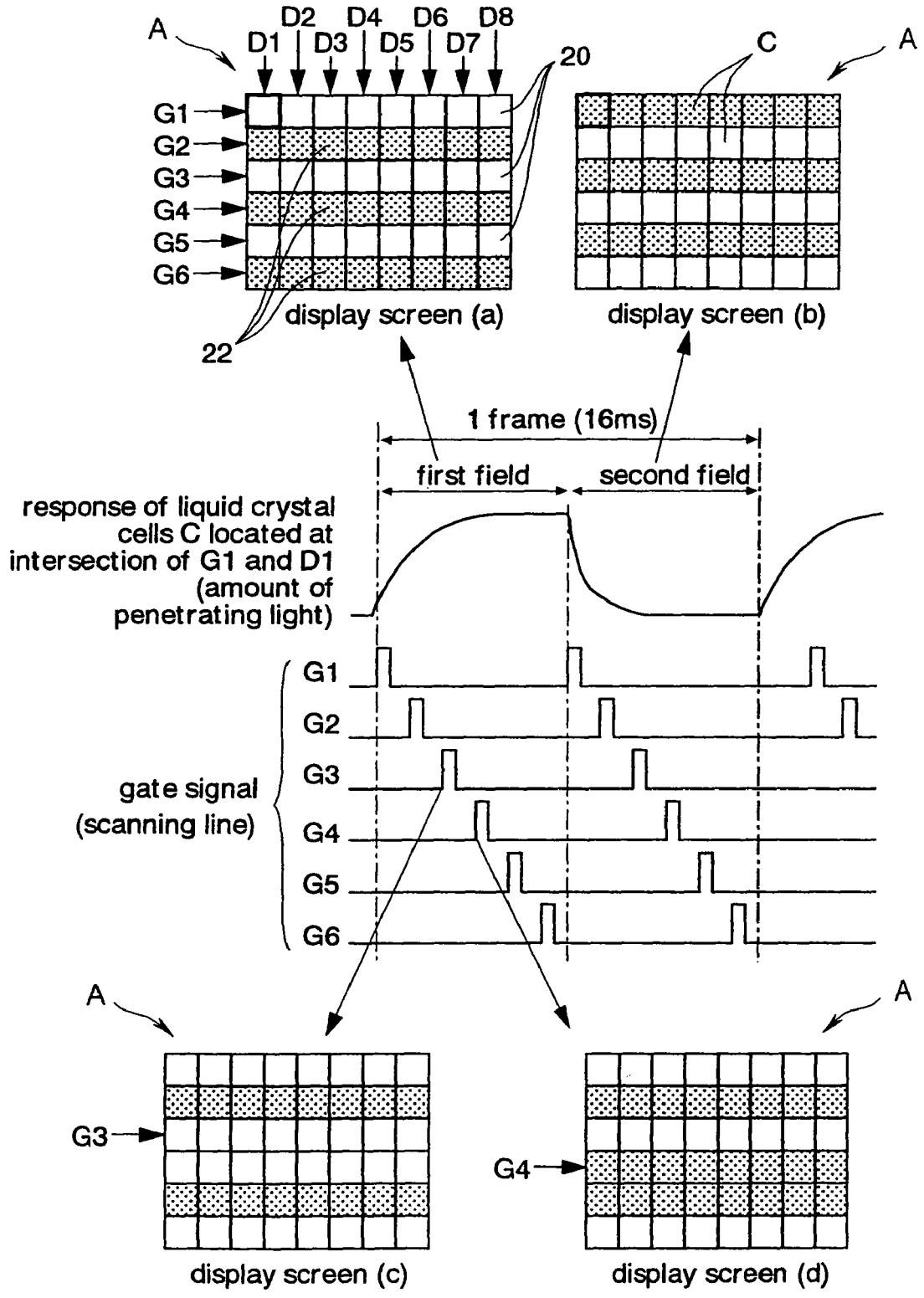
FIG. 10 shows a state of writing display data in the liquid crystal display device shown in FIG. 9.

FIG. 10 shows a state in which the display data are written in the liquid crystal display device described above. The liquid crystal panel A has 6 pixels and 8 pixels in the vertical direction and in the horizontal direction respectively, for the sake of simpler explanation. In other words, the liquid crystal panel A is driven by the 6 scanning lines G1-G6 and the 8 signal lines D1-D8.

The scanning lines G1-G6 are respectively activated twice in one frame period (16 ms) in which one image is displayed, as shown by the waveforms in FIG. 10. The scanning lines transmit high level-pulse gate signals to the liquid crystal panel A. Therefore, each of the liquid crystal cells C can display two data in one frame period. The Y driver 14 shown in FIG. 9 carries out a so-called "line-sequential scanning" to activate the scanning lines G1-G6 in the order of an arrangement while shifting the phases of each of the gate signals. Therefore, the control circuit such as the Y driver can be configured without substantially changing a conventional circuit. Within one frame period, a period in which the scanning lines G1-G6 are activated for the first time is called a first field and a period in which the scanning lines G1-G6 are activated for the second time is called a second field in this specification.

The control circuit 18 shown in FIG. 9 receives display data for two images in one frame period. The control circuit 18 writes in the first pixel regions 20 data corresponding to these regions 20 out of the display data having been received, and writes black data in the second pixel regions 22 as the reset data. The cells in which the display data are written are shown by white cells and cells in which the black data are written are shown by hatched areas. As a result, as shown in a display screen in FIG. 10(*a*), the display data are written in every other line corresponding to one scanning line at the end of the first field. For example, the amount of penetrating light increases in the first field in the cell C shown by a bold frame where the scanning line G1 and the signal line D1 intersect, as shown in FIG. 10. Therefore, white is displayed.

The control circuit 18 deletes the display data corresponding to the second pixel regions 22 out of the display data having been received first and writing black data instead of the display data. Conversion of the display data to the black data can be carried out by a simple gate circuit. In this embodiment, it is unnecessary for the portion of the displayed data to be stored in a buffer memory or the like. Therefore, a circuit necessary for the conversion processing in the control circuit 18 can be minimized. Furthermore, the control of conversion to the black data can be carried out easily.

In the second field, the control circuit 18 then writes in the second pixel regions 22 data corresponding thereto out of the display data received in the second time, and writes the black data in the first pixel regions 20 as the reset data. The control circuit 18 deletes the display data corresponding to the first pixel regions 20 out of the display data received in the first time, and writes the black data instead of the display data. As a result, as shown by a display screen in FIG. 10(*b*), display of the first pixel regions 20 in which the display data were written in the first field is reset by the black data.

The control circuit 18 alternately resets (black) the display data written in the first pixel regions 20 and the second pixel regions 22 by repeating the writing operations described above. Therefore, blurring such as tailing in a moving image can be prevented from occurring.

A display screen shown in FIG. 10(*c*) shows a state in which the scanning line G3 is activated in the first field. The lines where the display data are displayed over a plurality of the scanning lines adjacent to each other are the lines controlled by the line G3 and its neighboring line. In other lines, the display data and the black data are displayed alternately.

A display screen shown in FIG. 10(*d*) shows a state in which the scanning line G4 is activated in the first field. The lines where the black data are displayed over a plurality of the scanning lines adjacent to each other are the lines controlled by the line G4 and a neighboring line thereof. In other lines, the display data and the black data are displayed alternately.

As has been described above, the display data and the black data are written separately in the first pixel regions 20 and the second pixel regions 22 rather than one undivided area in the panel 20. Therefore, flicker is prevented from occurring in the display screen.

As has been described above, according to the liquid crystal display device and the controlling method of the present invention, the liquid crystal panel A is divided into a plurality of the first pixel regions 20 and the second pixel regions 22 separated from each other, and the display data and the reset data are written alternately in these areas 20 and 22. Therefore, blurring in a display image can be alleviated and flicker is prevented from occurring.

The control circuit 18 carries out conversion processing from the display data to the black data by deleting a portion of the display data and writing the black data instead of the deleted display data. Therefore, the conversion processing can be carried out by a simple gate circuit in the control circuit 18. Consequently, the size of the control circuit 18 can be minimized and the conversion processing can be controlled easily.

Since the scanning lines G1-G6 are subjected to line-sequential scanning as in a conventional device, the control circuit such as the Y driver 14 can be configured without a substantial change in a conventional circuit. In other words, the scanning lines are controlled easily.

In this embodiment, the liquid crystal panel A comprises the π cells having the 2-ms response time. However, the present invention is not limited to this example, and liquid crystal cells having a 16-ms response time may be used. In this case, the same effect as by the first embodiment can be obtained by setting the period of one frame to 32 ms, for example. As the liquid crystal cells, VA (Vertical Alignment) type cells having vertical alignment and partially including an electric field horizontal to the panel with anisotropy of the dielectric constant E being positive may be used. Alternatively, MVA (Multi-domain Vertical Alignment) type cells having vertical alignment, and a vertical electric field, with anisotropy of a negative dielectric constant ε, or IPS (In Plane Switching) type cells having horizontal alignment and a horizontal electric field may be used.

The Second Embodiment of the Liquid Crystal Display Device and the Second Embodiment of the Liquid Crystal Display Device Controlling Method In this embodiment, elements corresponding to the elements described above for the first embodiment are given the same reference numerals and explanation of these elements is not repeated.

Figure 11:
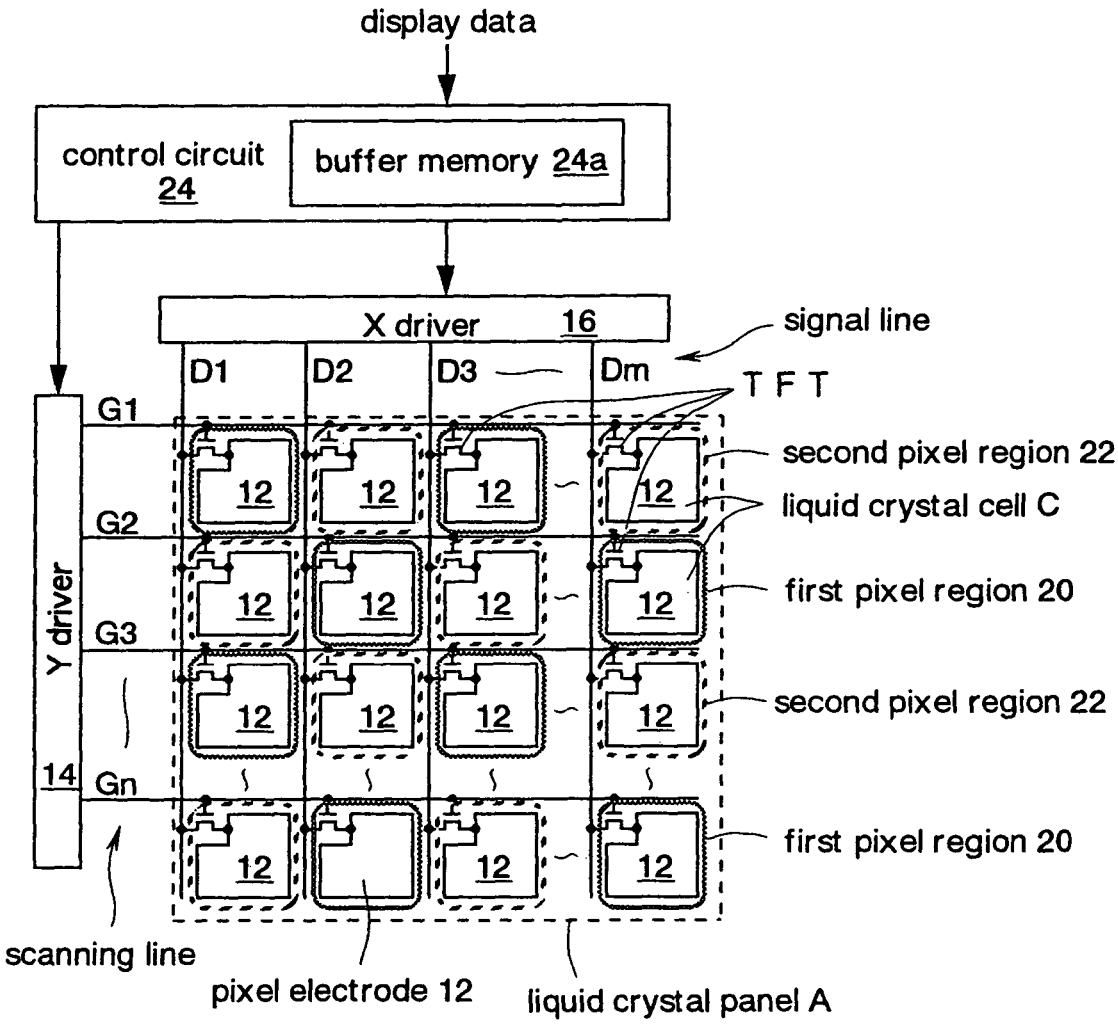
FIG. 11 is a block diagram showing a second embodiment of the liquid crystal display device of the present invention and the controlling method thereof.

FIG. 11 shows an outline of the TFT (Thin Film Transistor) driving liquid crystal display device used in this embodiment. In this embodiment, the first pixel regions 20 and the second pixel regions 22 are in a lattice-like form of each liquid crystal cell C. A control circuit 24 comprises a buffer memory 24*a* for retaining a portion of the display data transmitted from exterior. Other configurations are the same as in the first embodiment.

Figure 12:
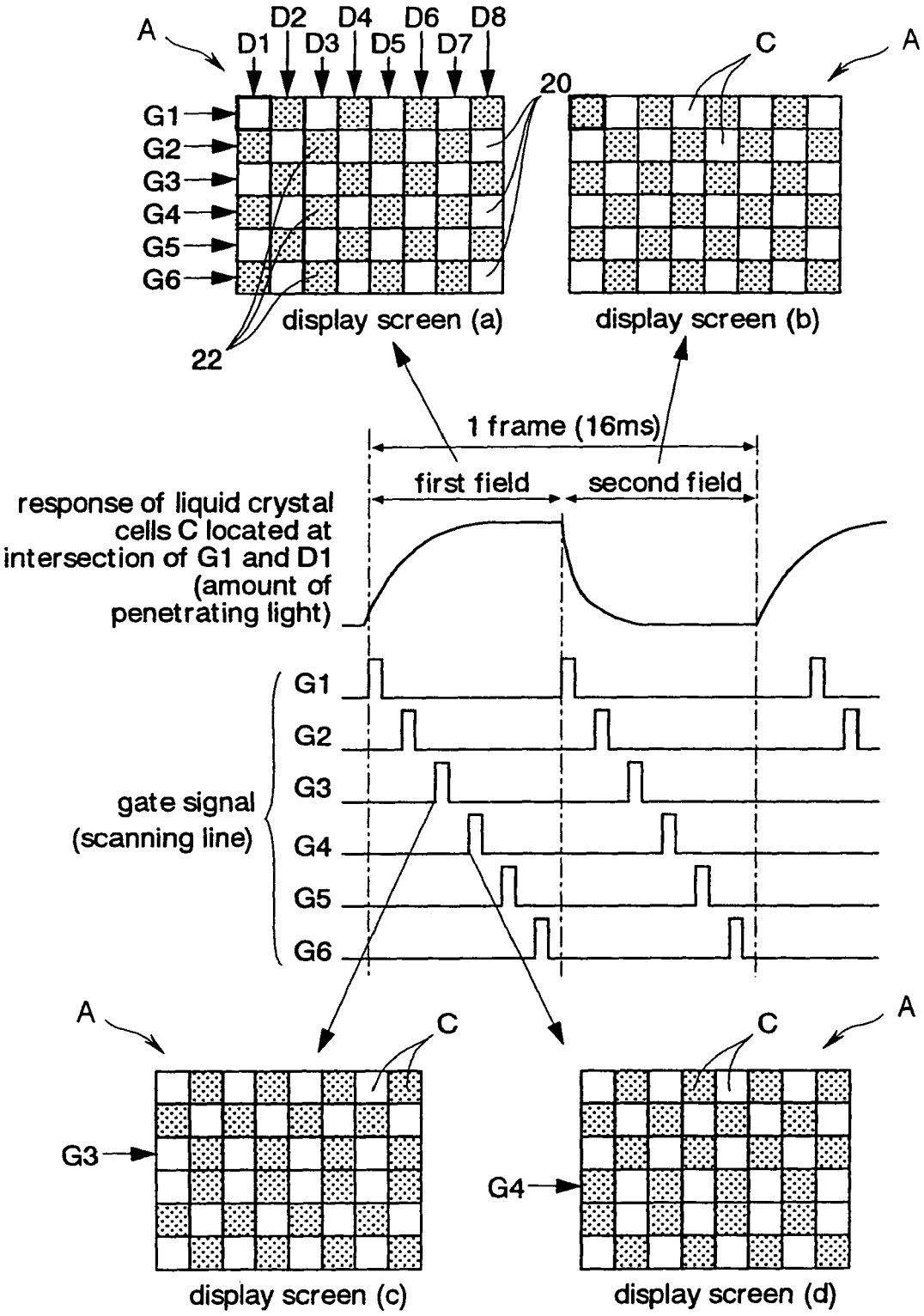
FIG. 12 shows a state of writing display data in the liquid crystal display device shown in FIG. 11.

FIG. 12 shows a state in which display data are written in the liquid crystal display device described above.

In this embodiment, the control circuit 24 shown in FIG. 11 receives display data for one image in one frame period (16 ms). In the first field, the control circuit 24 writes in the pixel regions 20 data corresponding thereto out of the display data having been received, and writes black data in the second pixel regions 22 as the reset data. In other words, the control circuit 24 alternately outputs the display data and the black data as the reset data to the X driver 16. The display data and the reset data are respectively transmitted to every other signal line. The control circuit 24 temporarily retains in the buffer memory 24*a* a portion of the display data corresponding to the second pixel regions 22 in which the black data are written in the first field. Control of the scanning lines G1-Gn by the Y driver 14 is the same as in the first embodiment.

As a result, as a display screen shown in FIG. 12(*a*), data in a check pattern are displayed on the liquid crystal panel A at the end of the first field. For example, the amount of light penetrating through one of the cells C shown by a bold frame where the scanning line G1 and the signal line D1 intersect increases as shown by the waveform in the first field, and white is displayed.

In the second field, the control circuit 24 then reads the display data having been retained in the buffer memory 24*a*. The control circuit 24 writes the data in the second pixel regions 22 while writing black data in the first pixel regions 20 as the reset data. As a result, as in a display screen shown in FIG. 12(*b*), the first pixel regions 20 in which the display data were written in the first field are reset by the black data.

The control circuit 24 alternately resets (black) the display data written in the first pixel regions 20 and the second pixel regions 22 by repeating the writing operations described above. Therefore, blurring such as tailing in a moving image can be prevented.

A display screen shown in FIG. 12(*c*) shows a state in which the scanning line G3 is activated in the first field. The only cells in which the display data are displayed over a plurality of the lines are every other cell in the line controlled by the scanning line G3 and its neighboring line. Therefore, the display data are not displayed in consecutive cells C in the direction of the scanning line, and the display data and the black data are alternately displayed in other lines.

A display screen shown in FIG. 12(*d*) shows a state in which the scanning line G4 is activated in the first field. The only cells in which the black data are displayed over a plurality of the lines are every other cell in the line controlled by the scanning line G4 and its neighboring line. Therefore, the black data are not displayed in consecutive cells C in the direction of the scanning line, and the display data and the black data are alternately displayed in other lines.

As has been described above, writing the display data and the reset data is carried out separately and alternately in the first pixel regions 20 and in the second pixel regions 22 (in other words, in each of the cells C). Therefore, flicker is prevented from occurring in the display screen.

In this embodiment, the same effect as by the first embodiment can be obtained. Furthermore, in this embodiment, the first pixel regions 20 and the second pixel regions 22 are further divided along the scanning line. Therefore, flicker is prevented with certainty from occurring in the display screen.

Figure 13:
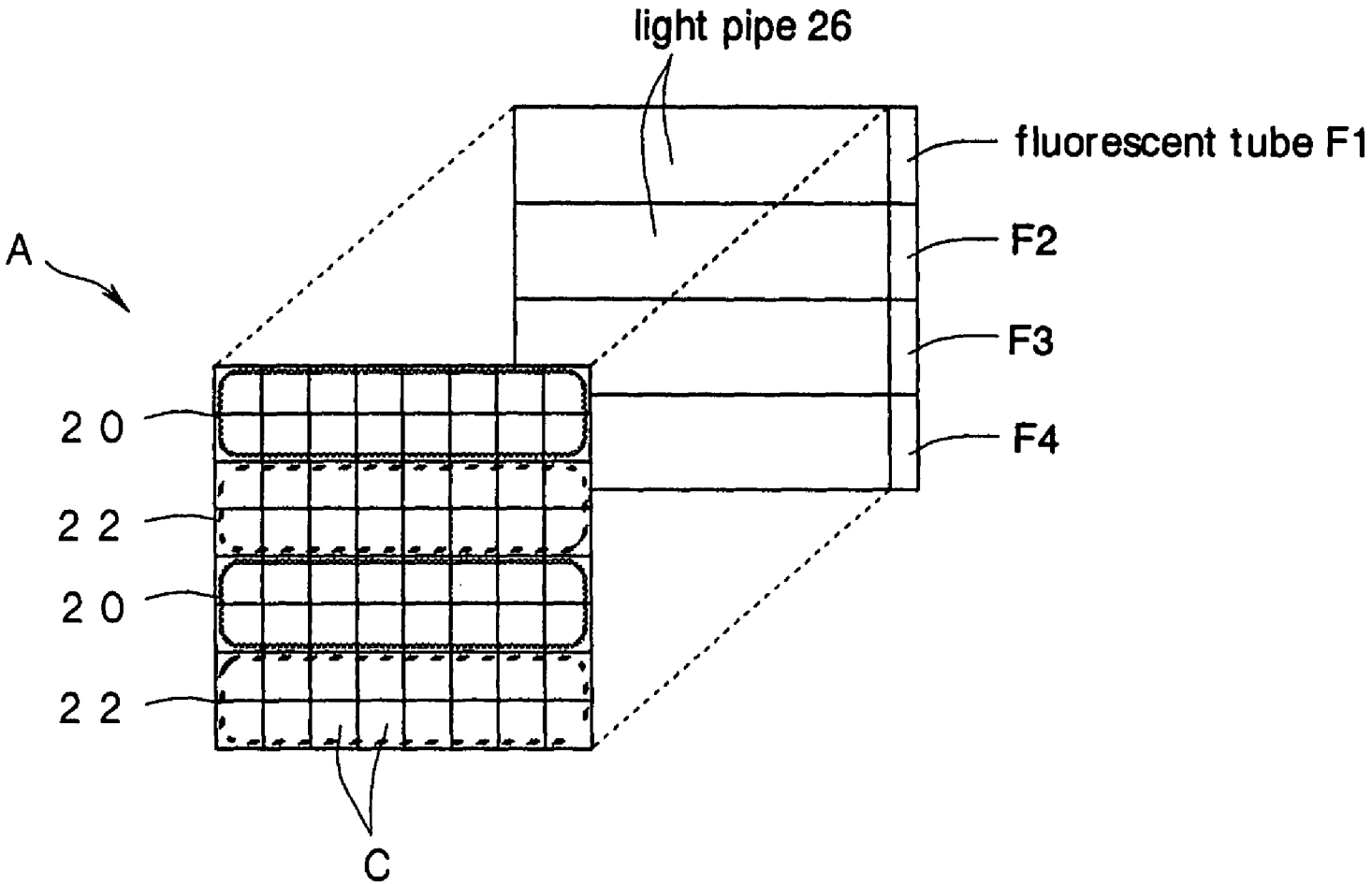
FIG. 13 is a block diagram showing a third embodiment of the liquid crystal display device of the present invention and the controlling method thereof.

The Third Embodiment of the Liquid Crystal Display Device and the Third Embodiment of the Liquid Crystal Display Device Controlling Method FIG. 13 shows a configuration of the TFT (Thin Film Transistor) driving liquid crystal display device used in this embodiment. In this embodiment, elements corresponding to the elements described above in the first embodiment are given the same reference numerals and explanation of these elements is not repeated.

In this embodiment, the liquid crystal panel A comprises the two first pixel regions 20 and the two second pixel regions 22 arranged alternately in the form of stripes.

Each of the first pixel regions 20 and the second pixel regions 22 is divided according to liquid crystal cells C corresponding to two scanning lines. The liquid crystal panel A is assumed to have 8 pixels in vertical direction and 8 pixels in horizontal direction, for the sake of simpler explanation. In reality, the height and the width of the liquid crystal cells C are approximately 0.3 mm each. Each of the first pixel regions 20 and the second pixel regions 22 is actually divided according to the liquid crystal cells C corresponding to several to tens of lines or hundreds or thousands of lines.

On the backside of the liquid crystal panel A, light guide plates 26 made of a transparent resin such as polycarbonate are arranged at positions facing the first pixel regions 20 and the second pixel regions 22. Surfaces of the light guide plates 26 where these light guide plates 26 are in contact with each other have minute irregularities. By these irregularities, light guided thereto is irregularly reflected and joints between the light guide plates 26 become inconspicuous. Fluorescent tubes F1-F4 as backlights are arranged at one end of each of the light guide plates 26 in the longitudinal direction. Other configurations are the same as in the first embodiment, except for a control circuit (not shown) having a function of controlling the fluorescent tubes F1-F4.

Figure 14:
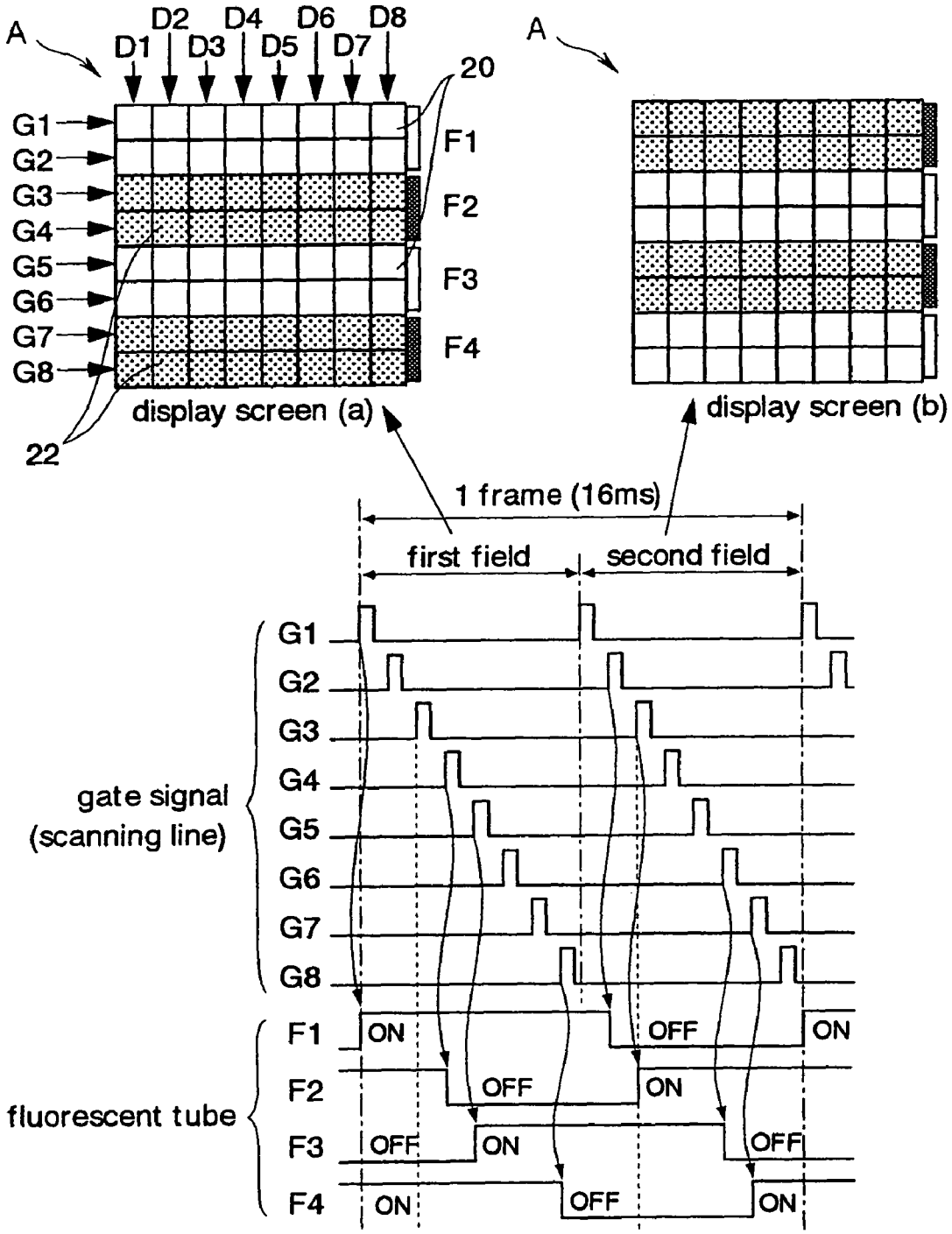
FIG. 14 shows a state of writing display data in the liquid crystal display device shown in FIG. 13.

FIG. 14 shows a state in which display data are written in the liquid crystal display device described above.

The scanning lines G1-G8 are activated twice in one frame period (16 ms) in which one image is displayed, as shown by the waveforms in FIG. 14. In this manner, a so-called sequential line scanning is carried out. In the first field, data corresponding to the first pixel regions 20 out of the display data are written in the first pixel regions, and black data are written in the second pixel regions 22 as the reset data. In the second field, data corresponding to the second pixel regions 22 out of the display data are written in the second pixel regions 22, and black data are written in the first pixel regions 20 as the reset data.

The fluorescent tubes F1-F4 are controlled in accordance with the control of the scanning lines G1-G8. For example, in the first field, the fluorescent tube F1 is turned on in synchronization with activation of the scanning line G1. The fluorescent tube F3 is turned on in synchronization with activation of the scanning line G5. Likewise, the fluorescent tubes F2 and F4 are turned off in synchronization with activation of the scanning lines G4 and G8, respectively. In the second field, the fluorescent tubes F1 and F3 are respectively turned off in synchronization with activation of the scanning line G2 and G6, and the fluorescent tubes F2 and F4 are turned on in synchronization with activation of the scanning lines G3 and G7, respectively.

A display screen shown in FIG. 14(*a*) shows a state in which the scanning line G8 is activated in the first field. The fluorescent tubes F1 and F3 which are turned on are shown in white. Likewise, a display screen shown in FIG. 14(*b*) shows a state in which the scanning line G8 is activated in the second field. In other words, in this embodiment, the fluorescent tubes corresponding to the first pixel regions 20 and the second pixel regions 22 in which display data are written are turned on while the fluorescent tubes corresponding to the first pixel regions 20 and the second pixel regions 22 in which black data are written are turned off. This control is carried out by the control circuit which is not shown. As a result, brightness at the time the black data are displayed decreases and the contrast ratio between the display data and the black data increases. Therefore, an easy-to-see screen can be configured. Furthermore, since the fluorescent tubes corresponding to the first pixel regions 20 and the second pixel regions 22 in which the display data are not displayed are turned off, power consumption is reduced.

Figure 15:
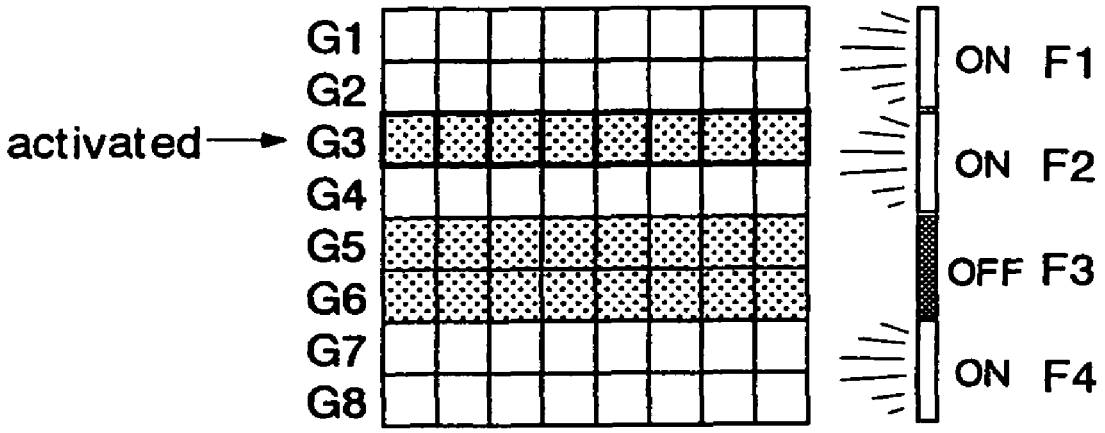
FIG. 15 shows a state in which fluorescent tubes are turned on and off in the liquid crystal display device shown in FIG. 13.
Figure 15:
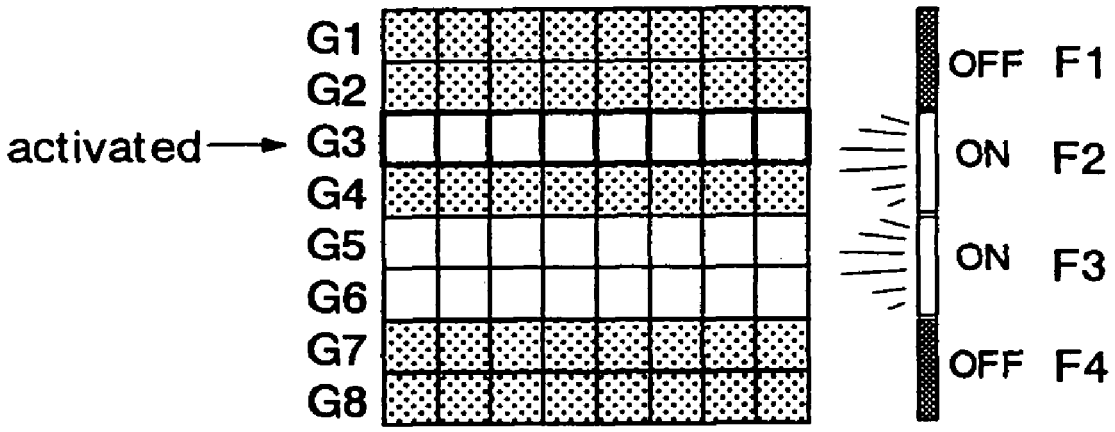

FIGS. 15(*a*) and 15(*b*) show states in which the scanning line G3 is activated in the first field and in the second field, respectively.

In FIG. 15(*a*), the fluorescent tube T2 is not turned off at the time the black data are written in the line corresponding to the scanning line G3. This is because the display data are displayed in the line corresponding to the scanning line G4 when the scanning line G3 is activated in the first field. As shown by the waveforms in FIG. 14, the fluorescent tube F2 is turned off in synchronization with activation of the scanning line G4.

On the contrary, the fluorescent tube F2 is turned on in synchronization with activation of the scanning line G3 as in FIG. 15(*b*). This is because the display data are displayed in the line corresponding to the scanning line G3 when the scanning line G3 is active in the second field. By the timings of turning on and off the fluorescent tubes, brightest display can be realized.

In this embodiment, the same effect as by the first embodiment can be obtained. Furthermore, in this embodiment, the backlights are arranged on the backside of the liquid crystal panel A. Therefore, the contrast ratio between the case of writing the display data and the case of writing the black data as the reset data can be increased and an easy-to-see screen can be configured.

Since the fluorescent tubes F1-F4 are used, the backlights can be configured easily in accordance with the first pixel regions 20 and the second pixel regions 22.

Moreover, the light guide plates 26 are used in accordance with the size of the first pixel region 20 and the second pixel region 22, and the number of the fluorescent tubes to be used can be minimized.

In this embodiment, the fluorescent tubes F1-F4 are turned off after being turned on. However, the present invention is not limited to this example, and brightness of the fluorescent tubes F1-F4 may be weakened instead of completely turning off the fluorescent tubes.

Figure 16:
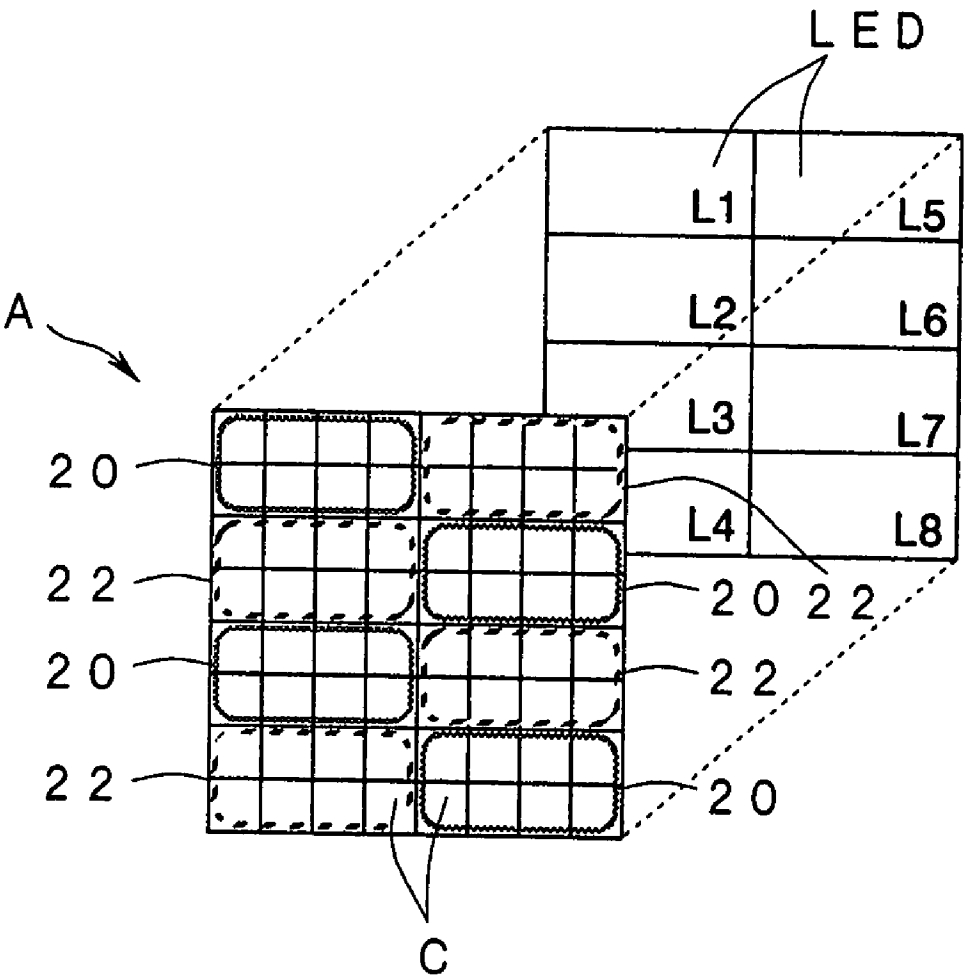
FIG. 16 is a block diagram showing a fourth embodiment of the liquid crystal display device of the present invention and the controlling method thereof.

The Fourth Embodiment of the Liquid Crystal Display Device and the Fourth Embodiment of the Liquid Crystal Display Device Controlling Method FIG. 16 shows an outline of the TFT (Thin Film Transistor) driving liquid crystal display device used in this embodiment. In this embodiment, elements corresponding to the elements described above for the first embodiment are given the same reference numerals and explanation of these elements is not repeated.

In this embodiment, the liquid crystal panel A is divided in lattice-like form, into four first pixel regions 20 and four second pixel regions 22 adjacent to each other. For simpler explanation, the liquid crystal panel A is assumed to have 8 pixels in the vertical direction and 8 pixels in the horizontal direction. Light-emitting diodes L1-L8 are arranged on the backside of the liquid crystal panel A at positions facing the first pixel regions 20 and the second pixel regions 22. In other words, each of the light-emitting diodes L1-L8 is arranged corresponding to an area of 2 pixels in the vertical direction and 4 pixels in the horizontal direction. In reality, the first pixel regions 20 and the second pixel regions 22 are divided corresponding to tens or hundreds of the liquid crystal cells C. Configurations other than the above are the same as in the first embodiment, except for a control circuit (not shown) having a function of controlling the light-emitting diodes L1-L8.

As in the third embodiment described above, fluorescent tubes and light guide plates may be used instead of the light-emitting diodes L1-L8.

Figure 17:
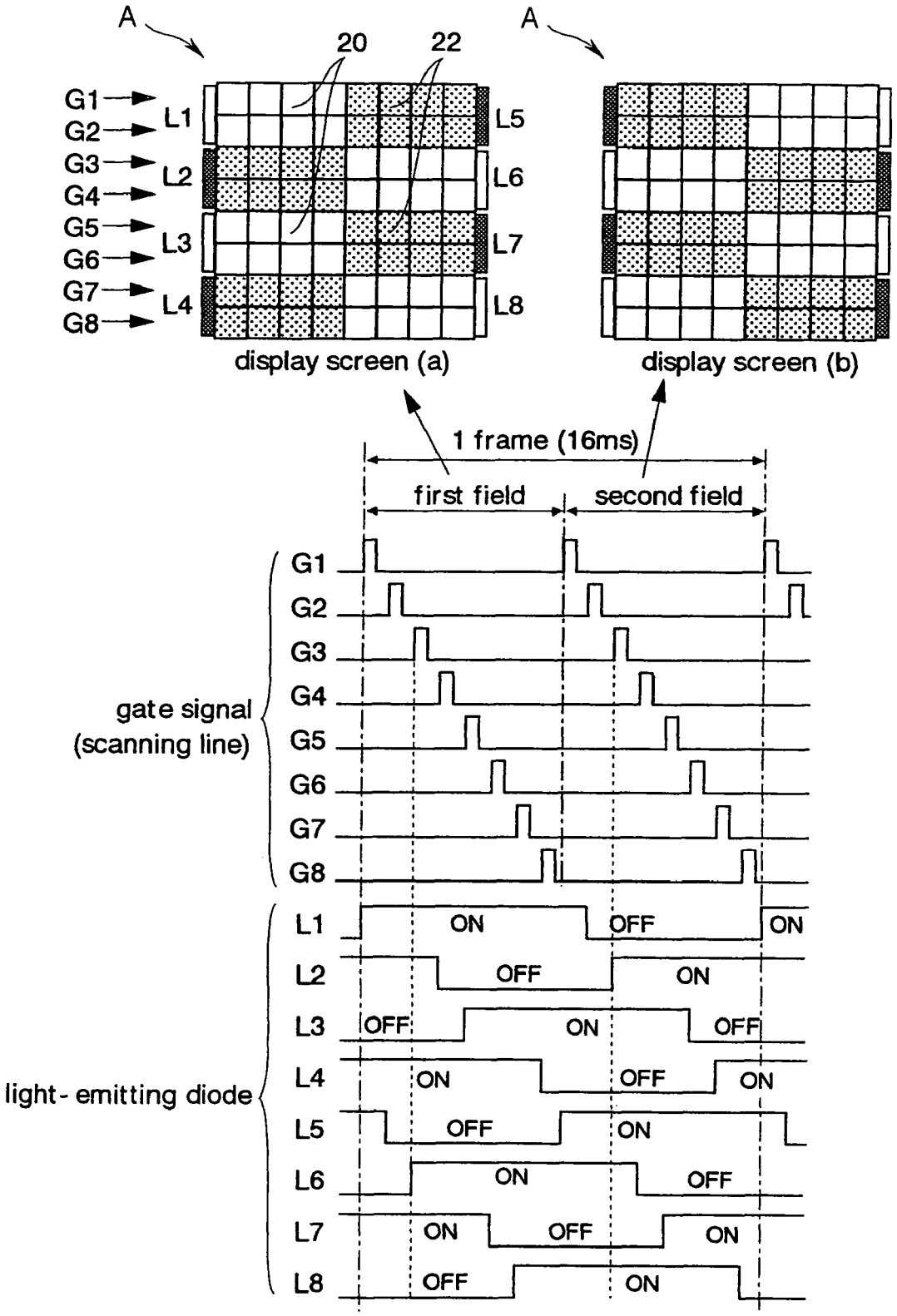
FIG. 17 shows a state of writing display data in the liquid crystal display device shown in FIG. 16.

FIG. 17 shows a state in which display data are written in the liquid crystal display device.

As shown by waveforms in FIG. 17, the scanning lines G1-G8 are activated twice in one frame period (16 ms) in which an image is displayed, and the so-called line-sequential scanning is carried out. In the first field, data corresponding to the first pixel regions 20 out of the displayed data are written in the first pixel regions 20, and the black data as the reset data are written in the second pixel regions 22. In the second field, data corresponding to the second pixel regions 22 out of the display data are written in the second pixel regions 22 and the black data as the reset data are written in the first pixel regions 20.

The light-emitting diodes L1-L8 are controlled in accordance with the control of the scanning lines G1-G8. For example, in the first field, the light emitting diode L1 is turned on in synchronization with activation of the scanning line G1. The light-emitting diodes L6, L3 and L8 are turned on in synchronization with activation of the scanning lines G3, G5 and G7. Likewise, the light-emitting diodes L5, L2, L7, and L4 are turned off in synchronization with activation of the scanning lines G2, G4, G6, and G8. In the second field, the light-emitting diodes L5, L2, L7, and L4 are turned on in synchronization with activation of the scanning lines G1, G3, G5, and G7. In synchronization with activation of the scanning lines G2, G4, G6, and G8, the light-emitting diodes L1, L6, L3, and L8 are turned off.

A display screen shown in FIG. 17(*a*) shows a state in which the scanning line G8 is activated in the first field. The light-emitting diodes L1, L3, L6, and L8 which are on are shown in white. Likewise, a display screen shown in FIG. 17(*b*) shows a state in which the scanning line G8 is activated in the second field. In other words, in this embodiment, the light-emitting diodes corresponding to the first pixel regions 20 and the second pixel regions 22 in which the display data are written are turned on. This control is carried out by the control circuit which is not shown.

Figure 18:
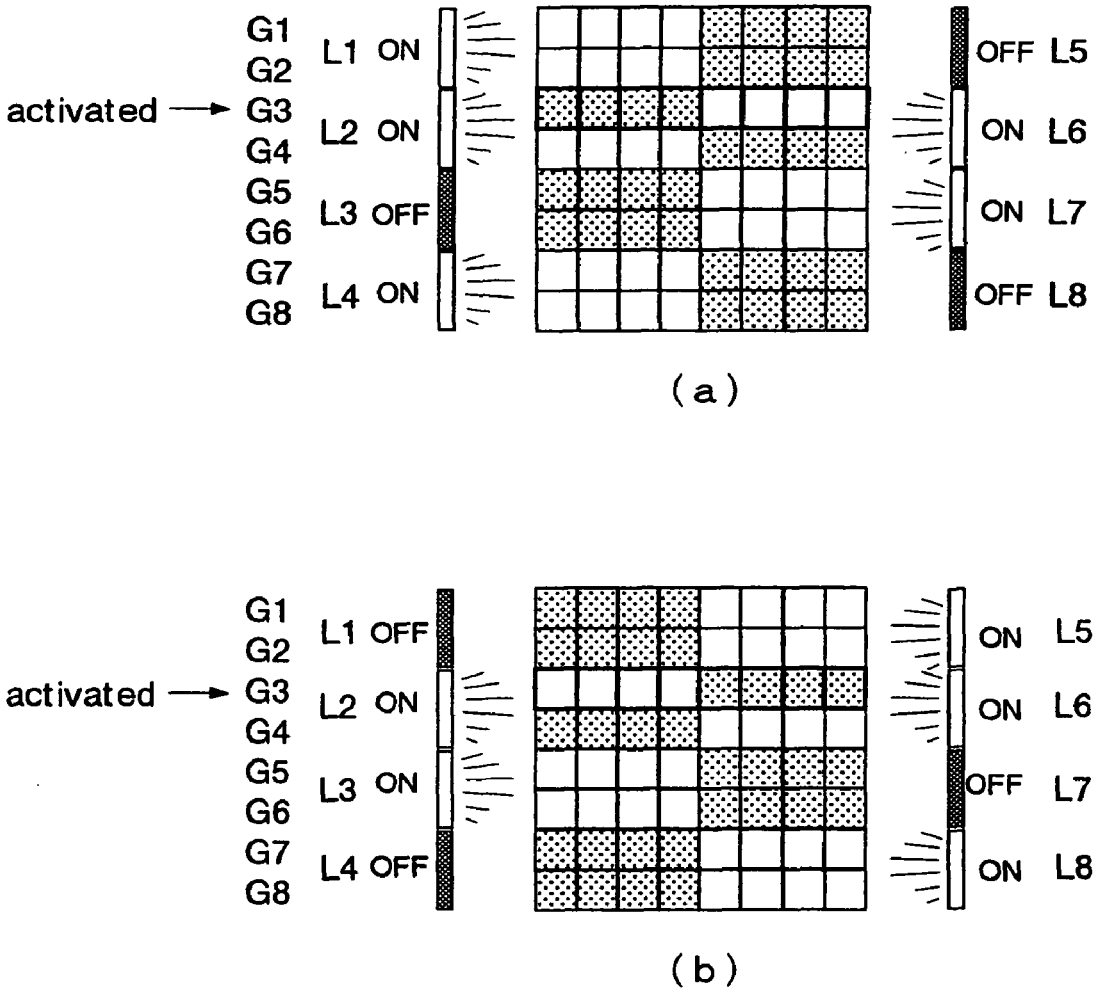
FIG. 18 shows a state in which light-emitting diodes are turned on and off in the liquid crystal display device shown in FIG. 16.

FIGS. 18(*a*) and 18(*b*) show states in which the scanning line G3 is activated in the first field and in the second field, respectively.

In FIG. 18(*a*), the light emitting diode L2 is not turned off in the case where black data are written in the line corresponding to the scanning line G3. This is because display data are displayed in the line corresponding to the scanning line G4 at the time of activation of the scanning line G3 in the first field. The light emitting diode L2 is turned off in synchronization with activation of the scanning line G4, as shown by the waveforms in FIG. 17. On the contrary, the light emitting diode L2 is turned on when the scanning line G3 is activated. This is because the display data are displayed in the line corresponding to the scanning line G3.

On the other hand, in FIG. 18(*b*), the light emitting diode L2 is turned on in synchronization with activation of the scanning line G3. This is because the display data are displayed in the line corresponding to the scanning line G3 at the time of activation of the scanning line G3 in the second field.

In this embodiment, the same effects as by the third embodiment can be obtained.

In this embodiment, the light-emitting diodes L1-L8 are used as the backlights. However, the present invention is not limited to this example. For example, the backlights can be formed by using a PDP (Plasma Display Panel). In this case, a multitude of the first pixel regions 20 and the second pixel regions 22 each having a small area can be used.

Figure 19:
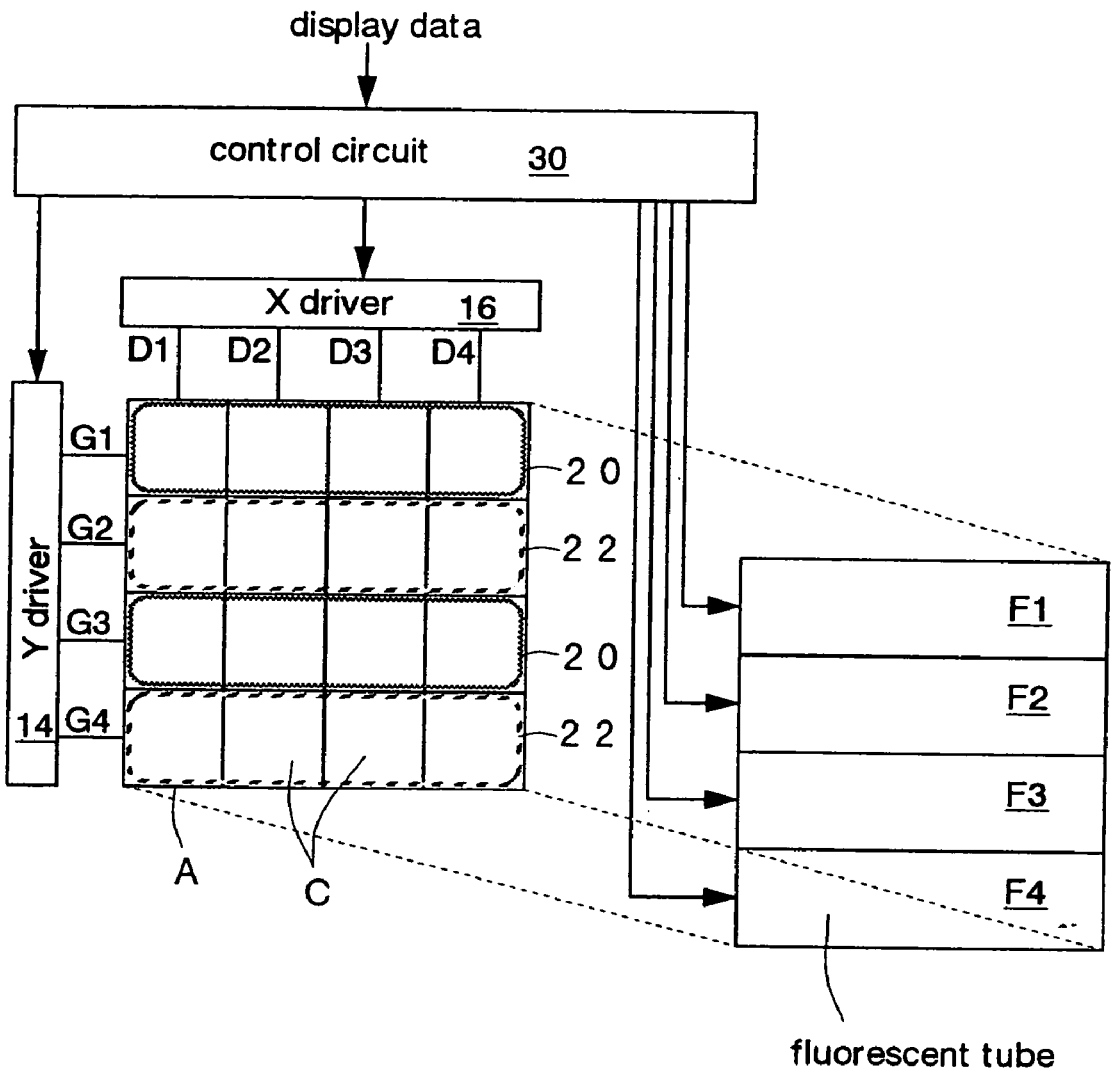
FIG. 19 is a block diagram showing a fifth embodiment of the liquid crystal display device of the present invention and the controlling method thereof.

The Fifth Embodiment of the Liquid Crystal Display Device and the Fifth Embodiment of the Liquid Crystal Display Device Controlling Method FIG. 19 shows an outline of the TFT (Thin Film Transistor) driving liquid crystal display device used in this embodiment. In this embodiment, elements corresponding to the elements described above for the first embodiment and for the third embodiment are given the same reference numerals and explanation of these elements is not repeated.

In this embodiment, the liquid crystal panel A has the two first pixel regions 20 and the two second pixel regions 22 arranged in alternation in stripes. For simpler explanation, the first pixel regions 20 and the second pixel regions 22 are divided according to the liquid crystal cells C corresponding to one line. In reality, the first pixel regions 20 and second pixel regions 22 are divided according to the liquid crystal cells C corresponding to tens to hundreds, or hundreds to thousands of lines. The fluorescent tubes F1-F4 are arranged on the backside of the liquid crystal panel A, each facing the first pixel regions 20 and the second pixel regions 22. In reality, each of the fluorescent tubes F1-F4 is formed with a plurality of tubes laid out in parallel in the direction of the scanning lines. A control circuit 30 controls the Y driver 14, the X driver 16, and the fluorescent tubes F1-F4. The control circuit 30 has a function of supplying an AC voltage having a predetermined frequency to each of the fluorescent tubes F1-F4 while shifting the phase thereof.

Figure 20:
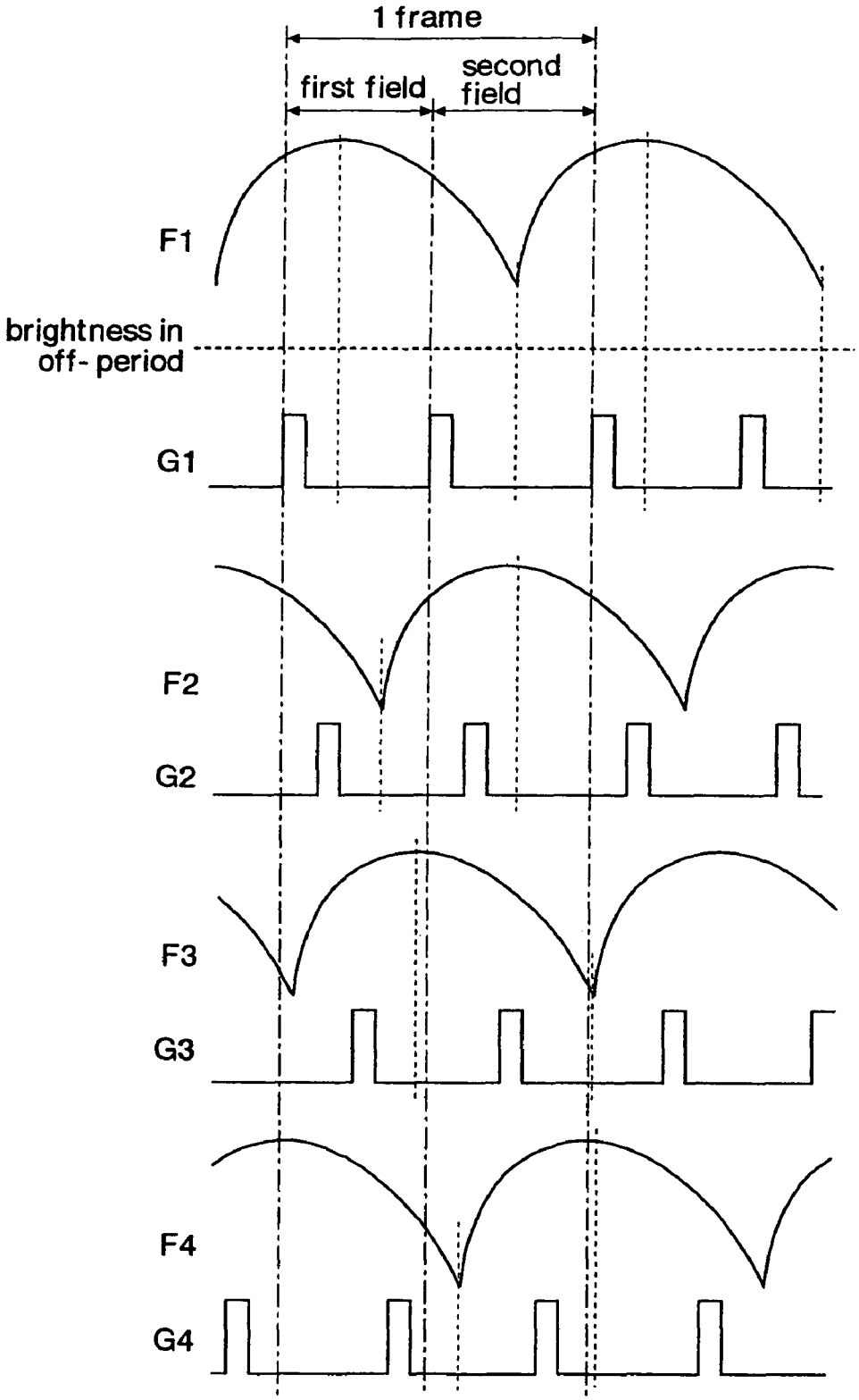
FIG. 20 shows a state in which fluorescent tubes are turned on and off in the liquid crystal display device shown in FIG. 19.

FIG. 20 shows a state in which the fluorescent tubes F1-F4 are turned on and off and the scanning lines G1-G8 are driven in the liquid crystal display device described above.

Each of the fluorescent tubes F1-F4 emits light in the same period, with a predetermined phase shift.

Therefore, a phase of maximum brightness is different between the fluorescent tubes F1-F4, and so is a phase of minimum brightness. The control circuit 30 shown in FIG. 19 causes one frame period to synchronize with the luminescent period of the fluorescent tubes F1-F4 and activates each of the scanning lines G1-G4 at timings slightly before the timings of maximum and minimum brightness of the fluorescent tubes F1-F4. More specifically, the scanning line G1 is activated slightly before the time the fluorescent tube F1 has the maximum brightness in the first field, and activated again slightly before the time the fluorescent tube F1 has the minimum brightness in the second field. The scanning line G2 is activated slightly before the time the fluorescent tube F2 has the minimum brightness in the first field, and activated again slightly before the time the fluorescent tube F2 has the maximum brightness in the second field. The scanning line G3 is activated slightly before the time the fluorescent tube F3 has the maximum brightness in the first field, and activated again slightly before the time the fluorescent tube F3 has the minimum brightness in the second field. The scanning line G4 is activated slightly before the time the fluorescent tube F4 has the minimum brightness in the first field, and activated again slightly before the time the fluorescent tube F4 has the maximum brightness in the second field.

In the first field, by activation of the scanning lines G1 and G3, display data are written in the first pixel regions 20 shown in FIG. 19. By activation of the scanning lines G2 and G4, black data are written in the second pixel regions 22. In the first field, by activation of the scanning lines G1 and G3, black data are written in the first pixel regions 20. By activation of the scanning lines G2 and G4, display data are written in the second pixel regions 22.

Therefore, brightness of the fluorescent tubes F1-F4 becomes maximal immediately after writing the display data, and becomes minimal immediately after writing the black data. As a result, without special on-off control of the fluorescent tubes F1-F4, an image having a high contrast ratio and no flicker can be displayed.

In this embodiment, the same effect as by the first embodiment can be obtained. Furthermore, in this embodiment, the control circuit 30 controls the scanning lines G1-G4 by causing one frame period to synchronize with the period of the AC voltage supplied to the fluorescent tubes F1-F4. Therefore, without special on-off control of the fluorescent tubes F1-F4, the contrast ratio of the screen can be increased.

Figure 21:
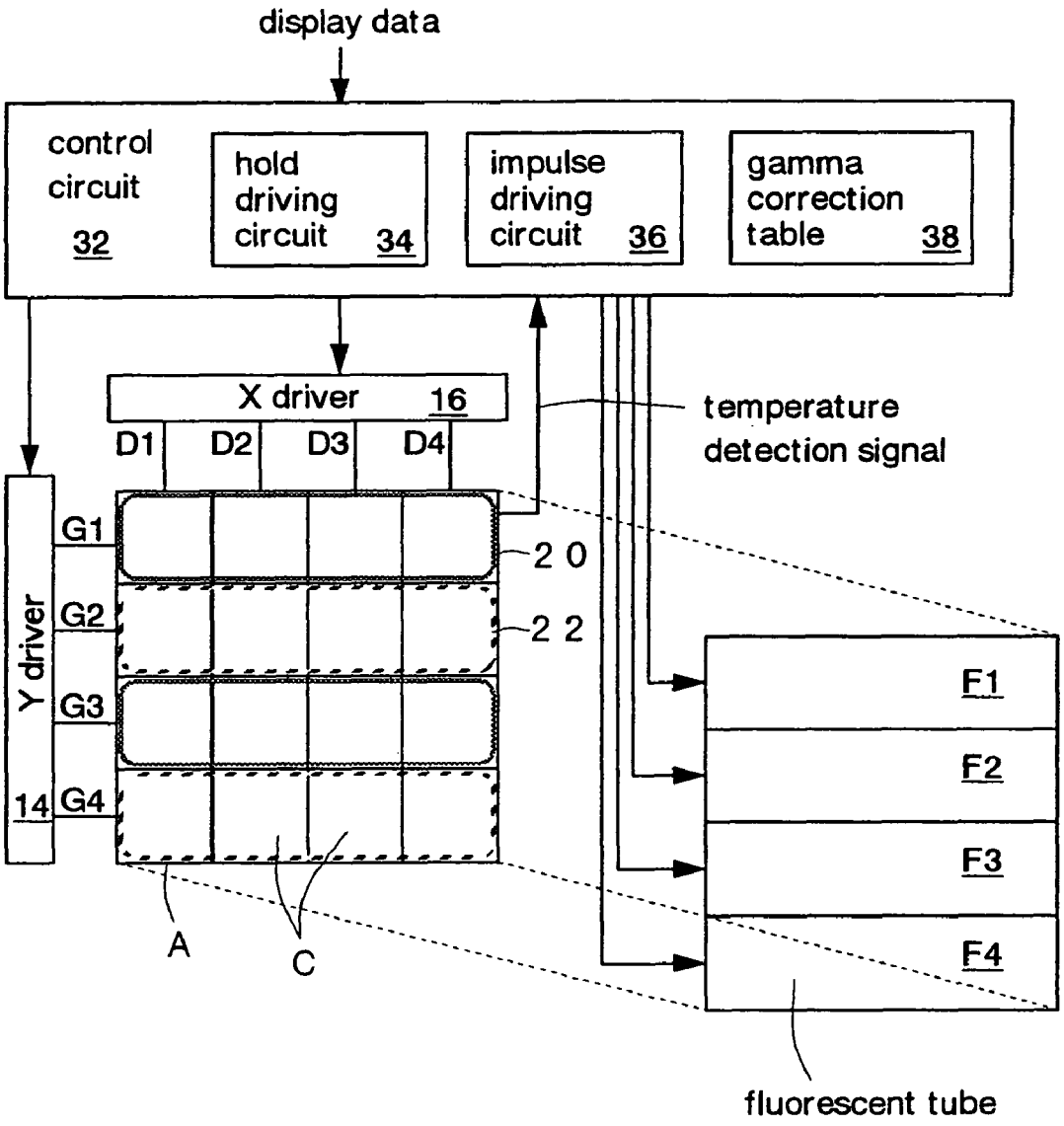
FIG. 21 is a block diagram showing a sixth embodiment of the liquid crystal display device of the present invention and the controlling method thereof.

The Sixth Embodiment of the Liquid Crystal Display Device and the Sixth Embodiment of the Liquid Crystal Display Device Controlling Method FIG. 21 shows an outline of the TFT (Thin Film Transistor) driving liquid crystal display device used in this embodiment. In this embodiment, elements corresponding to the elements described above for the first embodiment and for the third embodiment are given the same reference numerals and explanation of these elements is not repeated.

In this embodiment, a control circuit 32 has a hold driving circuit 34, an impulse driving circuit 36 and a gamma correction table 38. Configurations other than the above are the same as in the fifth embodiment.

The gamma correction table 38 has correction data for hold driving and impulse driving and correction data corresponding to a temperature of the liquid crystal panel A.

The control circuit 32 activates the impulse driving circuit 36 when a moving image is displayed and activates the hold driving circuit 34 when a still image is displayed. In other words, in this embodiment, hold driving and impulse driving can be switched from one to another, depending on a display screen. The still image is not limited to a photograph. For example, if the liquid crystal display device of the present invention is connected to a personal computer, a screen displayed by software, such as a spread sheet used on the computer, is dealt with as the still image.

When the impulse driving in which the display data are displayed at a low rate in one frame period is carried out, the control circuit 32 increases the brightness of the fluorescent tubes F1-F4 than in the case of the hold driving. Therefore, variance in the brightness between the case of the impulse driving and the case of the hold driving can be reduced.

The control circuit 32 carries out optimal gamma correction at the time of the hold driving and the impulse driving.

Furthermore, the control circuit 32 receives the temperature of the liquid crystal panel A as a temperature detection signal and reads the correction data corresponding to the temperature from the gamma correction table. The control circuit 32 carries out gamma correction on the display data according to the correction data and adjusts a write voltage to each of the liquid crystal cells C.

The temperature of the liquid crystal panel A may be detected by a temperature sensor or by monitoring a value of an electric current flowing in elements such as the TFTs.

In this embodiment, the same effect as by the first and third embodiments can be obtained. Furthermore, in this embodiment, a still image is displayed according to the hold driving and a moving image is displayed according to the impulse driving. Therefore, optimal screen display can be realized for any image.

Since the brightness of the fluorescent tubes F1-F4 is increased at the time of the impulse driving, variance between the impulse driving and the hold driving can be reduced.

Since optimal gamma correction is carried out in the hold driving and in the impulse driving, a change in the amount of light penetrating through the liquid crystal cells C can be faster especially in the impulse driving. Therefore, brightness can be increased.

Since the gamma correction is carried out in response to the temperature change of the liquid crystal panel A, brightness, contrast, and gray-scale displaying characteristics can be constant regardless of the temperature change in the liquid crystal panel A.

Figure 22:
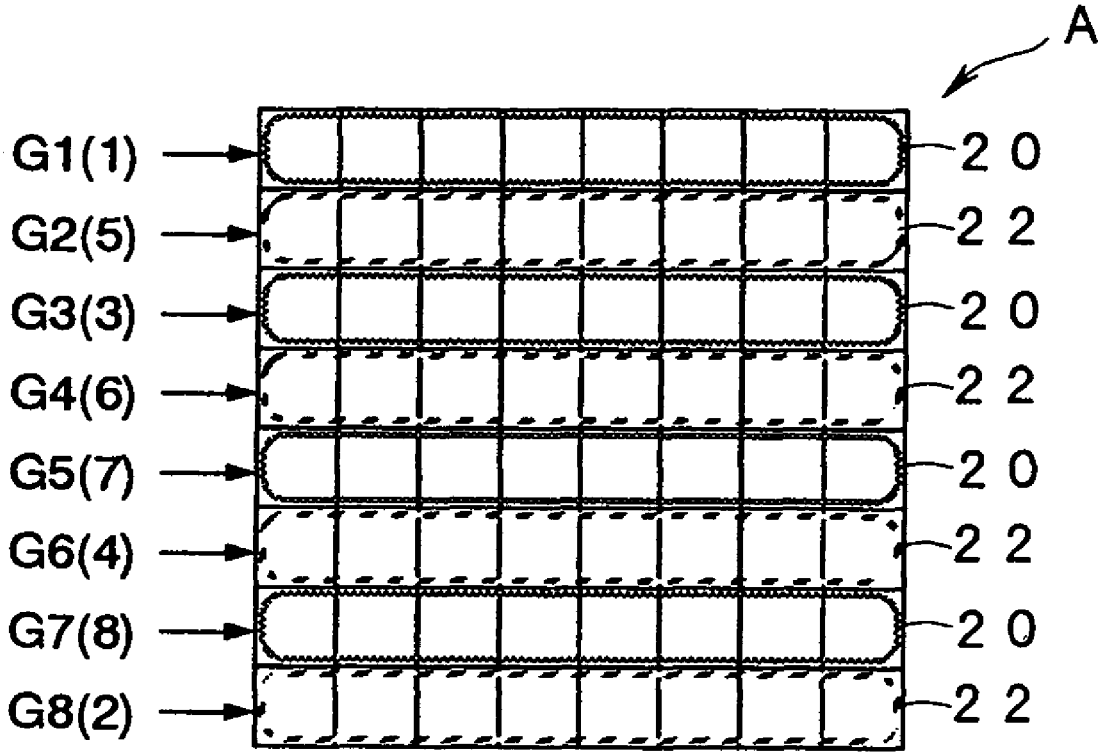
FIG. 22 is a block diagram showing a seventh embodiment of the liquid crystal display device of the present invention and the controlling method thereof.

The Seventh Embodiment of the Liquid Crystal Display Device and the Seventh Embodiment of the Liquid Crystal Display Device Controlling Method FIG. 22 shows an outline of the liquid crystal panel A of the TFT (Thin Film Transistor) driving liquid crystal display device used in this embodiment.

The liquid crystal panel A comprises the four first pixel regions 20 and the four second pixel regions 22 arranged alternately in the form of stripes. The first pixel regions 20 and the second pixel regions 22 are divided corresponding to the liquid crystal cells C for one line. The liquid crystal panel A is assumed to have 8 pixels in vertical direction and 8 pixels in horizontal direction, for the sake of simpler explanation. Other configurations are the same as in the first embodiment described above. In FIG. 22, numbers in parentheses shown together with the scanning lines G1-G8 indicate a driving order of the scanning lines G1-G8.

Figure 23:
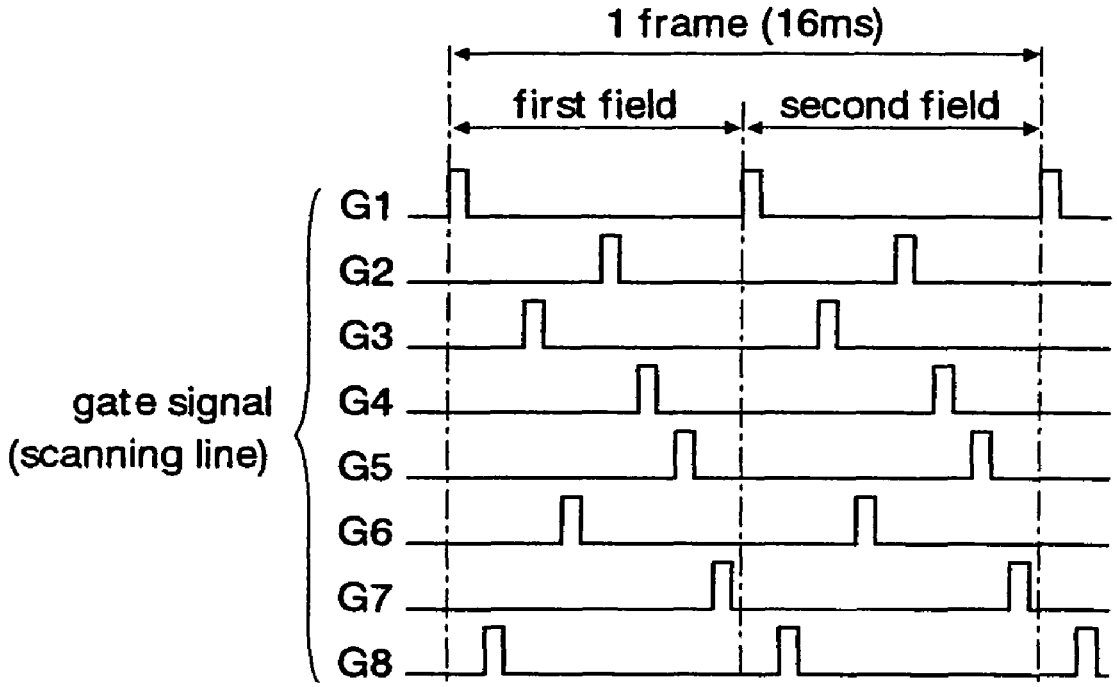
FIG. 23 is a timing chart showing a state of writing display data in the liquid crystal display device shown in FIG. 22.

FIG. 23 shows timings at which display data are written in the liquid crystal display device.

A control circuit which is not shown activates the scanning lines G1, G8, G3, G6, G2, G4, G5 and G7 in this order in the first filed and in the second field. In the first filed, the control circuit writes in the first pixel regions 20 data corresponding thereto out of the display data, and writes black data in the second pixel regions 22. In the second field, the control circuit writes in the second pixel regions 22 data corresponding thereto out of the display data, and writes black data in the first pixel regions 20.

In this embodiment, the same effect as by the first embodiment can be obtained. Furthermore, in this embodiment, the scanning lines G1-G8 are driven in the predetermined order which is not related to an order the scanning lines are arranged in. Therefore, flicker is prevented with more certainty.

Figure 24:
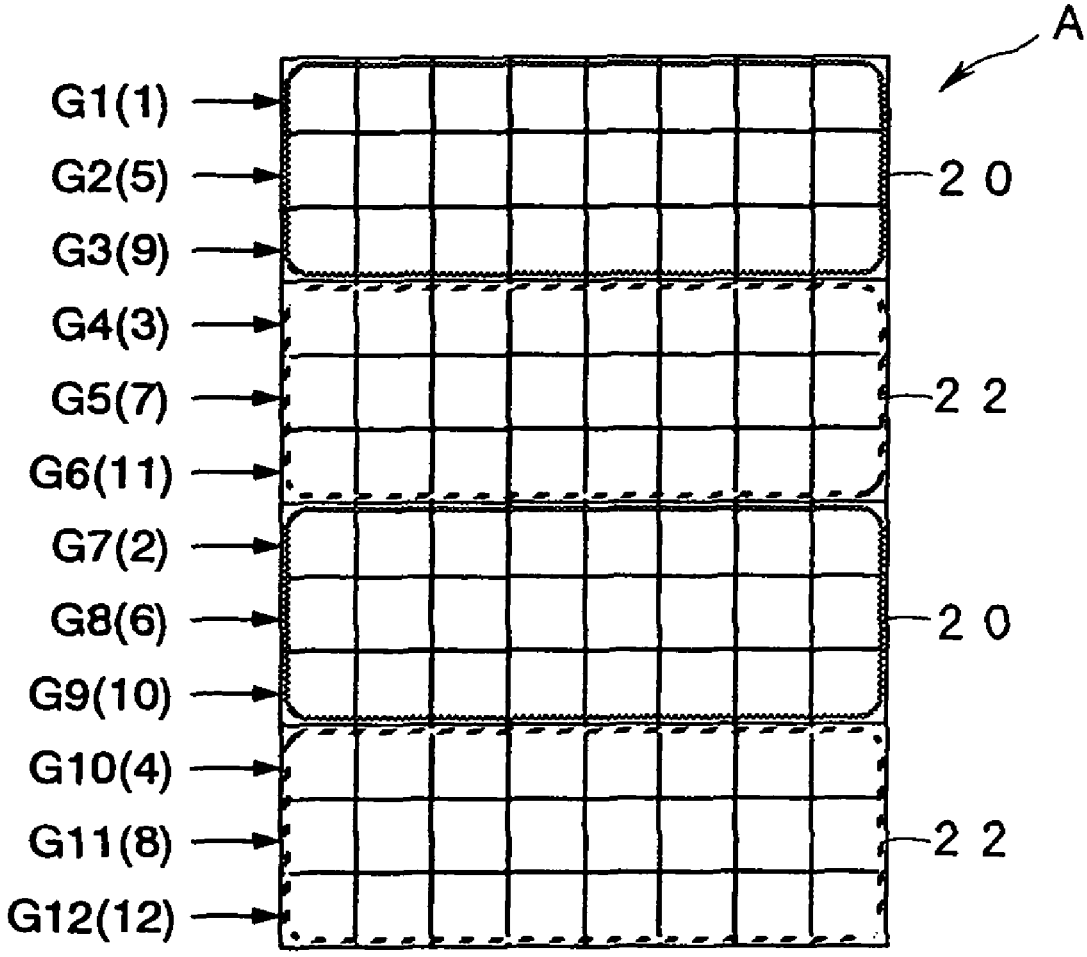
FIG. 24 is a block diagram showing an eighth embodiment of the liquid crystal display device of the present invention and the controlling method thereof.

The Eighth Embodiment of the Liquid Crystal Display Device and the Eighth Embodiment of the Liquid Crystal Display Device Controlling Method FIG. 24 shows an outline of the liquid crystal panel A of the TFT (Thin Film Transistor) driving liquid crystal display device used in this embodiment. In this embodiment, elements corresponding to the elements described above for the first embodiment are given the same reference numerals and explanation of these elements is not repeated.

The liquid crystal panel A comprises the two first pixel regions 20 and the two second pixel regions 22 arranged alternately in a stripe-like pattern. Each of the first pixel regions 20 and the second pixel regions 22 is divided according to the liquid crystal cells C for 3 lines. The liquid crystal panel A is assumed to have 12 pixels in the vertical direction and 8 pixels in the horizontal direction, for the sake of simpler explanation. Other configurations are the same as in the first embodiment described above. In FIG. 24, numbers in parentheses shown together with the scanning lines G1-G12 indicate a driving order of the scanning lines G1-G12.

Figure 25:
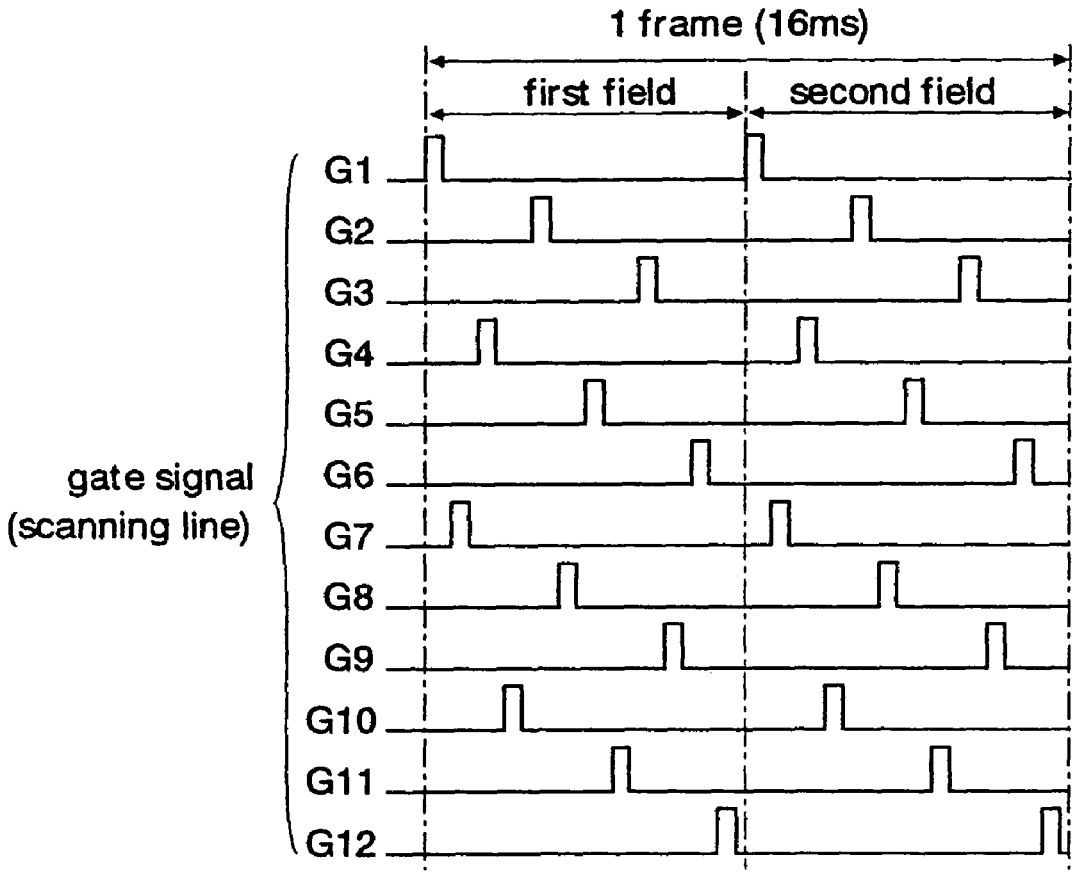
FIG. 25 is a timing chart showing a state in which display data are written in the liquid crystal display device shown in FIG. 24.

FIG. 25 shows timings at which display data are written in the liquid crystal display device.

A control circuit which is not shown activates the scanning lines G1, G7, G4, G10, G2, G8, G5, G11, G3, G9, G6 and G12 in this order in the first filed and in the second field. In the first filed, the control circuit writes in the first pixel regions 20 data corresponding thereto out of the display data, and writes black data in the second pixel regions 22. In the second field, the control circuit writes in the second pixel regions 22 data corresponding thereto out of the display data, and writes black data in the first pixel regions 20.

In this embodiment, the same effect as by the first embodiment and by the seventh embodiment can be obtained. Furthermore, in this embodiment, line-sequential scanning is carried out in a portion of the areas. Therefore, flicker is prevented with more certainty, without causing a structure of the control circuit to become complex.

The Ninth Embodiment of the Liquid Crystal Display Device

Figure 26:
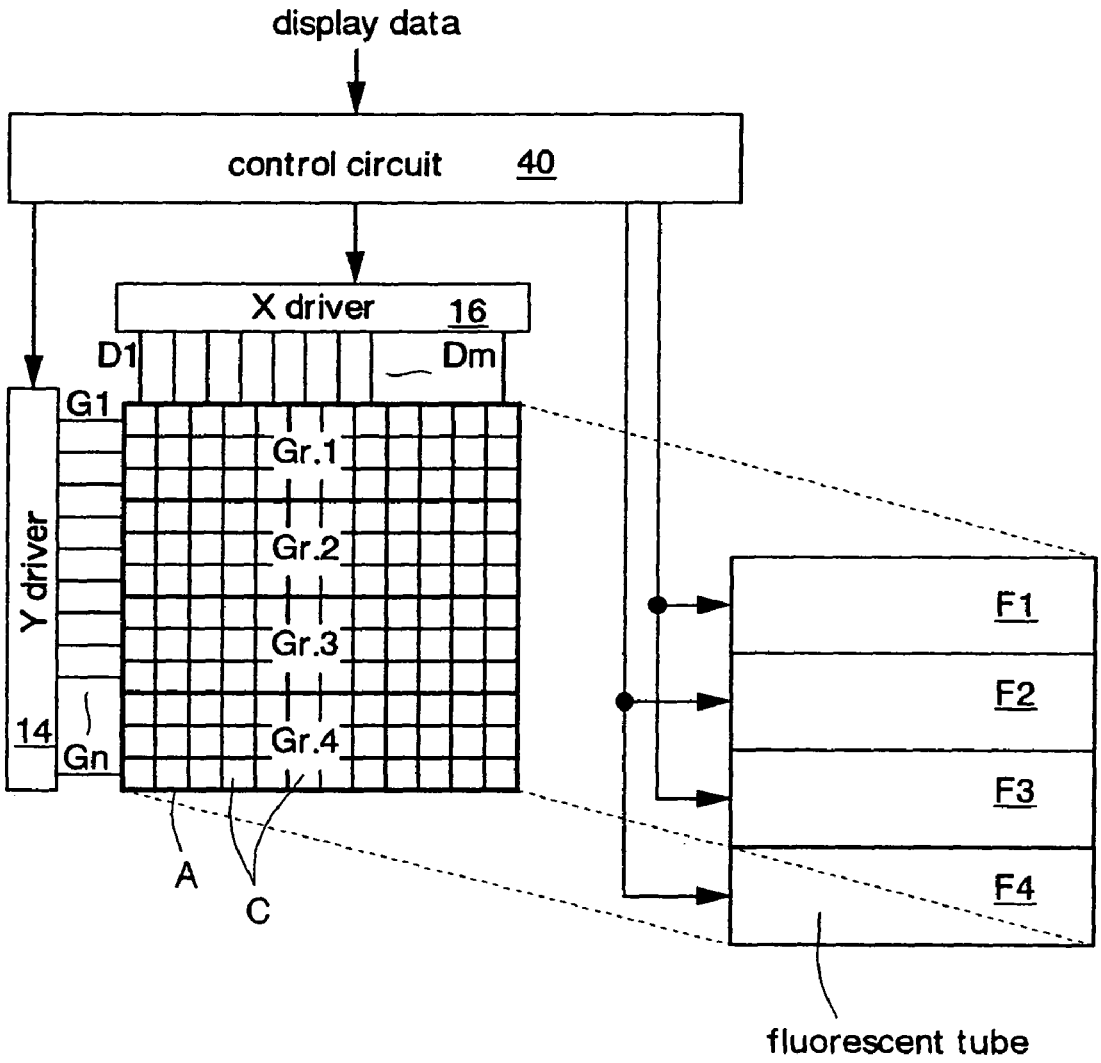
FIG. 26 is a block diagram showing a ninth embodiment of the liquid crystal display device of the present invention.

FIG. 26 shows an outline of the TFT (Thin Film Transistor) driving liquid crystal display device used in this embodiment. In this embodiment, elements corresponding to the elements described above for the first embodiment are given the same reference numerals and explanation of these elements is not repeated.

In this embodiment, the liquid crystal panel A comprises a plurality of the liquid crystal cells C arranged vertically and horizontally. On the backside of the liquid crystal panel A, the fluorescent tubes F1-F4 are arranged corresponding to band-like areas Gr.1, Gr.2, Gr.3, and Gr.4 each formed by the liquid crystal cells C over a plurality of lines. Each of the fluorescent tubes F1-F4 may be formed with a plurality of fluorescent tubes. A control circuit 40 has a function of carrying out on-off control of pairs of the fluorescent tubes F1 and F3, and F2 and F4, in which the fluorescent tubes are not adjacent to each other. The control circuit 40 also has a function of carrying out hold driving. The fluorescent tubes F1 and F3 are turned on and off as first backlights and the fluorescent tubes F2 and F4 are turned on and off as second backlights.

Figure 27:
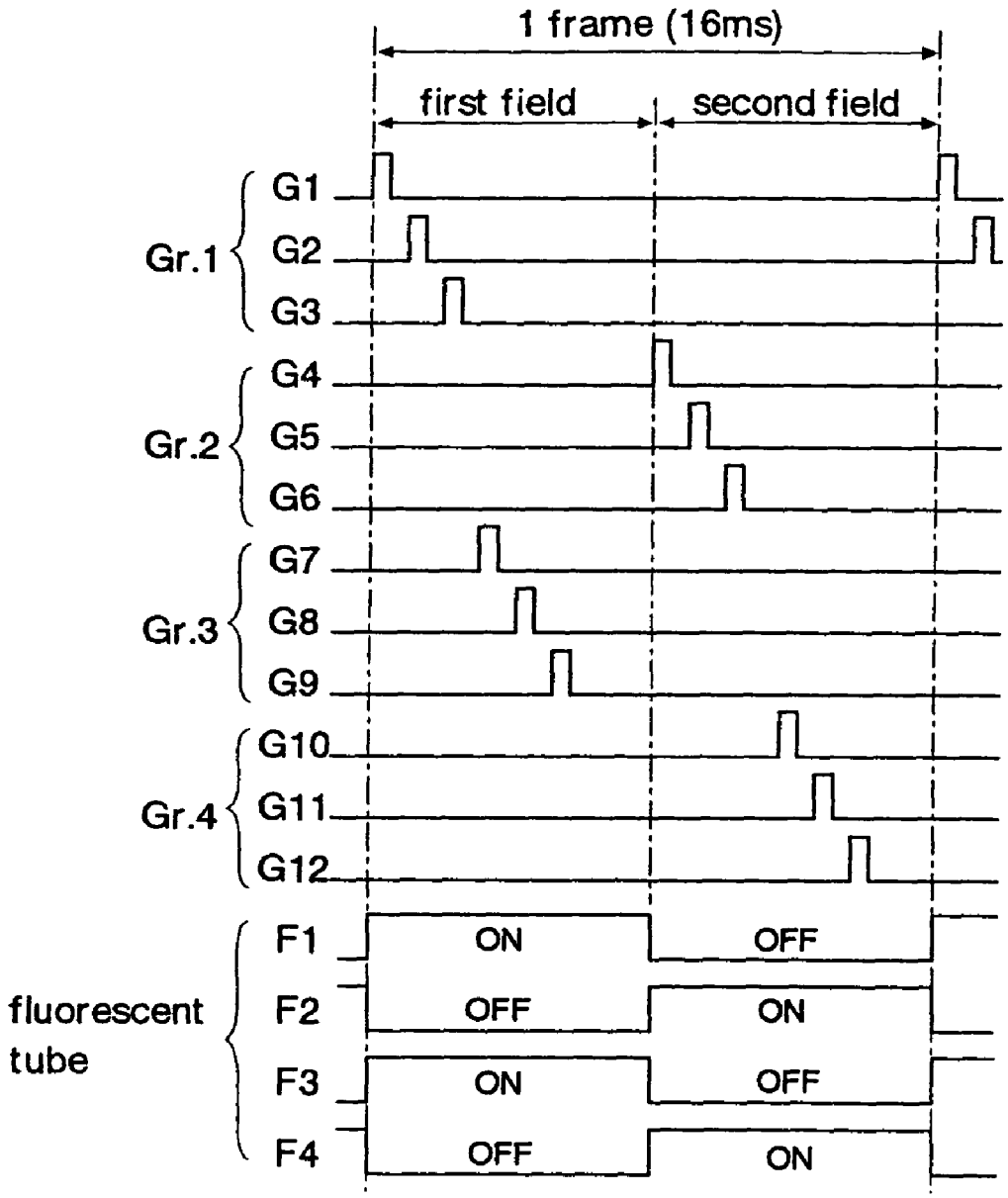
FIG. 27 is a timing chart showing a state in which display data are written in the liquid crystal display device shown in FIG. 26.

FIG. 27 shows timings at which display data are written in the liquid crystal display device. For simpler explanation, an example of the liquid crystal panel A comprising 12 scanning lines G1-G12 is shown.

The control circuit 40 carries out hold driving in which the scanning lines G1-G3 and G7-G9 are scanned sequentially in the first field, and the scanning lines G4-G6 and G10-G12 are sequentially scanned in the second field. Each of the scanning lines G1-G12 is activated once in one frame period.

The control circuit 40 turns on the fluorescent tubes F1 and F3 and turns off the fluorescent tubes F2 and F4 in the first field. In the second field, the control circuit turns on the fluorescent tubes F2 and F4 and turns off the fluorescent tubes F1 and F3. As a result, in the first field, pixels corresponding to the fluorescent tubes F1 and F3 are displayed, and pixels corresponding to the fluorescent tubes F2 and F4 are displayed in the second field. In other words, the fluorescent tubes F1 and F3 and the fluorescent tubes F2 and F4 are turned on and off alternately and pseudo-impulse driving is carried out.

In this embodiment, the same effects as by the first embodiment described above can be obtained.

The Tenth Embodiment of the Liquid Crystal Display Device

Figure 28:
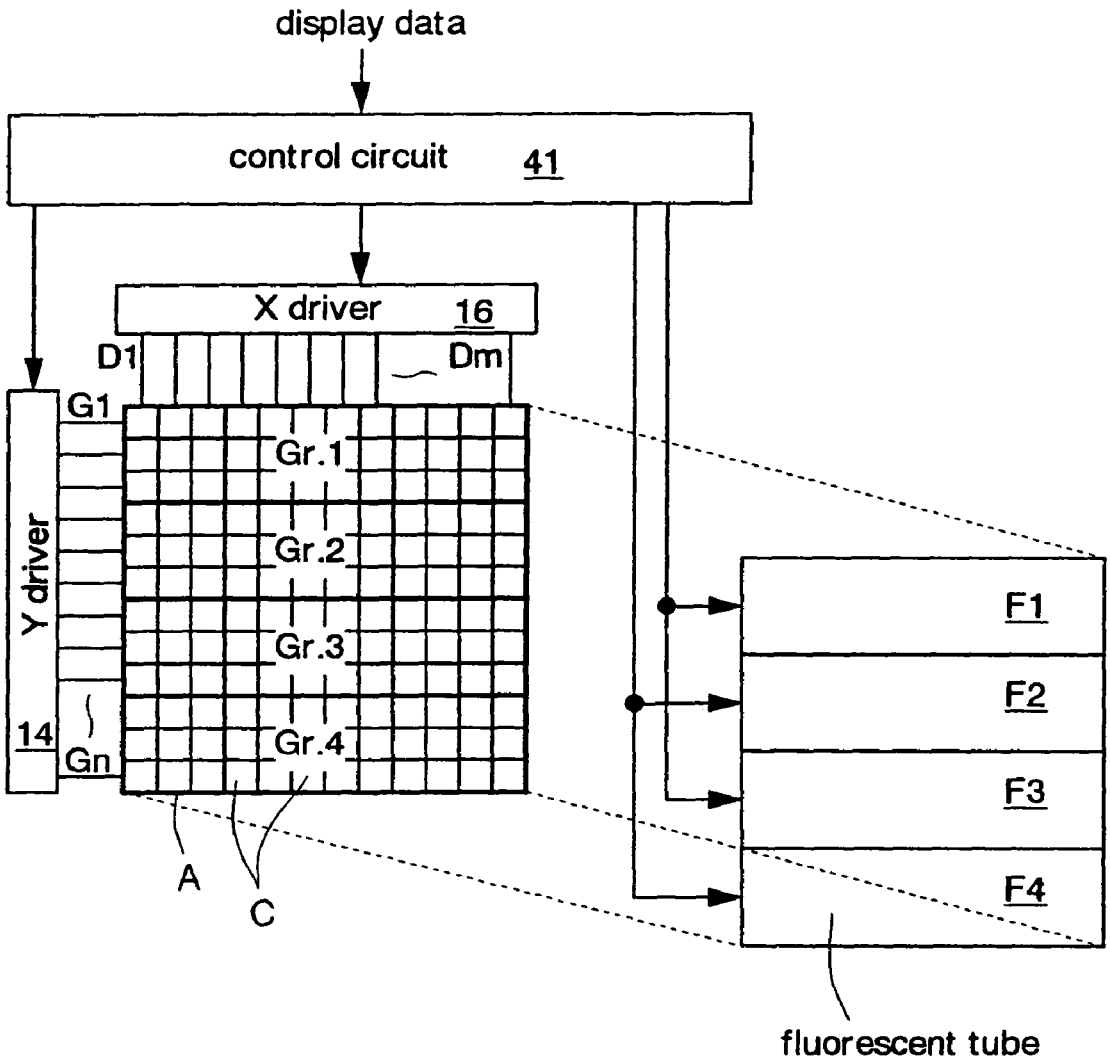
FIG. 28 is a block diagram showing a tenth embodiment of the liquid crystal display device of the present invention.

FIG. 28 shows an outline of the TFT (Thin Film Transistor) driving liquid crystal display device used in this embodiment. In this embodiment, elements corresponding to the elements described above for the above embodiments are given the same reference numerals and explanation of these elements is not repeated.

In this embodiment, the liquid crystal display device comprises the liquid crystal panel A, the fluorescent tubes F1-F4, the Y driver 14, and the X driver 16 which are the same as in the ninth embodiment above. On the backside of the liquid crystal panel A, the fluorescent tubes F1-F4 are arranged corresponding to the band-like areas Gr.1, Gr.2, Gr.3, and Gr.4 divided into a plurality of the liquid crystal cells C over a plurality of the lines.

A control circuit 41 has a function of sequentially turning on and off the fluorescent tubes F1-F4. The control circuit 41 may turn on and off two or more areas at the same time. In this embodiment, the liquid crystal panel A is divided into the large areas Gr.1, Gr.2, Gr.3, and Gr.4. However, the panel A can be divided into two or any larger number of groups.

Figure 29:
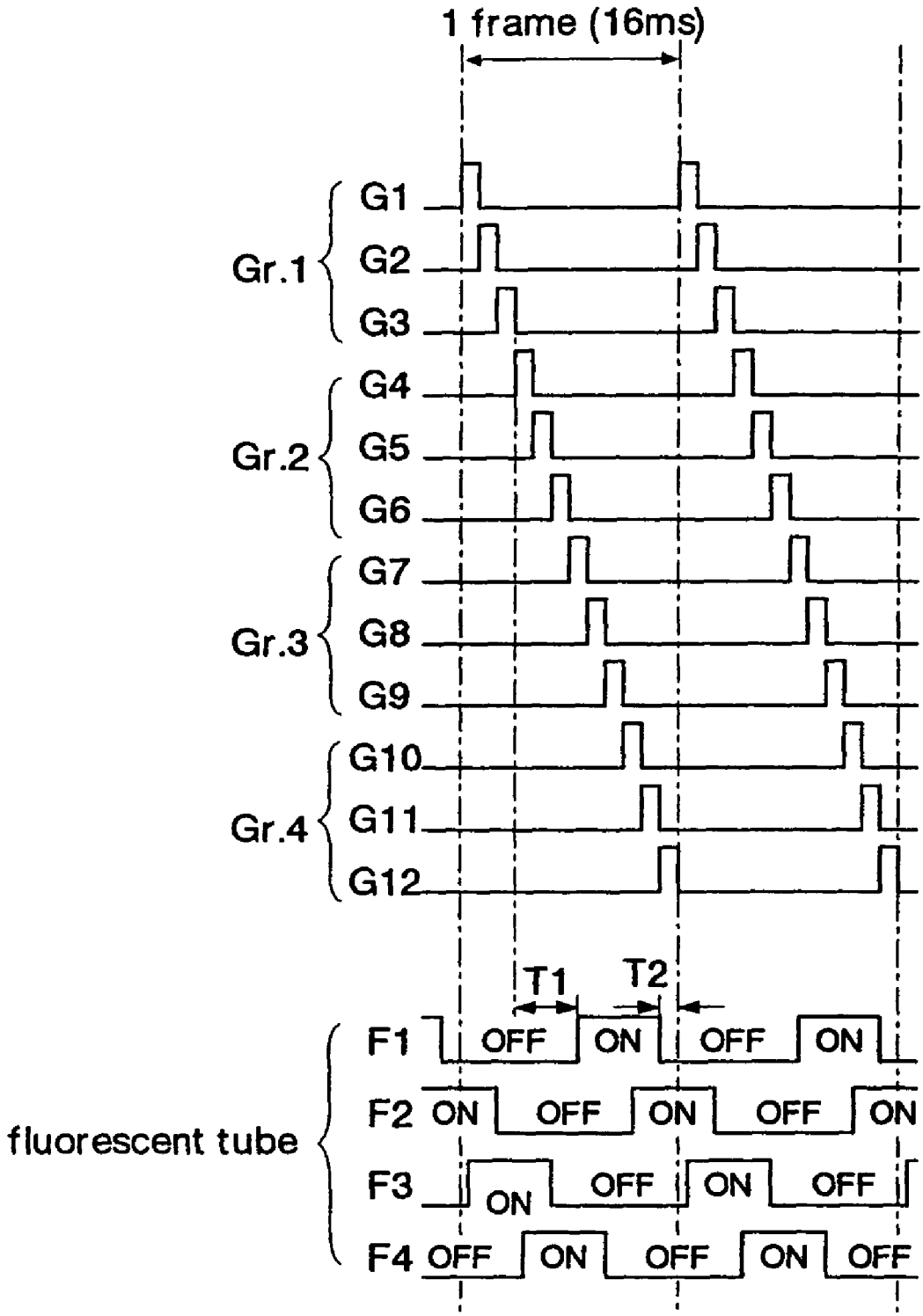
FIG. 29 is a timing chart showing a state in which display data are written in the liquid crystal display device shown in FIG. 28.

FIG. 29 shows timings at which display data are written in the liquid crystal display device described above (including on and off timings of the fluorescent tubes F1-F4). For simpler explanation, an example of the liquid crystal panel A comprising the 12 scanning lines G1-G12 is shown.

A period of turning on and off each of the fluorescent tubes F1-F4 is in agreement with the period of one frame, that is, in agreement with a scanning period of the liquid crystal panel A. The area Gr.1 is formed by three small groups comprising pixels on the lines of the scanning lines G1-G3. Likewise, the areas Gr.2, Gr.3, and Gr.4 comprise three groups each.

Hereinafter, an operation mainly in the area Gr.1 will be explained.

The control circuit 41 writes display data in the scanning lines G1-G3 and then turns on the fluorescent tube F1 corresponding to the area Gr.1 after a predetermined time T1 has elapsed. The control circuit 41 turns off the fluorescent tube F1 at a timing which is a predetermined time T2 before the scanning line G1 is scanned. The predetermined times T can be "0". However, it is preferable for the times T to be set more than a time necessary for turning off the fluorescent tube F1. In this manner, displaying two images at one time can be prevented. By setting the time T1 more than ½ of the one frame period (16 ms, in this case), duration of displaying black becomes longer and more preferable display can be realized.

It is preferable for liquid crystal elements on the scanning line G3 scanned last in the area Gr.1 to have completed responding before the fluorescent tube F1 is turned on. For this reason, it is preferable for the response time in all gradations of the liquid crystal elements to be shorter than the predetermined time T1. For example, π cells or a liquid crystal display device of an in-plane switching mode having vertical or horizontal alignment are preferably used. The predetermined time T1 is preferably set to be equal to or shorter than ⅘ of one frame period. Since one frame period is generally 16 ms, it is preferable for the response speed of the liquid crystals to be adjusted to 10 ms or smaller for all gradations.

The control circuit 41 carries out the same control for the areas Gr.2, Gr.3 and Gr.4.

In this embodiment, the same effect as by the first embodiment described above can be obtained.

The Ninth Embodiment of the Liquid Crystal Display Device Controlling Method

Figure 30:
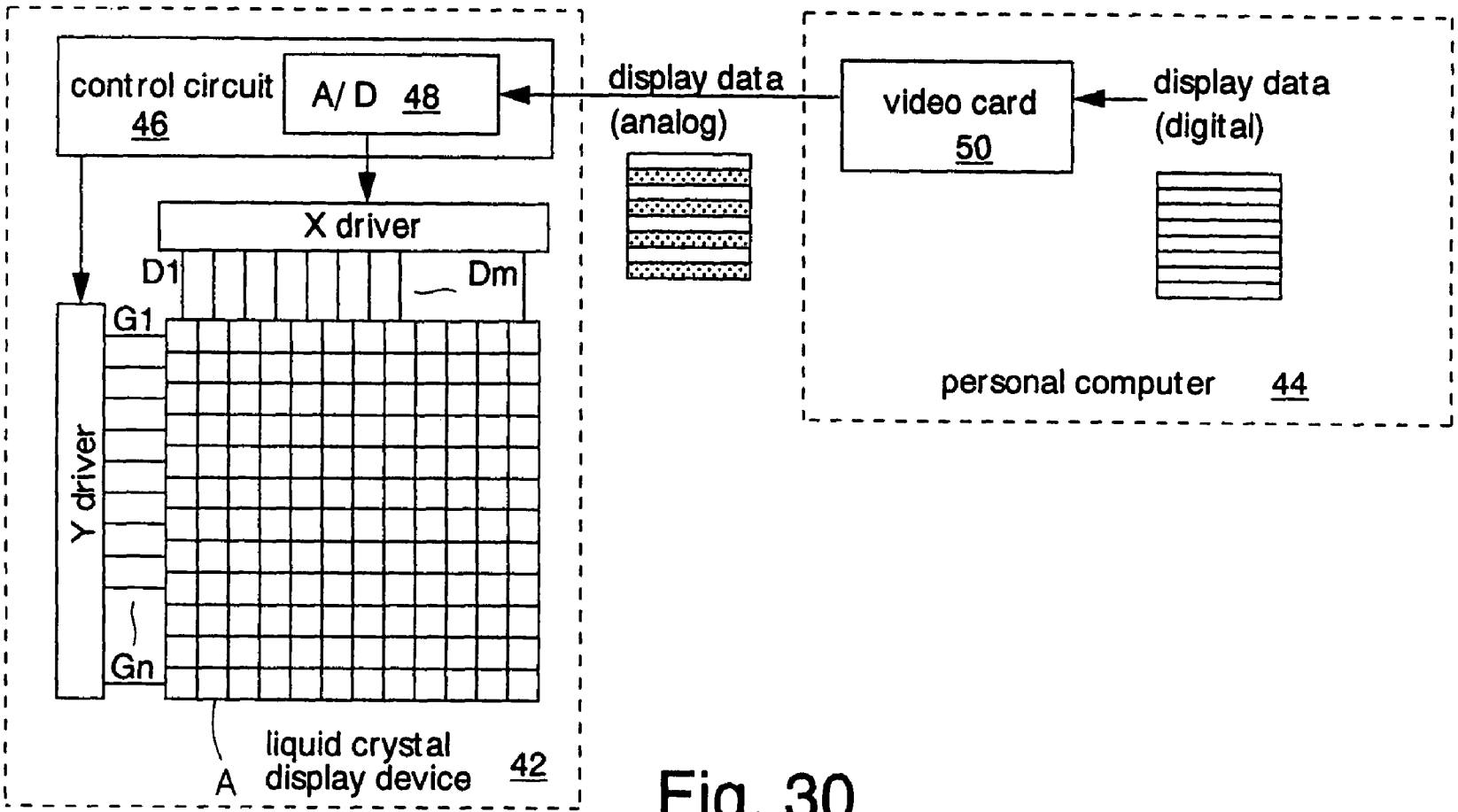
FIG. 30 is a block diagram showing a ninth embodiment of the liquid crystal display device controlling method of the present invention.

FIG. 30 shows a liquid crystal display device 42 and a personal computer 44 used in this embodiment.

The liquid crystal display device 42 has the same configuration as the liquid crystal display device having been used conventionally. The liquid crystal display device 42 comprises a control circuit 46, an X driver, a Y driver, and the liquid crystal panel A. The control circuit 46 has an A/D conversion unit 48.

The personal computer 44 comprises a video card 50 for converting digital display data into analog data. The video card 50 has a function of converting display data for one frame into black data in every other line, upon conversion to analog data. Therefore, black data are written in every other line. The display data converted to the black data can be deleted or used for display in a subsequent frame. The video card 50 sequentially sends to the A/D conversion unit 48 of the liquid crystal display device 42 the display data in which the black data are included in every other line.

The liquid crystal display device 42 displays the data having been received on the liquid crystal panel A as they are. The black data are displayed in stripes in every other line on the liquid crystal panel A.

In this embodiment, blurring in an image and flicker can be prevented even if the liquid crystal display device 42 which is the same as the conventional device is used.

In this embodiment, the video card 50 has the function of conversion to black data. However, the present invention is not limited to this example. The A/D conversion unit 48 in the liquid crystal display device 42 may have the conversion function to the black data, for example.

The Tenth Embodiment of the Liquid Crystal Display Device Controlling Method

Figure 31:
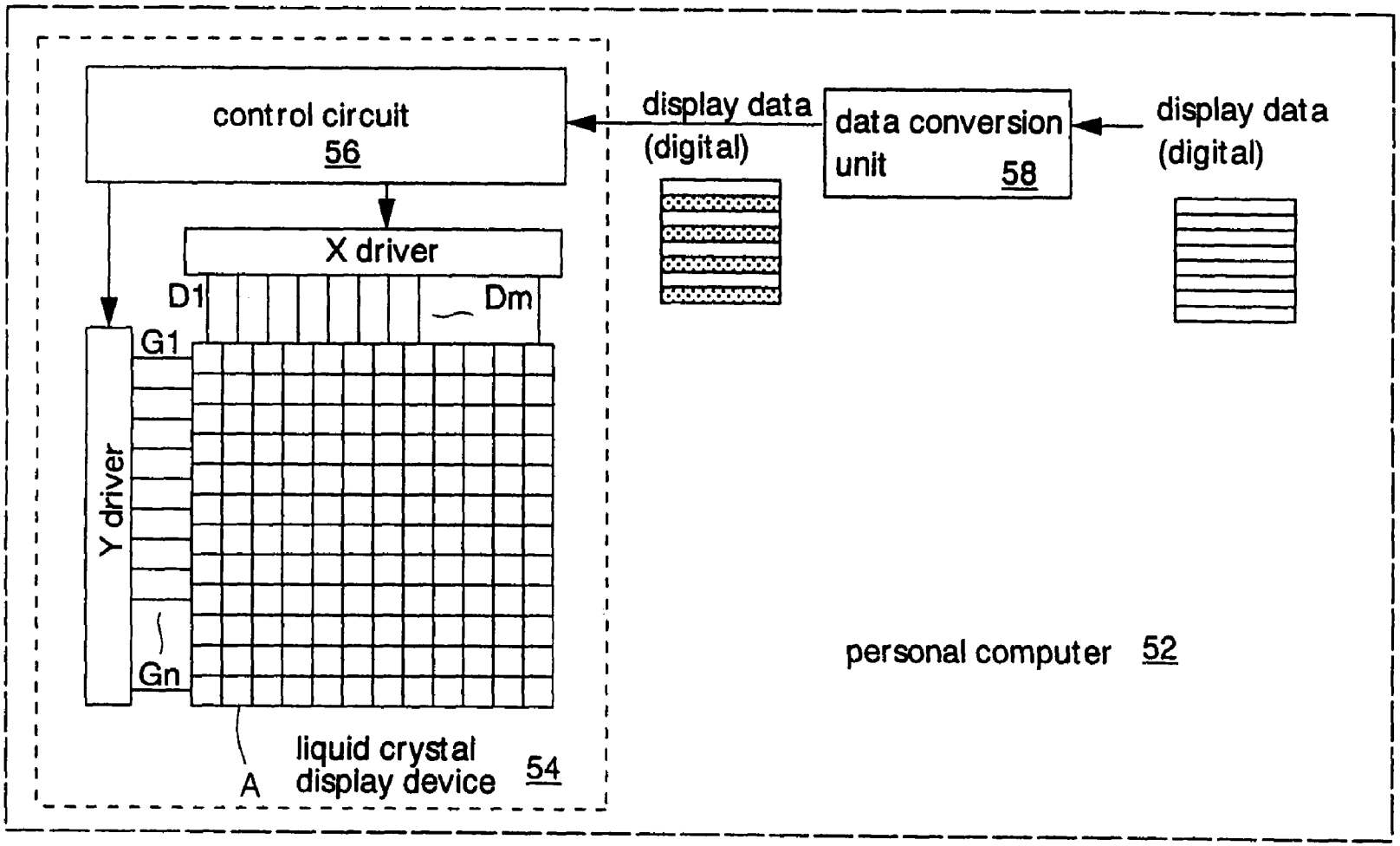
FIG. 31 is a block diagram showing a tenth embodiment of the liquid crystal display device controlling method of the present invention.

FIG. 31 shows a personal computer 52 used in this embodiment. The personal computer 52 comprises a built-in liquid crystal display device 54, such as in the case of a notebook type computer. The computer 52 has a conversion unit 58 for converting a portion of digital display data into black data.

The data conversion unit 58 has the function of converting the display data for one frame into black data in every other line. Therefore, black data are written in every other line. The display data converted to the black data may be deleted or used for display in a subsequent frame. The data conversion unit 58 sequentially sends to a control circuit 56 of the liquid crystal display device 54 the display data in which the black data are included in every other line. The liquid crystal display device 54 displays the data having been received on the liquid crystal panel A as they are. The black data forming stripes are displayed on the liquid crystal panel A in every other line. The data conversion unit 58 may be formed with an electronic circuit or by using a software program.

In this embodiment, the same effect as by the tenth embodiment of the liquid crystal display device controlling method can be obtained.

In this embodiment, an example of the data conversion unit 58 having the conversion function to the black data has been explained. However, the present invention is not limited to this example. The control circuit 56 of the liquid crystal display device 54 may have the conversion function, for example.

Figure 32:
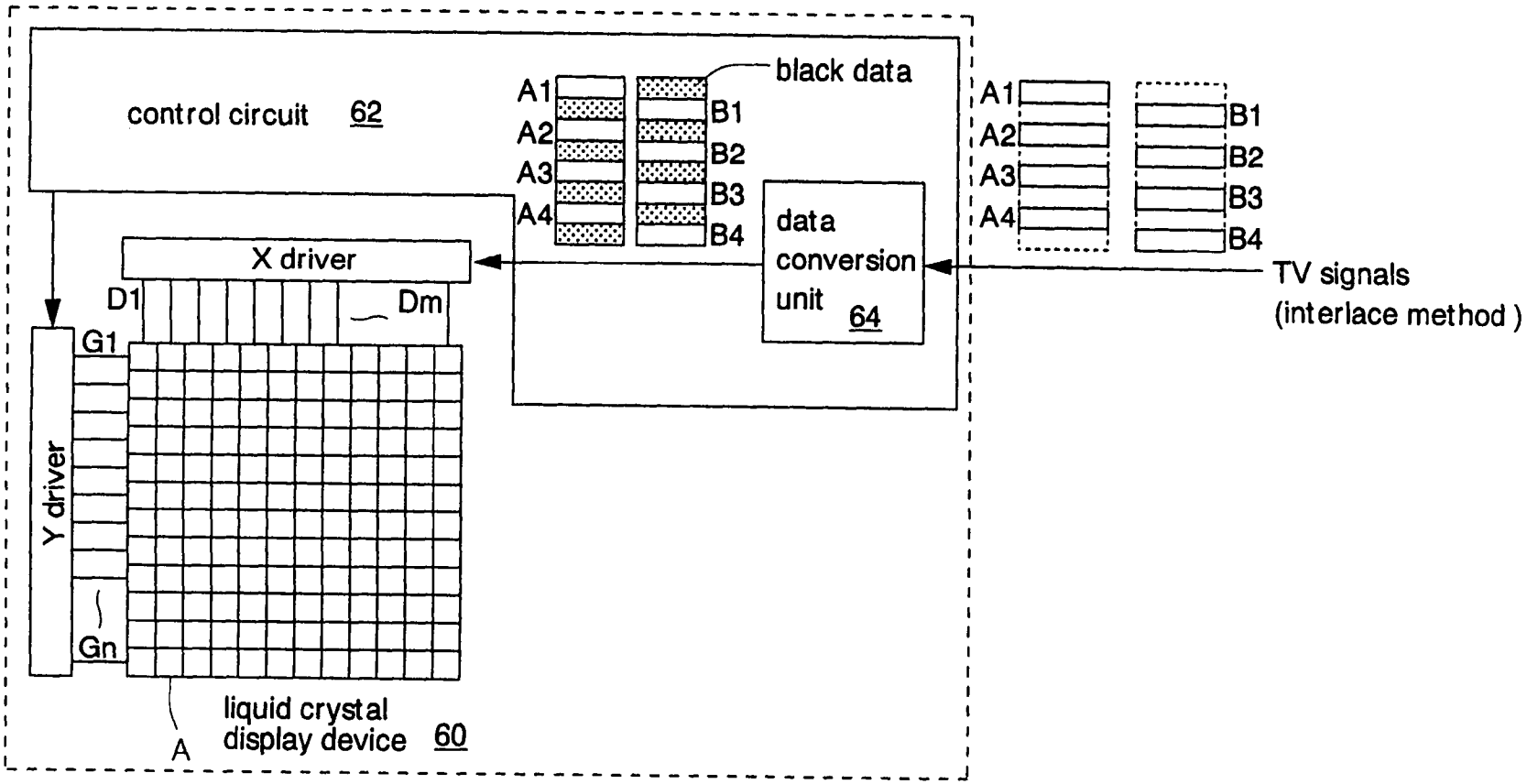
FIG. 32 is a block diagram showing an eleventh embodiment of the liquid crystal display device controlling method of the present invention.

The Eleventh Embodiment of the Liquid Crystal Display Device Controlling Method FIG. 32 shows an outline of a liquid crystal display device 60 used in this embodiment.

A control circuit 62 of the liquid crystal display device 60 has a data conversion unit 64 for converting display data of an interlace method (TV signals) supplied from exterior. The liquid crystal display device 60 also comprises the conventional X driver, the Y driver, and the liquid crystal panel A.

The data conversion unit 64 has functions of receiving display data A1-A4 and B1-B4 of respective fields, shown as in FIG. 32, and inserting black data into these display data. The control circuit displays on the liquid crystal panel A the data of each field having the black data inserted therein as display data in one frame. A screen is displayed on the liquid crystal panel A, in which black data forming stripes are displayed in every other line.

In this embodiment, the same effect as by the tenth embodiment of the liquid crystal display device controlling method can be obtained. Furthermore, in this embodiment, a preferable screen not having blurring in an image can be configured by using the display data of the interlace method (TV signals).

In the above embodiments, the time in which the display data are written and the time in which the black data are written are the same, as shown by the waveforms in FIG. 10. However, the present invention is not limited to this example, and the time of writing the display data may be shorter than the time of writing the black data. In this case, blurring in an image can be reduced further.

In the above embodiments, one frame period is set to 16 ms. However, the present invention is not limited to this example, and one frame period is determined according to the response time of the cells used.

The Eleventh Embodiment of the Liquid Crystal Display Device

Figure 33:
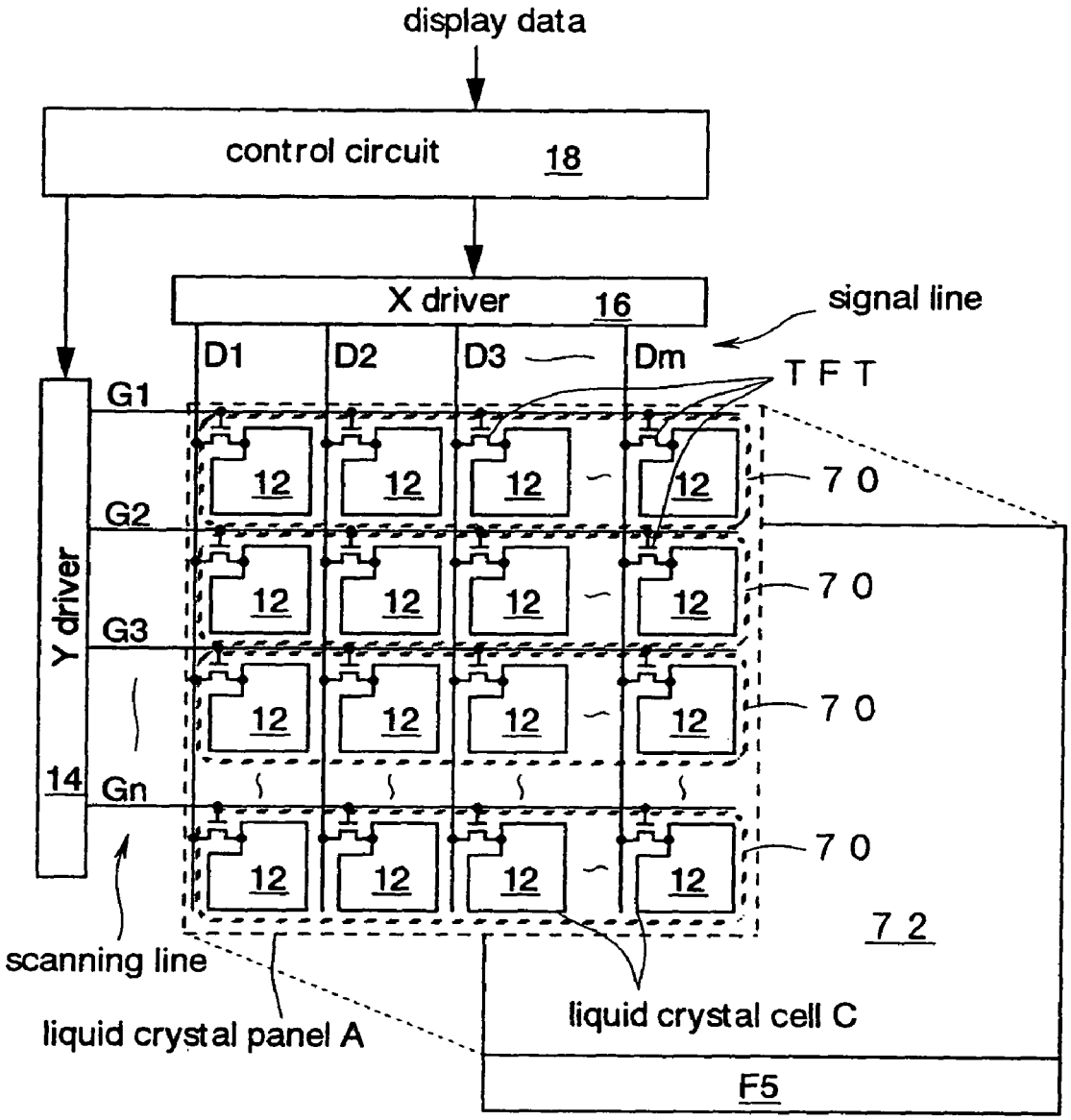
FIG. 33 is a block diagram showing an eleventh embodiment of the liquid crystal display device of the present invention.

FIG. 33 shows an outline of the TFT (Thin Film Transistor) driving liquid crystal display device used in this embodiment. In this embodiment, elements corresponding to the elements described above for the first embodiment are given the same reference numerals and explanation of these elements is not repeated.

This liquid crystal display device comprises TFTs and pixel electrodes 12 both laid out in the form of a matrix. Gate electrodes of the TFTs which are switching elements are connected to the scanning lines G1, G2, . . . , Gn. The scanning lines G1, G2, . . . , Gn are signal lines for transmitting gate signals output from the Y driver 14. Drain electrodes of the TFTs (Thin Film Transistors) are connected to the signal lines D1, D2, . . . , Dm. The signal lines D1, D2, . . . , Gm are signal lines for transmitting data signals output from the X driver 16. Source electrodes of the TFTs are respectively connected to the pixel electrodes 12.

Counter electrodes (not shown) are arranged, facing the pixel electrodes 12. Liquid crystals (not shown) are sandwiched between the pixel electrodes 12 and the counter electrodes, and the liquid crystal cells C are formed. The liquid crystal panel A is formed with the liquid crystal cells C arranged vertically and horizontally.

The liquid crystal panel A is divided into 5 pixel regions 70 along the scanning lines. On the backside of the liquid crystal panel A, a transparent light guide plate 72 formed with an acrylic resin or the like is arranged facing the liquid crystal panel A. A fluorescent tube (cold cathode tube) F5 is arranged as a backlight at one end of the direction of the scanning line Gn on the light guide plate 72.

In this embodiment, a 15-inch XGA liquid crystal panel is used as the liquid crystal panel A. The liquid crystal panel A adopts an improved VA (Vertical Alignment) type or an OCB (Optically Compensated Birefringence) type. A response time of the liquid crystal panel A is 7 ms, which is fast.

Figure 34:
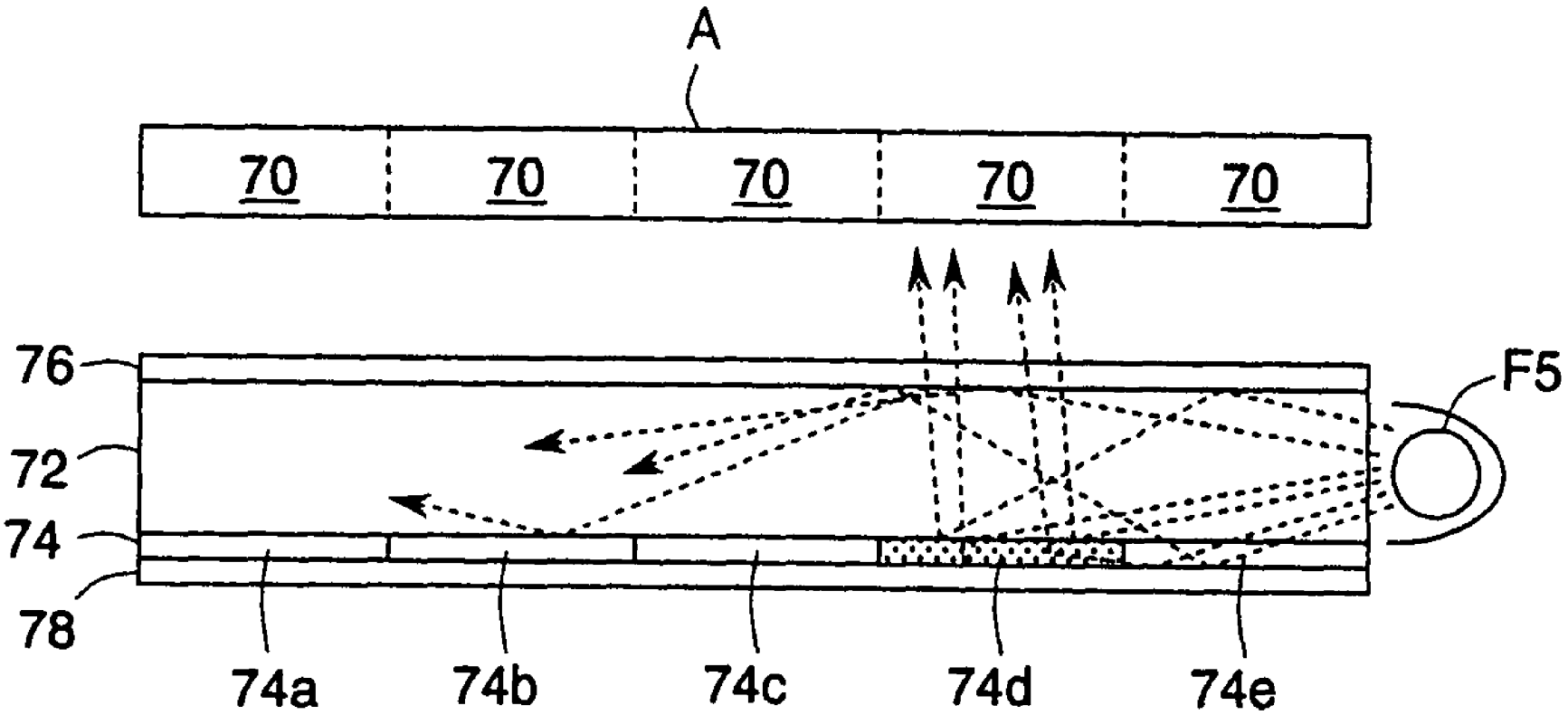
FIG. 34 is a diagram showing a backlight shown in FIG. 33 in detail.

FIG. 34 shows the backlight in detail.

A liquid crystal film 74 of polymer-diffused type is bonded on the light guide plate 72, on the opposite side of the liquid crystal panel A. In this embodiment, an LC light modulation sheet "Um film" manufactured by Nippon Sheet Glass is used as the liquid crystal film. Counter electrodes (not shown) of the liquid crystal film 74 are divided into 5 areas along the direction of guiding the light emitted by the fluorescent tube F5, and 5 scattering parts 74*a*~74*e* are formed. In FIG. 34, for the sake of simpler explanation, the liquid crystal film 74 is divided into 5 areas. In reality, the liquid crystal film 74 itself is formed with one sheet. Positions at which the parts 74*a*~74*e* are formed correspond to the 5 pixel regions 70 of the liquid crystal panel A.

A scattering sheet 76 such as a prism sheet for scattering the light from the light guide plate 72 is bonded on the light guide plate 72, on the side of the liquid crystal panel A. A mirror 78 for reflecting the light toward the light guide plate 72 is bonded on the outer surface of the liquid crystal film 74.

For bonding the materials, emulsion oil having almost the same refractive index as the acrylic board is used.

In the example shown in FIG. 34, a voltage is not supplied to the counter electrode of the scattering part 74*d* shown by a hatched area. The scattering part 74*a* becomes a scattering part scattering light. A predetermined voltage is supplied to the counter electrodes of the remaining scattering parts 74*a*, 74*b*, 74*c*, and 74*e*. These scattering parts transmit the light. As a result, the light is emitted only on the pixel region 70 of the liquid crystal panel A facing the scattering part 74*d*. The scattering parts can be formed and disappear easily by controlling the counter electrodes of the scattering parts 74*a*~74*e*.

By using a mirror or the like for reflecting light on both ends (right and left of FIG. 34) of the light guide plate 72, the light propagates through the light guide plate 72 repeatedly and is scattered by the scattering part 74*d* to be guided to exterior of the light guide plate 72, which is not shown. In other words, the light from the fluorescent tube F5 is collected at a desired position and emitted.

As has been described above, the light emitted on the light guide plate 72 can be used efficiently according to this embodiment, and power consumption can be reduced. In this example, power consumption of the fluorescent tube F5 can be reduced up to ⅕. Furthermore, since the luminescent parts can be solely formed with the fluorescent tube F5, uneven display due to degradation of the fluorescent tube does not occur. The liquid crystal film 74 is bonded on the light guide plate 72 on the opposite side of the liquid crystal panel A. Therefore, the light emitted toward the liquid crystal panel A is not shut by the liquid crystal film 74. Since the scattering parts are not in contact with the liquid crystal panel A, a boundary between neighboring luminescent parts can become inconspicuous. The scattering parts can be formed easily by the liquid crystal film 74 of the high-molecular type.

Figure 35:
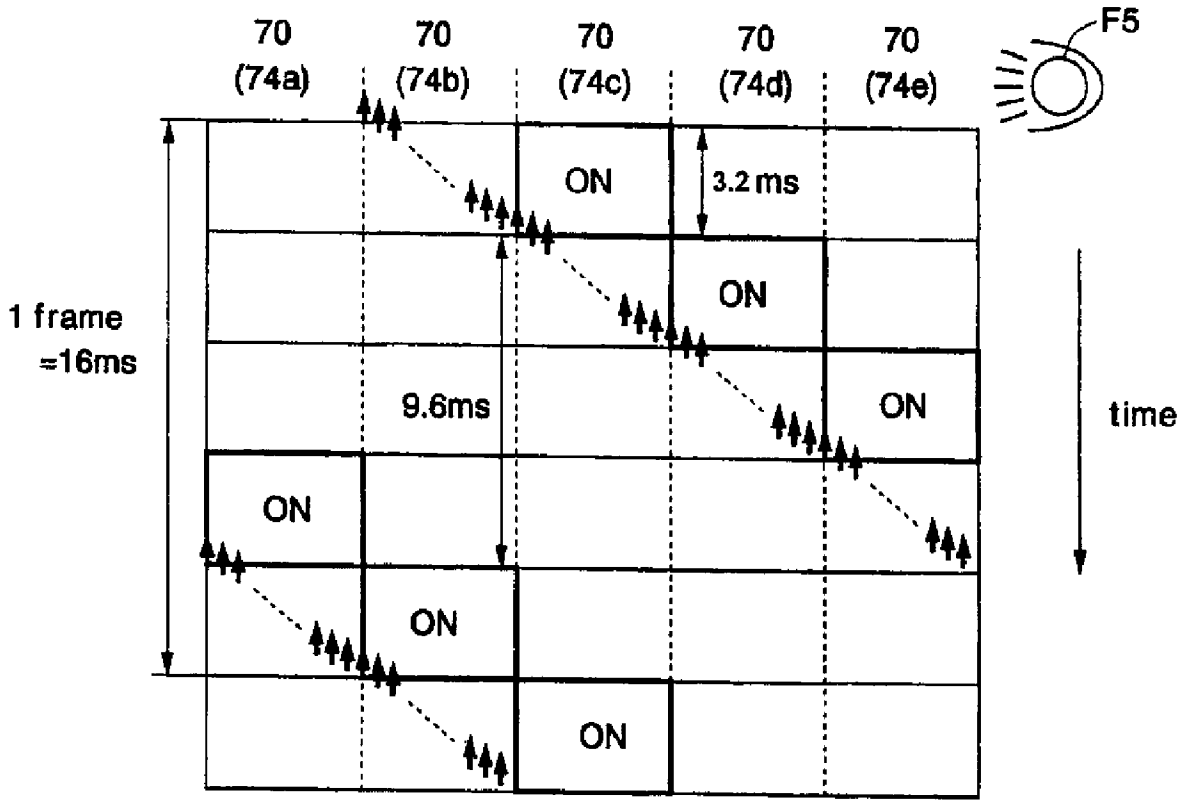
FIG. 35 is a diagram showing control of a liquid crystal liquid crystal panel and a backlight.

FIG. 35 shows control of the liquid crystal panel A and the backlight of the liquid crystal display device described above. The vertical direction of FIG. 35 represents time and the horizontal direction thereof shows the direction of guiding the light from the fluorescent tube F5. Arrows shown in FIG. 35 indicate scan of the scanning lines.

In this embodiment, line-sequential scanning by hold driving, in which the scanning lines are scanned once in one frame period and display data are written in the pixel electrodes 12, is carried out. The scanning lines are sequentially scanned toward lower right of FIG. 35. The backlight is turned on for 3.2 ms after one pixel region 70 is scanned. This duration, 3.2 ms, is ⅕ of one frame period (16 ms) and equal to the scanning period of one of the pixel regions 70. The phrase stating that "the backlight is turned on" refers to a shift to a state in which the scattering parts 74*a*~74*e* of the liquid crystal film 74 scatter the light.

For example, in the pixel regions 70 corresponding to the scattering part 74*d*, the time between scan of the last scanning line Gn and the backlight' becoming on is 9.6 ms. This time shows a worst response time of the liquid crystal cells C shown in FIG. 33, and expressed by the following equation (1) with n being the number of the pixel regions 70:

$$1 \text{ frame period} \times (n-2)/n \quad (1)$$

Since the response speed of the liquid crystals in this embodiment is approximately 7 ms, the cell C in which the display data are written at a last scan of the pixel regions 70 can complete responding with certainty, before the backlight is turned on. As a result, even in the case of displaying a moving image, occurrence of blurring is alleviated.

In FIG. 34, the scattering parts 74*a*~74*e* are bonded on the light guide plate 72 on the opposite side of the liquid crystal panel A. However, the scattering parts 74*a*~74*e* may be bonded on the light guide plate 72 on the side of the liquid crystal panel A. In this case, the light irregularly reflected by the scattering parts 74*a*~74*e* is emitted to exterior of the light guide plate 72, and emitted to a predetermined luminescent part of the liquid crystal panel A. Since a boundary between neighboring luminescent parts becomes clearer, impulse driving can be carried out with good visibility, and flicker is prevented.

The Twelfth Embodiment of the Liquid Crystal Display Device

Configurations of a main portion of the liquid crystal display device in this embodiment are the same as in FIG. 33, except for the liquid crystal cells C comprising π cells in this embodiment. The response time of the π cells is fast, approximately 2 ms.

Figure 36:
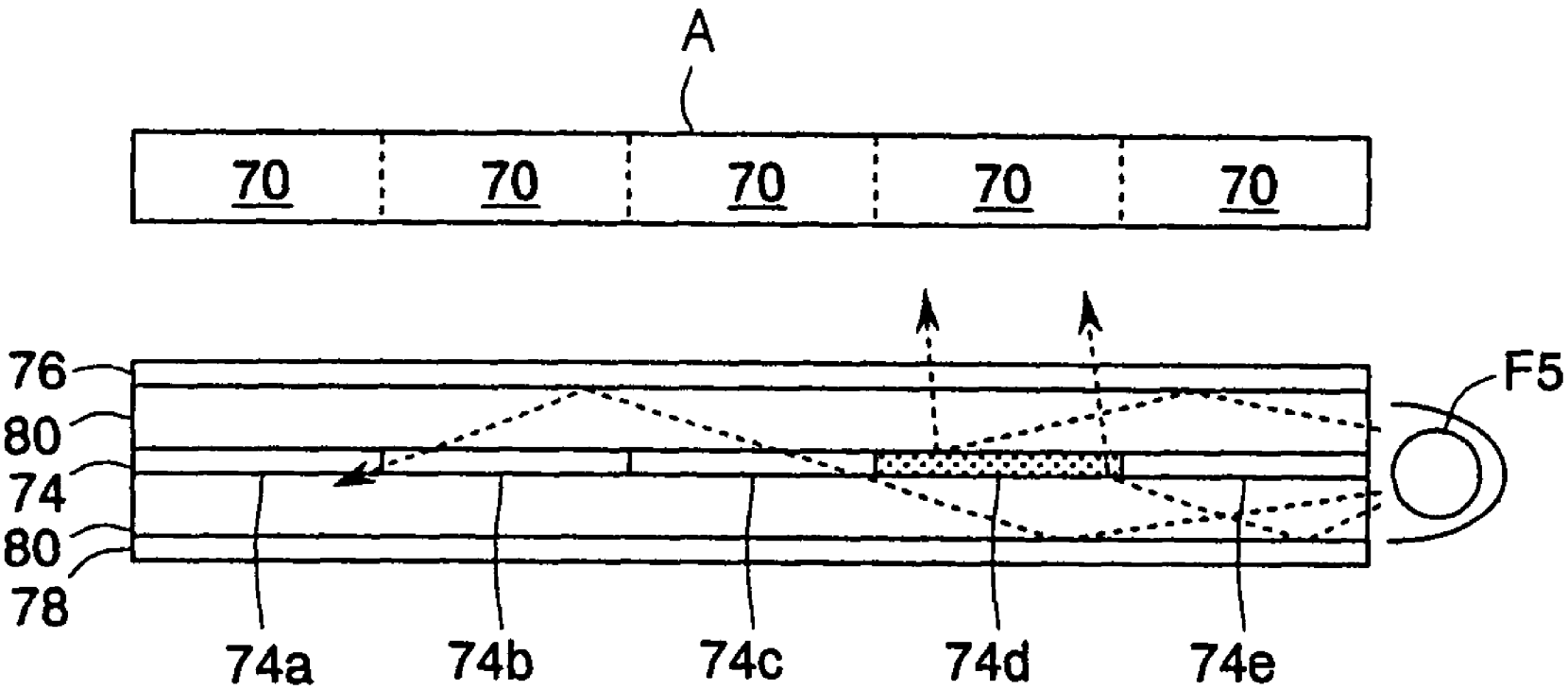
FIG. 36 is a diagram showing in detail a backlight in a twelfth embodiment of the liquid crystal display device of the present invention.

FIG. 36 shows the backlight used in this embodiment in detail.

In this embodiment, the liquid crystal film 74 the same as in FIG. 34 is sandwiched between two light guide plates 80. Therefore, the liquid crystal film 74 is securely protected by the light guide plates 80. Furthermore, due to a so-called sandwich structure, this light emission system can be formed easily with accuracy. FIG. 36 shows that the scattering part 74*d* shown by a stippled area is a scattering area for scattering light.

The scattering plate 76 such as a prism for scattering light from the light guide plates 80 is bonded on one of the light guide plates 80, on the side of the liquid crystal panel A. The mirror 78 for reflecting light toward the light guide plates 80 is bonded on the other light guide plate 80, on the opposite side of the liquid crystal panel A.

Figure 37:
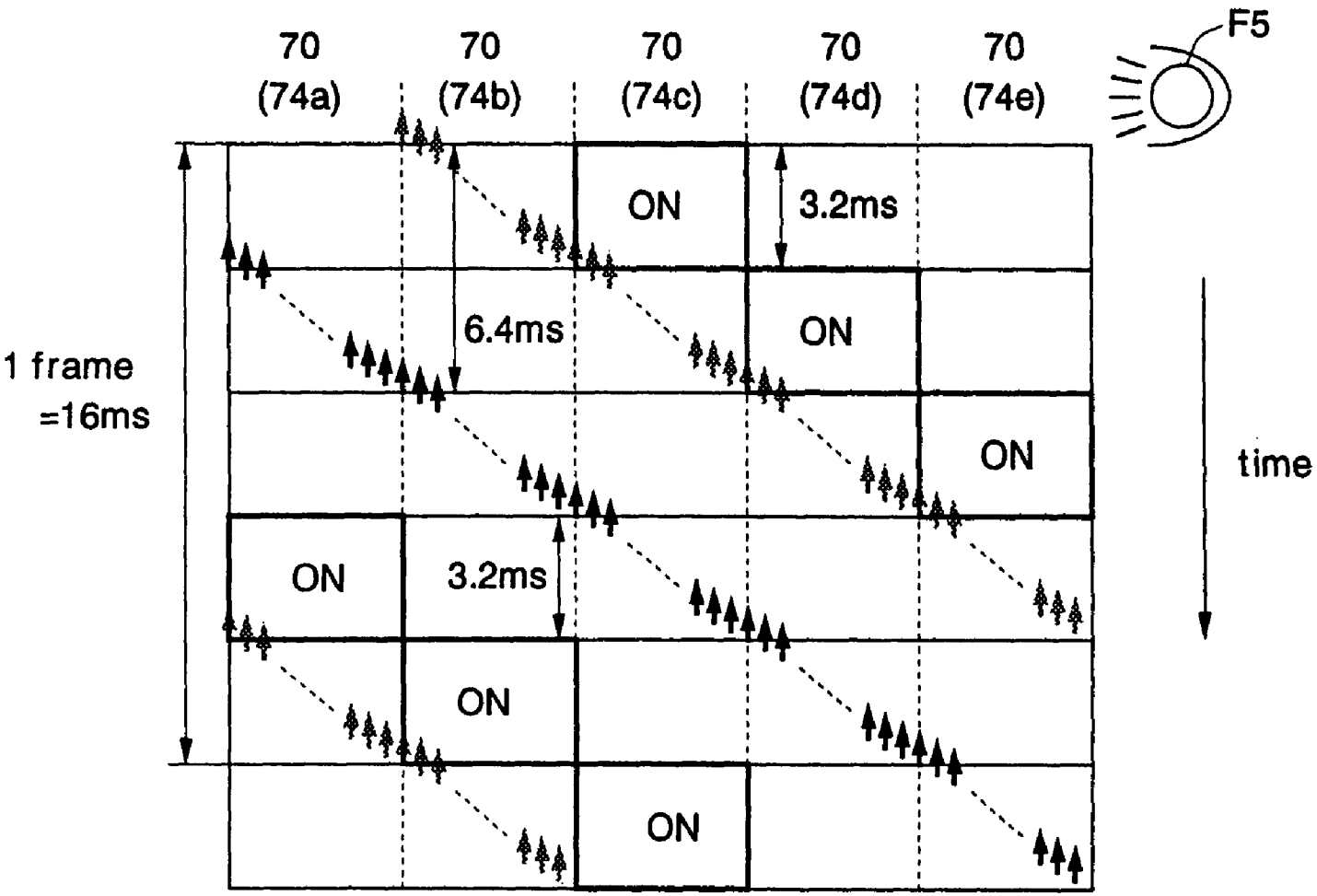
FIG. 37 is a diagram showing control of a liquid crystal liquid crystal panel and a backlight.

FIG. 37 shows control of the liquid crystal panel A and the backlight in the liquid crystal display device described above.

In FIG. 37, the vertical direction shows time and the horizontal direction shows a direction of guiding the light emitted from the fluorescent tube F5.

In this embodiment, line-sequential scanning by impulse driving, in which each of the scanning lines is scanned twice in one frame period and reset data (black) and display data are written in the pixel electrodes 12, is carried out. The scanning lines are sequentially scanned toward lower right of FIG. 35. Gray arrows show scan of the scanning lines for writing the reset data while black arrows show scan of the scanning lines for writing the display data.

The backlight is turned on for 3.2 ms after the predetermined pixel region 70 is scanned. This duration, 3.2 ms, is ⅕ of one frame period (16 ms) and equal to the scanning period of one of the pixel regions 70. The display data are written 6.4 ms after the reset data have been written.

For example, in the pixel regions 70 corresponding to the scattering part 74*d*, the time between scan of the last scanning line Gn and the backlight's becoming on is 3.2 ms. This time shows a worst response time of the liquid crystal cells C, and expressed by the following equation (2) with n being the number of the pixel regions 70:

$$\text{One-frame period} \times [[(n-1)/(2 \times n)]-1/n] \quad (2)$$

Since the response time of the liquid crystals in this embodiment is approximately 2 ms, the cell C in which the display data are written at a last scan of the pixel regions 70 can complete responding with certainty, before the backlight is turned on. As a result, even in the case of displaying a moving image, occurrence of blurring is alleviated.

In the case where the number of the pixel regions 70 is even, the worst response time of the liquid crystals is expressed by the following equation (3):

$$\text{One-frame period} \times [[(n-2)/(2 \times n)]-1/n] \quad (3)$$

For example, in the case of the liquid crystal panel A having six pixel regions 70, preferable screen display can be realized by using the liquid crystal cells C having the response time approximately equal to or smaller than approximately 2.6 ms.

In this embodiment, the same effect as by the embodiment shown in FIG. 33 can be obtained. Furthermore, in this embodiment, the liquid crystal film 74 can be protected securely by being sandwiched between the light guide plates 80. Moreover, the light emission system comprising the light guide plates 80 and the scattering parts 74*a*~74*e* can be formed easily with accuracy.

Figure 38:
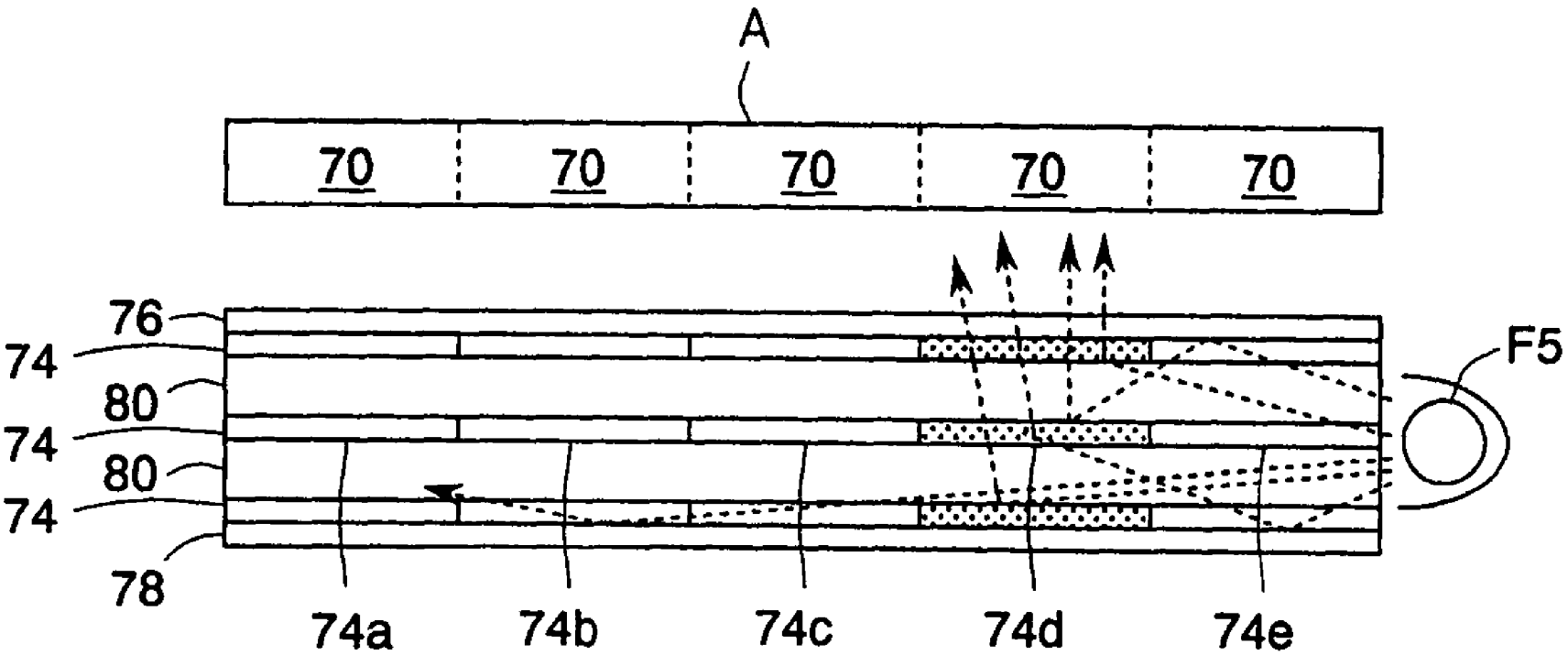
FIG. 38 is a diagram showing another example of the backlight.

The liquid crystal film 74 may not only be sandwiched between the light guide plates 80 but also further be bonded on the outer surfaces of the light guide plates 80 as shown in FIG. 38.

The Thirteenth Embodiment of the Liquid Crystal Display Device

Configurations of a main portion of the liquid crystal display device are the same as in FIG. 33.

Figure 39:
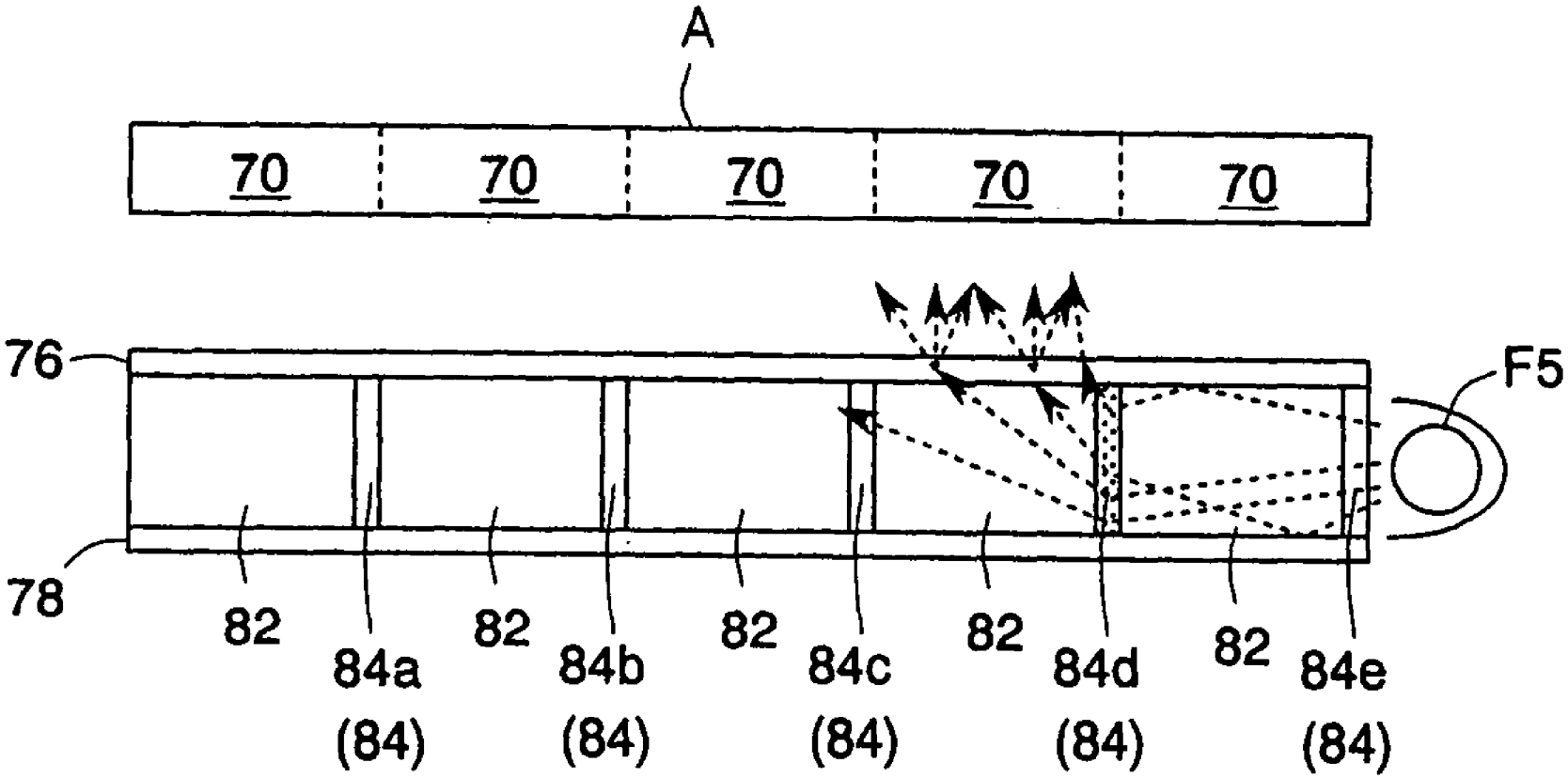
FIG. 39 is a diagram showing in detail a backlight in a thirteenth embodiment of the liquid crystal display device of the present invention.

FIG. 39 shows a backlight used in this embodiment in detail.

In this embodiment, the light guide plate 82 is divided into 5 portions along the direction of guiding the light from the fluorescent tube F5. Scattering parts 84*a*~84*d* comprising a film 84 of high-molecular type are bonded on 4 partitions of the light guide plate 82. The partitions of the light guide plate 82 are orthogonal to the direction light is guided. A scattering portion 84*e* comprising the liquid crystal film 84 is bonded on one partition of the light guide plate 82 arranged on the side of the fluorescent tube F5. The scattering parts 84*a*~84*e* are arranged orthogonal to the direction light is guided, cutting across the direction. In other words, the light penetrating through the light guide plate 82 always penetrates through the scattering parts 84*a*~84*e*.

Figure 40:
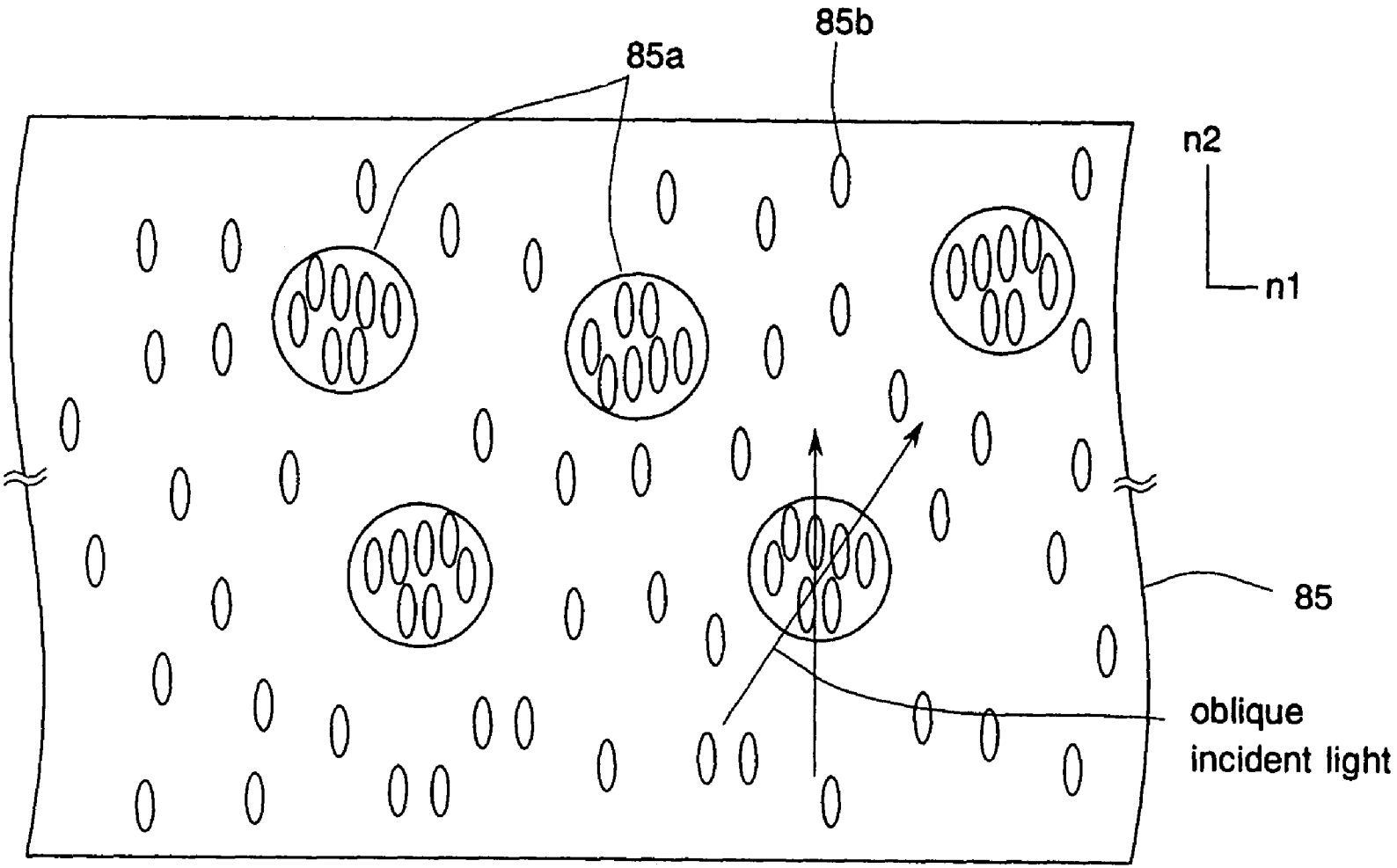
FIG. 40 is a diagram showing a liquid crystal film in shown FIG. 39 in detail.

FIG. 40 shows a detailed structure of the liquid crystal film 84.

The liquid crystal film 84 has a structure in which nematic liquid crystals 85*a* (low molecular liquid crystal) having negative isotropy of dielectric constant ε are covered with a resin layer 85*b*. The resin layer 85*b* is formed with high-molecular liquid crystal. In this embodiment, a UV curable liquid crystal resin manufactured by Dainippon Ink & Chemicals Inc. is used for the resin layer 85*b*. In the liquid crystals 85*a* and the resin layer 85*b*, a refractive index n1 of the liquid crystals in the radial direction is the same as a refractive index n2 of the liquid crystals in the axial direction.

All liquid crystals in the liquid crystal film 84 are aligned orthogonal to a surface of the liquid crystal film 84 in a state in which a voltage is not supplied to the counter electrodes, and let the incident light penetrate through. When the voltage is supplied to the counter electrodes, the nematic liquid crystals 85*a* of the liquid crystal film 84 try to become orthogonal to an electric field. The axial direction of the liquid crystals 85*a* becomes random, and incident light is scattered. The voltage is applied to the scattering part 84*d* shown by a stippled area in FIG. 39, and the part becomes a scattering area scattering light.

The liquid crystal film 84 is manufactured by injecting a mixture of the UV curable liquid crystals and low molecular liquid crystals after a substrate is coated with a vertical-alignment film, and by hardening the resin layer 85*b* with ultraviolet rays.

Figure 41:
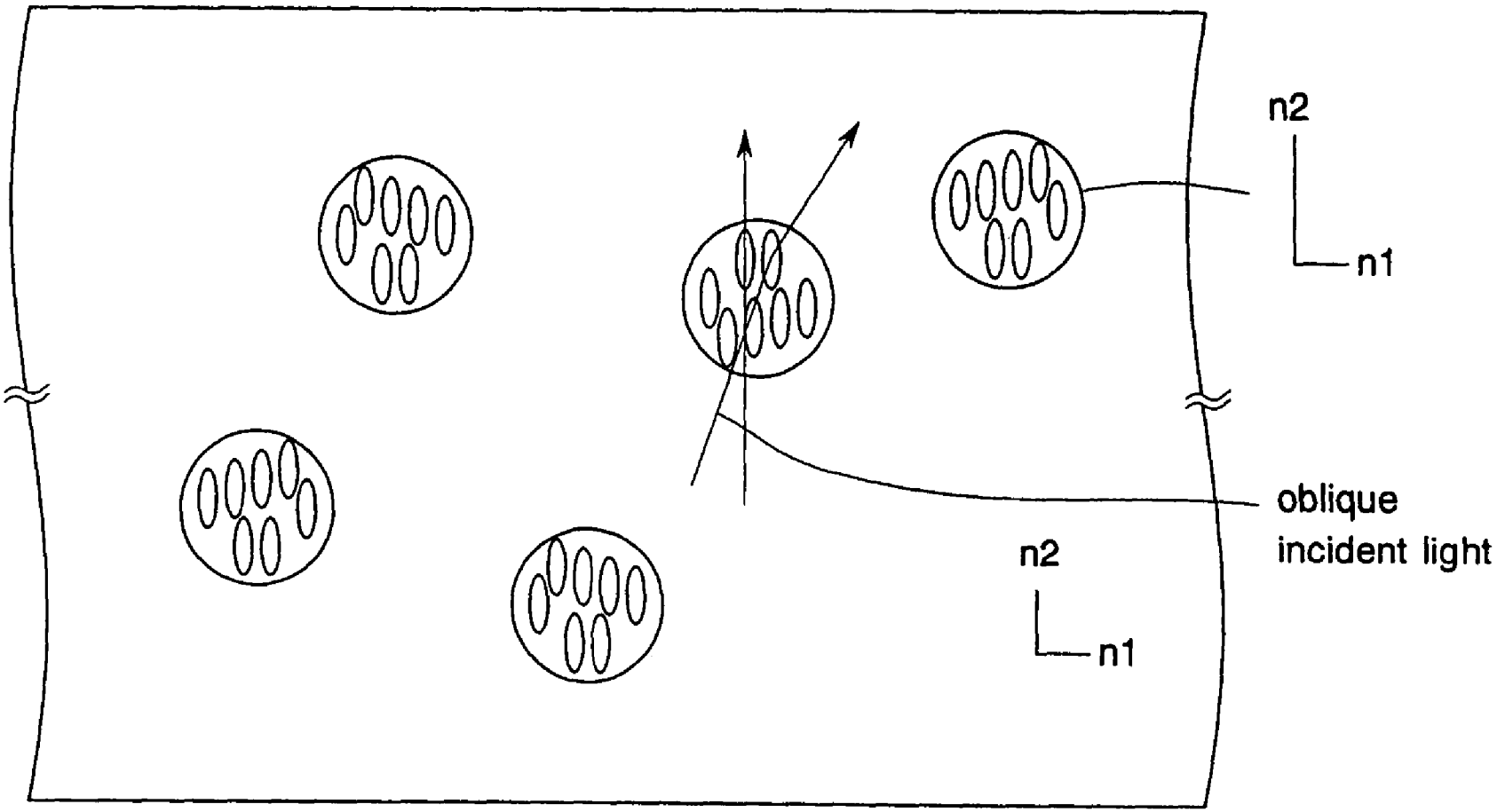
FIG. 41 is a diagram showing an ordinary liquid crystal film in detail.

FIG. 41 shows an example of the liquid crystal film formed with an ordinary resin layer (high polymer).

The liquid crystal film of this kind has different refractive indices between the liquid crystal layer and the resin layer. Therefore, light entering obliquely is scattered by the liquid crystal film. The liquid crystal film 84 shown in FIG. 40 lets the light entering obliquely penetrate through.

In this embodiment, the same effect as by the embodiment shown in FIG. 36 can be obtained. Furthermore, in this embodiment, the light penetrating through the light guide plate 82 always penetrates through any one of the scattering parts 84*a*~84*e*. Therefore, the light can be scattered with certainty.

The scattering parts 84*a*~84*e* are orthogonal to the direction light is guided. Therefore, the partitions of the light guide plate 82 need to be simply vertical and the scattering parts 84~84*e* are jointed easily with the light guide plate 82 with accuracy.

The resin layer 85*b* covering the nematic liquid crystals 85*a* in the liquid crystal film 84 are formed with the high-molecular liquid crystals having the same refractive index as the nematic liquid crystals 85*a*. Therefore, in a state where the scattering parts let the light penetrate, the light is prevented from being scattered at an interface between the nematic liquid crystals 85*a* and the resin layer 85*b*.

If the nematic liquid crystals 85*a* and the high-molecular liquid crystals are aligned orthogonal to the direction light is guided in a state where the voltage is not applied to the counter electrodes, the same effect can be obtained.

The Fourteenth Embodiment of the Liquid Crystal Display Device

Configurations of the main portions of the liquid crystal display device are the same as in FIG. 33.

Figure 42:
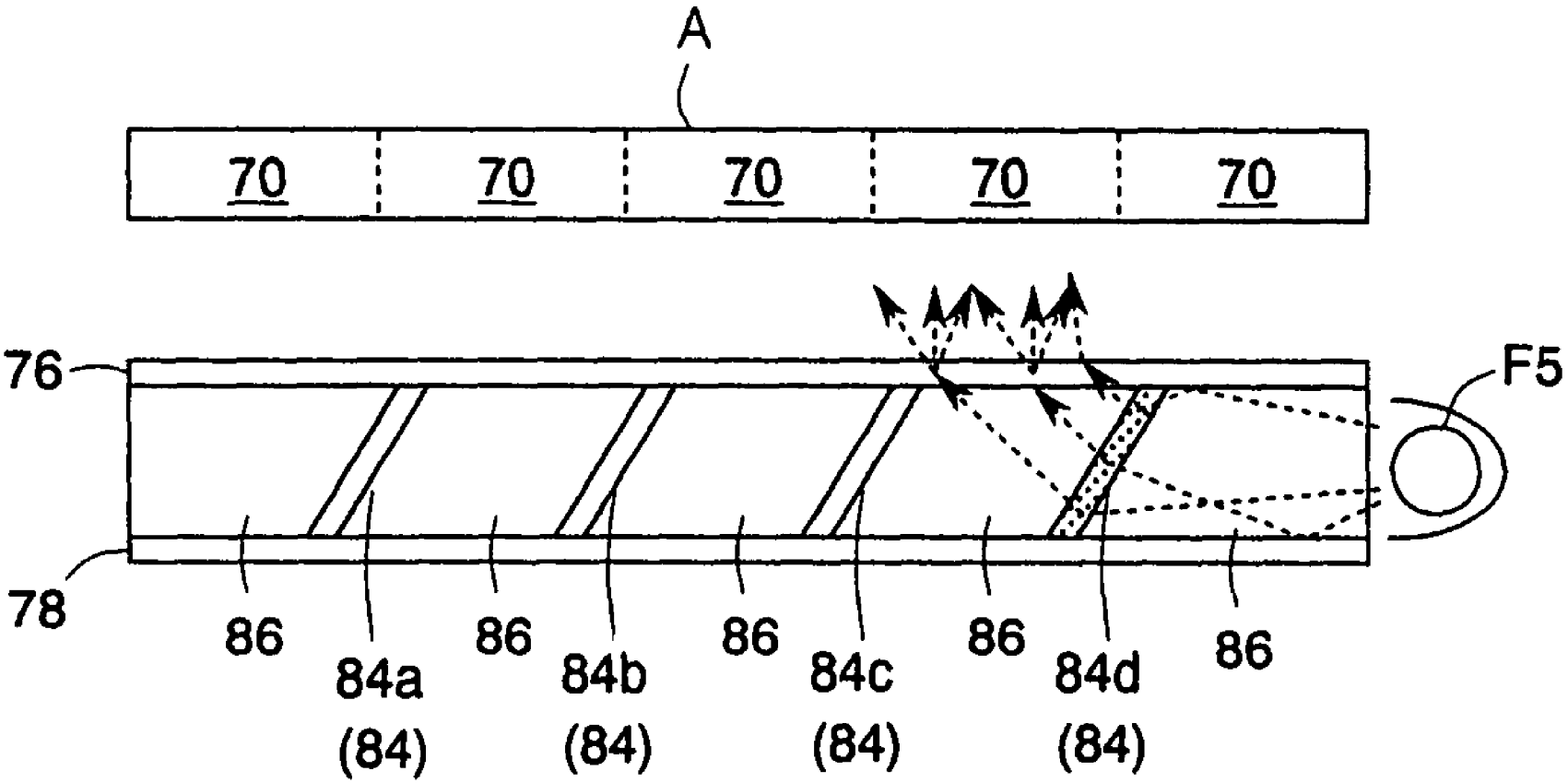
FIG. 42 is a diagram showing in detail a backlight in a fourteenth embodiment of the liquid crystal display device of the present invention.

FIG. 42 shows the backlight used in this embodiment in detail.

In this embodiment, the scattering parts 84*a*~85*e* are arranged obliquely along the direction of guiding the light from the fluorescent tube F5. Other configurations are the same as in FIG. 38.

In this embodiment, light penetrating through the inside of light guide plate 86 is necessarily scattered by the scattering parts 84*a*~84*e*, and the scattered light can be emitted in a large dose toward the liquid crystal panel A.

Figure 43:
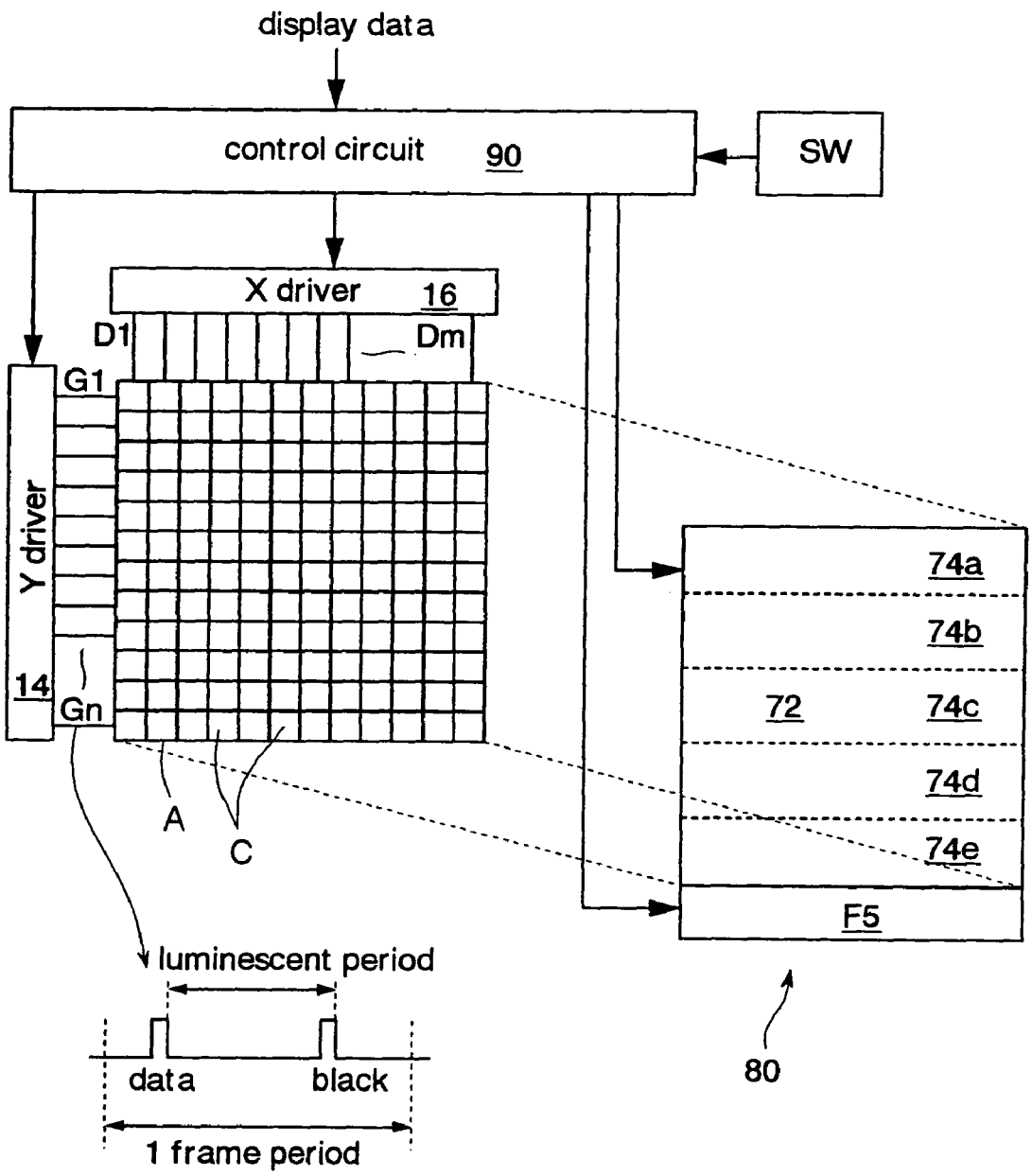
FIG. 43 is a block diagram showing a fifteenth embodiment of the liquid crystal display device and a twelfth embodiment of the liquid crystal display device controlling method of the present invention.

The Fifteenth Embodiment of the Liquid Crystal Display Device and the Twelfth Embodiment of the Liquid Crystal Display Device Controlling Method FIG. 43 shows an outline of the TFT (Thin Film Transistor) driving liquid crystal display device used in this embodiment. In this embodiment, elements corresponding to the elements described above for the above embodiment are given the same reference numerals and explanation of these elements is not repeated.

In this embodiment, the liquid crystal panel A is formed with the liquid crystal cells C arranged vertically and horizontally. A backlight 88 comprising the light guide plate 72, the liquid crystal film 74, and the fluorescent tube F5 is arranged on the backside of the liquid crystal panel A. A control circuit 90 receives an output from a manual switch SW and display data, and controls the Y driver 14, the X driver 16, and the backlight 88.

The manual switch SW is a switch for adjusting a luminescent period between the display data writing and the reset data writing. In other words, a viewer of a display screen of the liquid crystal panel A can freely adjust the luminescent period.

The control circuit 90 carries out line-sequential scanning according to impulse driving in which each of the scanning lines is scanned twice in one frame period, and the display data and the reset data (black) are written in the liquid crystal cells C. The control circuit 90 controls the backlight 88 and causes the scattering parts 74*a*~74*e* formed on the light guide plate 72 to sequentially emit light, in synchronization with display data writing. In other words, the luminescent period is adjusted by the impulse driving of the liquid crystal panel A and the control of the backlight.

The control circuit 90 adjusts the luminous intensity of the fluorescent tube F5 in response to the operation of the manual switch SW, so that the display brightness is kept constant.

In this embodiment, the viewer of the display screen can directly adjust the display screen for optimal view, by controlling the manual switch SW. For example, the luminescent period is increased when a still image is being viewed, while the time is shortened when a moving image is being viewed. In this manner, the display screen can be adjusted in accordance with a sense of the viewer. Therefore, blurring in a moving image is alleviated and flicker is prevented.

The display brightness of the liquid crystal panel A is controlled to be constant, in relation to the luminescent period control. Regardless of the image being still or moving, the display brightness can be kept constant and the screen becomes easier to see.

The luminescent period may be adjusted by arranging a shutter comprising a liquid crystals or the like on a front surface of the liquid crystal panel A and by controlling the liquid crystal shutter.

Furthermore, the brightness control of the display screen can be carried out according to the amount of the display data to be written in the liquid crystal cells C.

Figure 44:
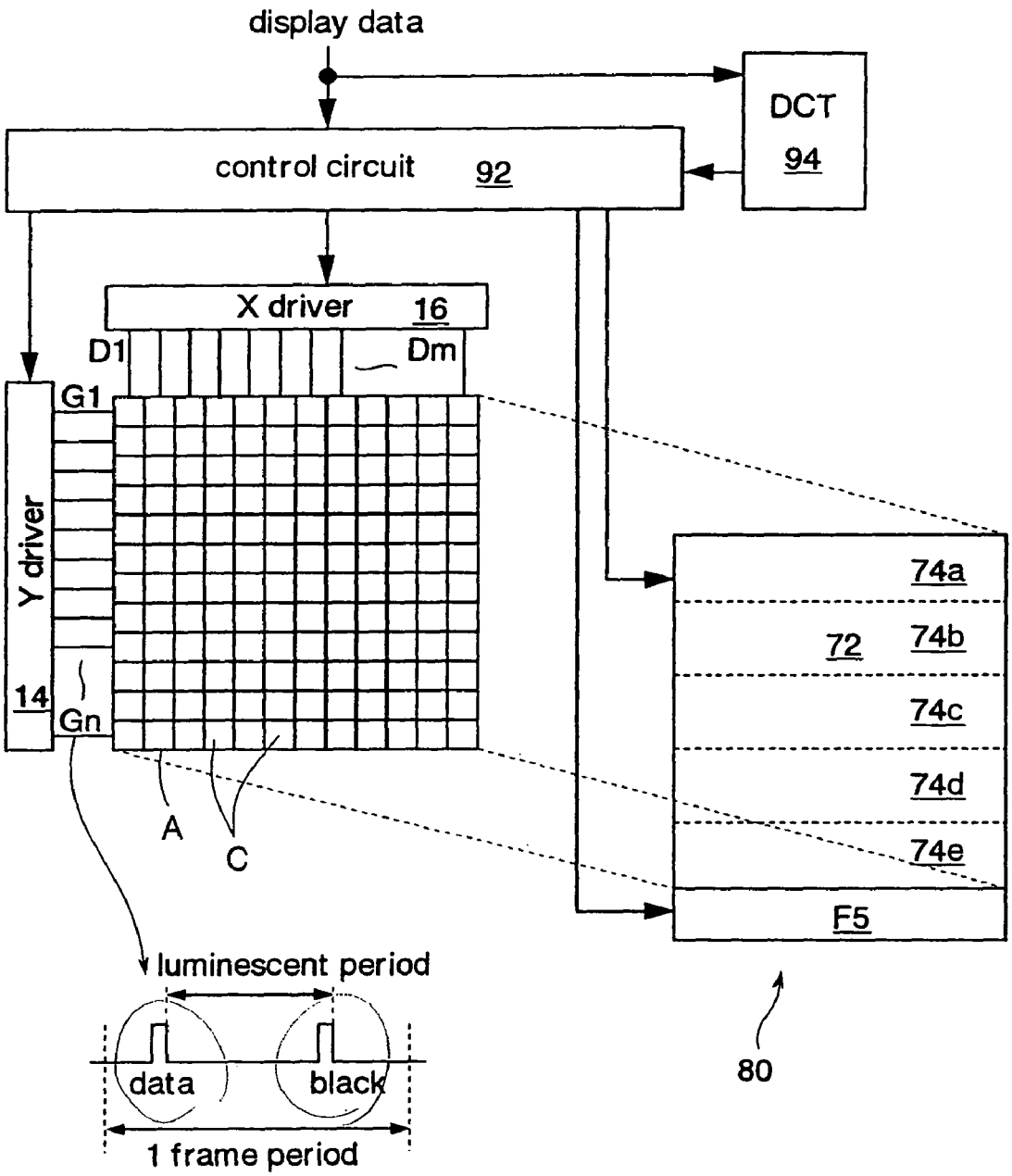
FIG. 44 is a block diagram showing a sixteenth embodiment of the liquid crystal display device and a thirteenth embodiment of the liquid crystal display device controlling method of the present invention.

The Sixteenth Embodiment of the Liquid Crystal Display Device and the Thirteenth Embodiment of the Liquid Crystal Display Device Controlling Method FIG. 44 shows an outline of the TFT (Thin Film Transistor) driving liquid crystal display device used in this embodiment.

In this embodiment, elements corresponding to the elements described above for the above embodiment are given the same reference numerals and explanation of these elements is not repeated.

In this embodiment, as in the above embodiment, the luminescent period is controlled by the impulse driving of the liquid crystal panel A and the backlight control.

A control circuit 92 receives information from a DCT (Discrete Cosine Transform) unit 94 for estimating motion of display data and judges whether the display data are of a still image or a moving image. The control circuit 92 controls the luminescent period in accordance with the display image. More specifically, the control circuit 92 judges an image to be moving when estimate of the motion of a DC component in the DCT exceeds the size of one block (16 pixels×16 lines). In the case of the moving image, the luminescent period is shortened, and the brightness of the backlight 88 is increased. The display brightness of the liquid crystal panel A is kept constant.

By using the information of DCT, consecutive still images are prevented from being judged moving due to a fluctuation of analog signals. Especially, it is preferable for an image to be judged as moving when the DC component changes by 10% or more.

In this embodiment, the luminescent period is adjusted by judging the display data to represent a still image or a moving image, using the information of DCT. By shortening the luminescent period for moving image display, blurring in the image is alleviated and flicker is prevented.

By using DCT widely used in motion compensation of moving images, the images can be judged still or moving with certainty.

The luminescent period can be adjusted by arranging a shutter comprising liquid crystals or the like on a front surface of the liquid crystal panel A, and by controlling the liquid crystal shutter.

The Seventeenth Embodiment of the Liquid Crystal Display Device

Figure 45:
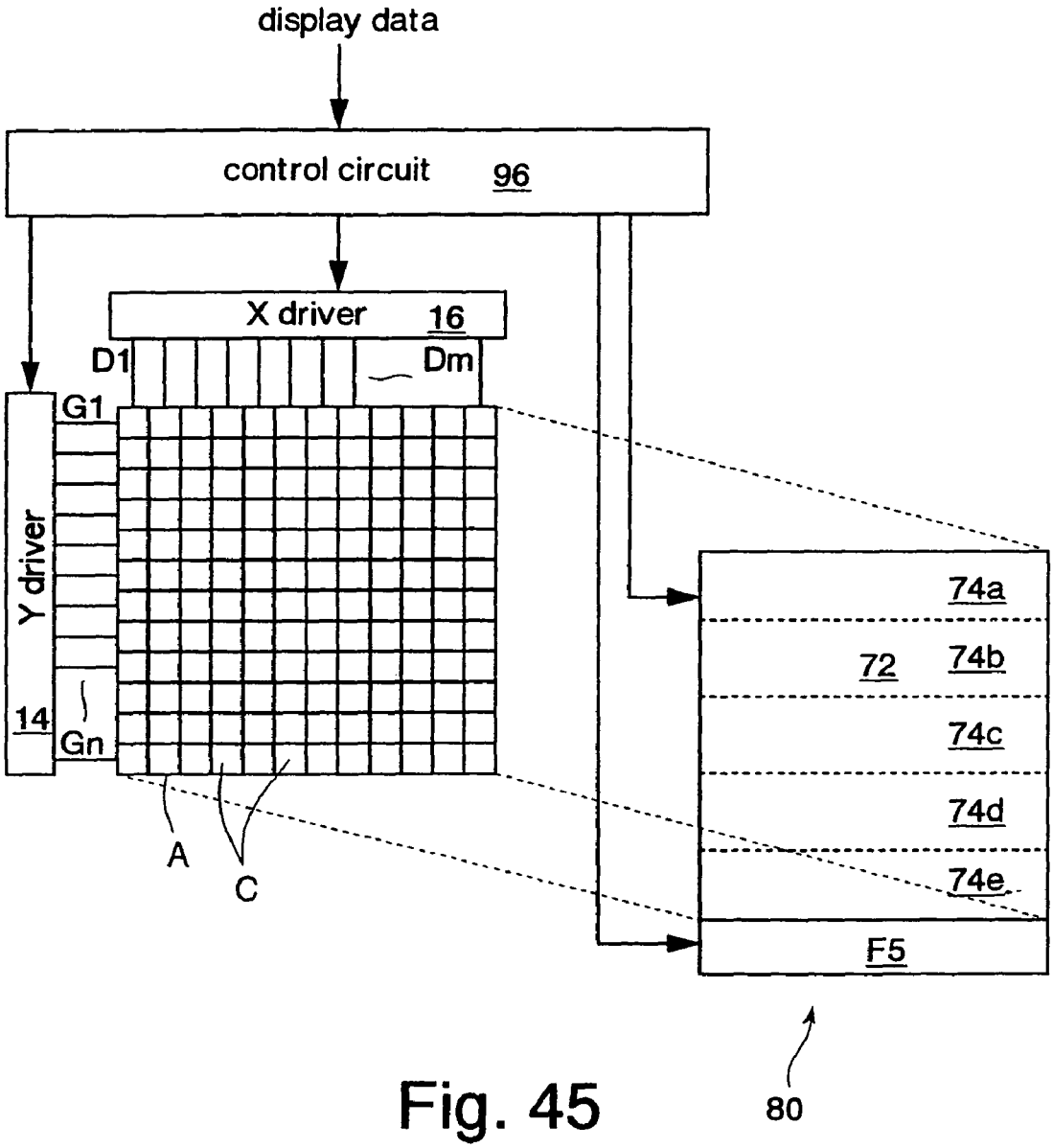
FIG. 45 is a block diagram showing a seventeenth embodiment of the liquid crystal display device of the present invention.

FIG. 45 shows an outline of the TFT (Thin Film Transistor) driving liquid crystal display device used in this embodiment. In this embodiment, elements corresponding to the elements described above for the above embodiment are given the same reference numerals and explanation of these elements is not repeated.

Configurations of a main portion of the liquid crystal display device are the same as in FIG. 44.

A control circuit 96 has a function of switching from impulse driving to hold driving and vice versa. The control circuit 96 carries out the hold driving in the case of display data for a still image and the impulse driving in the case of a moving image. The control circuit 96 carries out the impulse driving by impulse control of the scanning lines Gn and the on-off control of the backlight.

The display image is judged to be moving when a ratio of difference between pixels in a display image in one frame and pixels in a display image in an immediately preceding frame exceeds 10%. In other words, if the ratio of moving image to display data exceeds a predetermined value, the control is switched from the hold driving to the impulse driving.

Furthermore, the control circuit 96 increases the brightness of the backlight 88 when a moving image is displayed, and causes the display brightness of the liquid crystal panel A to be equal to the brightness in the case of a still image. Therefore, regardless of whether the hold driving or the impulse driving is carried out, the display brightness of the liquid crystal panel A becomes constant. In other words, the display brightness can be reduced at the time of still image display and power consumption can be reduced.

In this embodiment, polysilicon TFTs are used as the switching elements. Since the pixel electrodes are controlled by the polysilicon TFTs having a faster switching speed than amorphous silicon TFTs, blurring in a moving image can be alleviated, especially in the case of the impulse driving.

In this embodiment, blurring in a moving image can also be alleviated and flicker is prevented.

The present invention is not limited to the above embodiment. The display image may be judged to be moving when the display data changes for two or more frames, and the hold driving is then switched to the impulse driving.

Furthermore, the display image may be judged to be moving when motion compensation is carried out according to DCT (Discrete Cosine Transform) and vector information indicating motion of an image is included in compressed image information. The hold driving is then switched to the impulse driving.

Moreover, a shutter comprising liquid crystals or the like may be arranged on a front surface of the liquid crystal panel A so that the luminescent period in the impulse driving can be adjusted by controlling the liquid crystal shutter.

The Eighteenth Embodiment of the Liquid Crystal Display Device

Configurations of a main portion of the liquid crystal display device are the same as in FIG. 33. In this embodiment, elements corresponding to the elements described above for FIG. 33 are given the same reference numerals and explanation of these elements is not repeated.

Figure 46:
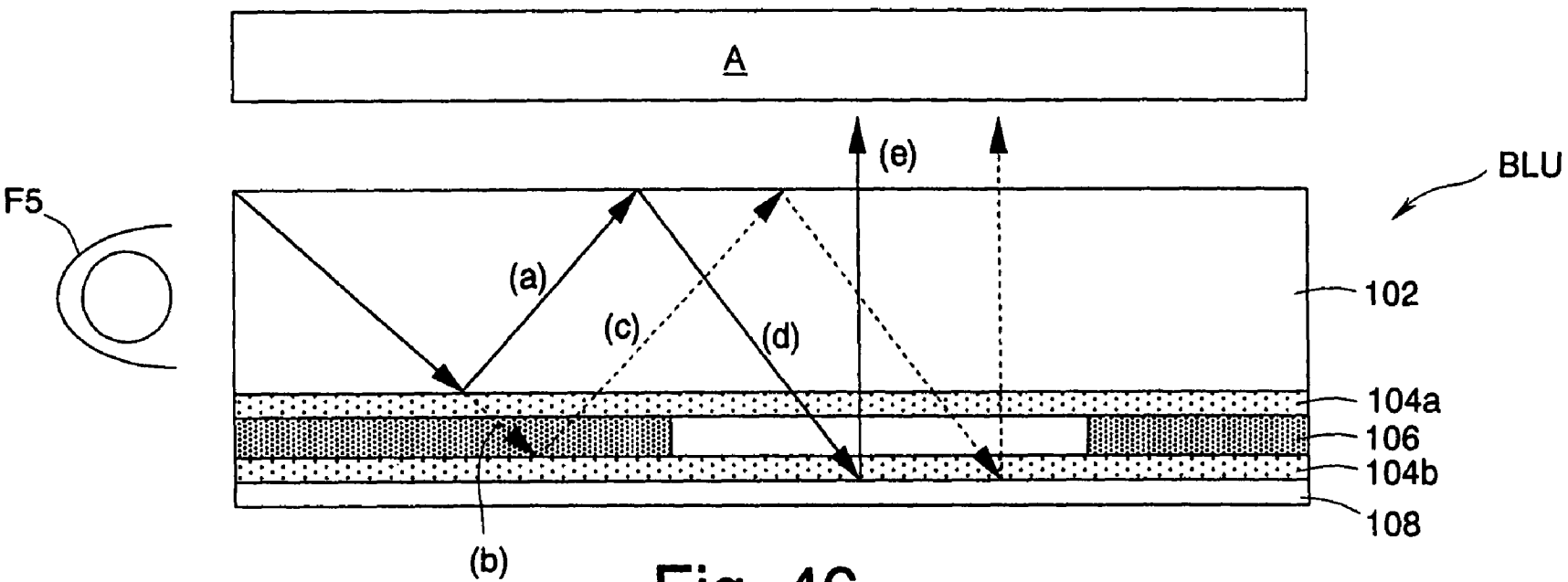
FIG. 46 is a diagram showing an eighteenth embodiment of the liquid crystal display device of the present invention.

FIG. 46 shows the backlight unit BLU used in this embodiment in detail.

The backlight unit BLU has a light guide plate 102. A polarization splitting sheet 104*a* (a first polarization splitting sheet), a liquid crystal shutter 106, a polarization splitting sheet 104*b* (a second polarization splitting sheet), and a scattering sheet 108 are bonded in this order on the light guide plate 102, on the opposite side of the liquid crystal panel A. The polarization splitting sheets 104*a* and 104*b* let a normal light component out of unpolarized light penetrate and reflect a component other than the normal light component (an abnormal light components).

In this embodiment, an acrylic board (refractive index: approximately 1.5) is used for the light guide plate 102 and "Transmax" of MercK Japan Ltd. is used for the polarization splitting sheets 104*a* and 104*b*. "Transmax" is formed with cholesteric liquid crystals. The liquid crystal shutter 106 is divided into 10 areas (only 3 areas are shown in FIG. 46) along the scanning lines. The liquid crystal shutter 106 has a function of sequentially opening (a penetrative state) each of the areas in accordance with the impulse control of the liquid crystal panel A. The refractive indices of "Transmax" and the liquid crystal shutter 106 are approximately 1.5, which is the same as the refractive index of the light guide plate 102. The scattering sheet 108 is formed with a resin board of milk white color. A 15-inch XGA liquid crystal panel is used as the liquid crystal panel A.

An operation of the backlight unit BLU will be explained next.

Light emitted from the fluorescent tube F5 (unpolarized light) propagates while being totally reflected (ranging 0~4°) within the light guide plate 102. The abnormal light component is reflected by the polarization splitting sheet 104*a* and propagates within the light guide plate 102 while being totally reflected [FIG. 46(*a*)]. The normal light component penetrates through the polarization splitting sheet 104*a* and reaches the liquid crystal shutter 106. In the case where the liquid crystal shutter 106 is in a state of birefringence (portions shown by stippled areas), the component having penetrated through the polarization splitting sheet 104*a* is subjected to the phase shift by 90° by the liquid crystal shutter 106, and reaches the polarization splitting sheet 104*b* as an abnormal light component [FIG. 46(*b*)]. The light is reflected by the polarization splitting sheet 104*b* again and subjected to the phase shift by 90° by the liquid crystal shutter 106 to become the original normal light component. Thereafter, the light penetrates through the polarization splitting sheet 104*a* and is returned to within the light guide plate 102 [FIG. 46(*c*)]. On the other hand, in the case where the liquid crystal shutter 106 is not in the state of birefringence (shown by a white portion in FIG. 46), the light having penetrated through the polarization splitting sheet 104*a* (the normal light component) penetrates through the liquid crystal shutter 106 and the polarization splitting sheet 104*b*, and is scattered (reflected) by the scattering sheet 108 [FIG. 46(*d*)]. The light irregularly reflected by the scattering sheet 108 penetrates through the polarization splitting sheet 104*b*, the liquid crystal shutter 106, and the polarization splitting sheet 104*a* and returns to the light guide plate 102. At this time, most components of the light exceeds a critical angle and emitted to the liquid crystal panel A, penetrating through the light guide plate 102 [FIG. 46(*e*)].

The liquid crystal display device can easily carry out the impulse driving by causing the predetermined area of the liquid crystal shutter to sequentially become penetrative in accordance with control of the panel. Therefore, blurring in a moving image can be alleviated and flicker is prevented.

Although not shown, the light can repeatedly penetrate through the light guide plate 102 if mirrors or the like for reflecting the light are set at both ends (right and left) of the light guide plate 102. The light is then emitted from the predetermined area of the liquid crystal shutter 106 to the liquid crystal panel A. In other words, the light emitted from the fluorescent tube F5 is collected at a desired position and emitted therefrom.

As has been described above, in this embodiment, the light emitted to the light guide plate 102 can be used efficiently and power consumption can thereby be reduced. In this example, the power consumption of the fluorescent tube F5 can be reduced up to 1/10. Furthermore, since the plurality of the luminescent parts can be formed by using the fluorescent tube F5 alone, uneven display caused by degradation of the fluorescent tube does not occur.

The Nineteenth Embodiment of the Liquid Crystal Display Device

Configurations of a main portion of the liquid crystal display device are the same as those of the eighteenth embodiment. In this embodiment, elements corresponding to the elements described above for the eighteenth embodiment are given the same reference numerals and explanation of these elements is not repeated.

Figure 47:
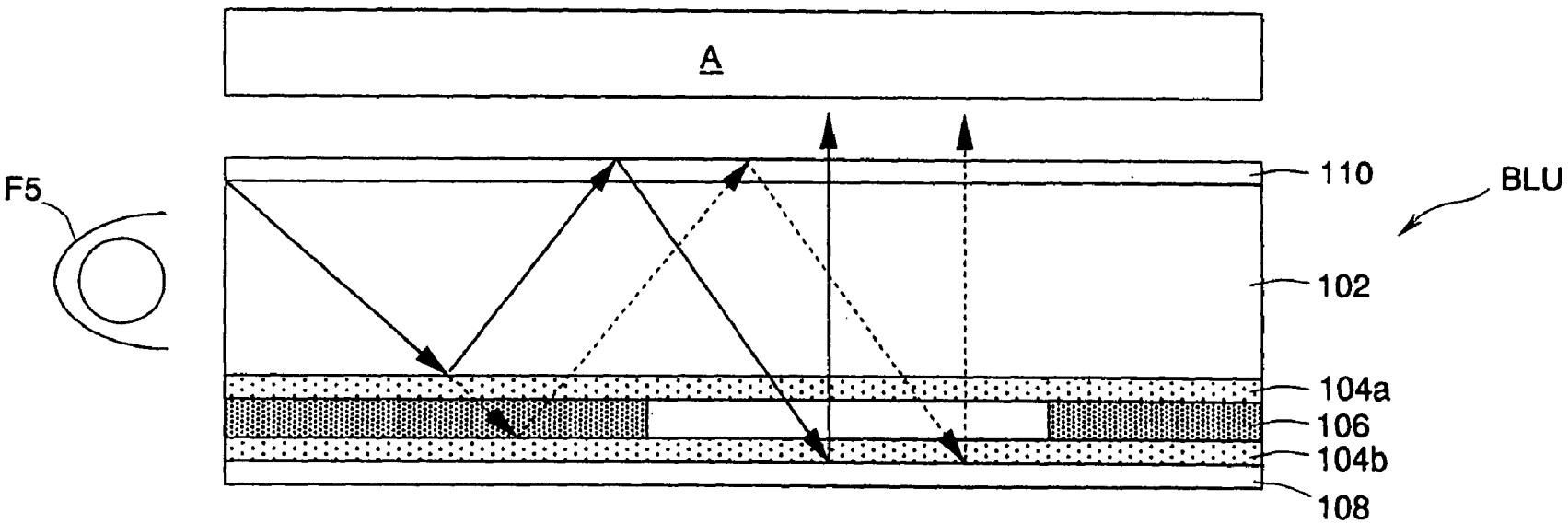
FIG. 47 is a diagram showing a nineteenth embodiment of the liquid crystal display device of the present invention.

FIG. 47 shows the backlight unit BLU used in this embodiment in detail.

In this embodiment, a retardation sheet 110 having 100 nm retardation is pasted on the light guide plate 102, on the side of the back liquid crystal panel A. The retardation value of the retardation sheet 110 is not specifically limited. Configurations other than the above are the same as in FIG. 46.

Figure 48:
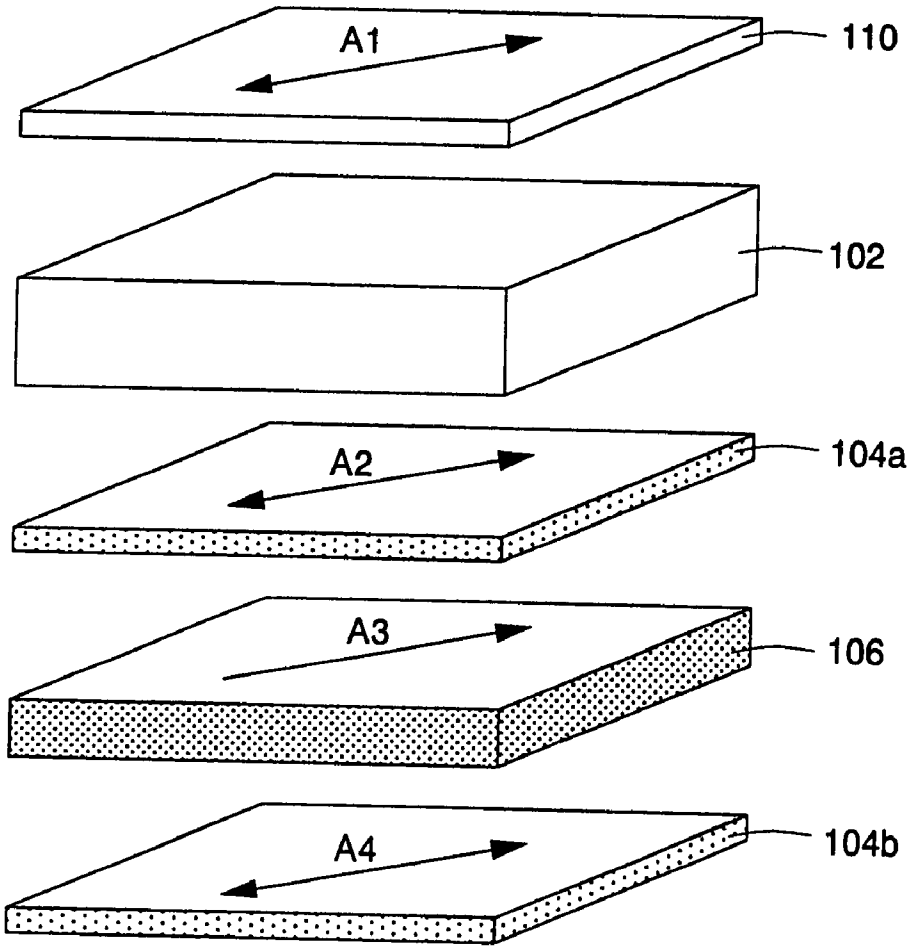
FIG. 48 is a diagram showing the detail of FIG. 47.

FIG. 48 shows a retardation axis A1 of the retardation sheet 110, a transmissive axis A2 of the polarization splitting sheet 104*a*, a liquid crystal alignment direction A3 of the liquid crystal shutter 106, and a transmissive axis of the polarization splitting sheet 104*b*. In this embodiment, the directions of the transmissive axes A2 and A4 are set to be in accordance with the liquid crystal alignment direction A3. The direction of the retardation axis A1 can be arbitrary.

As shown in FIG. 47, light penetrating through the light guide plate 102 is subjected to phase shift of reflected light by the retardation sheet 110. In other words, the phase of the light totally reflected within the light guide plate 102 (the abnormal light component) is shifted by the retardation sheet 110 and becomes to include the normal light component. Consequently, the normal light component penetrating through the polarization splitting sheet 104*a* can be increased.

In this embodiment, the same effect as by the eighteenth embodiment can be obtained. Furthermore, in this embodiment, the light can be used efficiently and power consumption is thus reduced more.

The Twentieth Embodiment of the Liquid Crystal Display Device

Configurations of a main portion of this device are the same as the eighteenth embodiment. In this embodiment, elements corresponding to the elements described above for the eighteenth embodiment are given the same reference numerals and explanation of these elements is not repeated.

Figure 49:
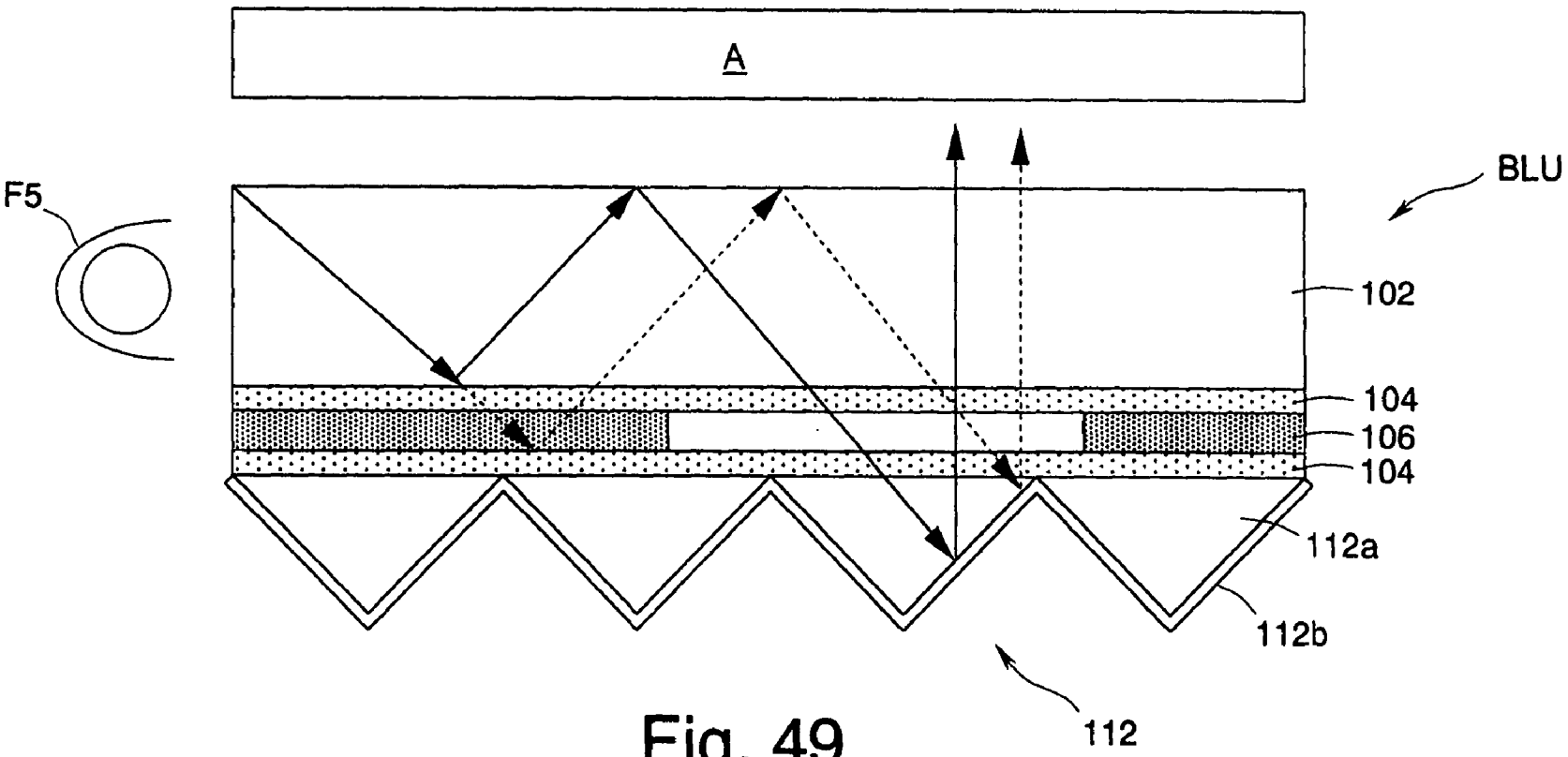
FIG. 49 is a diagram showing a twentieth embodiment of the liquid crystal display device of the present invention.

FIG. 49 shows the backlight unit BLU used in this embodiment in detail.

In this embodiment, instead of the scattering sheet 108, a prism sheet 112 comprising a plurality of prisms 112*a* is bonded. Configurations other than the prism sheet are the same as in FIG. 46.

A prism surface of each of the prisms 112*a* comprises a reflection film 112*b* on which aluminum or the like is vapor-deposited. Each of the prisms 112*a* is designed to reflect incident light to a direction forming an angle of ±20° with a direction orthogonal to the liquid crystal panel A. In other words, the normal light component penetrating through the liquid crystal shutter 106 is reflected by the prism sheet 112 and emitted toward the liquid crystal panel A in a direction almost orthogonal to the liquid crystal panel A.

In this embodiment, the same effect as by the eighteenth embodiment can be obtained. Furthermore, in this embodiment, the light is emitted at the predetermined angle toward the liquid crystal panel A and luminous intensity can be improved.

The Twenty-first Embodiment of the Liquid Crystal Display Device

Configurations of a main portion of the liquid crystal display device are the same as those of the eighteenth embodiment. In this embodiment, elements corresponding to the elements described above for the eighteenth embodiment are given the same reference numerals and explanation of these elements is not repeated.

Figure 50:
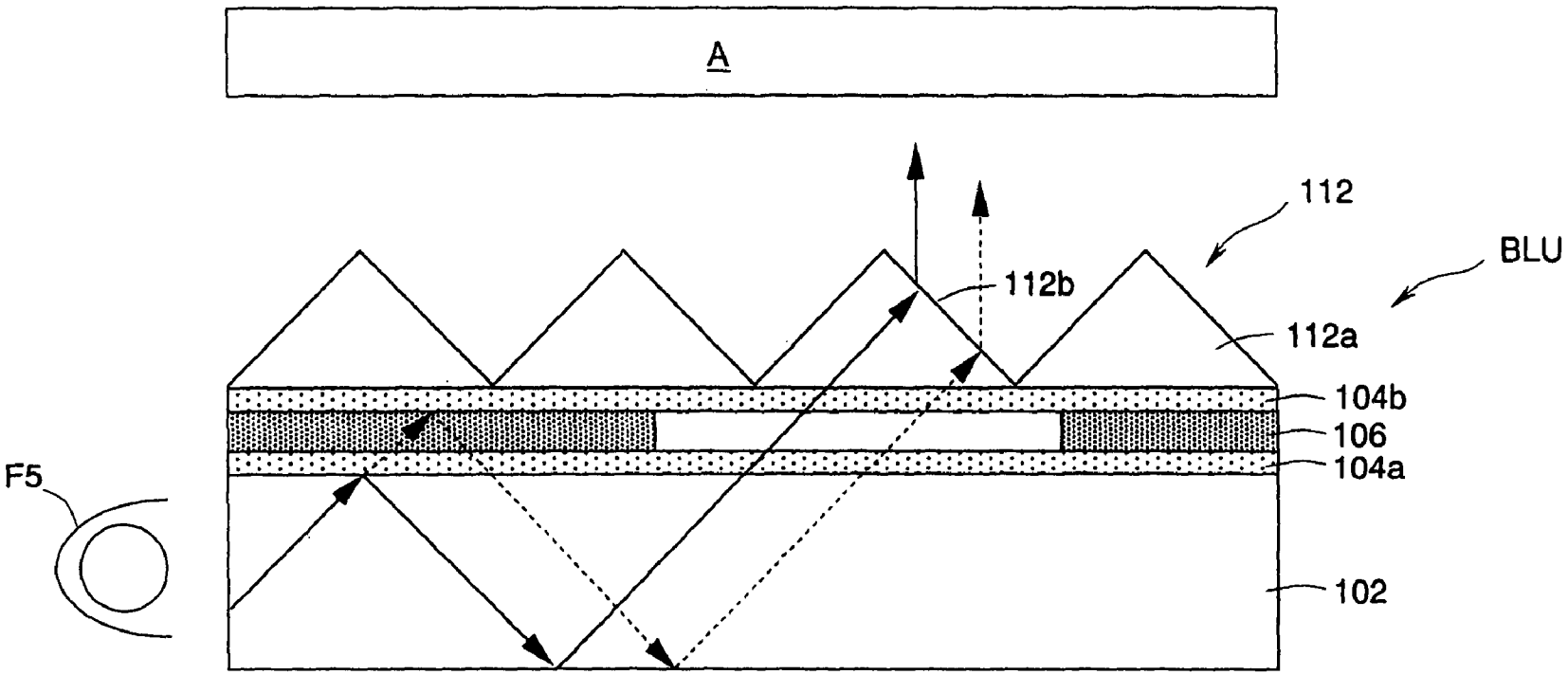
FIG. 50 is a diagram showing a twenty-first embodiment of the liquid crystal display device of the present invention.

FIG. 50 shows the backlight unit BLU used in this embodiment.

In this embodiment, the polarization splitting sheet 104*a*, the liquid crystal shutter 106, the polarization splitting sheet 104*b*, and the prism sheet 112 are bonded in this order on the light guide plate 102, on the side of the liquid crystal panel A. The prism sheet 112 does not have a reflection film on the prism surface 102*b*.

Light propagating through the light guide plate 102 penetrates through or is reflected by the polarization splitting sheets 104*a* and 104*b* and by the liquid crystal shutter 106 in the same mechanism as in the eighteenth embodiment. The light penetrated through the liquid crystal shutter 106 in the penetrative state is reflected by the prism surface 102*b*, and emitted toward the liquid crystal panel A.

In this embodiment, the same effect as by the eighteenth and twentieth embodiments can be obtained.

The Twenty-second Embodiment of the Liquid Crystal Display Device

Configurations of a main portion of the liquid crystal display device are the same as those of the twenty-first embodiment. In this embodiment, elements corresponding to the elements described above for the twenty-first embodiment are given the same reference numerals and explanation of these elements is not repeated.

Figure 51:
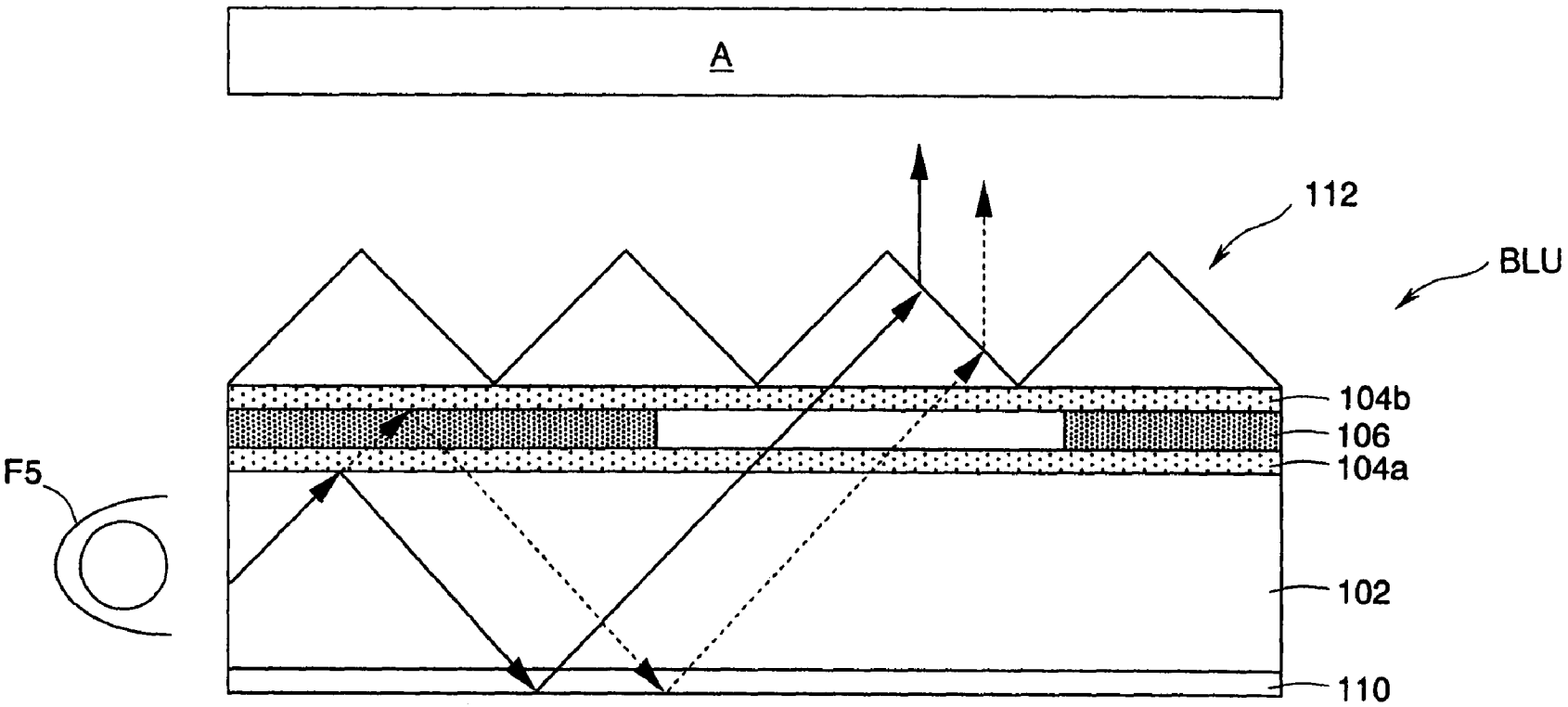
FIG. 51 is a diagram showing a twenty-second embodiment of the liquid crystal display device of the present invention.

FIG. 51 shows the backlight unit BLU used in this embodiment in detail.

In this embodiment, the retardation sheet 110 is pasted on the light guide plate 102, on the opposite side of the liquid crystal panel A. In this embodiment, the same effect as by the nineteenth embodiment and the twenty-first embodiment can be obtained.

The Twenty-third Embodiment of the Liquid Crystal Display Device

Configurations of a main portion of the liquid crystal display device are the same as those of the eighteenth embodiment. In this embodiment, elements corresponding to the elements described above for the eighteenth embodiment are given the same reference numerals and explanation of these elements is not repeated.

Figure 52:
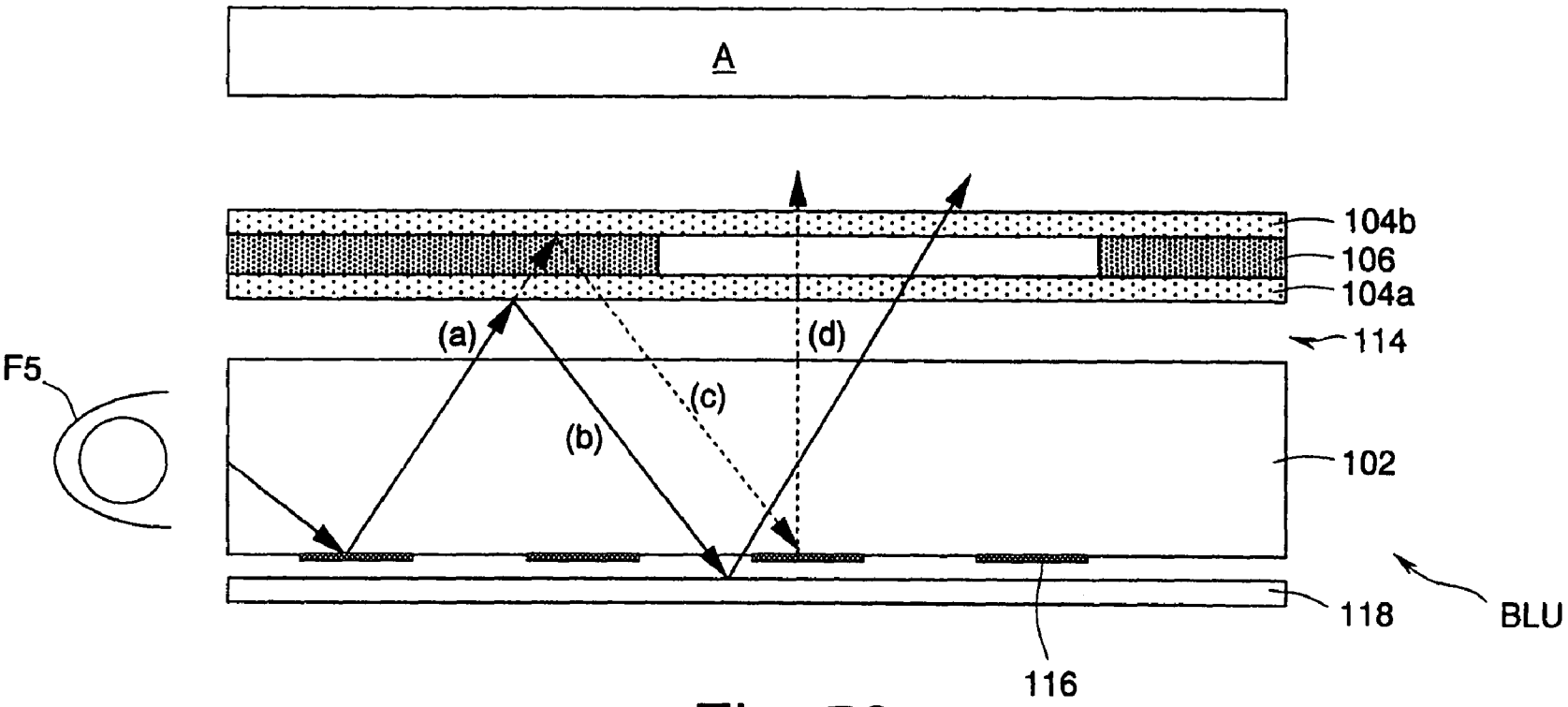
FIG. 52 is a diagram showing a twenty-third embodiment of the liquid crystal display device of the present invention.

FIG. 52 shows the backlight unit BLU used in this embodiment in detail.

In this embodiment, the polarization splitting sheet 104*a*, the liquid crystal shutter 106, the polarization splitting sheet 104*b* are arranged on the light guide plate 102 via an air layer 114, on the side of the liquid crystal panel A. A plurality of scattering patterns 116 are printed in intervals on the light guide plate 102, on the opposite side of the liquid crystal panel A. The patterns 116 may be formed as stripe patterns or check patterns. A reflection plate 118 is arranged adjacent to the light guide plate 102, on the opposite side of the liquid crystal panel A.

A component of light penetrating through the light guide plate 102 (unpolarized light) exceeding the critical angle due to the patterns 116 is emitted on the polarization splitting sheet 104*a* from the light guide plate via the air layer 114 [FIG. 52(*a*)]. Out of the unpolarized light, the abnormal light component is reflected by the polarization splitting sheet 104*b* and returned to the light guide plate 102 via the air layer 114 [FIG. 52(*b*)]. The normal light component penetrates through the polarization splitting sheet 104*a* and reaches the liquid crystal shutter 106. In the case where the liquid crystal shutter 106 is in the state of birefringence (stippled portions in FIG. 52), the normal light component having penetrated through the polarization splitting sheet 104*a* is subjected to the 90° phase shift by the liquid crystal shutter 106, and reflected by the polarization splitting sheet 104*b* to be returned to the light guide plate 102 [FIG. 52(*c*)]. On the other hand, in the case where the liquid crystal shutter 106 is not in the birefringence state (a white portion in FIG. 52), the light having penetrated through the polarization splitting sheet 104*a* (the normal light component) penetrates through the liquid crystal shutter 106 and the polarization splitting sheet 104*b*, to be emitted toward the liquid crystal panel A [FIG. 52(*d*)].

In this embodiment, the same effect as by the eighteenth embodiment can be obtained. Furthermore, in this embodiment, the light penetrating through the light guide plate 102 easily exceeds the critical angle by the scattering patterns 116, and the light is used efficiently.

The Twenty-fourth Embodiment of the Liquid Crystal Display Device

Configurations of a main portion of the liquid crystal display device are the same as those in the twenty-third embodiment. In this embodiment, elements corresponding to the elements described above for the twenty-third embodiment are given the same reference numerals and explanation of these elements is not repeated.

Figure 53:
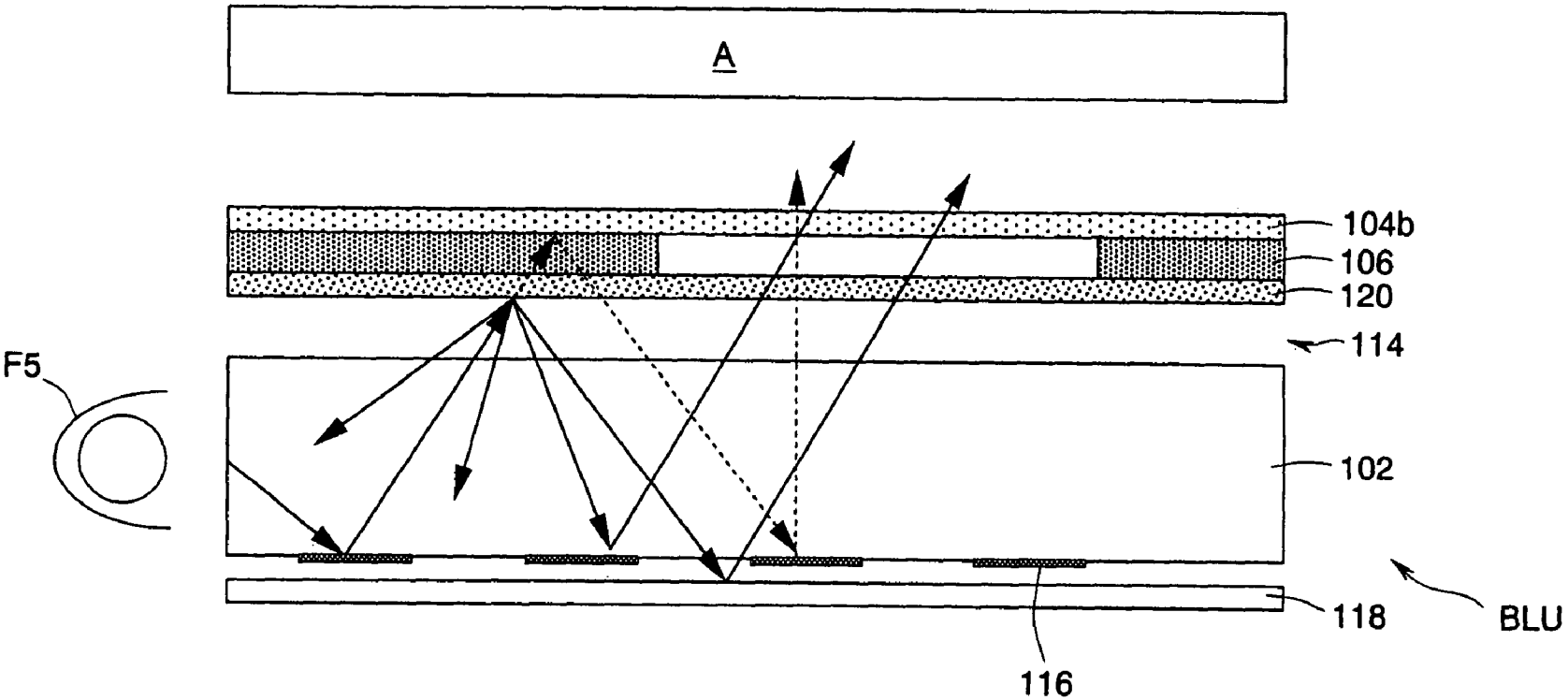
FIG. 53 is a diagram showing a twenty-fourth embodiment of the liquid crystal display device of the present invention.

FIG. 53 shows the backlight BLU used in this embodiment in detail.

In this embodiment, a polarization splitting sheet 120 is used instead of the polarization splitting sheet 104*a*. The polarization splitting sheet 120 lets the normal light component penetrate through and irregularly reflects the abnormal light component. As the polarization splitting sheet 120, "DRPF (Diffuse Reflective Polarizing Film) manufactured by Minnesota Mining and Manufacturing Company is used, for example.

Out of light emitted from the light guide plate 102 to the polarization splitting sheet 120 via the air layer 114, the abnormal light component is irregularly reflected by the polarization splitting sheet 120 and returned to the light guide plate 120. Operations other than this are the same as in the twenty-third embodiment.

In this embodiment, the same effect as by the twenty-third embodiment can be obtained.

The polarization splitting sheets 104*a* and 104*b* used in the eighteenth to twenty-fourth embodiments are not limited to "Transmax". The polarization splitting sheets may be formed with a plurality of films having different refractive indices. Alternatively, the polarization splitting sheets may be formed with a prism array comprising a plurality of prisms. As the polarization splitting sheets having a plurality of films stacked, "D-BEF" manufactured by Minnesota Mining and Manufacturing Company can be used. As the prism array, "Weber" of Minnesota Mining and Manufacturing Company can be used.

The Twenty-fifth Embodiment of the Liquid Crystal Display Device

Figure 54:
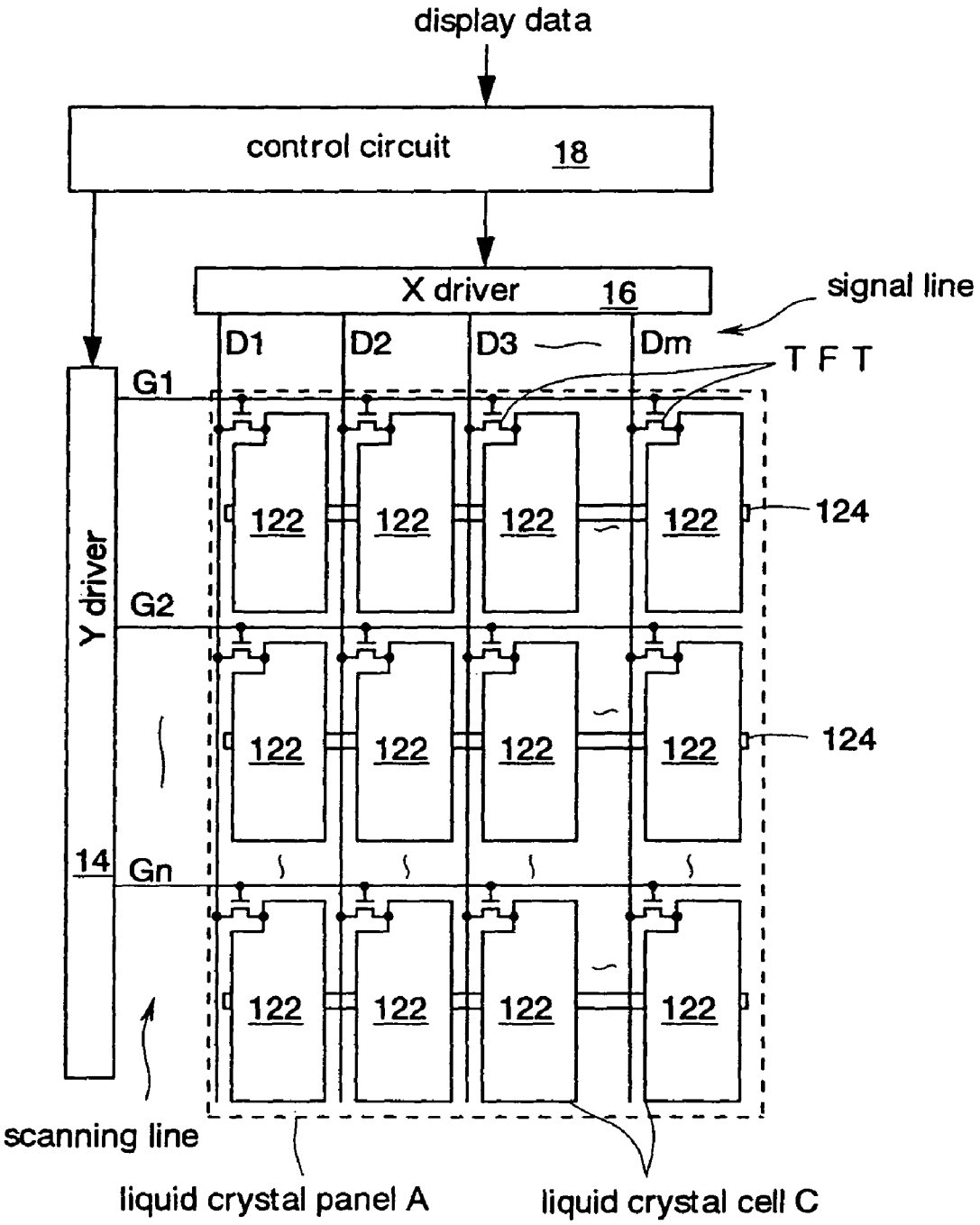
FIG. 54 is a block diagram showing a twenty-fifth embodiment of the liquid crystal display device of the present invention.

FIG. 54 shows the TFT (Thin Film Transistor) driving liquid crystal display device used in this embodiment.

In this embodiment, elements corresponding to the elements described above for the first embodiment are given the same reference numerals and explanation of these elements is not repeated.

The liquid crystal display device comprises the liquid crystal panel A having TFTs and liquid crystal cells C laid out in the form of a matrix. The size of the liquid crystal cells C is approximately 100 μm×300 μm. The gate electrodes of the TFTs as switching elements are connected to the scanning lines G1, G2, . . . , Gn. The drain electrodes of the TFTs are connected to the signal lines D1, D2, . . . , Dm. The source electrodes of the TFTs are connected to display electrodes 122 of the liquid crystal cells C which will be explained later.

Second pixel electrodes 124 are formed along the scanning lines beneath the display electrodes 122. The width of the second pixel electrodes 124 is approximately 10 μm. In this embodiment, a liquid crystal mode of the liquid crystal panel A is normally black in which light penetrates through when an electric field exists. The liquid crystal panel A adopts liquid crystals having a fast response speed, such as the VA (Vertical Alignment) type or the OCB (Optically Compensated Birefringence) type. The liquid crystal panel A may adopt the TN (Twist Nematic) type.

Figure 55:
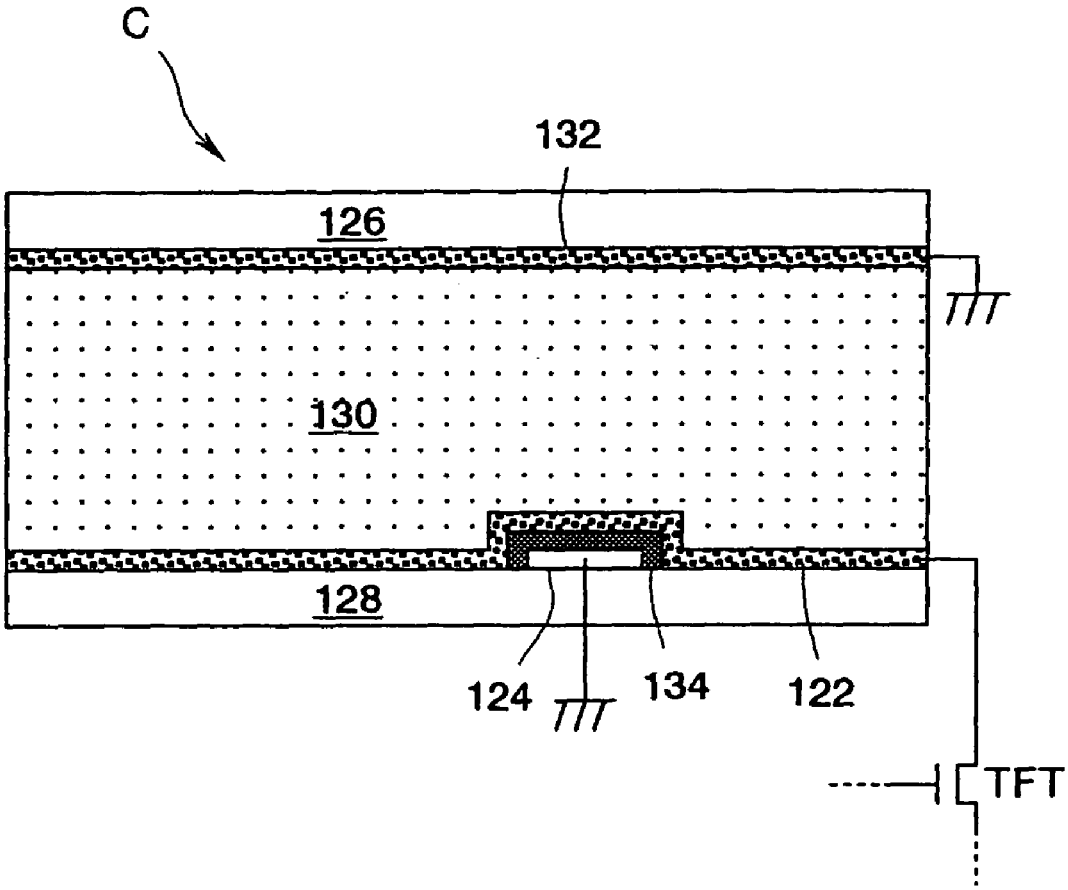
FIG. 55 is a cross-section showing a liquid crystal cell in detail.

FIG. 55 shows a cross section of the liquid crystal cell C along the signal line Dm in FIG. 54.

The liquid crystal cell C is formed by sandwiching a liquid crystal layer 130 between a CF substrate 126 and a TFT substrate 128. First pixel electrode 132 is formed on the inner side of the CF substrate 126, and the display electrode 122 is formed on the inner side of the TFT substrate 128. The first pixel electrode 132 is connected to a ground line. The second pixel electrode 124 is formed on the inner side of the TFT substrate 128. The second pixel electrode 124 is connected to a ground line.

A thin film 134 made of amorphous silicon having 0.4 μm thickness and 10 μm width is formed between the second pixel electrode 124 and the display electrode 122, by using a CVD technique. The resistibility of the amorphous silicon is 1E8~1E9 Ωcm, which is lower than the resistibility of the liquid crystal layer (1E14 Ωcm). The dielectric constant of the amorphous silicon and the liquid crystal layer 130 are 5 and "12", respectively. The liquid crystal film 134 forms a subsidiary capacitance.

Figure 56:
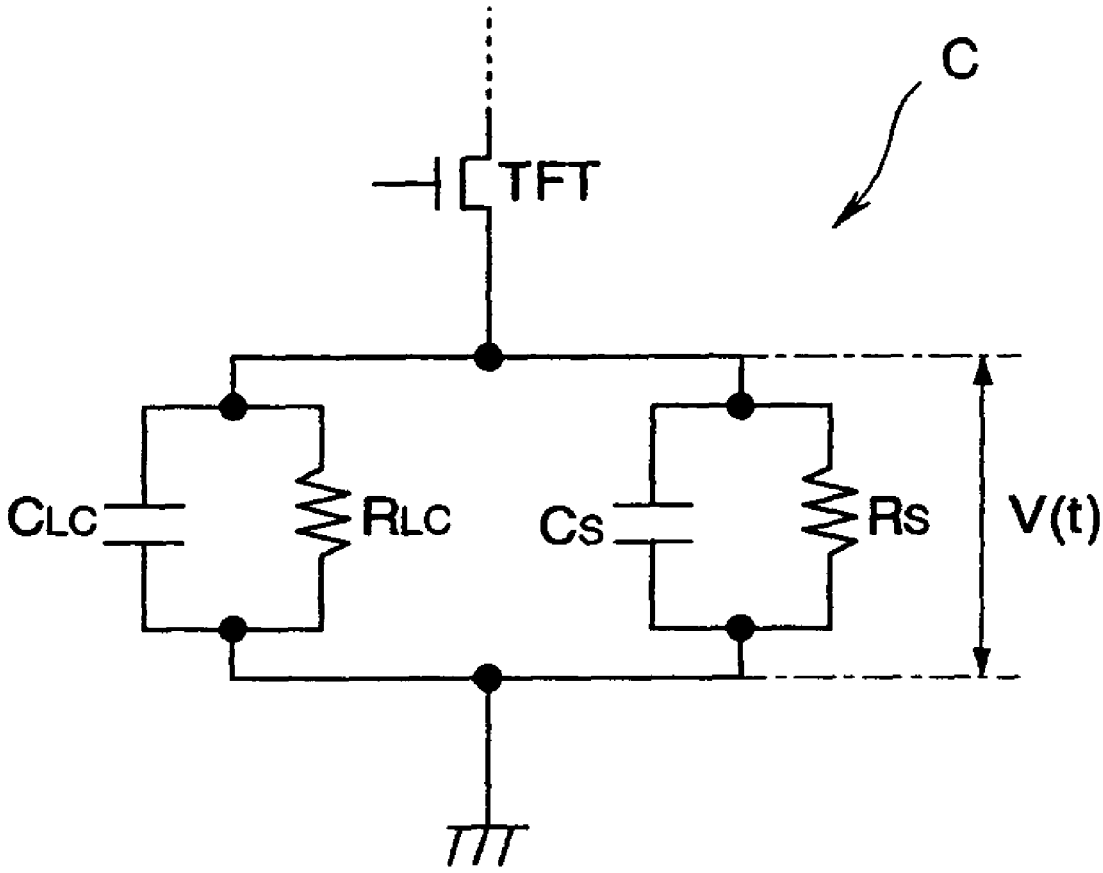
FIG. 56 is an equivalent circuit of the liquid crystal cell.

FIG. 56 shows an equivalent circuit of the liquid crystal cell C shown in FIG. 55.

The liquid crystal cell C can be dealt with as two CR time constant circuits in which a capacitance CLC of the liquid crystal layer 130, resistance RLC thereof and a capacitance CS of the subsidiary capacitance, resistance RS thereof are connected in parallel. A transient phenomenon of the equivalent circuit is expressed by the following Equations (4)~(6), with t being time and V being a voltage:

$$V(t)=V0\times\exp(-t/CR) \quad (4)$$

$$C=CLC+CS \quad (5)$$

$$R=(RLC\times RS)/(RLC+RS) \quad (6)$$

Figure 57:
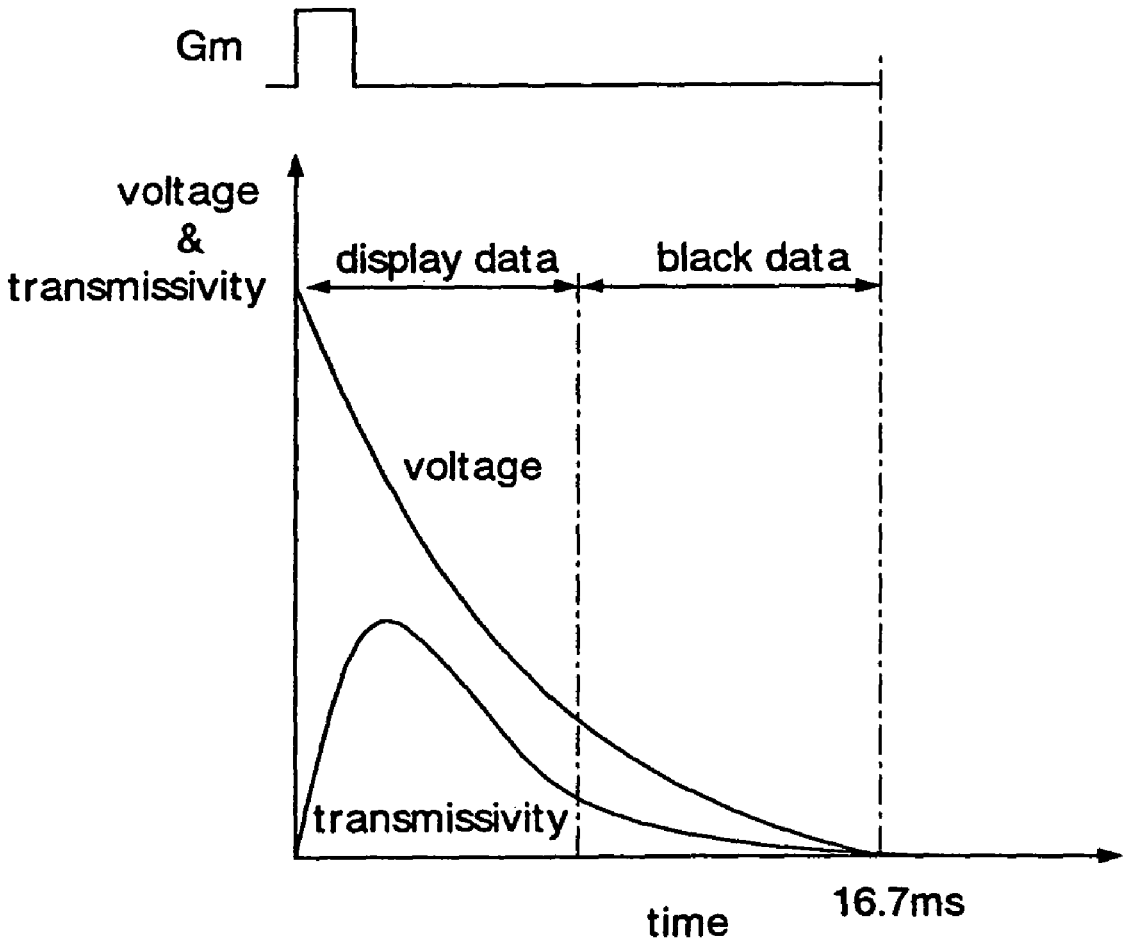
FIG. 57 shows a state in which display data are written in the liquid crystal cell.

FIG. 57 shows a state in which display data (white) are written in the liquid crystal cells C.

The scanning line Gn is selected and the data are written in the liquid crystal cells C. A voltage between the first pixel electrode 132 and the display electrode 122 reaches a predetermined value, and penetrability of the liquid crystal layer 130 increases. Since the voltage between the two electrodes decreases according to equation (4), the penetrability of the layer 130 decreases. Therefore, the liquid crystal cell Cs are automatically reset after the display data are displayed. In other words, black data are displayed. As a result, the impulse driving in which the display data and the reset data are written in one frame period (16.6 ms) can be realized. By writing the display data with a voltage equal to or larger than a saturation voltage, the transmissivity can be increased.

Issues of discussion in the present invention will be described below.

Figure 58:
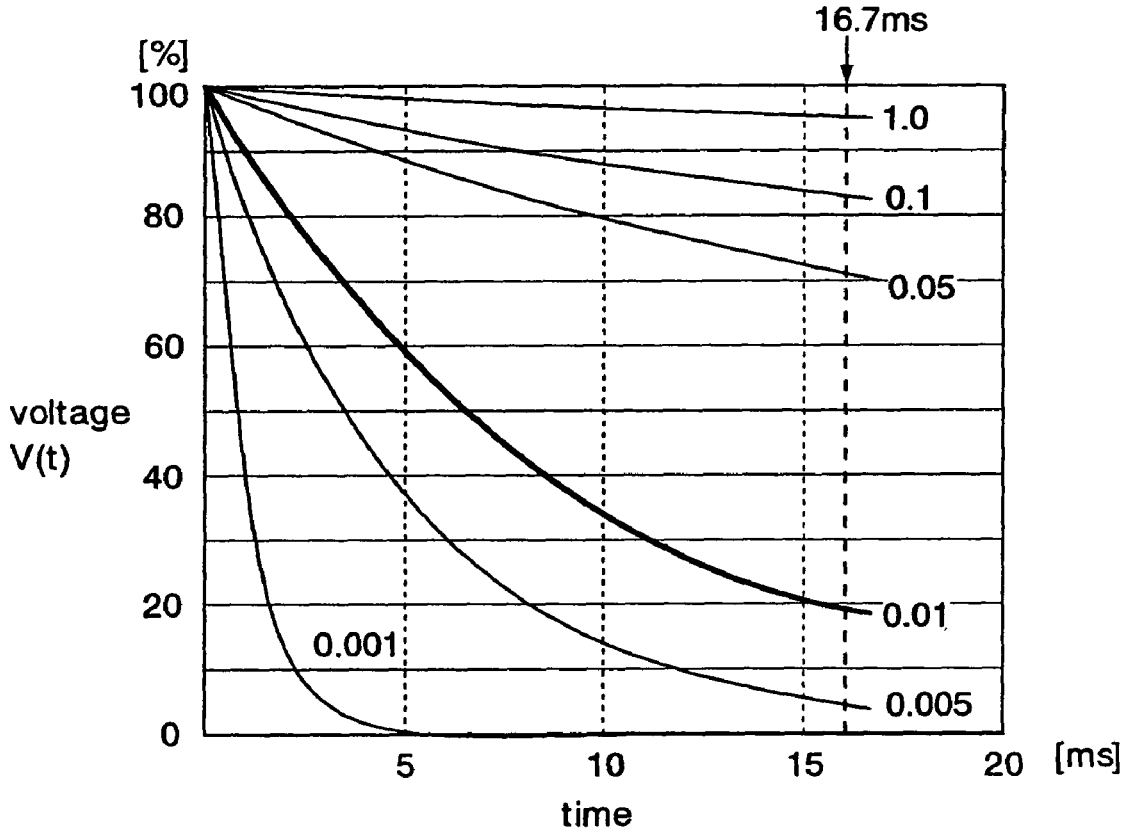
FIG. 58 shows changes in a supplied voltage in accordance with a CR time constant of the equivalent circuit.

FIG. 58 shows a change in the voltage supplied to the equivalent circuit shown in FIG. 55 in relation to the CR time constant. In order to display black data in the latter half of one frame period, it is preferable for the supplied voltage to become equal to or less than 20% of an initial voltage in 16.7 ms. At this time, the CR time constant becomes 0.01 or smaller.

Figure 59:
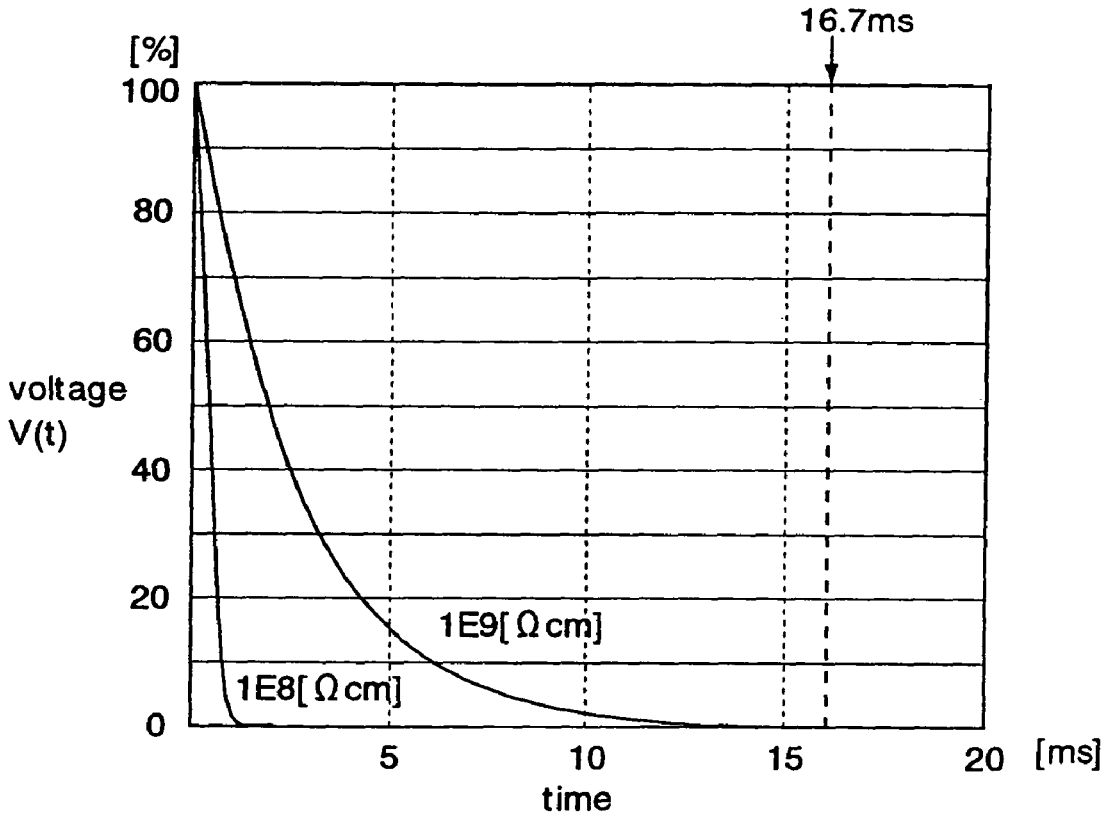
FIG. 59 shows changes in a supplied voltage in relation to a CR constant of amorphous silicon.

FIG. 59 shows a change in the supplied voltage in the case of forming the CR time constant circuit by using amorphous silicon. The amorphous silicon satisfies the condition explained by using FIG. 58.

Figure 60:
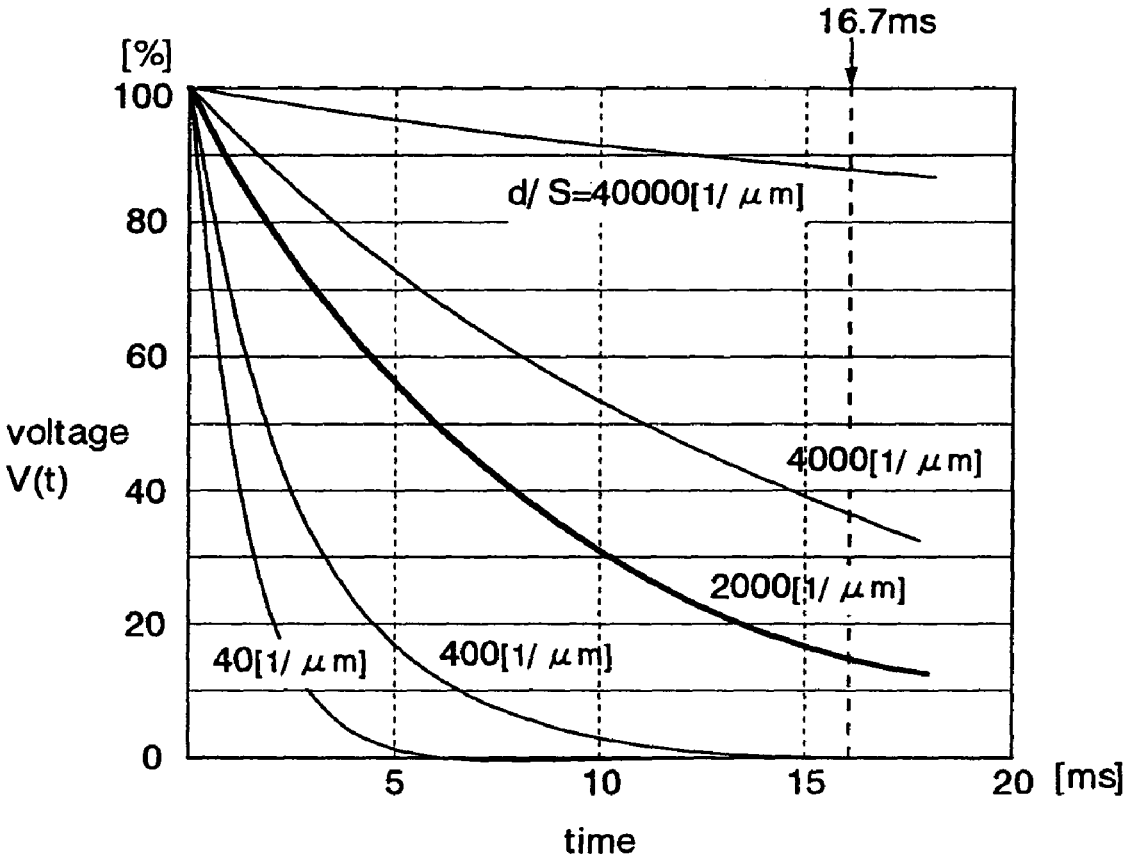
FIG. 60 shows changes in a supplied voltage in relation to a layer thickness and an area of the amorphous silicon.

FIG. 60 shows a change in the supplied voltage in the case of the amorphous silicon having a d [μm] thickness and an S [$\mu m^2$] area. When d/S<2000[1/μm], the condition explained for the case of FIG. 58 is satisfied. As a result, the impulse driving can be carried out even if the width of the amorphous silicon is 3 μm (a minimum pattern in a manufacturing process). The smaller the area S of the amorphous silicon (the subsidiary capacitance) is, the larger the aperture ratio of the liquid crystal cells C becomes. Therefore, the high-brightness liquid crystal panel A can be formed. The area of the subsidiary capacitance is preferably equal to or less than 10% of the area of the display electrode 122.

Figure 61:
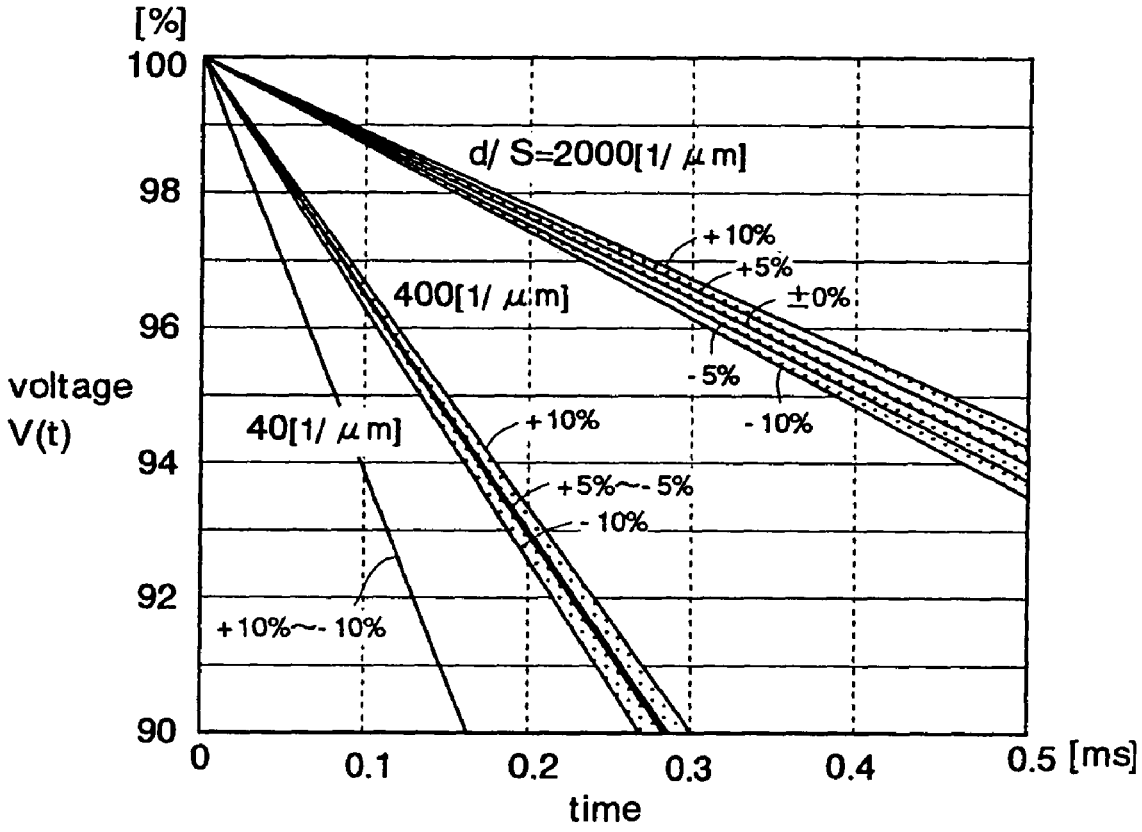
FIG. 61 shows changes in a supplied voltage in relation to a change in the layer thickness of the amorphous silicon.

FIG. 61 shows a change in the supplied voltage in relation to a change in thickness of the amorphous silicon. Generally, in a semiconductor manufacturing process, an approximately ±5% change in a layer thickness needs to be considered. Meanwhile, if the thickness change exceeds ±5%, unevenness may occur in the brightness of the liquid crystal panel A. In FIG. 61, an error in the CR time constant against the thickness change of ±5% is not observed when d/S<400[1/μm]. In other words, if d/S<400[1/μm], unevenness in the brightness of the liquid crystal panel A does not easily occur.

As has been described above, the liquid crystal display device in the present invention can carry out the impulse driving of the liquid crystal panel A by using a charge/discharge characteristic of the liquid crystal cells C, without using a special control circuit. As a result, blurring in a moving image can be alleviated and flicker is prevented.

In the above embodiment, the subsidiary capacitance is formed with amorphous silicon. However, the present invention is not limited to this example, and the subsidiary capacitance may be formed with a composite material of silicon nitride and carbonate silicon. At this time, the subsidiary capacitance may be formed by using a CVD method, using a mixture gas of silicon nitride and silicon carbonate. Alternatively, two layers formed with silicon nitride and silicon carbonate may be used. Furthermore, the subsidiary capacitance may be formed by placing a silicon nitride layer and a silicon carbonate layer adjacent to each other.

Furthermore, the liquid crystal display device may comprise a brightness correction circuit for adjusting a difference of brightness in the liquid crystal cells C in relation to a change in the layer thickness. In this case, uneven brightness is not observed if the layer thickness changes by more than ±5%.

The Twenty-sixth Embodiment of the Liquid Crystal Display Device

Figure 62:
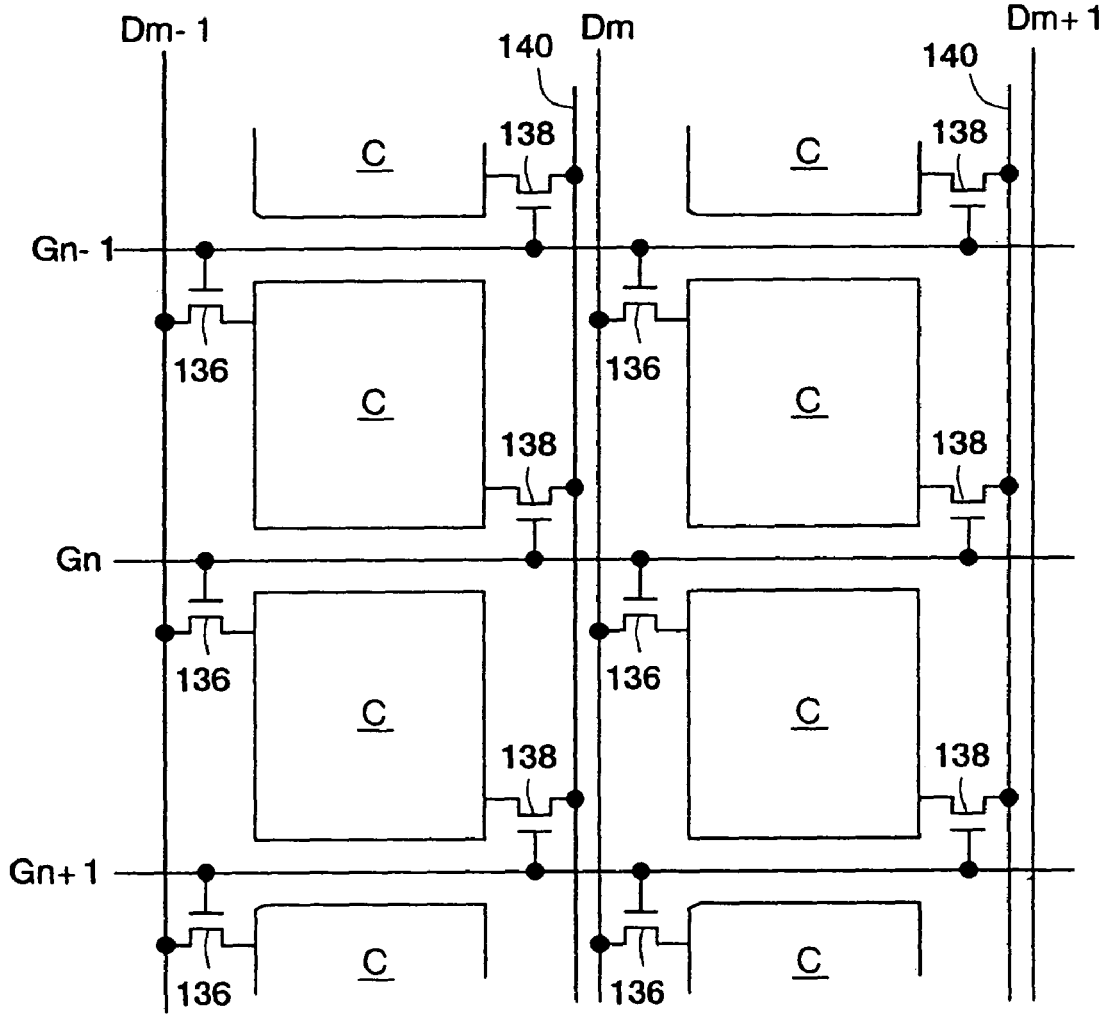
FIG. 62 is a block diagram showing a twenty-sixth embodiment of the liquid crystal display device of the present invention.

FIG. 62 shows in detail the penal A used in this embodiment. Configurations of a main portion of this device are almost the same as those shown in FIG. 54.

In this embodiment, elements corresponding to the elements described above for the twenty-fifth embodiment are given the same reference numerals and explanation of these elements is not repeated.

The liquid crystal panel A comprises the liquid crystal cells C laid out in the form of a matrix. The pixel electrode in each of the liquid crystal cells C is connected to source electrodes of two TFTs 136 and 138. A threshold voltage of the TFT 138 is set higher than that of the TFT 136. Drain electrodes of the TFTs 136 are connected to the signal lines. Drain electrodes of the TFTs 138 are connected to electrodes 140 to which a voltage corresponding to the reset data (black data) is supplied. The electrodes 140 are formed along the signal lines. Gate electrodes of the TFTs 138 are connected to a scanning line Gn+1 (a scanning line scanned after Gn) which is adjacent to the scanning line Gn controlling the TFTs 136 of the liquid crystal cells C to which the TFTs 138 are connected. In other words, the gate electrodes of the TFTs 136 and 138 connected to the liquid crystal cells C (pixel electrodes) adjacent to each other in the direction the scanning lines are connected to the same scanning line Gn. Since the number of the scanning lines is the same as in a conventional device, a penetrative efficiency of the liquid crystal panel A is prevented from decreasing.

In this embodiment, the mode of the liquid crystal panel A is normally black meaning that light penetrates through the liquid crystal panel when an electric field exists. The liquid crystal panel A may adopt liquid crystals having a fast response time, such as the VA (Vertical Alignment) type or the OCB (Optically Compensated Birefringence) type. The liquid crystal panel A may adopt a ferroelectric type, an antiferroelectric type, or the TN (Twisted Nematic) type.

Figure 63:
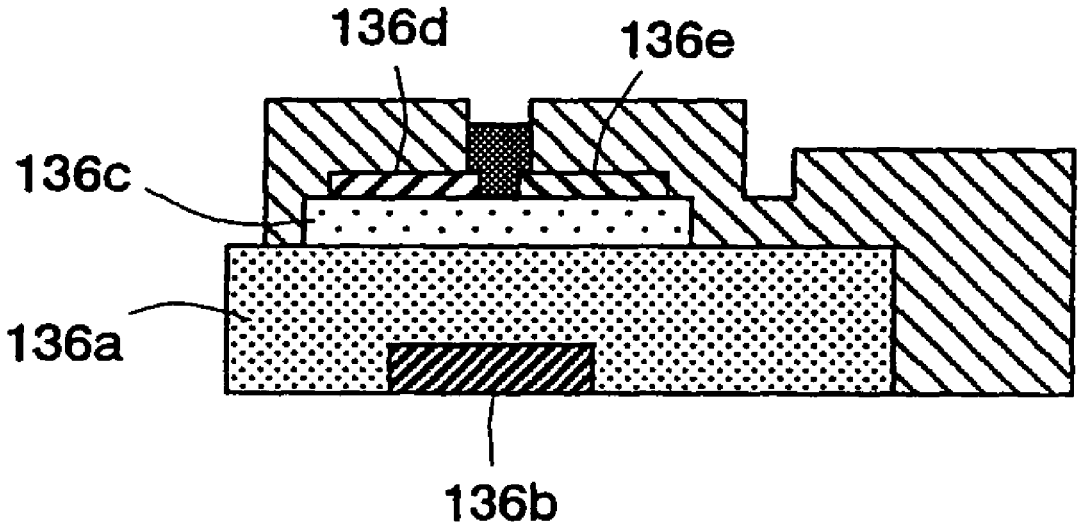
FIG. 63 is a cross-section showing a detailed structure of a TFT (Thin Film Transistor)

FIG. 63 shows a structure of the TFT 136. The TFT 138 has an almost the same structure.

The TFT 136 is formed by arranging a gate electrode 136*b* and a semiconductor layer 136*c* facing each other via a gate insulator 136*a* and by connecting a data electrode 136*d* (drain electrode) and a pixel electrode 136*e* (source electrode) to the semiconductor layer 136*c*.

The threshold voltages of the TFTs 136 and 138 are adjusted by changing the thickness of the gate insulator 136*a*. More specifically, the TFT 138 has the insulator layer thicker than the TFT 136. Like a general MOSFET, the threshold value can be adjusted by:

(1) changing the material of the gate insulator 136*a*

(2) changing the material of the semiconductor layer 136*c*

(3) changing an impurity concentration of the semiconductor layer 136*c*.

Figure 64:
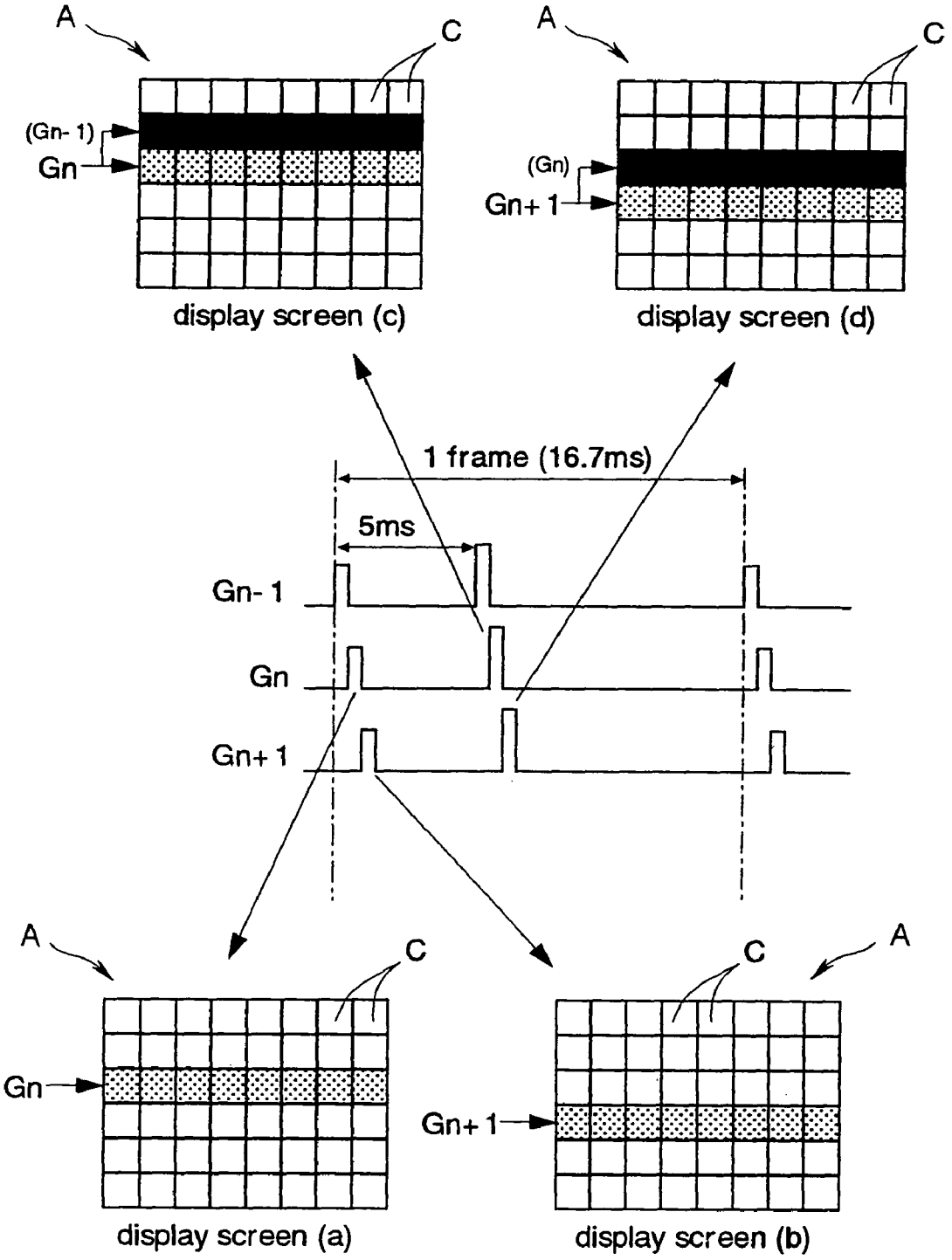
FIG. 64 shows an operation of a liquid crystal panel.

FIG. 64 shows an operation of the liquid crystal panel A.

In this embodiment, each of the scanning lines is scanned twice in one frame period (16.7 ms), and a line-sequential operation is carried out. The scanning lines are selected at a second time at a voltage higher than at a first time. More specifically, the voltage at which the scanning lines are selected at the first time is higher then the threshold voltage of the TFTs 136 and lower than that of the TFTs 138. The voltage at which the scanning lines are selected at a second time is higher than the threshold voltage of the TFT 138.

The scanning line Gn is selected first and display data are written in the liquid crystal cells C (a hatched portion of a display screen shown in FIG. 64(*a*)). The voltage of the scanning line Gn is lower than the threshold value of the TFT 138. Therefore, reset data are not written in the liquid crystal cells C. Display screens shown in FIGS. 64(*a*)~(*d*) show only changes in the liquid crystal cells C corresponding to the scanning line Gn.

The scanning line Gn+1 is then selected and display data are written in the liquid crystal cells C (a hatched portion of the display screen (b)).

5 ms after the selection of the scanning line Gn for the first time in one frame period, the second-time selection thereof (at the higher voltage) is carried out. At this time, the display data corresponding to another line are written in the liquid crystal cells C corresponding to the line Gn. At the same time, reset data (black data) are written in the liquid crystal cells C corresponding to the scanning line Gn−1 (a hatched portion and a black portion of the display screen (c).

A high voltage is then supplied to the scanning line Gn+1 and display data corresponding to another scanning line are written in the liquid crystal cells C corresponding to the line Gn+1. At the same time, the reset data (black data) are written in the liquid crystal cells C corresponding to the line Gn (a hatched portion and a black portion in the screen (d)). In other words, the invalid display data written in the liquid crystal cells C corresponding to the scanning line Gn in the screen (c) are overwritten with the black data.

As has been described above, in this embodiment, the impulse driving in which the display data and the reset data are written alternately can be carried out, without increasing the number of the scanning lines and without causing the control circuit to become complex. In this manner, blurring in a moving image can be alleviated and flicker is prevented.

The Twenty-seventh Embodiment of the Liquid Crystal Display Device

Figure 65:
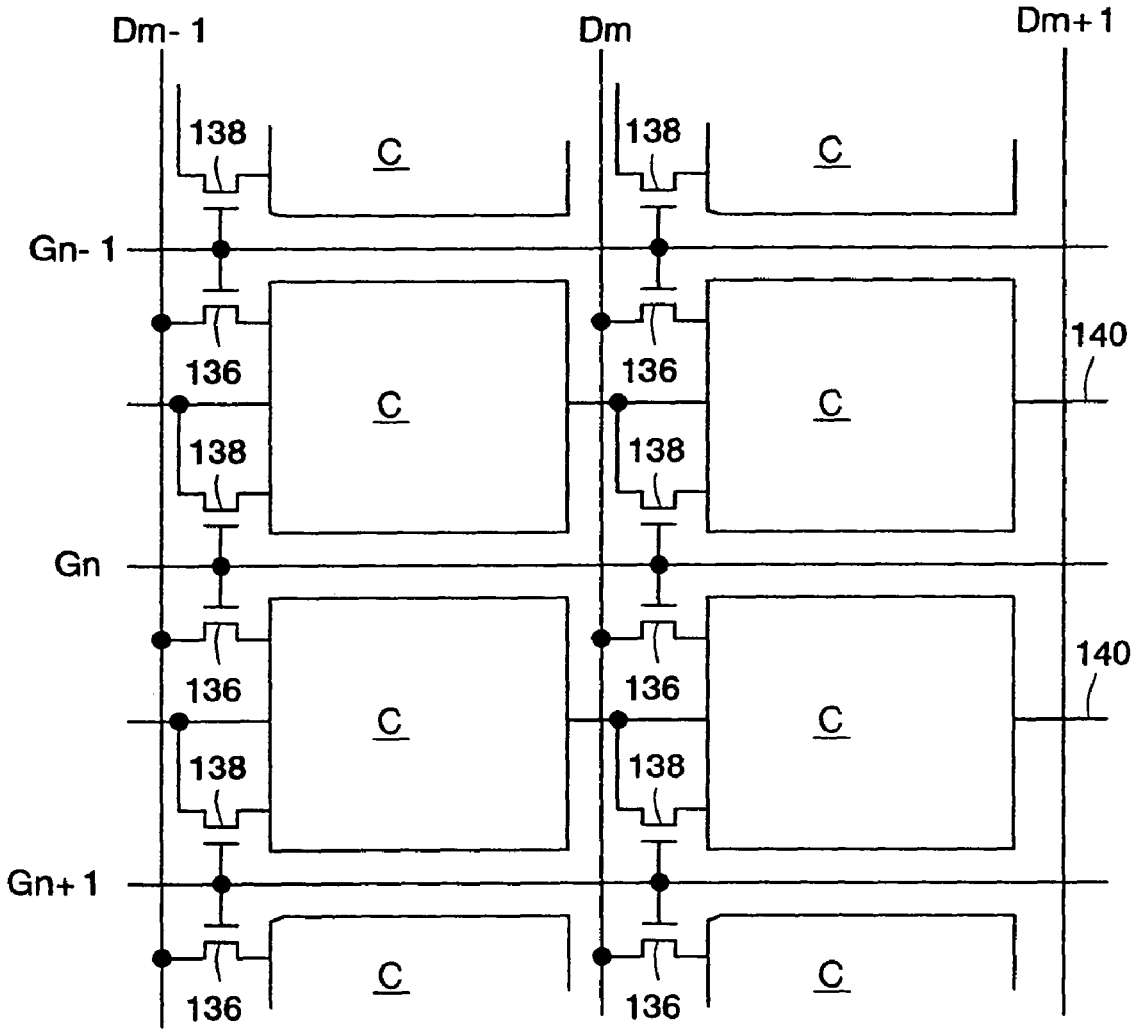
FIG. 65 is a block diagram showing a twenty-seventh embodiment of the liquid crystal display device of the present invention.

FIG. 65 shows the liquid crystal panel A used in this embodiment in detail. Configurations of a main portion of this device are the same as in FIG. 54.

In this embodiment, elements corresponding to the elements described above for the twenty-sixth embodiment are given the same reference numerals and explanation of these elements is not repeated.

In this embodiment, the electrodes 140 to which the voltage corresponding to the reset data (black data) is supplied are formed along the scanning lines. Configurations other than this are the same as those in the twenty-sixth embodiment.

In this embodiment, the same effect as by the twenty-sixth embodiment can be obtained.

Figure 66:
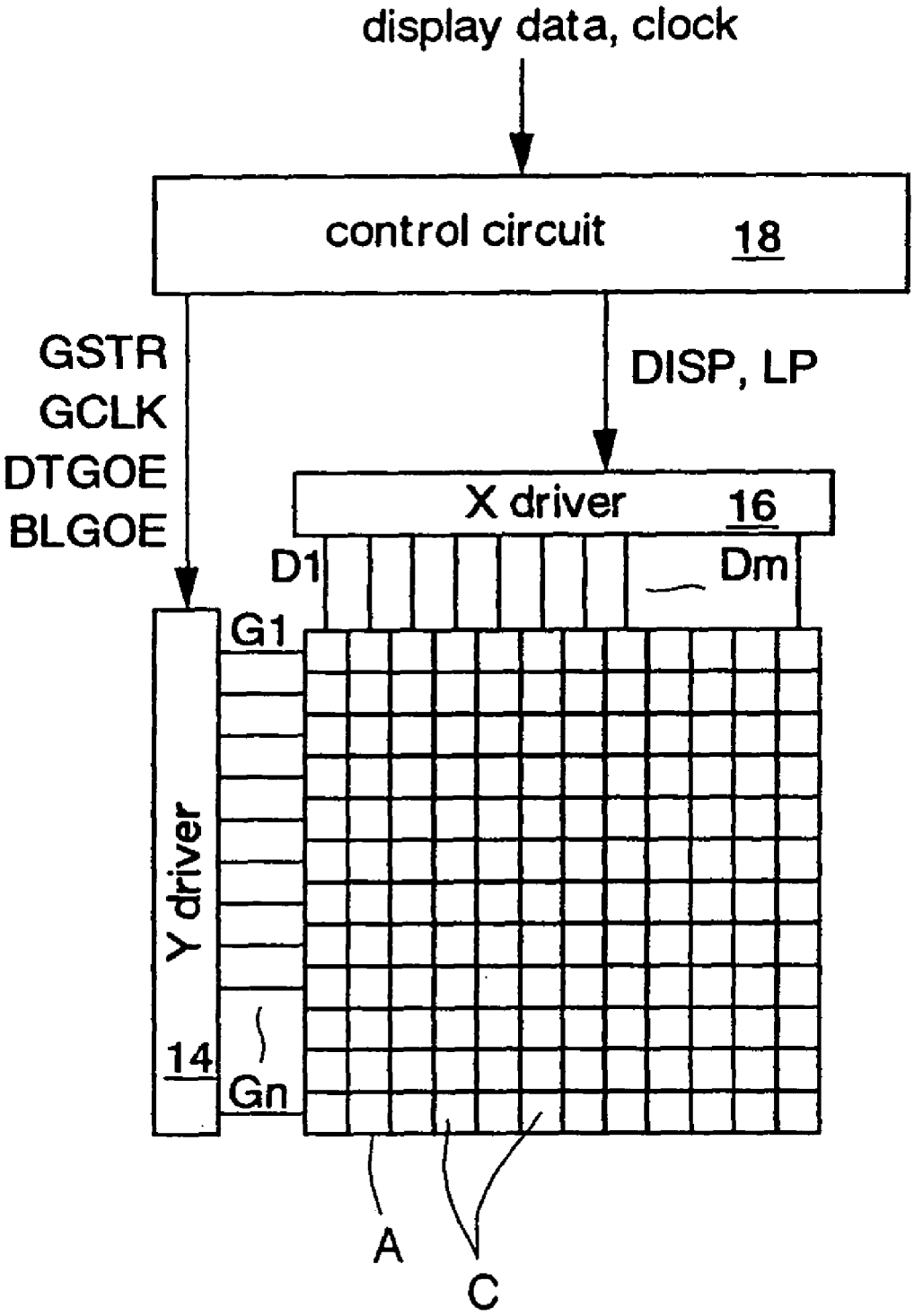
FIG. 66 is a block diagram showing a fourteenth embodiment of the liquid crystal display device controlling method of the present invention.

The Fourteenth Embodiment of the Liquid Crystal Display Device Controlling Method FIG. 66 shows an outline of the TFT (Thin Film Transistor) driving liquid crystal display device used in this embodiment.

In this embodiment, elements corresponding to the elements described above for the first embodiment are given the same reference numerals and explanation of these elements is not repeated.

The liquid crystal display device has the liquid crystal panel A comprising the TFTs and the liquid crystal cells C laid out in the form of a matrix. The scanning lines G1, G2, . . . , Gn are signal lines for transmitting gate signals output from the Y driver (gate driver) 14. The signal lines D1, D2, . . . , Dm are signal lines for transmitting data signals output from the X driver (data driver) 16. The X driver 14 and the Y driver 16 are controlled by the control circuit 18. The control circuit 18 receives display data and a clock signal from the exterior. The control circuit 18 outputs to the Y driver 14 a scan starting signal GSTR, a clock signal GCLK, a gate signal controlling signal DTGOE for writing display data, and a gate signal controlling signal BLGOE for writing reset data (black data). The control circuit 18 outputs to the X driver 16 display data DISP for one line, and a driver output controlling signal LP for controlling an output timing of the display data.

Figure 67:
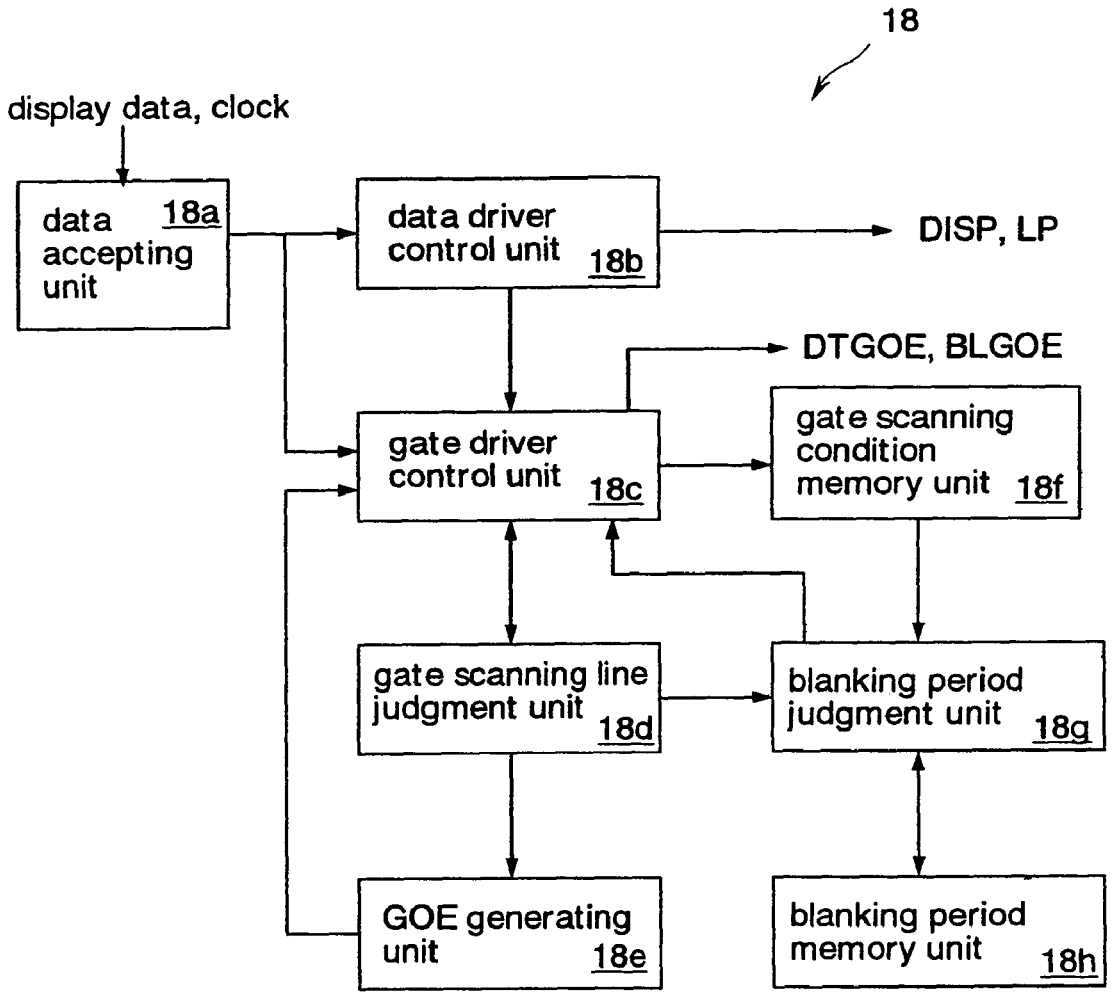
FIG. 67 is a block diagram showing a control circuit in detail.

FIG. 67 shows the control circuit 18 in detail.

The control circuit 18 comprises data receiving unit 18*a*, a data driver control unit 18*b*, a gate driver control unit 18*c*, a gate scanning line judgment unit 18*d*, a GOE generating unit

18*e*, a gate scanning condition memory unit 18*f*, a blanking period judgment unit 18*g*, and a blanking period memory unit 18*h*.

The data accepting unit 18*a* accepts the display data and the clock signal and outputs the accepted signals to the data driver control unit 18*b* and to the gate driver control unit 18*c*. The data driver control unit 18*b* generates the display data DISP and the driver output controlling signal LP. The gate driver control unit 18*c* receives the gate signal controlling signal DTGOE generated by the GOE generating unit 18*e* and a timing signal which the gate signal controlling signal BLGOE is based on. The gate driver control unit 18*c* outputs the gate signal controlling signal DTGOE and the gate signal controlling signal BLGOE. The gate scanning line judgment unit 18*d* detects a fact that ½ a frame has been scanned after a start of display data writing and causes the gate driver control unit 18*c* to output the gate signal controlling signal BLGOE for writing the black data.

The gate scanning condition memory unit 18*f* stores a scanning condition of the gate signals in an immediately proceeding frame. The blanking period judgment unit 18*g* counts how many times the gate signals can be scanned within a blanking period which is a period between scan of the last scanning line in which the display data are written and an end of one frame. The blanking period memory unit 18*h* stores the value counted by the blanking period judgment unit 18*g*.

After the scan of the last scanning line to write the display data, the gate driver control unit 18*c* and the data driver control unit 18*b* operate under control of the blanking period judgment unit 18*g* so that the black data are written a number of times according to the value stored in the blanking period memory unit 18*h*. Display of the liquid crystal panel A will be explained in detail with reference to FIG. 69.

Figure 68:
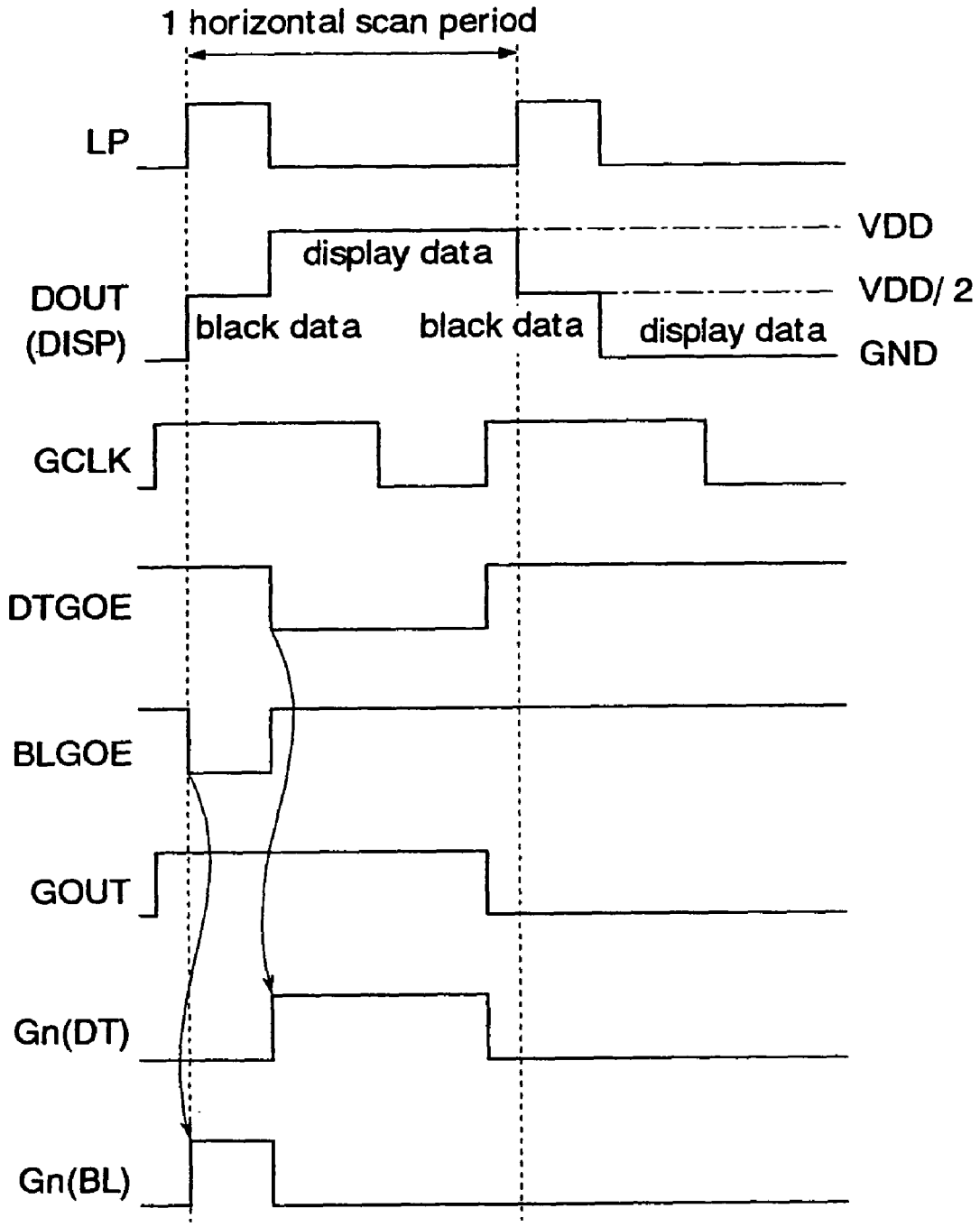
FIG. 68 is a timing chart showing an operation of the control circuit.

FIG. 68 shows an operation of the control circuit 18.

At the start of one horizontal scan period, the driver output controlling signal LP is output once. At the fall of the driver output controlling signal LP, display data DOUT are latched, and output for a period of the driver output controlling signal LP being low level. During a period in which the driver output controlling signal LP is high level, the black data DOUT are output. The voltage of the black data is set to be a central voltage (VDD/2) of an AC power source generating the display data.

The gate signal controlling signal DTGOE becomes low level while the driver output controlling signal LP is low level. The gate signal controlling signal BLGOE becomes low level during the time the driver output controlling signal LP is high level. A gate signal Gn(BL) for writing the black data is generated when a basic gate signal GOUT generated within the control circuit 18 is high level and the gate signal controlling signal BLGOE is low level at the same time. Likewise, the basic gate signal GOUT being high level and the gate signal controlling signal DTGOE being low level generate a gate signal Gn(DT) for writing the display data. In synchronization with the gate signal Gn(BL), the black data (DOUT) are written. The display data (DOUT) are written in synchronization with the gate signal Gn(DT) for writing. In other words, the control circuit 18 in this embodiment can output not only the display data but also the black data (2 values) in the one horizontal period.

Figure 69:
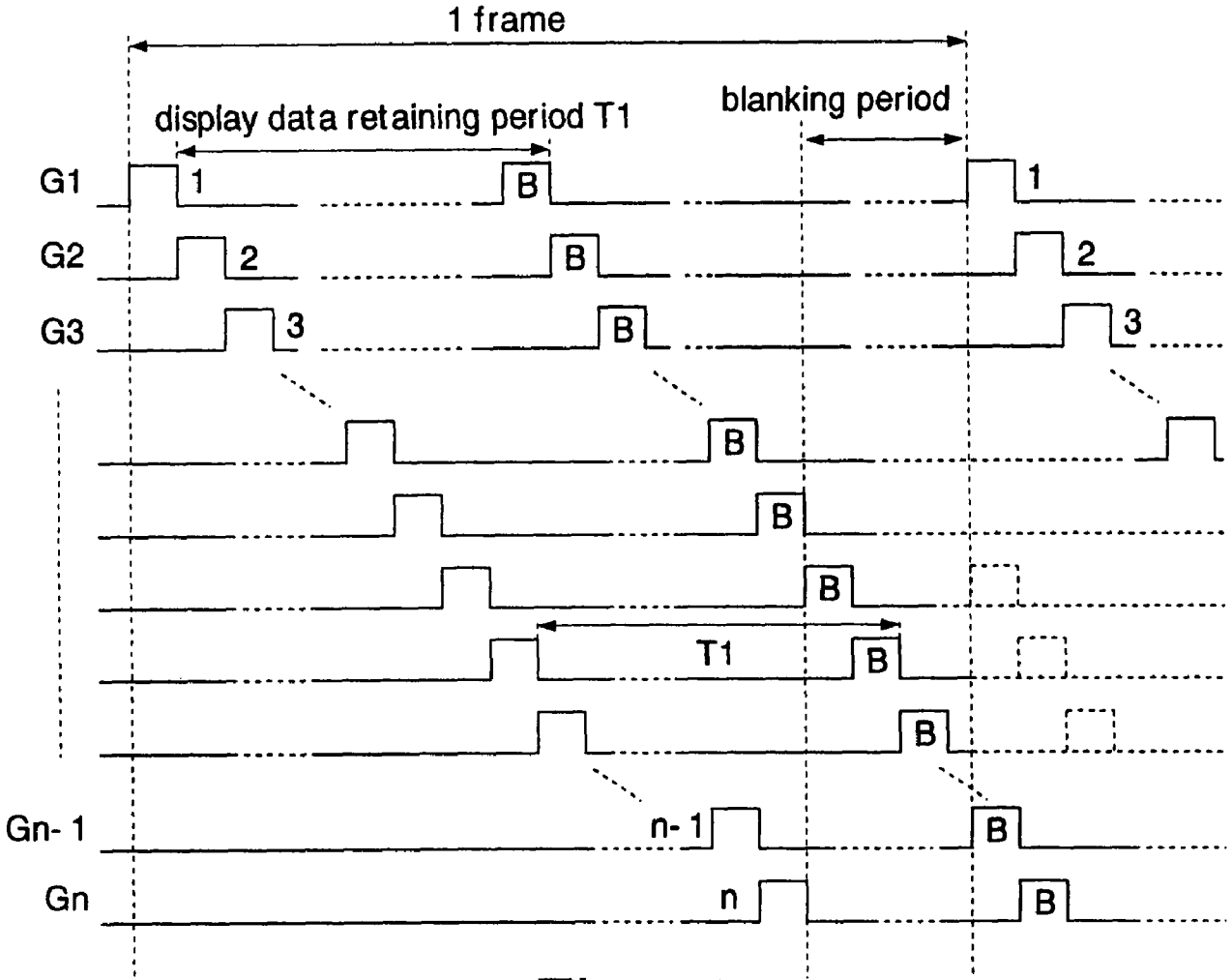
FIG. 69 is a timing chart showing an operation of a liquid crystal panel.

FIG. 69 shows an operation of the liquid crystal panel A.

The scanning lines are sequentially scanned in one frame period and display data are written. A ½ frame after the display data writing, the scanning lines are sequentially scanned again and the black data (B) are written. In other words, impulse driving is carried out. The black data are written by using the data DOUT output when the driver output controlling signal LP is high level, as has been described above.

The control circuit 18 sequentially scans the scanning lines in the blanking period and performs the black data writing control. Therefore, a display data retaining period T1 in which the display data are displayed is constant at all times.

Pulses shown by dashed lines are timings at which the black data are conventionally written. In this case, the display data retaining period T1 is different between an upper area and a lower area of the liquid crystal panel A.

Figure 70:
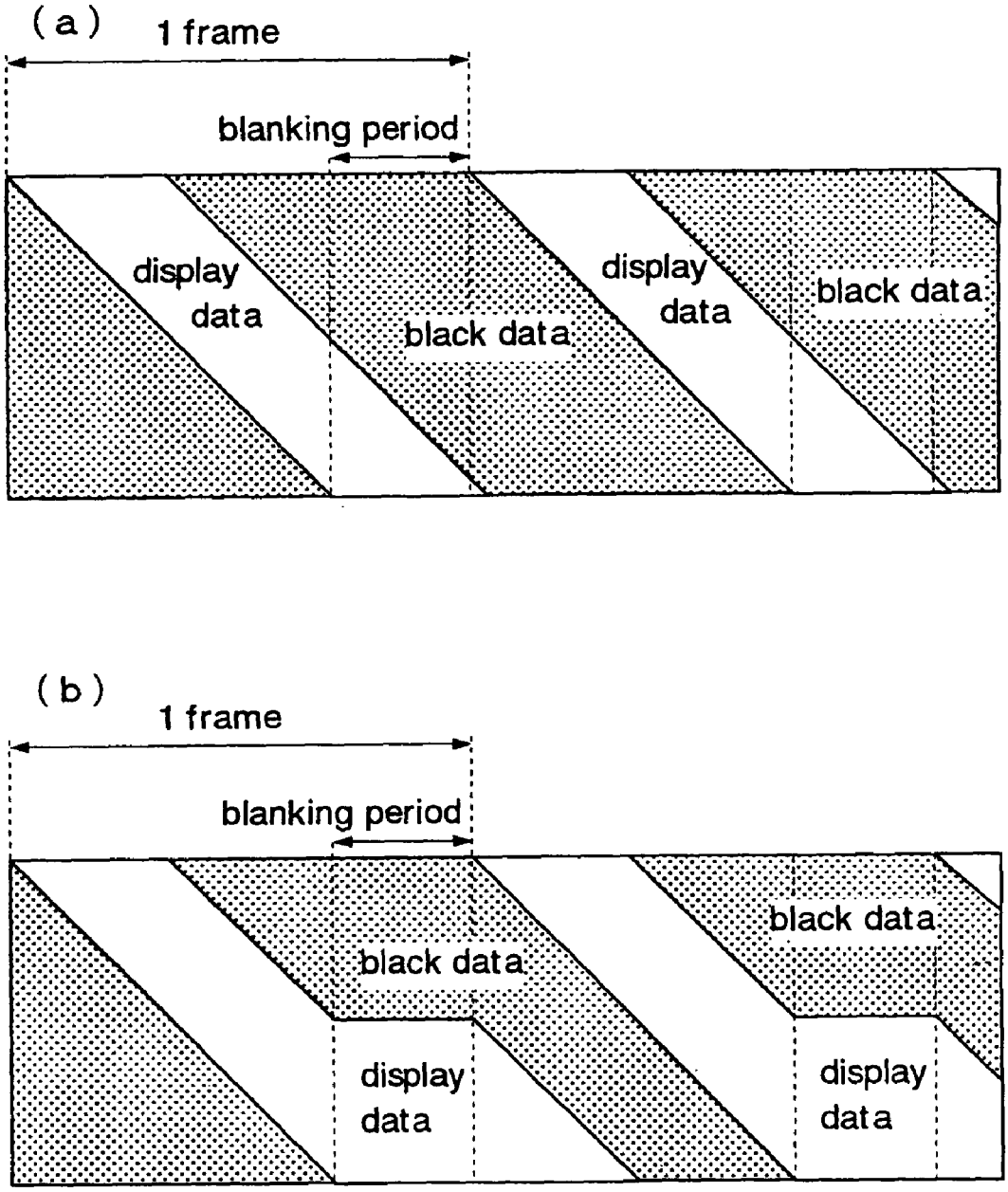
FIG. 70 shows an outline of display of the liquid crystal display device.

FIG. 70(*a*) shows an outline of the display of the liquid crystal display device to which the present invention has been applied. Display periods of the display data and the black data are always constant.

FIG. 70(*b*) shows an outline of the display of a conventional device. The display periods of the display data and the black data are different, marking a border at the center of the screen. Therefore, brightness becomes different in the lower and the upper areas of the screen, which means uneven display.

As has been described above, in the controlling method of the present invention, impulse driving is carried out in such a manner that the two values of the display data and the black data are output in the one horizontal period. Therefore, blurring in a moving image can be alleviated and flicker is prevented.

The black data are sequentially written in the blanking period. Therefore, brightness of the display data in the liquid crystal panel A can be uniform and uneven display is prevented from occurring.

Furthermore, a conventional data driver for generating the display data can be used as it is for carrying out the impulse driving.

Figure 71:
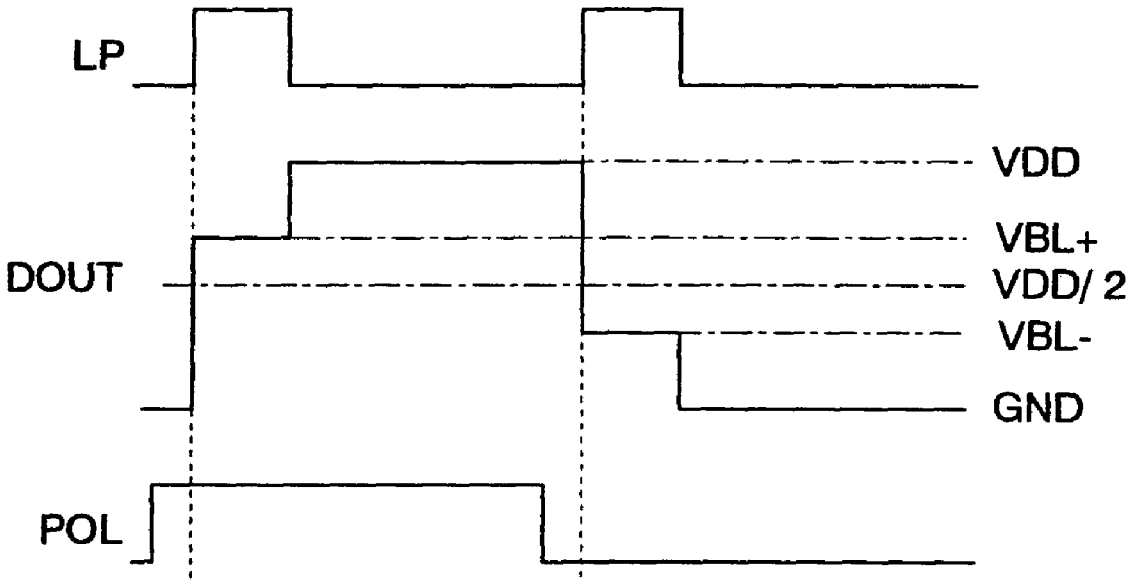
FIG. 71 is a timing chart showing a fifteenth embodiment of the liquid crystal display device controlling method of the present invention.

The Fifteenth Embodiment of the Liquid Crystal Display Device Controlling Method FIG. 71 shows an operation of the control circuit 18. Configurations of a main portion of the liquid crystal display device are the same as in FIG. 66.

In this embodiment, elements corresponding to the elements described above for FIG. 66 are given the same reference numerals and explanation of these elements is not repeated.

The control circuit 18 shifts the voltage of the black data from the central voltage (VDD/2) of the AC power source generating the display data to positive side or to negative side by VBL+ and VBL−, respectively. More specifically, the voltage of the black data is shifted to VBL+ and VBL− when a polarity selection signal POL is high level and low level, respectively. Operations other than this are the same as in FIG. 68.

In this embodiment, the same effect as by the fourteenth embodiment of the controlling method can be obtained. Furthermore, in this embodiment, the alternating current driving is carried out for the black data, which leads to secure display of the black data.

Figure 72:
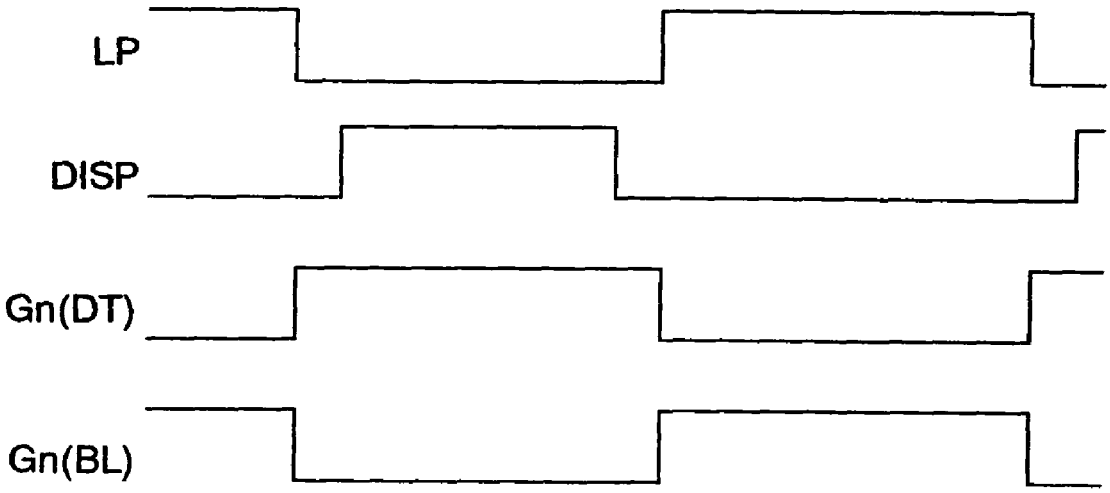
FIG. 72 is a timing chart showing a sixteenth embodiment of the liquid crystal display device controlling method of the present invention.

The Sixteenth Embodiment of the Liquid Crystal Display Device Controlling Method FIG. 72 shows an operation of the control circuit 18. Configurations of a main portion of the liquid crystal display device are the same as in FIG. 66.

In this embodiment, elements corresponding to the elements described above for FIG. 66 are given the same reference numerals and explanation of these elements is not repeated.

The control circuit 18 shortens an output period of the display data by shortening a low-level period of the driver output controlling signal LP. Since a high-level period of the driver output control signal LP becomes relatively longer, an output period of the black data becomes longer. Active periods of the gate signals Gn(DT) and Gn(BL) are the same. In this embodiment, the width of a gate pulse for writing the black data can be substantially long and the black data are written with certainty.

Since the display data output period becomes shorter, the display area for the display data are divided into two, one area in the right and the other area in the left. For each area, the scanning lines are scanned and the display data are displayed.

The Seventeenth Embodiment of the Liquid Crystal Display Device Controlling Method)

Figure 73:
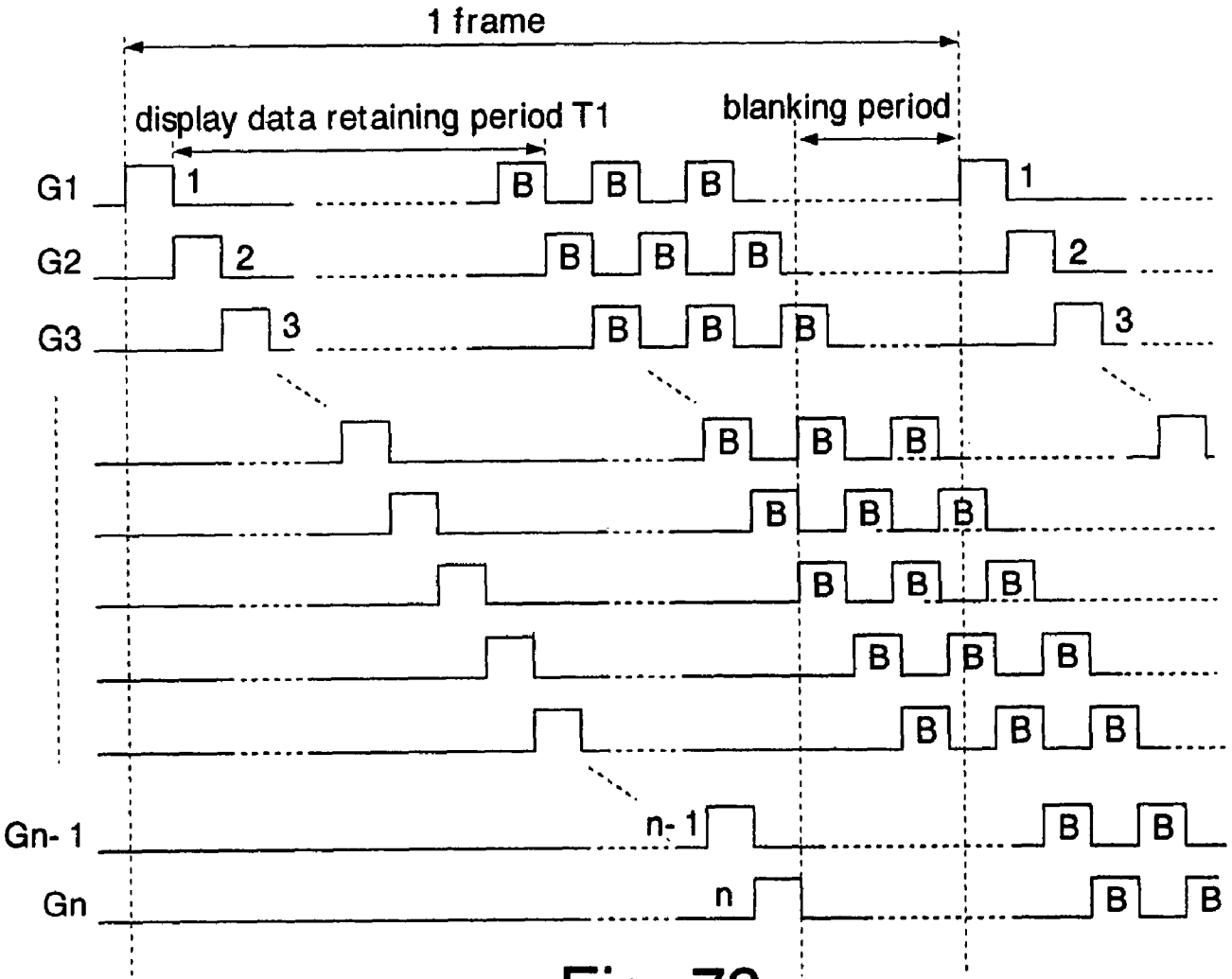
FIG. 73 is a timing chart showing a seventeenth embodiment of the liquid crystal display device controlling method of the present invention.

FIG. 73 shows an operation of the liquid crystal panel A. Configurations of a main portion of the liquid crystal display device are the same as in FIG. 66.

The control circuit 18 writes the black data a plurality of times in one frame period. In other words, black data writing is complemented. Therefore, the black data can be written with certainty.

In the fourteenth embodiment of the controlling method described above, the gate signal Gn(DT) for writing the display data is generated by using the basic gate signal GOUT and the gate signal controlling signal DTGOE. However, the present invention is not limited to this example, and the control may be simplified. The basic gate signal GOUT may be simply used as the gate signal Gn(DT), for example. In this case, the display data are written over the black data having been written in the pixel electrodes. This causes no problem on display quality.

In the sixteenth embodiment of the controlling method described above, the active periods of the gate signal Gn(DT) and the gate signal Gn(BL) are the same. However, the present invention is not limited to this example, and a ratio of the active period of the gate signal Gn(DT) to the active period of the gate signal Gn(BL) can be set arbitrarily.

The Twenty-eighth Embodiment of the Liquid Crystal Display Device

Figure 74:
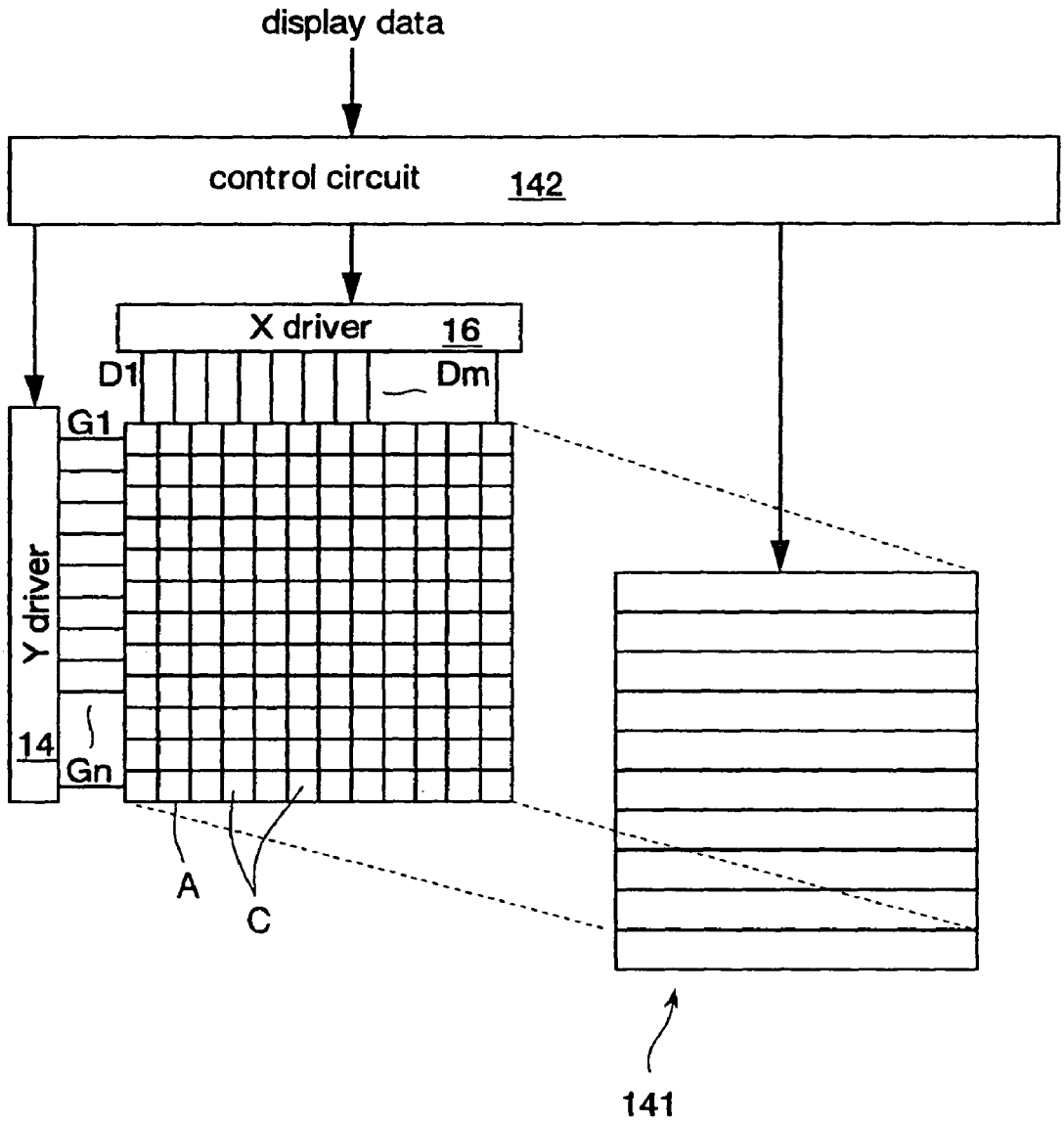
FIG. 74 is a block diagram showing a twenty-eighth embodiment of the liquid crystal display device of the present invention.

FIG. 74 shows an outline of the TFT (Thin Film Transistor) driving liquid crystal display device used in this embodiment.

In this embodiment, elements corresponding to the elements described above for the first embodiment are given the same reference numerals and explanation of these elements is not repeated.

The liquid crystal display device comprises the liquid crystal panel A having TFTs (not shown) and liquid crystal cells C laid out in the form of a matrix. The liquid crystal panel A is controlled by the X driver 16 and the Y driver 14. A backlight 141 is arranged on the backside of the liquid crystal panel A. The backlight 141 is formed with 10 cold cathode tubes (luminescent parts) laid out in parallel along the scanning lines. The X driver 16, the Y driver 14, and the backlight 141 are controlled by a control circuit 142. The driving frequency in this case is 60 Hz.

In this embodiment, the liquid crystal panel A adopts a TN (Twisted Nematic) type panel having a 2.2 μm liquid crystal layer thickness(15-inch panel, 1024×768 pixels). A dielectric constant $\epsilon$, a refractive index n, an N−1 transition temperature, and a response time $\tau m$ of these liquid crystals are −3.2, 0.2007, 70° C., and 14 ms, respectively. By sequentially turning on and off the cold cathode tubes of the backlight 141, impulse driving is carried out. A duty ratio which is a ratio of an on-state period of the light to one-frame period is 10%.

Figure 75:
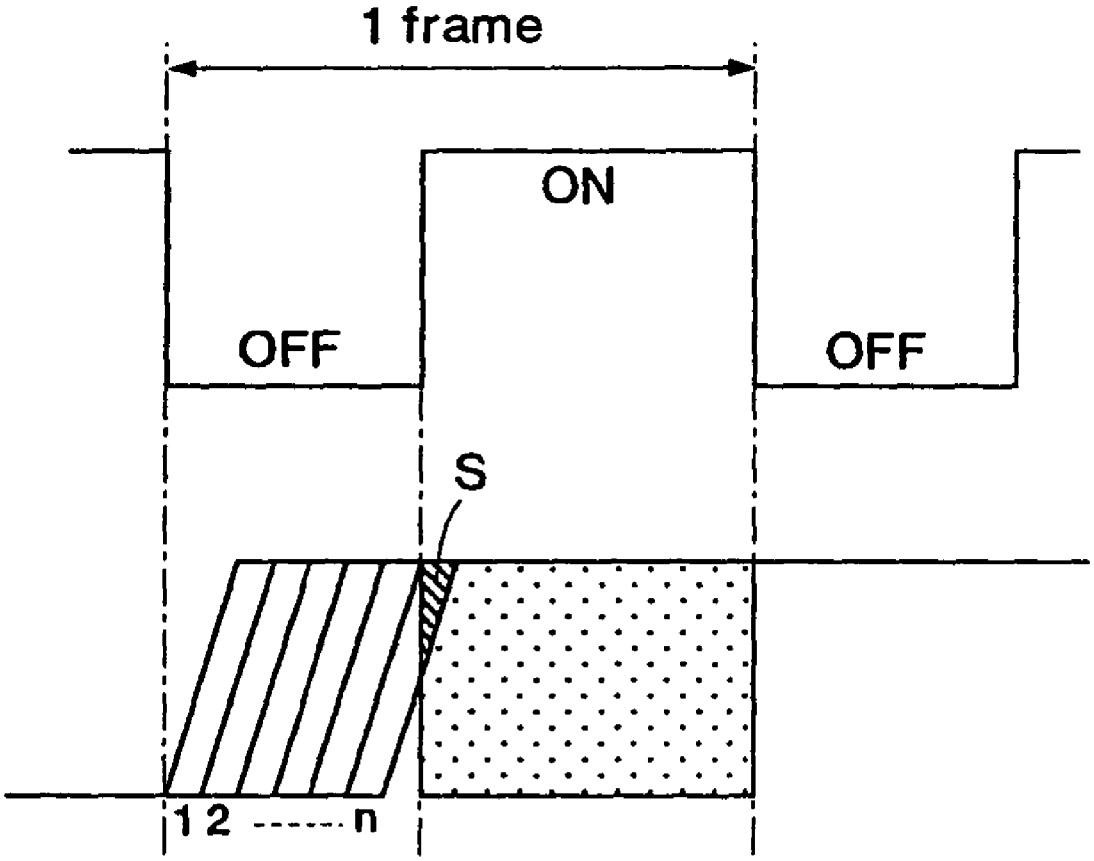
FIG. 75 shows a ground for determining each condition of the liquid crystal display device.

FIG. 75 shows a ground for determining conditions (the response time of the liquid crystal, the number of the cold cathode tubes, and the duty ratio) adopted in this embodiment.

Generally, when a change in brightness due to a transient response of the liquid crystal cells C after the luminescent parts such as the cold cathode tubes are turned on exceeds 5% of the brightness during the period in which the luminescent parts are on (a stippled portion in FIG. 75), it is said that ghosts appear in an image or blurring in the image becomes conspicuous. Therefore, if impulse driving, in which the scanning lines corresponding to the luminescent parts are scanned in the off-period of the luminescent parts (off in FIG. 75) and writing display data is started, is carried out, the brightness change of the liquid crystal cells C (a hatched area S in FIG. 75) occurring after the luminescent parts becomes on needs to be equal to or less than 5%.

Figure 76:
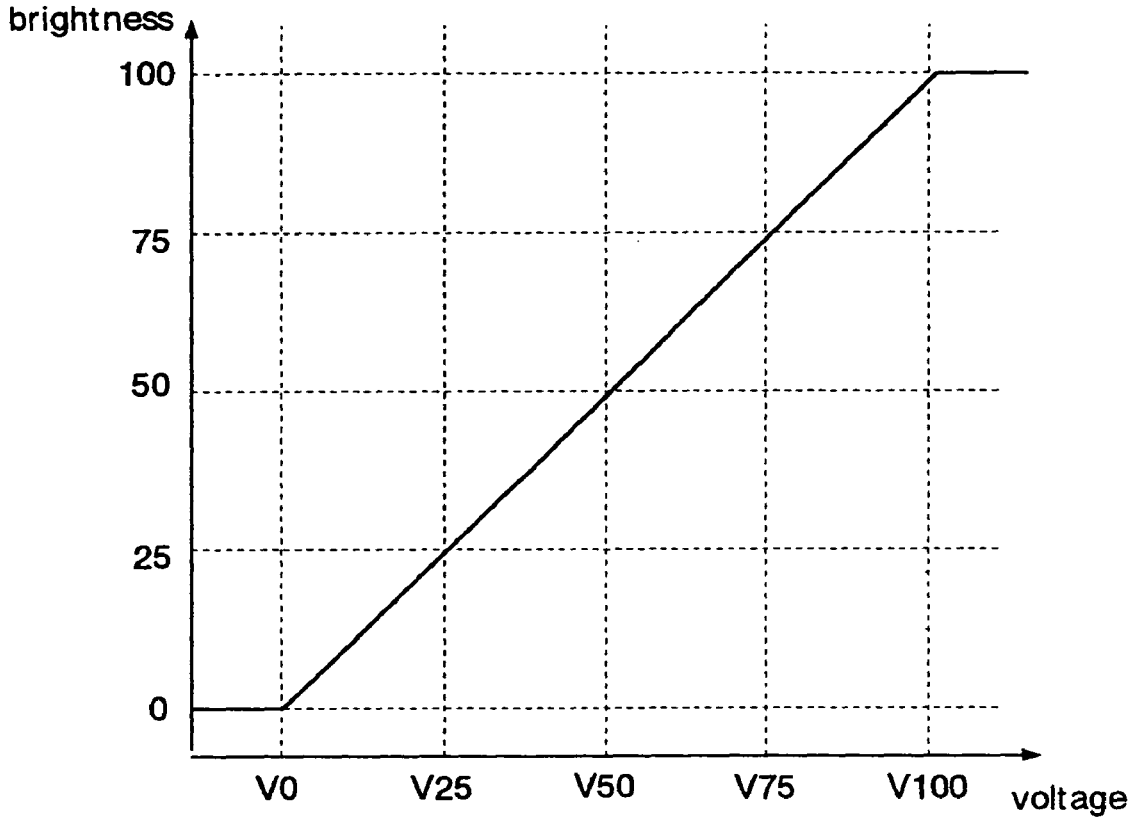
FIG. 76 shows a reference for the case of measuring a response time of a liquid crystal.

FIG. 76 shows a reference for measuring the response time of the liquid crystals.

Maximal and minimal brightness of the liquid crystals are set to 100 and 0 respectively, and voltages causing the brightness to be 0, 25, 50, 75, and 100 are defined as V0, V25, V50, V75, and V100. A maximum of the response time of these five voltages is defined as the response time of the liquid crystals. The response time is obtained by measuring the rise and the fall. The response time is also defined as the time at which 95% of a predetermined transmission ratio is obtained.

Figure 77:
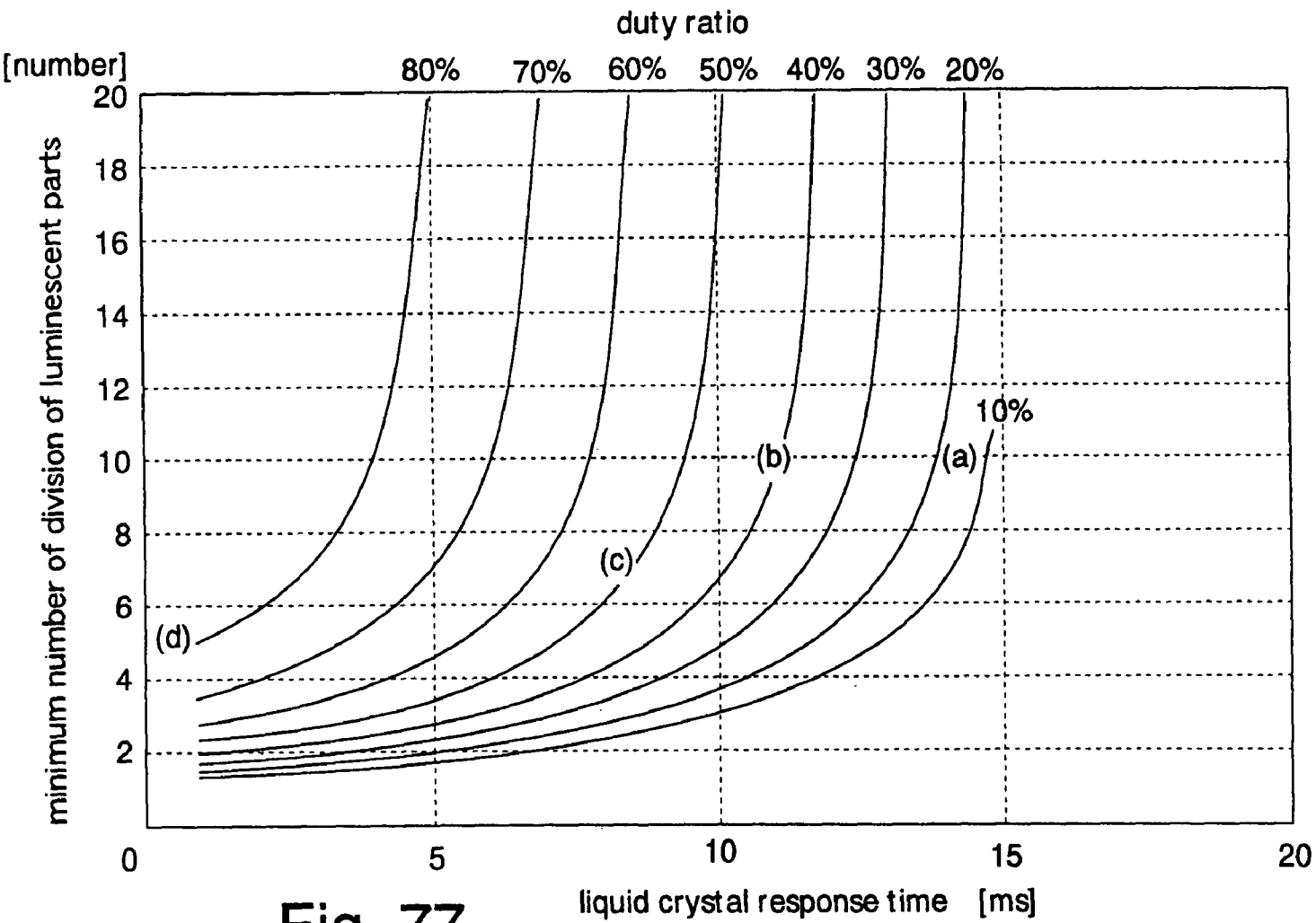
FIG. 77 shows conditions for not causing ghosts or blurring in an image.

FIG. 77 shows the conditions of the liquid crystal response time, the number of division of the luminescent parts (the number of the cold cathode tubes), and the duty ratio for not causing ghosts or blurring. FIG. 77 shows the case of one frame period being set to 16.7 ms. By dividing the horizontal axis by a frame time T, FIG. 77 becomes a graph not depending on time. In this case, even if one frame period T is different from 16.7 ms, FIG. 76 is also valid for a ratio of T to $\tau m$.

The conditions adopted in this embodiment are shown by FIG. 77(*a*). Problems such as ghosts occur when the adopted conditions are arranged in the lower right side of each curve. By using the conditions in this embodiment, ghosts do not appear even if the number of the cold cathode tubes is 7. In the case where the duty ratio is set to 20%, ghosts appear. In the case where the liquid crystals having a 14 ms response time is used and the duty ratio is set to 20%, the number of the cold cathode tubes needs to be 14 or more.

Likewise, if the liquid crystals having an 11 ms response time are used and the duty ratio is set to 40% or more, the number of the cold cathode tubes needs to be equal to or larger than 10 [FIG. 77(*b*)]. When liquid crystals having an 8 ms response time are used and the duty ratio is 50% or more, the number of the cold cathode tubes is 7 or more [FIG. 77(*c*)]. In the case where an anti-ferroelectric liquid crystals of thresholdless type having a 56 pC/cm2 spontaneous polarization, a 1.5 μm layer thickness, and a 0.55 ms response time are used and the duty ratio is set to 80%, the number of the cold cathode tubes needs to be 5 or more [FIG. 77(*d*)]. When the duty ratio is large, it is advantageous for improving the brightness.

As has been described above, in the liquid crystal display device in this embodiment, the number of the cold cathode tubes, the ratio of the on-period of the cold cathode tubes to one frame period (the duty ratio) and the response time of the liquid crystal cells C are determined so that the change in brightness due to the transient response of the liquid crystal cells C after turning on the cold cathode tubes becomes equal to or less than 5% of the brightness in the on-period of the cold cathode tubes. Therefore, ghosts and blurring in an image can be prevented.

The Twenty-ninth Embodiment of the Liquid Crystal Display Device

Figure 78:
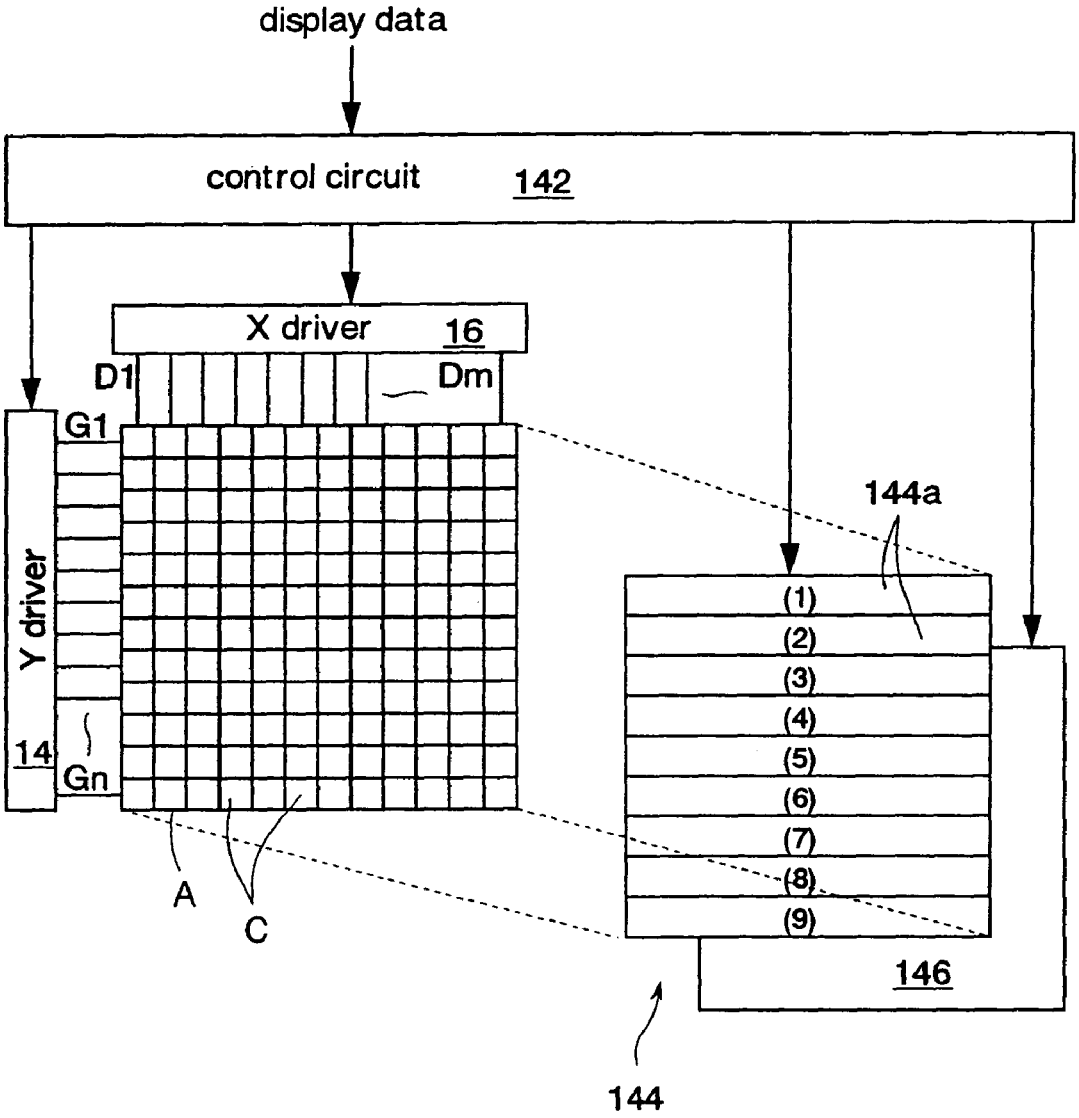
FIG. 78 is a block diagram showing a twenty-ninth embodiment of the liquid crystal display device of the present invention.

FIG. 78 shows an outline of the TFT (Thin Film Transistor) driving liquid crystal display device used in this embodiment.

In this embodiment, elements corresponding to the elements described above for the twenty-eighth embodiment are given the same reference numerals and explanation of these elements is not repeated.

In this embodiment, a backlight system is formed with a liquid crystal shutter 144 and a backlight 146 which is always on. The liquid crystal shutter 144 has transparent electrodes made of ITO (Indium Tin Oxide) divided into 9 areas along the scanning lines. The transparent electrodes form 9 areas 144*a*. By causing one or a plurality of the areas 144*a* to be in a penetrative state letting light from the backlight 146 penetrate through, a plurality of luminescent parts which will be explained later are formed. The backlight 146 has a function of emitting light including ultraviolet components. A phosphor covers an inner surface of the liquid crystal panel A, on the opposite side of the liquid crystal shutter 144. By the surface covered with the phosphor, a viewing angle of an image displayed on the liquid crystal panel A becomes larger and display data can be displayed at high brightness.

Figure 79:
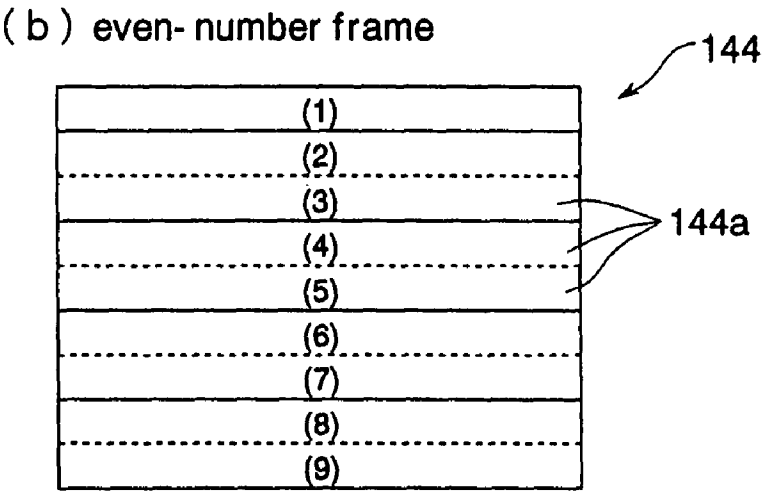
FIG. 79 shows how a luminescent part is formed.
Figure 79:
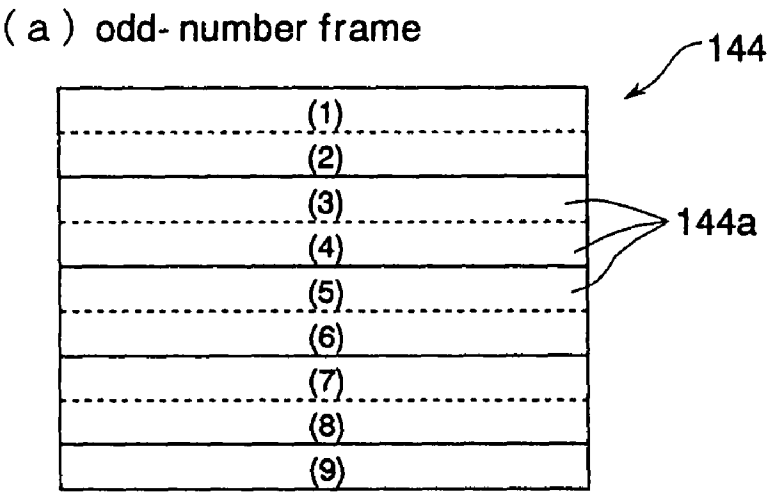

FIG. 79 shows how the luminescent parts are formed.

In an odd-number frame, every two areas 144*a* neighboring each other positioned up to the eighth area are in the penetrative state (become luminescent parts). The ninth area 144*a* is in the penetrative state (luminescent part) by itself. Within one frame period, five luminescent parts are sequentially turned on and off.

In an even-number frame, the first area 144*a* is in the penetrative state (luminescent part) by itself. Every two neighboring areas 144*a* between the second area and the ninth area are in the light penetrating state (luminescent parts). Within one frame period, these five luminescent parts are sequentially turned on and off. Positions of the boundaries of the luminescent parts are different between the odd-number frames and the even-number frames. By carrying out the impulse driving while moving the boundaries of the luminescent parts in every frame, the boundaries become inconspicuous.

In this embodiment, the OCB (Optically Compensated Birefringence) type liquid crystal having 7 ms response time is adopted and impulse driving is carried out by setting the duty ratio to 60%. These conditions satisfy FIG. 77 and no ghosts appear.

In this embodiment, the same effect as by the twenty-eighth embodiment can be obtained. Furthermore, in this embodiment, the luminescent part areas turned on at the same time change in every frame. Therefore, the boundaries become inconspicuous.

In the twenty-eighth embodiment described above, the liquid crystal panel A adopts the TN (Twisted Nematic) type panel. However, the present invention is not limited to this example, and the ferroelectric type, or liquid crystals having a fast response speed may be adopted for the liquid crystal panel A.

The Thirtieth Embodiment of the Liquid Crystal Display Device

Figure 80:
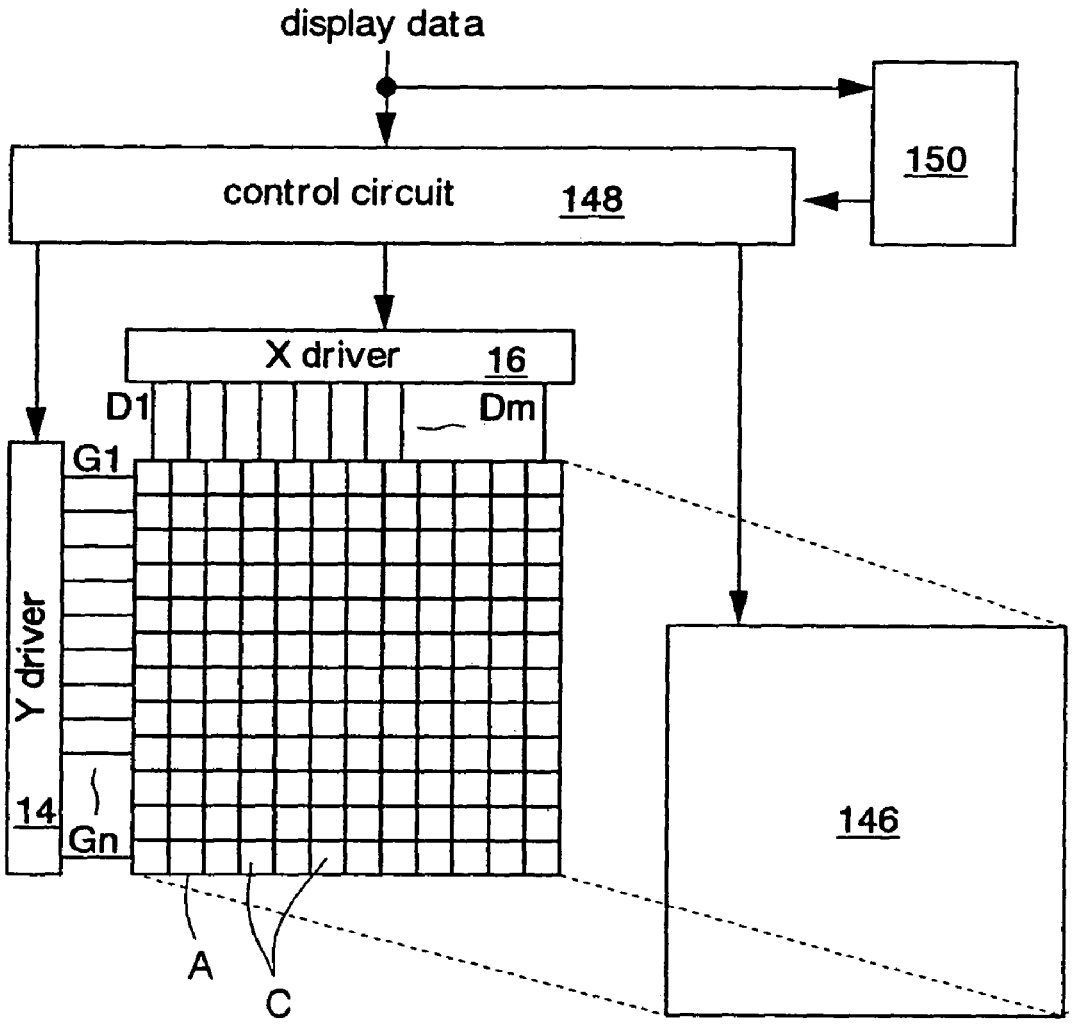
FIG. 80 is a block diagram showing a thirtieth embodiment of the liquid crystal display device of the present invention.

FIG. 80 shows an outline of the TFT (Thin Film Transistor) driving liquid crystal display device.

In this embodiment, elements corresponding to the elements described above for the twenty-eighth embodiment are given the same reference numerals and explanation of these elements is not repeated.

The liquid crystal display device comprises a control circuit 148 and an interpolating circuit 150 for carrying out motion compensation. The interpolating circuit 150 receives display data supplied from the exterior and carries out motion compensation to output estimate data to the control circuit 148. The liquid crystal panel A adopts a 15-inch VA (Vertical Alignment) type panel. The number of the pixels in the liquid crystal panel A is 1024×768. The dielectric constant E and the refractive index n of the liquid crystals are −3.8 and 0.0082, respectively. The backlight 146 is formed by cold cathode tubes repeatedly turning on and off at a 50% duty ratio. One frame period is 16.7 ms (60 Hz).

Figure 81:
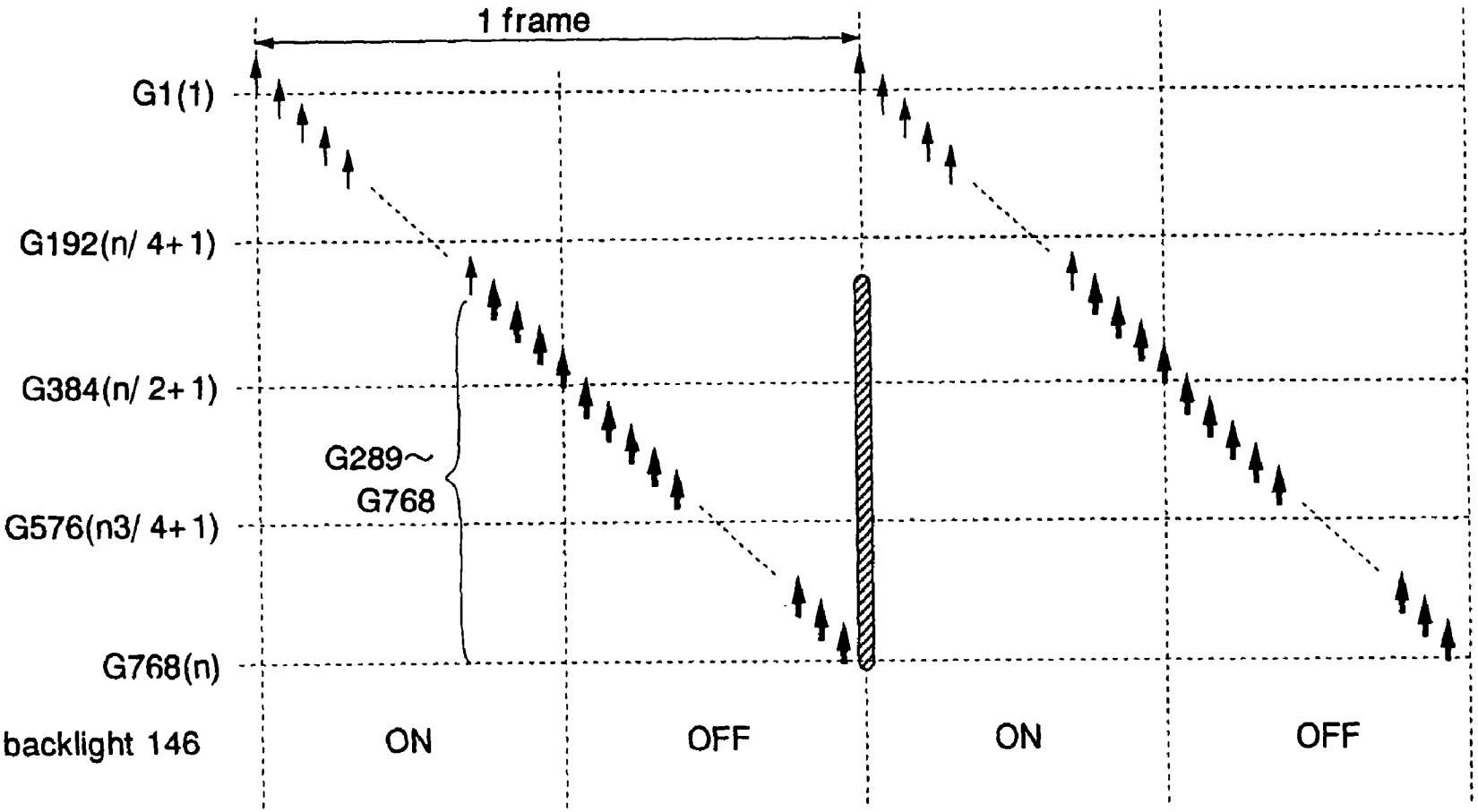
FIG. 81 is a block diagram showing an interpolating circuit in detail.

FIG. 81 shows an outline of an operation and motion compensation of the liquid crystal display device.

In this embodiment, the scanning lines Gn (768 lines) are sequentially scanned. The backlight 146 is turned on in the first half of one frame period and turned off in the latter half. In this manner, impulse driving is carried out. The backlight 146 is turned off at the time the scanning lines G384~G768 are scanned. The display data written in the liquid crystal cells C corresponding to the scanning lines G384~G768 are outputted to the exterior when the backlight 146 is turned on in a subsequent frame. The display data written in the scan of the scanning lines G289~G383 are outputted to the exterior in a short period during the backlight 146 is on in the current frame.

Therefore, in this embodiment, motion compensation is carried out on the display data written in the scanning lines G289~G768. Practically, the estimate data to be displayed at a start of the subsequent frame shown by a hatched area in FIG. 81 are written at the scan of the scanning lines G289~G768. The estimate data are calculated by interpolation using the display data in the frame and in the subsequent frame. The display data corresponding to the scan of the scanning lines G1~G288 are written as they are, without being interpolated.

Figure 82:
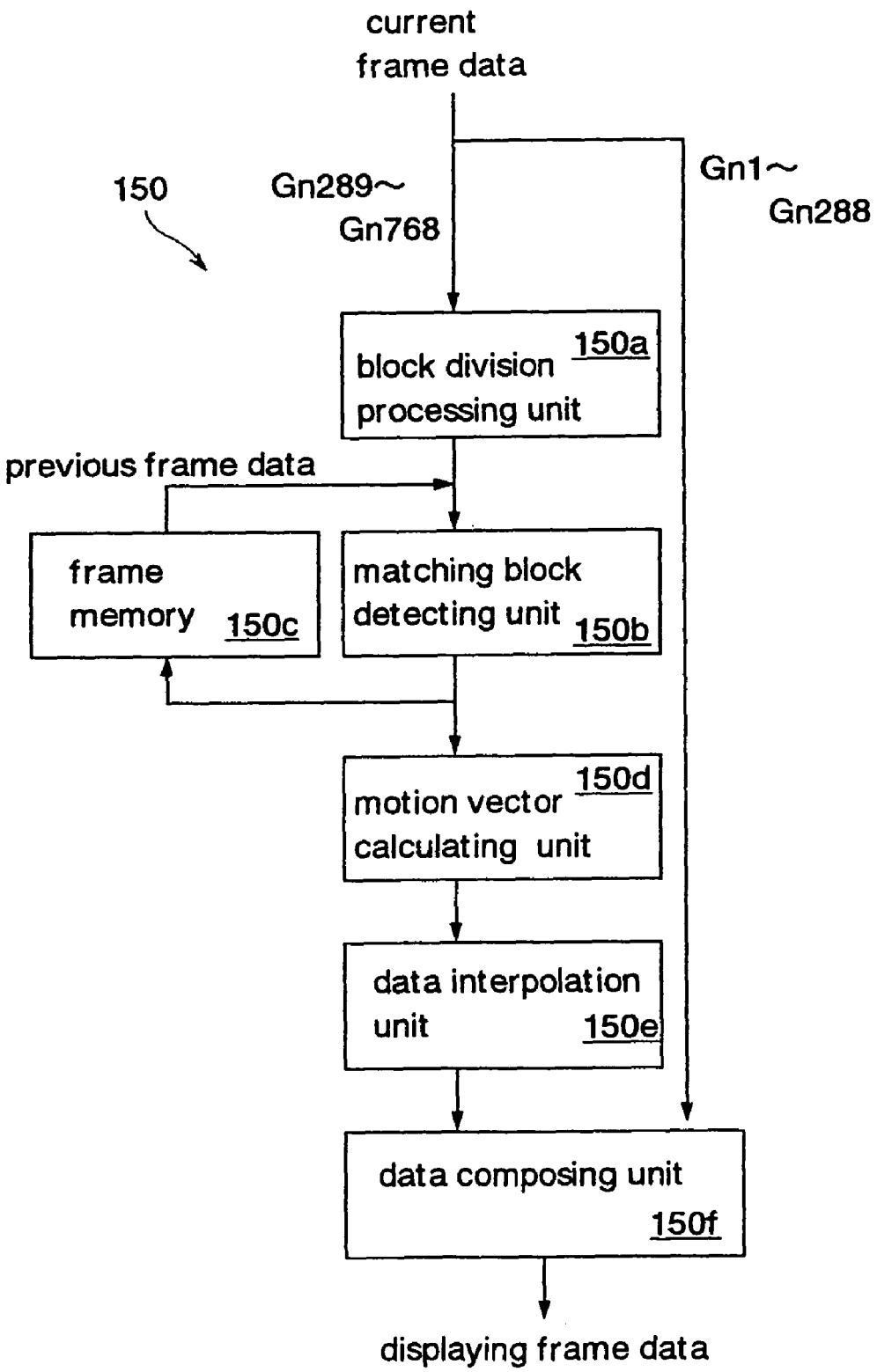
FIG. 82 shows an outline of an operation and motion compensation of the liquid crystal display device.

FIG. 82 shows the interpolating circuit 150 in detail.

The interpolating circuit 150 comprises a block division processing unit 150*a*, a matching block detecting unit 150*b*, a frame memory 150*c*, a motion vector calculating unit 150*d*, a data interpolation unit 150*e*, and a data composing unit 150*f*.

The block division processing unit 150*a* receives data of the current frame corresponding to the scanning lines G289~G768 and divides the liquid crystal panel A into 16×16 pixel regions. Motion compensation is carried out in each region.

The matching block detecting unit 150*b* compares the display data in the current frame and in the preceding frame in every region and detects to which region a predetermined region in the preceding frame has moved in the current frame.

The frame memory 150*c* stores display data for one frame.

The motion vector calculating unit 150*d* calculates the motion vector for each region by using a technique generally called block matching.

The data interpolation unit 150*e* carries out interior division of the motion vector in a predetermined ratio for each of the scanning lines Gn and finds the estimate data. The ratio of the interior division is determined according to time between the scan of the scanning line Gn and the backlight's becoming on in the subsequent frame.

The data composing unit 150*f* composes the estimate data corresponding to the scanning lines G289~G768 and the display data corresponding to the scanning lines G1~G288, and outputs the composed data as frame data to be displayed.

As shown in FIG. 81, the estimate data to be displayed in the subsequent frame shown by the hatched area are written at the scan of the scanning lines G289~G768. As a result, blurring or awkward motion in a moving image can be prevented. In other words, moving image quality is improved.

In the thirtieth embodiment described above, the VA (Vertical Alignment) type panel is adopted for the liquid crystal panel A. However, the present invention is not limited to the above example, and an OCB (Optically Compensated Birefringence) type, a ferroelectric type, or an anti-ferroelectric type may be used, for example.

In the thirtieth embodiment described above, impulse driving is carried out by turning on and off the backlight 146. However, the present invention is not limited to this example, and impulse driving may be carried out by controlling a backlight system comprising a backlight and a liquid crystal shutter. In this case, it is preferable for the liquid crystals used for the liquid crystal shutter to be of a VA (Vertical Alignment) type, or an OCB (Optically Compensated Birefringence) type, or a ferroelectric type, or an anti-ferroelectric type.

In the thirtieth embodiment described above, the backlight 146 is turned on and off at the 50% duty ratio. The smaller the duty ratio is, the darker the screen becomes. In order to improve moving image quality, the backlight 146 is preferably turned on and off at the 50% duty ratio or less.

The invention is not limited to the above embodiments and various modifications may be made without departing from the spirit and scope of the invention. Any improvement may be made in part or all of the components.

What is claimed is:

1. A liquid crystal display device comprising:

a liquid crystal panel with pixels in which a plurality of signal lines for transmitting display data and a plurality of scanning lines for transmitting control signals are laid out vertically and horizontally, said pixels are all driven with a same frame rate and pixel electrodes are arranged at intersections of said signal lines and said scanning lines via switching elements; and a control circuit for controlling said liquid crystal panel via said signal lines and said scanning lines, and for performing impulse driving to activate said control signals, which are to be transmitted to each of said scanning lines, during one frame period for displaying one image, wherein:

said one image is divided into a first partial image and a second partial image, said one frame period is divided into a first partial frame period during which said first partial image is displayed and a second partial frame period during which said second partial image is displayed, said control circuit activates said control signals one time per one scanning line and per one partial frame period, said liquid crystal panel is divided into first pixel regions for displaying said first partial image and second pixel regions adjacent to said first pixel regions for displaying the second partial image;

said display data are written in said first pixel regions and reset data are written in said second pixel regions, when said control signals are activated during the first partial frame period, and said reset data are written in said first pixel regions and said display data are written in said second pixel regions, when said control signals are activated during the second partial frame period.

2. A liquid crystal display device according to claim 1, wherein said first pixel regions and said second pixel regions are divided in the form of stripes along said scanning lines.

3. A liquid crystal display device according to claim 1, wherein the first pixel regions and the second pixel regions are divided in lattice-like form.

4. A liquid crystal display device according to claim 1, further comprising backlights on the backside of the liquid crystal panel, each facing said first pixel regions and said second pixel regions, respectively, wherein each of said backlights is turned on in synchronization with writing said display data in said first pixel regions and in said second pixel regions, and each of said backlights is turned off in synchronization with writing said reset data in said first pixel regions and in said second pixel regions.

5. A liquid crystal display device according to claim 4, wherein said backlights comprise light-emitting diodes, or fluorescent tubes, or a plasma display panel.

6. A liquid crystal display device according to claim 4, wherein:

said backlights comprise fluorescent tubes;

said one frame cycle is adjusted in accordance with a cycle of an alternating current signal supplied to the fluorescent tubes; and said display data is written in accordance with the peak of brightness of said fluorescent tubes.

7. A liquid crystal display device according to claim 1, wherein light guide plates are arranged on the backside of said liquid crystal panel, each facing said first pixel regions and said second pixel regions, and a fluorescent tube is arranged at one end of each of said light guide plates.

8. A liquid crystal display device according to claim 1, wherein:

said control circuit receives said display data for one image per frame;

writes a portion of said display data in said first pixel regions when said control signals are activated at once of said two times; and writes the remaining display data in said second pixel regions when said control signals are activated the other time of said two times.

9. A liquid crystal display device according to claim 1, having a hold driving function for activating each of said control signals once in said one frame period and writing said display data in all said pixel electrodes, and wherein said control circuit controls switching between said hold driving to said impulse driving, depending on an image to be displayed.

10. A liquid crystal display device according to claim 9, comprising:

a backlight in which brightness can be adjusted arranged on the backside of said liquid crystal panel, and wherein said impulse driving is carried out by increasing brightness of said backlight.

11. A liquid crystal display device according to claim 9, wherein gamma correction is carried out during said impulse driving and during said hold driving, and said gamma correction during said impulse driving is carried out more rapidly than said gamma correction during said hold driving.

12. A liquid crystal display device according to claim 1, wherein said control circuit selects said scanning lines according to an order the scanning lines are arranged in.

13. A liquid crystal display device according to claim 1, wherein said control circuit selects said scanning lines according to a predetermined order which is not related to an order said scanning lines are arranged in.

14. A liquid crystal display device according to claim 13, wherein said first pixel regions and said second pixel regions are divided, each including a plurality of said scanning lines, and said control circuit selects said scanning lines according to the order said scanning lines are arranged in, in said first pixel regions and said second pixel regions.

15. A liquid crystal display device according to claim 1, further comprising:

plural scanning-line groups, each of which consists of a predetermined number, which is at least one, of the scanning lines adjacent to each other, wherein the first and second pixel regions are distributed per one scanning-line group.

16. A liquid crystal display device according to claim 1, wherein the first and second pixel regions are distributed per one scanning line.

17. A liquid crystal display device according to claim 1, wherein there are at least two first pixel regions and at least two second pixel regions.

18. A liquid crystal display device according to claim 17, wherein a number of the first pixel regions and a number of the second pixel regions are the same.

19. A liquid crystal display device according to claim 18, wherein a total area of the first pixel regions and a total area of the second pixel regions are the same.

20. A liquid crystal display device according to claim 1, wherein at most two regions among the first and second pixel regions which are adjacent to each other display the display data.

21. A liquid crystal display device according to claim 1, wherein the reset data is a data indicative of a constant luminance irrelevant to the display data.

22. A liquid crystal display device according to claim 21, wherein the reset data is a black data.

23. A liquid crystal display device according to claim 1, wherein the control circuit comprises only one source driver and only one gate driver.

24. A method of controlling a liquid crystal display device, the device comprising:

a liquid crystal panel with pixels in which a plurality of signal lines for transmitting display data and a plurality of scanning lines for transmitting control signals are laid out vertically and horizontally, said pixels are all driven with a same frame rate, and pixel electrodes are arranged at intersections of the signal lines and the scanning lines via switching elements;

a control circuit for controlling said liquid crystal panel via said signal lines and said scanning lines, and for performing impulse driving to activate said control signals, which are to be transmitted to each of said scanning lines, during one frame period for displaying one image, wherein:

said one image is divided into a first partial image and a second partial image, said one frame period is divided into a first partial frame period during which said first partial image is displayed and a second partial frame period during which said second partial image is displayed; and a liquid crystal panel divided into first pixel regions for displaying said first partial image and second pixel regions adjacent to the first pixel regions for displaying said second partial regions, the method comprising the steps: of performing impulse driving for activating said control signals one time per one scanning line and per one partial frame period;

writing said display data in said first pixel regions and writing reset data in said second pixel regions respectively when said control signals are activated during the first partial frame period; and writing said reset data in said first pixel regions and writing said display data in said second pixel regions, when said control signals are activated during the second partial frame period.

25. A liquid crystal display device controlling method according to claim 24, further comprising the step of:

turning on backlights on the backside of said liquid crystal panel each facing said first pixel regions and said second pixel regions, respectively, in synchronization with writing said display data in said first pixel regions and in said second pixel regions; and turning off each of said backlights in synchronization with writing reset data in said first pixel regions and in said second pixel regions.

26. A liquid crystal display device controlling method according to claim 25, the device comprising said backlights being formed with fluorescent tubes, said device controlling method further comprising the steps of:

adjusting said one frame cycle in accordance with a cycle of an alternating current signal supplied to said fluorescent tubes; and writing said display data in accordance with the peak of brightness of said fluorescent tubes.

27. A liquid crystal display device controlling method according to claim 24, further comprising the steps of:

receiving said display data for one image per frame; and writing a portion of said display data in said first pixel regions when said control signals are activated once of the two times, and writing the remaining display data in said second pixel regions when said control signals are activated the other time of the two times.

28. A liquid crystal display device controlling method according to claim 24, the device having a hold driving function in which each of said control signals is activated once in one frame period and said display data are written in all said pixel electrodes, the method further comprising the step of controlling switching between said hold driving and said impulse driving depending on an image to be displayed.

29. A liquid crystal display device controlling method according to claim 28, further comprising the step of increasing brightness of a backlight arranged on a backside of said liquid crystal panel, having adjustable brightness, when said impulse driving is performed.

30. A liquid crystal display device controlling method according to claim 28, further comprising the step of carrying out gamma correction during impulse driving and during said hold driving, wherein said gamma correction is carried out more rapidly during said impulse driving than during said hold driving.

31. A liquid crystal display device controlling method according to claim 24, further comprising the step of selecting said scanning lines according to an order said scanning lines are arranged in.

32. A liquid crystal display device controlling method according to claim 24, further comprising the step of selecting the scanning lines according to a predetermined order which is not related to an order said scanning lines are arranged in.

33. A liquid crystal display device controlling method according to claim 32, the device comprising said first pixel regions and said second pixel regions divided, including a plurality of said scanning lines, further comprising the step of selecting said scanning lines in said first pixel regions and in said second pixel regions according to the order said scanning lines are arranged in.

34. A liquid crystal display device controlling method according to claim 24, the device further comprising:

plural scanning-line groups, each of which consists of a predetermined number, which is at least one, of the scanning lines adjacent to each other, wherein the first and second pixel regions are distributed per one scanning-line group.

35. A liquid crystal display device controlling method according to claim 24, wherein the first and second pixel regions are distributed per one scanning line.

36. A liquid crystal display device controlling method according to claim 24, wherein there are at least two first pixel regions and at least two second pixel regions.

37. A liquid crystal display device controlling method according to claim 36, wherein a number of the first pixel regions and a number of the second pixel regions are the same.

38. A liquid crystal display device controlling method according to claim 37, wherein a total area of the first pixel regions and a total area of the second pixel regions are the same.

39. A liquid crystal display device controlling method according to claim 24, wherein at most two regions among the first and second pixel regions which are adjacent to each other display the display data.

40. A liquid crystal display device controlling method according to claim 24, wherein the reset data is a data indicative of a constant luminance irrelevant to the display data.

41. A liquid crystal display device controlling method according to claim 40, wherein the reset data is a black data.

42. A liquid crystal display device controlling method according to claim 24, wherein the control circuit comprises only one source driver and only one gate driver.

43. A liquid crystal display device comprising:

a liquid crystal panel in which a plurality of signal lines for transmitting display data and a plurality of scanning lines for transmitting control signals are laid out vertically and horizontally, and pixel electrodes are arranged at intersections of said signal lines and said scanning lines via switching elements; and a control circuit for controlling said liquid crystal panel via said signal lines and said scanning lines, and for performing impulse driving to activate said control signals, which are to be transmitted to each of said scanning lines, two times per one frame period for displaying one image, wherein:

said liquid crystal panel is divided into first pixel regions and second pixel regions adjacent to said first pixel regions;

said display data are written in said first pixel regions and said reset data are written in said second pixel regions, when said control signals are activated once of said two times, and said reset data are written in said first pixel regions and said display data are written in said second pixel regions, when said control signals are activated the other time of said two times, wherein said control circuit receives said display data for two images per frame, and displays data deleting data corresponding to said first pixel regions and said second pixel regions for writing the reset data, of said display data.

44. A method of controlling a liquid crystal display device, the device comprising:

a liquid crystal panel in which a plurality of signal lines for transmitting display data and a plurality of scanning lines for transmitting control signals are laid out vertically and horizontally, and pixel electrodes are arranged at intersections of the signal lines and the scanning lines via switching elements; and a liquid crystal panel divided into first pixel regions and second pixel regions adjacent to the first pixel regions, the method comprising the steps of:

performing impulse driving for activating said control signals to be transmitted to each of said scanning lines two times per one frame period in which an image is displayed;

writing said display data in said first pixel regions and writing reset data in said second pixel regions respectively when said control signals are activated once of the two times;

writing said reset data in said first pixel regions and writing said display data in said second pixel regions, when said control signals are activated the other time of the two times;

receiving said display data for two images per frame; and deleting data corresponding to said first pixel regions and said second pixel regions for writing said reset data, of said display data.

* * * * *